US011413508B2

(12) United States Patent
Jertson et al.

(10) Patent No.: US 11,413,508 B2
(45) Date of Patent: Aug. 16, 2022

(54) GOLF CLUB HEADS WITH ENERGY STORAGE CHARACTERISTICS

(71) Applicant: KARSTEN MANUFACTURING CORPORATION, Phoenix, AZ (US)

(72) Inventors: Martin R. Jertson, Cave Creek, AZ (US); Eric J. Morales, Laveen, AZ (US); Cory S. Bacon, Cave Creek, AZ (US); Calvin Wang, Chandler, AZ (US); Xiaojian Chen, Phoenix, AZ (US); Travis D. Milleman, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 18 days.

(21) Appl. No.: 17/119,859

(22) Filed: Dec. 11, 2020

(65) Prior Publication Data

US 2021/0187365 A1 Jun. 24, 2021

Related U.S. Application Data

(63) Continuation of application No. 16/231,053, filed on Dec. 21, 2018, now abandoned, which is a continuation-in-part of application No. 15/908,427, filed on Feb. 28, 2018, and a continuation-in-part of application No. 15/628,639, filed on Jun. 20, 2017, (Continued)

(51) Int. Cl.

| | |
|---|---|
| ***A63B 53/04*** | (2015.01) |
| *A63B 53/08* | (2015.01) |
| *A63B 60/00* | (2015.01) |

(52) U.S. Cl.

CPC ..... *A63B 53/04* (2013.01); *A63B 53/0466* (2013.01); *A63B 53/0475* (2013.01);

(Continued)

(58) Field of Classification Search

CPC . A63B 53/04; A63B 53/0466; A63B 53/0475; A63B 53/045; A63B 53/0437;

(Continued)

(56) References Cited

U.S. PATENT DOCUMENTS

| | | | |
|---|---|---|---|
| 4,667,963 | A | 5/1987 | Yoneyama et al. |
| 5,090,702 | A | 2/1992 | Viste et al. |

(Continued)

FOREIGN PATENT DOCUMENTS

| | | |
|---|---|---|
| CN | 104740854 | 7/2015 |
| JP | 2001340501 | 12/2001 |

(Continued)

OTHER PUBLICATIONS

PCT International Search Report and Written Opinion from PCT Application No. PCT/US15/56933, filed Oct. 22, 2015.

(Continued)

*Primary Examiner* — William M Pierce

(57) ABSTRACT

Embodiments of golf club heads with energy storage characteristics are presented herein. In some embodiments, a golf club head comprises a hollow body comprising a strikeface, a heel region, a toe region opposite the heel region, a sole, a top rail and an inflection point. The inflection point provides increase bending of the strikeface thereby providing performance enhancement over clubs without an inflection point.

15 Claims, 37 Drawing Sheets

Related U.S. Application Data now Pat. No. 10,888,743, and a continuation-in-part of application No. 15/435,054, filed on Feb. 16, 2017, now Pat. No. 11,027,177, which is a continuation-in-part of application No. 14/920,484, filed on Oct. 22, 2015, now abandoned, said application No. 15/628,639 is a continuation-in-part of application No. 14/920,480, filed on Oct. 22, 2015, now Pat. No. 10,688,350, said application No. 15/908,427 is a continuation-in-part of application No. 14/920,484, filed on Oct. 22, 2015, now abandoned, said application No. 15/628,639 is a continuation of application No. 14/920,484, filed on Oct. 22, 2015, now abandoned.

(60) Provisional application No. 62/610,053, filed on Dec. 22, 2017, provisional application No. 62/484,529, filed on Apr. 12, 2017, provisional application No. 62/462,250, filed on Feb. 22, 2017, provisional application No. 62/436,019, filed on Dec. 19, 2016, provisional application No. 62/352,495, filed on Jun. 20, 2016, provisional application No. 62/313,215, filed on Mar. 25, 2016, provisional application No. 62/295,565, filed on Feb. 16, 2016, provisional application No. 62/206,152, filed on Aug. 17, 2015, provisional application No. 62/131,739, filed on Mar. 11, 2015, provisional application No. 62/105,464, filed on Jan. 20, 2015, provisional application No. 62/105,460, filed on Jan. 20, 2015, provisional application No. 62/068,232, filed on Oct. 24, 2014.

(52) U.S. Cl.
CPC ..... *A63B 53/045* (2020.08); *A63B 53/0408* (2020.08); *A63B 53/0433* (2020.08); *A63B 53/0437* (2020.08); *A63B 53/08* (2013.01); *A63B 60/002* (2020.08); *A63B 2053/0491* (2013.01); *A63B 2209/00* (2013.01)

(58) Field of Classification Search
CPC ..... A63B 60/002; A63B 53/0433; A63B 53/0408; A63B 53/08; A63B 2053/0491; A63B 2209/00
See application file for complete search history.

(56) References Cited

U.S. PATENT DOCUMENTS

| | | | |
|---|---|---|---|
| 5,213,328 | A | 5/1993 | Long et al. |
| 5,290,032 | A | 3/1994 | Fenton et al. |
| 5,328,184 | A | 7/1994 | Antonious |
| 5,499,814 | A | 3/1996 | Lu |
| 5,505,453 | A | 4/1996 | Mack |
| 5,676,605 | A | 10/1997 | Kobayashi |
| 5,766,092 | A | 6/1998 | Mimeur et al. |
| 6,306,048 | B1 | 10/2001 | McCabe et al. |
| 6,348,013 | B1 | 2/2002 | Kosmatka |
| 6,379,265 | B1 | 4/2002 | Hirakawa et al. |
| 6,482,104 | B1 | 11/2002 | Gilbert |
| 6,533,679 | B1 | 3/2003 | McCabe et al. |
| 6,572,491 | B2 | 6/2003 | Hasebe et al. |
| 6,695,714 | B1 | 2/2004 | Bliss et al. |
| 6,780,123 | B2 | 8/2004 | Hasebe |
| 6,852,038 | B2 | 2/2005 | Yabu |
| 6,855,066 | B2 | 2/2005 | Best |
| 6,923,734 | B2 | 8/2005 | Meyer |
| 6,971,961 | B2 | 12/2005 | Chen |
| 6,984,180 | B2 | 1/2006 | Hasebe |
| 7,125,343 | B2 | 10/2006 | Imamoto |
| 7,232,381 | B2 | 6/2007 | Imamoto et al. |
| 7,261,643 | B2 | 8/2007 | Rice et al. |
| 7,337,861 | B2 | 5/2008 | Tateno et al. |
| 7,367,899 | B2 | 5/2008 | Rice et al. |
| 7,431,668 | B2 | 10/2008 | Tateno et al. |
| 7,435,191 | B2 | 10/2008 | Tateno et al. |
| D581,000 | S | 11/2008 | Nicolette et al. |
| 7,448,964 | B2 | 11/2008 | Schweigert et al. |
| 7,455,597 | B2 | 11/2008 | Matsunaga |
| 7,470,200 | B2 | 12/2008 | Sanchez |
| 7,503,853 | B2 | 3/2009 | Matsunaga |
| 7,513,836 | B2 | 4/2009 | Matsunaga |
| 7,588,504 | B2 | 9/2009 | Matsunaga |
| 7,662,051 | B2 | 2/2010 | Chen |
| 7,704,162 | B2 | 4/2010 | Rice et al. |
| D621,893 | S | 8/2010 | Nicolette et al. |
| 7,798,915 | B2 | 9/2010 | Matsunaga |
| D635,627 | S | 4/2011 | Nicolette et al. |
| 7,922,604 | B2 | 4/2011 | Roach et al. |
| D643,492 | S | 8/2011 | Nicolette et al. |
| 8,012,040 | B2 | 9/2011 | Takechi |
| 8,043,165 | B2 | 10/2011 | Galloway |
| 8,109,842 | B2 | 2/2012 | Matsunaga |
| 8,182,365 | B2 | 5/2012 | Wada et al. |
| 8,226,501 | B2 | 7/2012 | Stites et al. |
| 8,235,841 | B2 | 8/2012 | Stites et al. |
| 8,277,337 | B2 | 10/2012 | Shimazaki |
| 8,449,406 | B1 | 5/2013 | Frame et al. |
| 8,647,217 | B2 | 2/2014 | Nishio |
| 8,651,975 | B2 | 2/2014 | Soracco |
| 8,657,703 | B2 | 2/2014 | Wada et al. |
| 8,753,224 | B1 | 6/2014 | Kim |
| 8,753,230 | B2 | 6/2014 | Stokke et al. |
| 8,758,153 | B2 | 6/2014 | Sargent et al. |
| 8,870,681 | B2 | 10/2014 | Yamamoto |
| 8,932,149 | B2 | 1/2015 | Oldknow |
| 8,961,336 | B1 | 2/2015 | Parsons et al. |
| 8,986,133 | B2 | 3/2015 | Bennett et al. |
| 9,011,266 | B2 | 4/2015 | Brunski et al. |
| 9,044,653 | B2 | 6/2015 | Wahl et al. |
| 9,079,078 | B2 | 7/2015 | Greensmith et al. |
| 9,089,747 | B2 | 7/2015 | Boyd et al. |
| 9,089,749 | B2 | 7/2015 | Bumett et al. |
| 9,162,115 | B1 | 10/2015 | Beach et al. |
| 9,168,435 | B1 | 10/2015 | Boggs et al. |
| 9,265,995 | B2 | 2/2016 | Roberts et al. |
| 9,415,280 | B2 | 8/2016 | Stokke et al. |
| 9,517,393 | B2 | 12/2016 | Cardani et al. |
| 9,908,018 | B2 | 3/2018 | Roberts et al. |
| 9,937,396 | B2 | 4/2018 | Stites et al. |
| 9,993,704 | B2 | 6/2018 | Hebreo et al. |
| 10,124,224 | B2 | 11/2018 | Solheim et al. |
| 10,150,019 | B2 | 12/2018 | Ines et al. |
| 10,220,272 | B2 | 3/2019 | Gonzalez et al. |
| 10,245,474 | B2 | 4/2019 | Boggs et al. |
| 10,357,695 | B2 | 7/2019 | Boggs et al. |
| 10,543,405 | B2 | 1/2020 | Greaney et al. |
| 10,646,754 | B2 | 5/2020 | Boggs et al. |
| 2011/0111883 | A1 | 5/2011 | Cackett |
| 2011/0183776 | A1 | 7/2011 | Breier et al. |
| 2013/0109500 | A1 | 5/2013 | Boyd et al. |
| 2013/0281229 | A1 | 10/2013 | Su |

FOREIGN PATENT DOCUMENTS

| | | |
|---|---|---|
| JP | 2002143356 | 5/2002 |
| JP | 2003062132 | 3/2003 |
| JP | 2006212066 | 8/2006 |
| JP | 2008054985 | 3/2008 |
| JP | 2010167131 | 8/2010 |
| JP | 5315577 | 10/2013 |
| JP | 2014008287 | 1/2014 |
| JP | 2014180540 | 9/2014 |
| JP | 5763701 | 8/2015 |

OTHER PUBLICATIONS http://www.golfworks.com/product.asp_Q_pn_E_MA0225_A_Maltby+DBM+Forged+Iron+Heads_A_c2p_E_cs, "Maltby Dbm Forged Head", Accessed Oct. 15, 2005.

(56) References Cited

OTHER PUBLICATIONS http://www.golfalot.com/equipment-news/taylormade-sldr-irons-2857.aspx, "Taylor Made Sldr Irons", Published May 5, 2014, Accessed Oct. 15, 2015.

http://www/golfwrx.com/322138/you-can-see-inside-cobras-king-ltd-drivers-andfairway-woods/, "You can see inside Cobra's King Ltd drivers and fairway woods", Zak Kozuchowski, Accessed on Oct. 15, 2015.

1800

1000

GOLF CLUB HEADS WITH ENERGY STORAGE CHARACTERISTICS

CROSS REFERENCE

This is a continuation of U.S. patent application Ser. No. 16/231,053, filed on Dec. 21, 2018, which is a continuation-in-part of U.S. patent application Ser. No. 15/435,054, filed on Feb. 16, 2017, which claims priority to U.S. Provisional Patent Appl. No. 62/295,565, filed Feb. 16, 2016, and U.S. Provisional Patent Appl. No. 62/313,215, Mar. 25, 2016, and is a continuation-in-part of U.S. patent application Ser. No. 14/920,484, filed on Oct. 22, 2015.

U.S. patent application Ser. No. 16/231,053 is also a continuation-in-part of U.S. patent application Ser. No. 15/628,639, filed Jun. 20, 2017, which claims priority to U.S. Provisional Patent Appl. No. 62/352,495, filed Jun. 20, 2016, and U.S. Provisional Patent Appl. No. 62/436,019, filed Dec. 19, 2016, and U.S. Provisional Patent Appl. No. 62/462,250, Feb. 22, 2017, and U.S. Provisional Patent Appl. No. 62/484,529, filed Apr. 12, 2017, and which is a continuation-in-part of U.S. patent application Ser. No. 14/920,484, filed Oct. 22, 2015, and which is a continuation-in-part of U.S. patent application Ser. No. 14/920,480, filed Oct. 22, 2015.

U.S. patent application Ser. No. 16/231,053 is also a continuation-in-part of U.S. patent application Ser. No. 15/908,427, filed Feb. 28, 2018, which is a continuation-in-part of U.S. patent application Ser. No. 14/920,484, filed Oct. 22, 2015. Furthermore, U.S. patent application Ser. No. 14/920,484, filed on Oct. 22, 2015, claims priority to U.S. Provisional Patent Appl. No. 62/105,464, filed Jan. 20, 2015, and U.S. Provisional Patent Appl. No. 62/206,152, filed Aug. 17, 2015, and U.S. Provisional Patent Appl. No. 62/131,739, filed Mar. 11, 2015, and U.S. Provisional Patent Appl. No. 62/105,460, filed Jan. 20, 2015, and U.S. Provisional Patent Appl. No. 62/068,232, filed Oct. 24, 2014. Also, U.S. patent application Ser. No. 14/920,480, filed on Oct. 22, 2015, claims priority to U.S. Provisional Patent Appl. No. 62/105,464, filed Jan. 20, 2015, and U.S. Provisional Patent Appl. No. 62/206,152, filed Aug. 17, 2015, and U.S. Provisional Patent Appl. No. 62/131,739, filed Mar. 11, 2015, and U.S. Provisional Patent Appl. No. 62/105,460, filed Jan. 20, 2015, and U.S. Provisional Patent Appl. No. 62/068,232, filed Oct. 24, 2014.

U.S. patent application Ser. No. 16/231,053 also claims priority to U.S. Provisional Patent Appl. No. 62/610,053, filed Dec. 22, 2017. The contents of all of the above-described disclosures are incorporated fully herein by reference in their entirety.

TECHNICAL FIELD

This disclosure relates generally to golf clubs, and relates more particularly to golf club heads with energy storage characteristics.

BACKGROUND

Golf club manufacturers have designed golf club heads to relieve stress in the strikeface of the golf club head. In many instances, these designs do not allow the golf club head to flex in the crown to sole direction. Additionally, these designs may not change where peak bending of the golf club head occurs and do not allow additional storage of spring energy in the golf club head due to impact with the golf ball. Additional spring energy can increase ball speed across the strikeface.

BRIEF DESCRIPTION OF THE DRAWINGS

To facilitate further description of the embodiments, the following drawings are provided in which.

Figure 1:
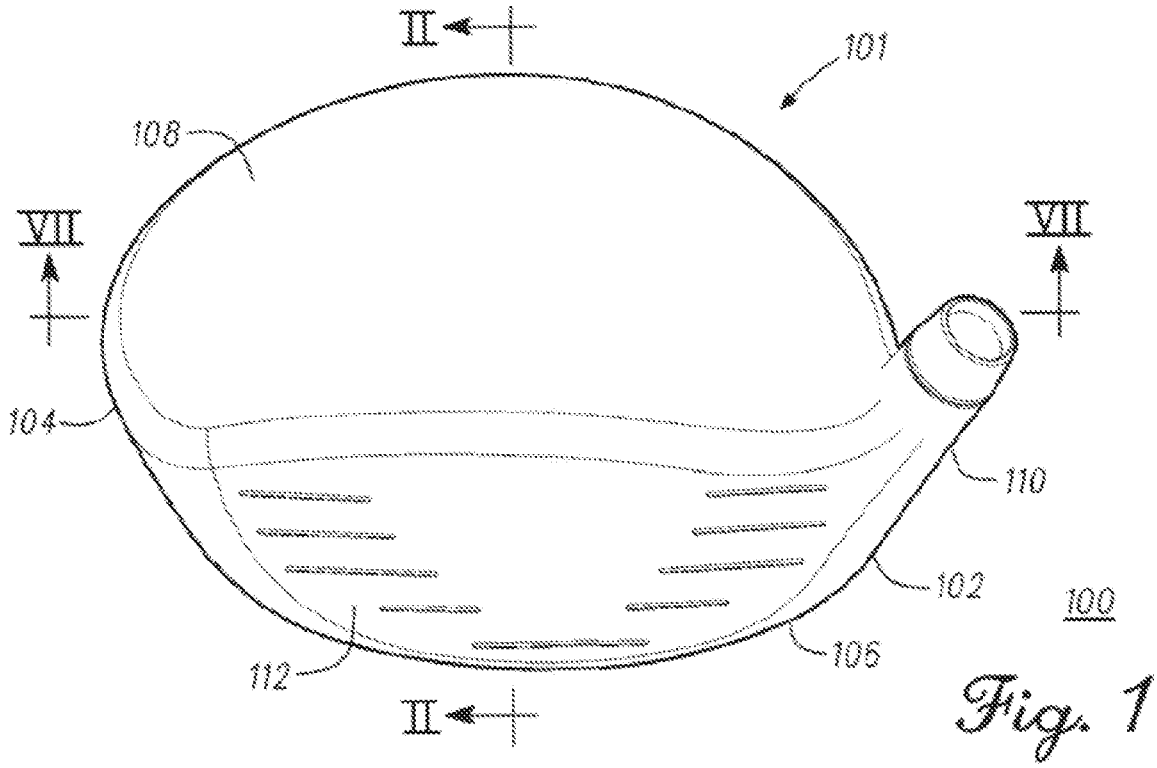
FIG. 1 depicts a front, crown-side perspective view of a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

DESCRIPTION OF EXAMPLES OF EMBODIMENTS

Various embodiments of the golf club heads with tiered internal thin sections include a golf club head comprising a body. The body comprises a strikeface, a heel region, a toe region opposite the heel region, a sole, a crown, and an internal radius transition region from the strikeface to at least one of the sole or the crown. In many embodiments, the internal radius transition region is not visible from an exterior of the golf club head and comprises a first tier, a second tier, and a tier transition region between the first tier and the second tier.

Another embodiment of the golf club heads with tiered internal thin sections include a golf club comprising a golf club head and a shaft coupled to the golf club head. The golf club head comprises a strikeface, a heel region, a toe region opposite the heel region, a sole, a crown, and an internal radius transition region from the strikeface to at least one of the sole or the crown. In many embodiments, the internal radius transition region is not visible from an exterior of the golf club head and comprises a first tier, a second tier, and a tier transition region between the first tier and the second tier.

Other embodiments of the golf club heads with tiered internal thin sections include a method for manufacturing a golf club head. The method comprises providing a body. The body comprises a strikeface, a heel region, a toe region opposite the heel region, a sole, and a crown. The method further comprises providing an internal radius transition region from the strikeface to at least one of the sole or the crown. The internal radius transition region is not visible from an exterior of the golf club head and comprises a first tier, a second tier, and a tier transition region between the first tier and the second tier. In many embodiments, the first tier has a first thickness, the second tier has a second thickness, and the second thickness is smaller than the first thickness.

Various embodiments include a golf club head comprising a hollow body. The hollow body comprises a strikeface, a heel region, a toe region opposite the heel region, a sole, and a crown. In many embodiments, the crown comprises an upper region comprising a top rail, and a lower region. In some embodiments, a cavity is located below the top rail, is located above the lower region of the crown, and is defined at least in part by the upper and lower regions of the crown. In many embodiments, the cavity comprises a top wall, a back wall, a bottom incline, a back cavity angle measured between the top and back walls of the cavity, and at least one channel.

Some embodiments include a golf club comprising a hollow-bodied golf club and a shaft coupled to the hollow-bodied golf club head. The hollow-bodied golf club head comprises a strikeface, a heel region, a toe region opposite the heel region, a sole, and a crown. In many embodiments, the crown comprises an upper region comprising a top rail, and a lower region. In some embodiments, a cavity is located below the top rail, is located above the lower region of the crown, and is defined at least in part by the upper and lower regions of the crown. In many embodiments, the cavity comprises a top wall, a back wall, a bottom incline, a back cavity angle measured between the top and back walls of the cavity, and at least one channel.

Other embodiments include a method for manufacturing a golf club head. In many embodiments, the method comprises providing a body. The body having a strikeface, a heel region, a toe region opposite the heel region, a sole, and a crown. The crown comprises an upper region comprising a top rail and a lower region. In some embodiments, a cavity is located below the top rail, above the lower region of the crown, and is defined at least in part by the upper and lower regions of the crown. In many embodiments, the cavity comprises a top wall, a back wall adjacent to the top wall, a bottom incline adjacent to the back wall, a back cavity angle measured between the top and back walls of the cavity, and at least one channel.

Various embodiments include a golf club head comprising a hollow body. The hollow body comprises a strikeface, a heel region, a toe region opposite the heel region, a sole, and a crown. In many embodiments, the crown comprises an upper region comprising a top rail, and a lower region comprising a lower exterior wall. In some embodiments, a cavity is located below the top rail, is located above the lower region of the crown, and is defined at least in part by the upper and lower regions of the crown. In many embodiments, the cavity comprises a top wall, a back wall, a first inflection point adjacent the top wall and the back wall, a bottom incline, a second inflection point adjacent to the back wall and the bottom incline, a third inflection point adjacent to the bottom incline and the lower exterior wall, a lower angle measured from between the bottom incline and the lower exterior wall, the lower angle is less than 180 degrees, a back cavity angle measured between the top and back walls of the cavity, and at least one channel.

Some embodiments include a golf club comprising a hollow-bodied golf club and a shaft coupled to the hollow-bodied golf club head. The hollow-bodied golf club head comprises a strikeface, a heel region, a toe region opposite the heel region, a sole, and a crown. In many embodiments, the crown comprises an upper region comprising a top rail, and a lower region comprising a lower exterior wall. In some embodiments, a cavity is located below the top rail, is located above the lower region of the crown, and is defined at least in part by the upper and lower regions of the crown. In many embodiments, the cavity comprises a top wall, a back wall, a first inflection point adjacent the top wall and the back wall, a bottom incline, a second inflection point adjacent to the back wall and the bottom incline, a third inflection point adjacent to the bottom incline and the lower exterior wall, a lower angle measured from between the bottom incline and the lower exterior wall, the lower angle is less than 180 degrees, a back cavity angle measured between the top and back walls of the cavity, and at least one channel.

Other embodiments include a method for manufacturing a golf club head. In many embodiments, the method comprises providing a body. The body having a strikeface, a heel region, a toe region opposite the heel region, a sole, and a crown. The crown comprises an upper region comprising a top rail and a lower region comprising a lower exterior wall. In some embodiments, a cavity is located below the top rail, above the lower region of the crown, and is defined at least in part by the upper and lower regions of the crown. In many embodiments, the cavity comprises a top wall, a back wall, a first inflection point adjacent the top wall and the back wall, a bottom incline, a second inflection point adjacent to the back wall and the bottom incline, a third inflection point adjacent to the bottom incline and the lower exterior wall, a lower angle measured from between the bottom incline and the lower exterior wall, the lower angle is less than 180 degrees, a back cavity angle measured between the top and back walls of the cavity, and at least one channel.

Other examples and embodiments are further disclosed herein. Such examples and embodiments may be found in the figures, in the claims, and/or in the present description.

I. Golf Club Head with Cascading Sole

Figure 18:
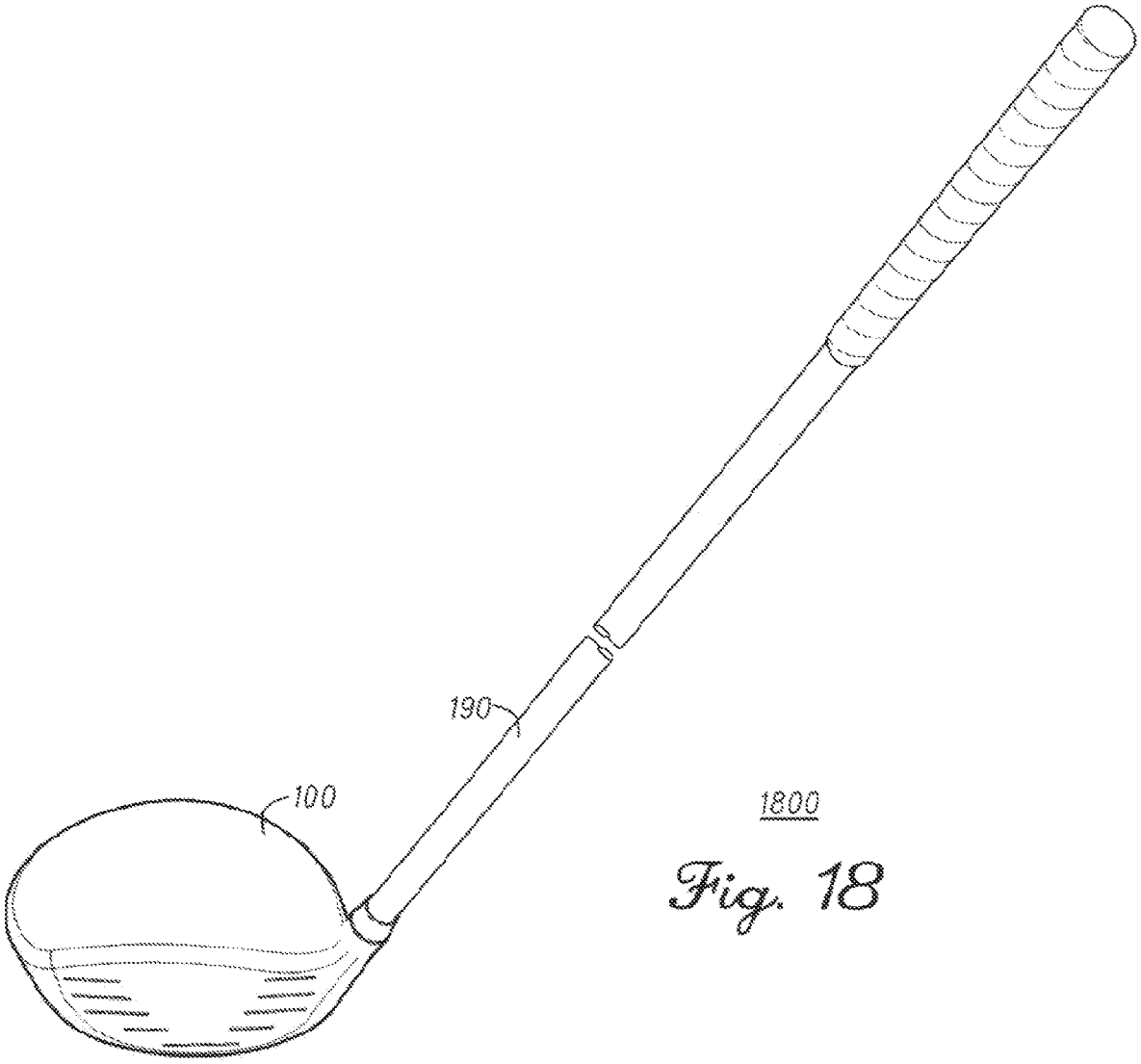
FIG. 18 depicts a front perspective view of a golf club according to another embodiment.

Turning to the drawings, FIG. 1 illustrates an embodiment of a golf club head 100. Golf club head 100 can be a wood-type golf club head. For example, golf club head 100 can be a fairway wood-type golf club head or a driver-type golf club head or a hybrid-type golf club head or an iron-type golf club head. Golf club head 100 comprises a body 101. Body 101 comprises a strikeface 112, a heel region 102, a toe region 104, a sole 106, and a crown 108. In FIG. 1, body 101 also comprises a skirt 110 extending between sole 106 and crown 108. In some embodiments, body 101 does not comprise skirt 110 or any skirt. FIG. 18 depicts a front perspective view of a golf club 1800 according to an embodiment. In some embodiments, golf club 1800 comprises golf club head 100 and a shaft 190.

In some embodiments, body 101 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S,), an aluminum alloy, or a composite material. In some embodiments, strikeface 112 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, body 101 can comprise the same material as strikeface 112. In some embodiments, body 101 can comprise a different material than strikeface 112.

Figure 2:
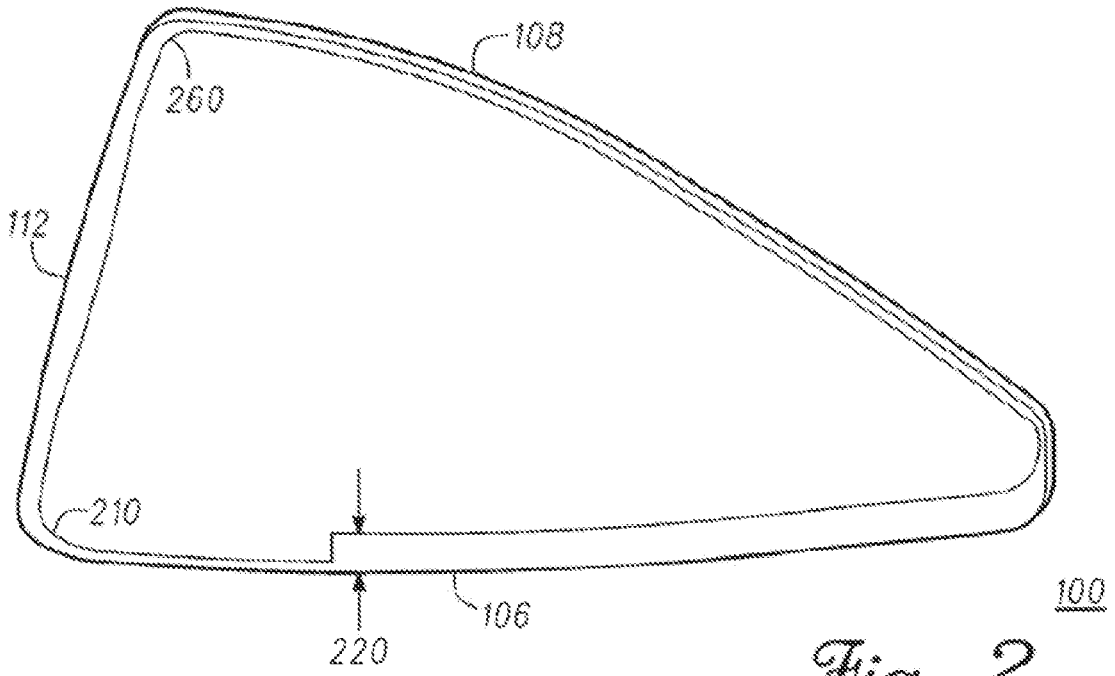
FIG. 2 depicts the golf club head of FIG. 1 along the cross-sectional line II-II in FIG. 1.

FIG. 2 illustrates a cross-section of golf club head 100 along the cross-sectional line II-II in FIG. 1, according to one embodiment. FIG. 2 shows an internal radius transition 210 from strikeface 112 to sole 106, according to an embodiment. Internal radius transition 210 can comprise a smooth transition, or internal radius transition 210 can comprise a cascading sole of at least two tiers or levels of thickness. For example, internal radius transition 210 can comprise a cascading sole having 2, 3, 4, 5, 6, or 7 tiers. In some embodiments, internal radius transition can provide more bending of strikeface 112. In some examples, the increase in bending or deflection of strikeface 112 can allow approximately 1% to approximately 3% more energy from the deflection of strikeface 112.

In many embodiments, internal radius transition 210 is not visible from an exterior of golf club head 100. FIG. 2 also shows a top internal radius transition 260 from strikeface 112 to crown 108. In some embodiments, top internal radius transition 260 can comprise a smooth transition, while in other embodiments, top internal radius transition 260 can comprise at least two tiers or levels of thickness. For example, top internal radius transition 260 can comprise 2, 3, 4, 5, 6, or 7 tiers or levels of thickness. In some embodiments, golf club head 100 also can have an internal sole thickness 220. Internal sole thickness 220 can be thicker than the smallest thickness of internal radius transition 210. In many embodiments, internal sole thickness 220 also is thicker than an adjacent tier or a final tier in internal radius transition 210. In some embodiments, internal sole thickness 220 can be thicker than all of internal radius transition 210.

In some embodiments, internal radius transition 210 can be similar to the sole front section and/or the weight distribution channels as described in U.S. Pat. No. 8,579,728, entitled Golf Club Heads with Weight Redistribution Channels and Related Methods, which is incorporated by reference herein.

In some embodiments, the golf club head can comprise a cascading transition region, tiered transition region or internal radius transition from the strikeface to at least one of a crown, a heel, a toe, a sole, or a skirt. In some embodiments, the golf club head can comprise a single, continuous tiered transition region ring around a circumference of perimeter of the golf club head, for example a tiered transition region ring from the strikeface to each of the crown, the toe region, the heel region, and the sole region. In other embodiments, the golf club head comprises a tiered transition region only at the crown and/or at the sole. In some embodiments, the golf club head comprises a tiered transition region only at the toe region and/or at the heel region. In other examples, the tiered transition region is only located from the strikeface to the skirt. In other embodiments, the golf club head comprises separate or individual tiered transition regions from the strikeface to the toe region of the crown, the heel region of the crown, the toe region of the sole, and/or the heel region of the sole.

Figure 3:
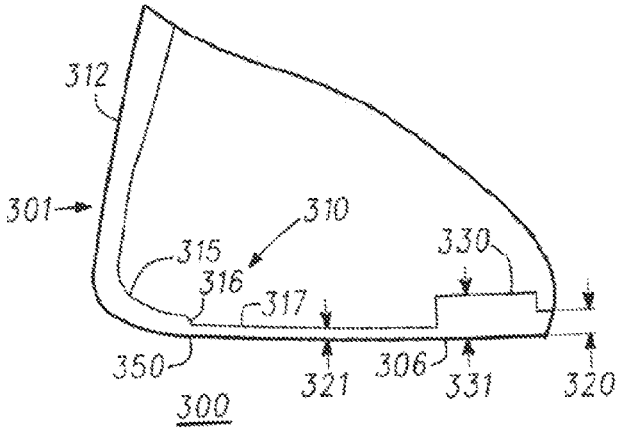
FIG. 3 depicts a view of a portion of a golf club head that is similar to the golf club head of FIG. 1, along a cross-sectional line similar to the cross-sectional line II-II in FIG. 1, according to another embodiment.
Figure 4:
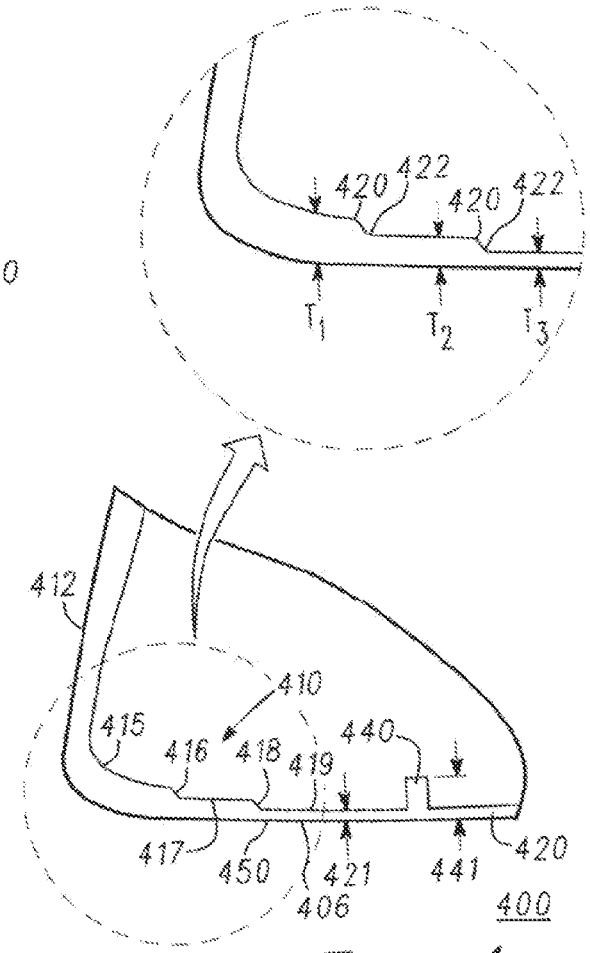
FIG. 4 depicts a view of a portion of a golf club head that is similar to the golf club head of FIG. 1, along a cross-sectional line similar to the cross-sectional line II-II in FIG. 1, according to another embodiment.
Figure 5:
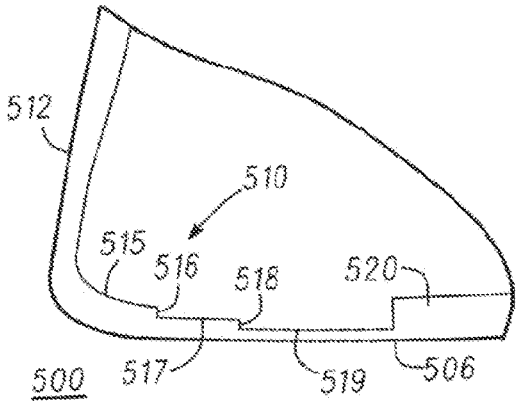
FIG. 5 depicts a view of a portion of a golf club head that is similar to the golf club head of FIG. 1, along a cross-sectional line similar to the cross-sectional line II-II in FIG. 1, according to another embodiment.

FIG. 3 depicts a view of an internal radius transition 310 of a golf club head 300 that is similar to the golf club head of FIG. 1, along a cross-sectional line similar to the cross-sectional line II-II in FIG. 1, according to another embodiment. FIG. 4 depicts a view of an internal radius transition 410 of a golf club head 400 that is similar to the golf club head of FIG. 1, along a cross-sectional line similar to the cross-sectional line II-II in FIG. 1, according to another embodiment. FIG. 5 depicts a view of an internal radius transition 510 of a golf club head 500 that is similar to the golf club head of FIG. 1, along a cross-sectional line similar to the cross-sectional line II-II in FIG. 1, according to another embodiment.

As shown in FIG. 3, internal radius transition 310 can be can be similar to internal radius transition 210 (FIG. 2) and golf club head 300 can be similar to golf club head 100 (FIGS. 1 and 2). Internal radius transition 310 comprises a first tier 315 having a first thickness, and a second tier 317 having a second thickness. In many embodiments, the thickness of each tier is substantially constant. For example, the first thickness of first tier 315 can comprise a first substantially constant thickness, and the second thickness of second tier 317 can comprise a second substantially constant thickness. In other embodiments, first tier 315 can comprise a first slope, wherein the first thickness of first tier 315 is thicker closer to strikeface 312 and thinner closer to a tier transition region 316. Tier transition region 316 can comprise a tier slope that is steeper than the first slope of first tier 315. Tier transition region 316 can be linearly sloped at an angle less than 90 degrees to transition from first tier 315 to second tier 317. In other embodiments, tier transition region 316 can comprise an approximately 90 degree step, as shown in tier transition regions 516 and 518 of FIG. 5. Tier transition region 516 (FIG. 5) and 518 (FIG. 5) can be similar to tier transition region 316 (FIG. 3), and tier transition regions 416 (FIG. 4) and 418 (FIG. 4).

As shown in FIG. 4, in some embodiments, each tiered transition 316, 416, 418, 516, 518 can include a first arcuate surface 420 and a second arcuate surface 422. The first arcuate surface 420 has a first radius of curvature and the second arcuate surface 422 has a second radius of curvature. The first radius of curvature and the second radius of curvature of each tiered transition 316, 416, 418, 516, 518 can be the same, or the first radius of curvature and the second radius of curvature of each tiered transition 316, 416, 418, 516, 518 can be different. For example, the first radius of curvature of the first arcuate surface 420 can be the same as the second radius of curvature of the first arcuate surface 420, the first radius of curvature of the first arcuate surface 420 can be less than the second radius of curvature of the first arcuate surface 420, or the first radius of curvature of the first arcuate surface 420 can be greater than the second radius of curvature of the first arcuate surface 420. For further example, the first radius of curvature of the second arcuate surface 422 can be the same as the second radius of curvature of the second arcuate surface 422, the first radius of curvature of the second arcuate surface 422 can be less than the second radius of curvature of the second arcuate surface 422, or the first radius of curvature of the second arcuate surface 422 can be greater than the second radius of curvature of the second arcuate surface 422.

Further, each of the tiered transitions 316, 416, 418, 516, 518 can have the same first radius of curvature or a different first radius of curvature, and each of the tiered transitions 316, 416, 418, 516, 518 can have the same second radius of curvature or a different second radius of curvature. For example, the first radius of curvature of the first arcuate surface 420 can be the same as the first radius of curvature of the second arcuate surface 422, the first radius of curvature of the first arcuate surface 420 can be less than the first radius of curvature of the second arcuate surface 422, or the first radius of curvature of the first arcuate surface 420 can be greater than the first radius of curvature of the second arcuate surface 422. For further example, the second radius of curvature of the first arcuate surface 420 can be the same as the second radius of curvature of the second arcuate surface 422, the second radius of curvature of the first arcuate surface 420 can be less than the second radius of curvature of the second arcuate surface 422, or the second radius of curvature of the first arcuate surface 420 can be greater than the second radius of curvature of the second arcuate surface 422.

The internal radius transition features (e.g. internal tier transition 310, FIG. 3) can change where a peak bending of a golf club head occurs. The tiered transition region can create a "plastic hinge" at the peak bending, promoting more localized deformation due to impact with the golf ball. In many embodiments, the buckling process starts at the location of the peak bending and the golf club head is optimized to stay just under the critical buckling threshold. The intentional plastic hinge allows the club to flex more in the crown and sole direction. Intentional Plastic Hinge allows control over exactly where and how much the crown and sole will flex by using the tiered features.

Using the internal radius transition, the stress of the golf club head can be distributed across a larger volume of material, thus lowering the localized peak stress. In many embodiments, the additional flex from crown to sole allows the face to bend further based on the same loading. This additional flex can generate more stress and bending in the face of the club to create more spring energy. An increase in spring energy can be stored in the golf club head due to an impact with the golf ball. In many embodiments, the additional spring energy will help to increase ball speed. In some embodiments, the internal radius transition can create more overall bending in the golf club head, which also can lead to more ball speed. Higher ball speeds across the strikeface can result in better distance control. In some embodiments, the golf club head with internal radius transition features can store approximately 4% to approximately 6% more energy, which can then be returned to the golf ball.

Returning to FIG. 3, internal radius transition 310 can change where a peak bending 350 of the sole of golf club head 300 occurs. In addition, internal radius transition 310 can engage more of the body of club head 300 in the bending process on impact from a golf ball. In some embodiments, first tier 315 and second tier 317 allow some of the stress created by an impact of strikeface 312 with the golf ball to build up on each tier. This structure can prevent the stress from collecting primarily at the thinnest section of the sole to increase the reliability and durability of golf club head 300. In many embodiments, this structure creates a plastic hinge opposite the strikeface end of internal radius transition 310 and promotes more localized deformation at the plastic hinge location. In many embodiments, the plastic hinge can be located at the peak bending, for example, peak bending 350. This structure also can allow for the storage of more potential energy, for example, in the crown and/or the sole. In some embodiments, body 301 can experience an increase of approximately 4% to approximately 7% in flex or bending in the crown to sole direction at the sole and/or the crown. The additional flex in the crown to sole direction at the sole and/or the crown can allow strikeface 312 to bend further on the same loading or impact by the golf ball. Therefore, this structure can create more stress and bending in strikeface 312 of golf club head 300 that can be transferred to the ball on impact with the strikeface 312.

In some embodiments, each tier comprises an approximately constant thickness throughout the tier. In many embodiments, first tier 315 is thicker than second tier 317. In some embodiments of a driver-type golf club head, first tier 315 can be approximately 0.030 inch (0.076 cm) to approximately 0.060 inch (0.152 cm) thick, or approximately 0.040 inch (0.102 cm) to approximately 0.050 inch (0.127 cm) thick, and second tier 317 can be approximately 0.020 inch (0.051 cm) to approximately 0.050 inch thick (0.127 cm), or approximately 0.030 inch (0.076 cm) to approximately 0.040 inch (0.102 cm) thick. In some embodiments of a fairway wood-type golf club head, first tier 315 can be approximately 0.035 inch (0.089 cm) to approximately 0.065 inch (0.165 cm) thick, or approximately 0.045 inch (0.114 cm) to approximately 0.055 inch (0.140 cm) thick, and second tier 317 can be approximately 0.025 inch (0.064 cm) to approximately 0.055 inch (0.140 cm) thick, or approximately 0.035 inch (0.089 cm) to approximately 0.045 inch (0.114 cm) thick. In some embodiments of a hybrid-type golf club head, first tier 315 can be approximately 0.050 inch (0.127 cm) to approximately 0.080 inch (0.203 cm) thick, or approximately 0.060 inch (0.152 cm) to approximately 0.070 inch thick (0.178 cm), and second tier 317 can be approximately 0.040 inch (0.102 cm) to approximately 0.070 inch (0.178 cm) thick, or approximately 0.050 inch (0.127 cm) to approximately 0.060 inch (0.152 cm) thick. In many embodiments of an iron-type golf club head, the first tier 315 can be approximately 0.055 inch (0.140 cm) to approximately 0.085 inch (0.216 cm) thick, or approximately 0.060 inch (0.152 cm) to approximately 0.080 inch thick (0.203 cm), and the second tier 317 can be approximately 0.045 inch (0.114 cm) to approximately 0.075 inch (0.191 cm) thick, or approximately 0.050 inch (0.127 cm) to approximately 0.070 inch (0.178 cm) thick.

In other embodiments, such as shown in FIG. 4, internal radius transition 410 can have more than 2 tiers. For example, internal radius transition 410 can have 2, 3, 4, 5, 6, or 7 tiers. A three tier internal radius transition 410 can be similar to internal radius transition 310 (FIG. 3) and has a first tier 415, a second tier 417, and a third tier 419. First tier 415 can be similar to first tier 315 in FIG. 3, and second tier 417 can be similar to second tier 317. In many embodiments, a peak bending 450 can occur further back from strikeface 412 as more tiers are added to the internal radius transition.

In many embodiments, second tier 417 is thicker than third tier 419. In some embodiments of a driver-type golf club head, third tier 419 is approximately 0.010 inch to approximately 0.040 inch (0.102 cm) thick, or approximately 0.020 inch (0.051 cm) to approximately 0.030 inch (0.076 cm) thick. In some embodiments of a fairway wood-type golf club head, third tier 419 is approximately 0.015 inch (0.038 cm) to approximately 0.045 inch (0.114 cm) thick, or approximately 0.025 inch (0.064 cm) to approximately 0.035 inch (0.089 cm) thick. In some embodiments of a hybrid-type golf club head, third tier 419 is approximately 0.030 inch (0.076 cm) to approximately 0.060 inch (0.152 cm) thick, or approximately 0.040 inch (0.102 cm) to approximately 0.050 inch (0.127 cm) thick. In some embodiments of an iron-type club head the third tier 419 is approximately 0.030 inch (0.076 cm) to approximately 0.060 inch (0.152 cm) thick, or approximately 0.035 inch (0.089 cm) to approximately 0.055 inch (0.140 cm) thick.

Meanwhile, referring to FIG. 5, in some embodiments of a driver-type golf club head, first tier 515 can be approximately 0.045 inch (0.114 cm) thick; second tier 517 can be approximately 0.035 inch (0.089 cm) thick; and third tier 519 can be approximately 0.025 inch (0.064 cm) thick. In some embodiments of a fairway wood-type golf club head, first tier 515 can be approximately 0.051 inch (0.130 cm) thick; second tier 517 can be approximately 0.039 inch (0.099 cm) thick; and third tier 519 can be approximately 0.030 inch (0.076 cm) thick. In some embodiments of a hybrid-type golf club head, first tier 515 can be approximately 0.067 inch (0.170 cm) thick; second tier 517 can be approximately 0.054 inch (0.137 cm) thick; and third tier 519 can be approximately 0.045 inch (0.114 cm) thick. In some embodiments of an iron-type club head, the first tier 515 can be approximately 0.067 inch (0.170 cm) thick; the second tier can be approximately 0.057 inch (0.145 cm) thick; and the third tier 519 can be approximately 0.042 inch (0.107 cm) thick.

In some embodiments, first tiers 315, 415, 515 in FIGS. 3, 4, and 5, respectively, can have a first tier length that is approximately equal to a second tier length of second tiers 317, 417, 517 in FIGS. 3, 4, and 5, respectively. In some embodiments, the first tier length of first tiers 315, 415, 515 in FIGS. 3, 4, and 5, respectively, can have a first tier length that is longer than the second tier length of second tiers 317, 417, 517. In other embodiments, the second tier length of second tiers 417, 517 in FIGS. 4 and 5, respectively, can be approximately equal to a third tier length of third tiers 419, 519 in FIGS. 4 and 5, respectively. In some embodiments, the second tier length of second tiers 417, 517 in FIGS. 4 and 5, respectively, can be longer than the third tier length of third tiers 419, 519 in FIGS. 4 and 5, respectively. In other embodiments, the second tier length of second tiers 417, 517 in FIGS. 4 and 5, respectively, can be shorter than the third tier length of third tiers 419, 519 in FIGS. 4 and 5, respectively.

Referring to FIGS. 3, 4, and 5, in some embodiments of a fairway wood-type golf club head or a driver-type golf club head or a hybrid-type golf club head, the first tiers 315, 415, 515 can have first tier lengths of approximately 0.05 inch (0.127 cm) to approximately 0.80 inch (2.03 cm); the second tiers 317, 417, 517 can have second tier lengths of approximately 0.03 inch (0.076 cm) to approximately 0.60 inch (1.52 cm); and the third tiers 419, 519 can have third tier lengths of approximately 0.04 inch (0.102 cm) to approximately 0.70 inch (1.78 cm). In some embodiments of an iron-type golf club head, the first tiers 315, 415, 515 can have first tier lengths of approximately 0.03 inch (0.076 cm) to approximately 0.30 inch (0.762 cm); the second tiers 317, 417, 517 can have second tier lengths of approximately 0.04 inch (0.102 cm) to approximately 0.40 inch (1.02 cm); and the third tiers 419, 519 can have third tier lengths of approximately 0.05 inch (0.127 cm) to approximately 0.50 inch (1.27 cm).

As shown in FIGS. 3, 4, and 5, in some embodiments, the first and the second arcuate surface of tiered transitions 316, 416, 516 can have first and second radii of curvatures that are at least two times larger than the difference between the first thickness $T_1$ and the second thickness $T_2$ of the first tier 315, 415, 515, and the second tier 317, 417, 517, respectively. In one embodiment, the first and the second arcuate surface of tiered transitions 316, 416, 516 has a first and a second radius of curvature that are approximately 6.5 times larger than the difference between the first thicknesses $T_1$ and the second thickness $T_2$ of the first tier 315, 415, 515 and the second tier 317, 417, 517, respectively. As shown in FIGS. 4 and 5, in some embodiments, the first and the second arcuate surface of tiered transitions 418, 518 can have first and second radii of curvatures that are at least two times larger than the difference between the second thickness $T_2$ and the third thickness $T_3$ of the second tier 417, 517 and the third tier 419, 519, respectively. In one embodiment, the first and the second arcuate surface of tiered transitions 418, 518 has a first and a second radius of curvature that are approximately 6.5 times larger than the difference between the second thicknesses $T_2$ and the third thickness $T_3$ of the second tier 417, 517 and the third tier 419, 519, respectively.

Some embodiments, such as golf club head 300, as shown in FIG. 3, comprise weight pad 330 to lower the center of gravity of golf club head 300. Weight pad 330 comprises a weight pad thickness 331 that is greater than the final tier thickness 321 of the adjacent tier. In this example, the adjacent tier is second tier 317. In many embodiments which comprise weight pad 330, internal sole thickness 320 can be approximately equal to final tier thickness 321. In some embodiments, internal sole thickness 320 can be thicker than final tier thickness 321. In some embodiments, internal sole thickness 320 is thinner than final tier thickness 321.

Some embodiments, such as golf club head 400, as shown in FIG. 4, comprise a rib 440. Rib 440 can be located internal to body 401 and approximately parallel to the strikeface. In many embodiments, rib 440 can be a ridge or bar. In some embodiments, rib 440 can have a rib thickness 441 that is greater than a third tier thickness 421, the thickness of the adjacent tier, or the thickness of the final tier of internal radius transition 410. The purpose for rib 440 is to reinforce the sole of golf club head 400 so that the peak bending of the sole occurs at tier transition region 416 and/or tier transition region 418.

Figure 6:
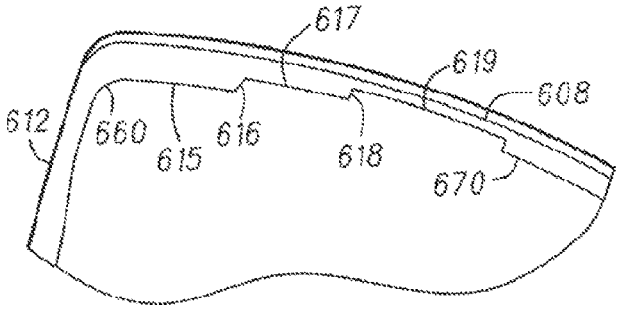
FIG. 6 depicts a view of another portion of a golf club head that is similar to the golf club head of FIG. 1, along a cross-sectional line similar to the cross-sectional line II-II in FIG. 1, according to another embodiment.

Turning to FIG. 6, in some embodiments, golf club head 600 can comprise a crown internal radius transition 660 at crown 608. Crown internal radius transition 660 can be similar to internal radius transition 310 in FIG. 3, except crown internal radius transition 660 is located at the strikeface to crown transition instead of the strikeface to sole transition. In many embodiments, first tier 615 can be similar to first tiers 315, 415, and/or 515 in FIGS. 3, 4, and 5, respectively; second tier 617 can be similar to second tiers 317, 417, and/or 517 in FIGS. 3, 4, and 5, respectively; third tier 619 can be similar to third tiers 419 and/or 519 in FIGS. 4 and 5, respectively; and tier transition regions 616 and/or 618 can be similar to tier transition regions 316, 416, 516, 418, and/or 518 in FIGS. 3, 4, and 5. Similarly, the crown internal radius transition 660 can have several internal radius transitions to form more than two tiers. For example, the crown internal radius transition 660 can have 2, 3, 4, 5, 6, or 7 tiers.

Figure 7:
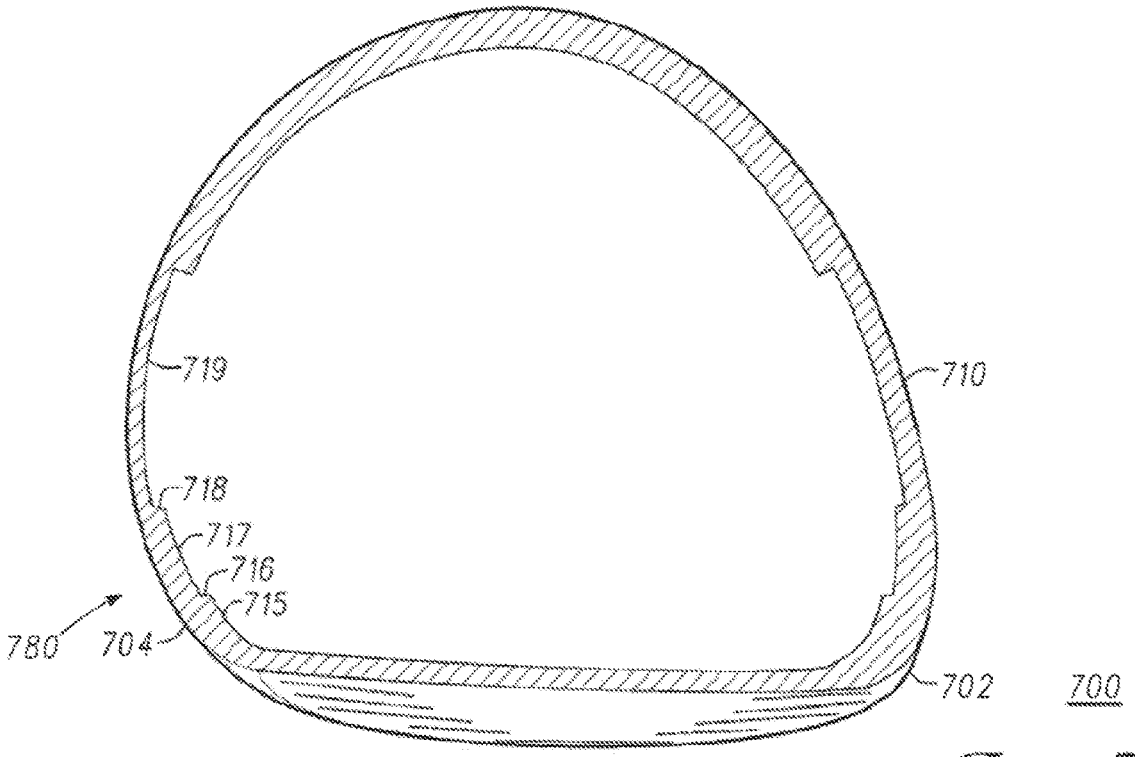
FIG. 7 depicts a cross-sectional view of a golf club similar to the golf club head of FIG. 1 along a similar cross-sectional line as the cross-sectional line VII-VII in FIG. 1, according to another embodiment.

In FIG. 7, a golf club head 700 can comprise a skirt internal radius transition 780 as shown in FIG. 7. FIG. 7 depicts a cross-sectional view of golf club 700 similar to golf club head 100 (FIG. 1) along a similar cross-sectional line as the cross-sectional line VII-VII in FIG. 1, according to another embodiment. Skirt internal radius transition 780 can be similar to internal radius transition 210 (FIG. 2), and first tier 715 can be similar to first tiers 315, 415, and/or 515 in FIGS. 3, 4, and 5, respectively; second tier 717 can be similar to second tiers 317, 417, and/or 517 in FIGS. 3, 4, and 5; third tier 719 can be similar to third tiers 419 and/or 519 in FIGS. 4 and 5, respectively; and tier transition regions 716 and/or 718 can be similar to tier transition regions 316, 416, 516, 418, and/or 518 in FIGS. 3, 4, and 5. Similarly, skirt internal radius transition 780 can have more than two tiers. For example, skirt internal radius transition 780 can have 2, 3, 4, 5, 6, or 7 tiers. As shown in FIG. 7, golf club head 700 also can comprise a skirt internal radius transition at the other side of strikeface 712. In another embodiment, golf club head 700 can comprise a skirt internal radius transition at a single side of strikeface 712.

Figure 8:
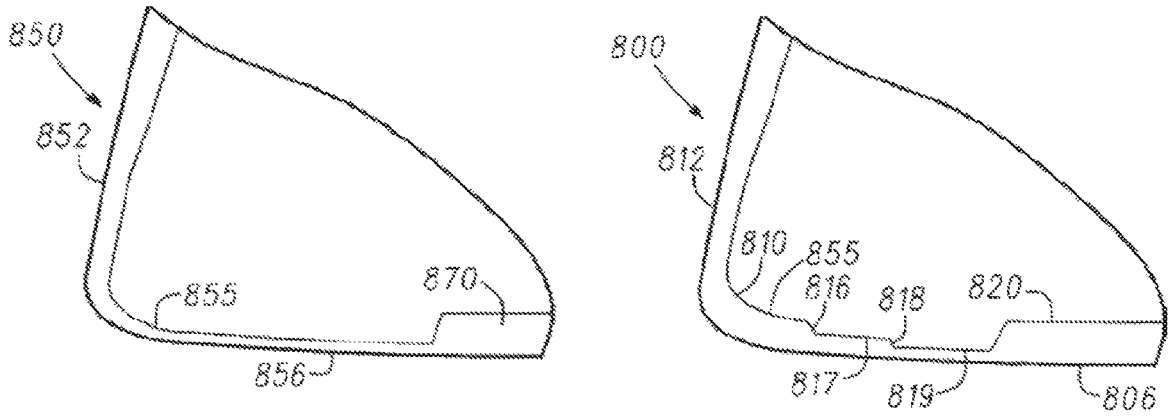
FIG. 8 depicts a view of a portion of a golf club head similar to the golf club head of FIG. 4, according to an embodiment, and a view of the same area of a standard golf club head.

FIG. 8 depicts a view of a portion of a golf club head 800 similar to golf club head 400 (FIG. 4), according to an embodiment, and a view of the same area of standard golf club head 850. Standard golf club head 850 comprises a uniform sole thickness 855 from a strikeface 852 to a sole 856, and an internal sole weight 870 that is thicker than a uniform sole thickness 855. Golf club head 800 comprises an internal radius transition 810 similar to internal radius transition 410 (FIG. 4). Internal radius transition 810 can comprise a first tier 815, similar to first tier 415 (FIG. 4), a second tier 817, similar to second tier 417 (FIG. 4), and a third tier 819, similar to third tier 419 (FIG. 4). Internal radius transition 810 also can comprise tier transition regions 816 and 818, similar to tier transition regions 416 (FIG. 4) and 418 (FIG. 4), and internal sole weight 820 that is similar to internal sole weight 870. In many embodiments, at least one of first tier 815, second tier 817, or third tier 819 can be thinner than uniform sole thickness 855. The thinness of the tiers can save weight that can then be redistributed in the club head.

There is a greater dispersion of higher stress over a greater area of sole 806 with internal transition region 810 than sole 856 without the cascading sole. In many embodiments, a general curve of a sole similar to uniform sole thickness 855 can absorb greater particular concentrations of impact force from a golf ball in particular regions, but will not disperse the force over a larger area. The cascading structure (or tiers of varying thickness along the internal radium transition), such as internal radius transition 810, however provides a technique to "package" the impact force from the golf ball over a larger area as the undulating or tier structure transfers higher stresses from one internal radium region of particular thickness to the next. In many embodiments, there is a bleeding, overflow, or pooling of the stress over internal radius transition 810 or the cascading thin sole. The greater dispersion of the greater stress force provides a greater recoiling force to the strikeface. The pooling of the stress over internal radius transition 810 also can prevent all of the stress from collecting directly at the thinnest tier. In many embodiments, the tiered features can help distribute the stress along the sole to prevent one large stress riser. Instead, there are multiple stress risers for a more even distribution of the stress. The stresses are extended along the cascading sole, allowing the sole to take on (or absorb) more stress. The stress, however, decreases at the thickest portion of the sole that without the cascading sole experiences the highest level of stress, and provides less spring back force to the strikeface.

An embodiment of a golf club head (e.g. 100, 300, 400, 500, 600, or 700) having the cascading sole was tested compared to a similar control club head devoid of a cascading sole. The club head with the cascading sole showed an increase in ball speed of approximately 0.5-1.5 miles per hour (mph) (0.8-2.4 kilometers per hour, kph), or approximately 0.5-0.9%, compared to the control club head. The increase in ball speed for center impacts was approximately 0.5-1.0 mph (0.8-1.6 kph), and the increase in ball speed for off-center impacts was approximately 1-1.5 mph (1.6-2.4 kph). The club head with the cascading sole further showed an increase in launch angle of approximately 0.1-0.3 degrees, a decrease in spin of approximately 275-315 revolutions per minute (rpm), and an increase in carry distance of approximately 3-6 yards (2.7-5.5 meters) compared to the control club head.

In some embodiments, the crown of a driver-type, hybrid-type, or wood-type golf club head having the cascading sole (e.g. 100, 300, 400, 500, 600, or 700) may further include a first crown thickness (not shown) and a second crown thickness (not shown). The first crown thickness may be positioned on the crown behind the strikeface or crown internal radius transition. The second crown thickness may be positioned on the crown behind the first crown thickness toward the rear of the club head. The first crown thickness is greater than the second crown thickness. Further, the first crown thickness may transition to the second crown thickness gradually according to any profile, or the first crown thickness may transition to the second crown thickness abruptly, such as with a step.

The first crown thickness may comprise any portion of the crown on a front end of the club head. For example, the first crown thickness may comprise 5%, 10%, 15%, 20%, 25%, 30%, 35%, 40%, 45%, 50%, or any other portion of the crown on the front end of the club head. The second crown thickness may comprise any portion of the crown on the rear of the club head. For example, the second crown thickness may comprise 40%, 45%, 50%, 55%, 60%, 65%, 70%, 75%, 80%, or any other portion of the rear of the club head.

The crown thickness may transition between the first crown thickness and the second crown thickness at any position on the crown of the club head, defining a crown thickness transition. The crown thickness transition may be any shape. In the exemplary embodiment, the crown thickness transition defines a bell-shaped curve, similar to the bell-shaped curve in U.S. Pat. No. 7,892,111, which is incorporated herein by reference. The first crown thickness is positioned on the crown between the strikeface and the bell-shaped curve, and the second crown thickness is positioned on the crown between the bell-shaped curve and the rear of the club head.

In the exemplary embodiment, the first crown thickness is approximately 0.022 inches (0.056 cm) and the second crown thickness is approximately 0.019 inches (0.048 cm) when the golf club head is a fairway wood type golf club head. Further, in the exemplary embodiment, the first crown thickness is approximately 0.024 inches (0.061 cm) and the second crown thickness is approximately 0.019 inches (0.048 inches) when the golf club head is a hybrid type golf club head.

In other embodiments of a fairway wood or hybrid type golf club head, the first crown thickness may be less than approximately 0.029 (0.074), 0.028 (0.071), 0.027 (0.069), 0.026 (0.066), 0.025 (0.064), 0.024 (0.061), 0.023 (0.058), 0.022 (0.056), 0.021 (0.053), 0.020 (0.051), 0.019 (0.048), 0.018 (0.046), or 0.017 (0.043) inches (cm), and the second crown thickness may be less than approximately 0.024 (0.061), 0.023 (0.058), 0.022 (0.056), 0.021 (0.053), 0.020 (0.051), 0.019 (0.048), 0.018 (0.046), 0.017 (0.043), 0.016 (0.041), 0.015 (0.038), 0.014 (0.036), 0.013 (0.033), or 0.012 (0.031) inches (cm).

The crown internal radius transition dissipates and/or reduces stresses on the crown of the club head, thereby allowing the first and the second crown thickness to be reduced compared to previous designs. In the exemplary embodiment, the first crown thickness is reduced by approximately 17.2-24.1%, and the second crown thickness is reduced by approximately 20.8% compared to previous designs. Reducing the first and the second crown thickness allows the center of gravity of the club head to be lowered (positioned closer to the sole) compared to previous designs. The lowered center of gravity of the club head improves the performance characteristics of the club head by reducing gearing and spin on the ball.

Figure 9:
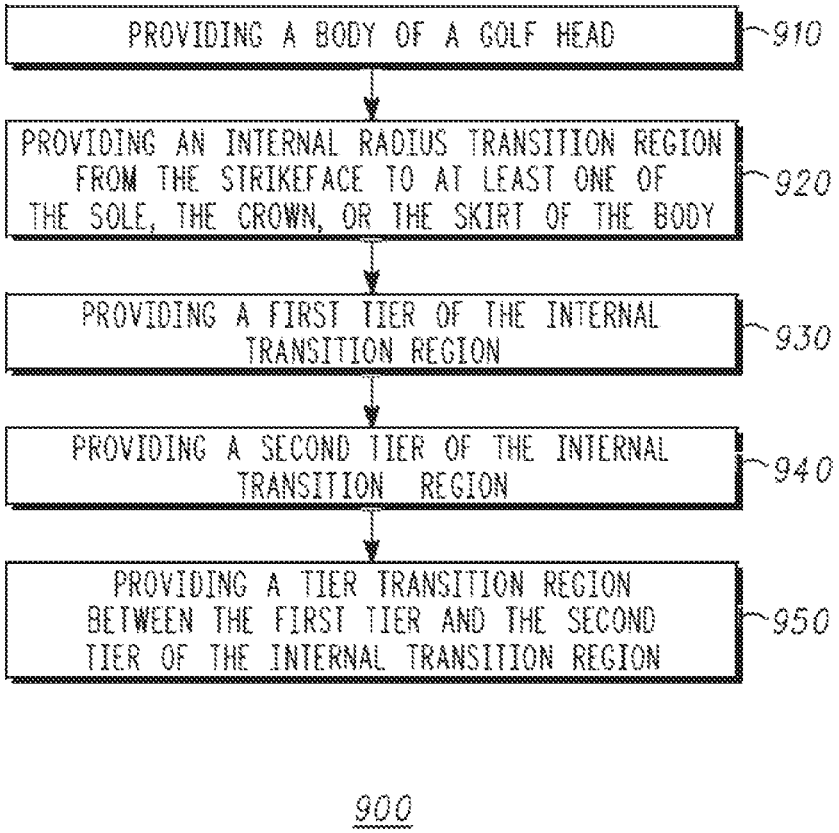
FIG. 9 depicts a method of manufacturing a golf club head according to an embodiment of a method.

Turning to FIG. 9, various embodiments of golf club heads with tiered internal thin sections include a method 900 for manufacturing a golf club head. Method 900 comprises providing a body (block 910). The body comprises a strikeface, a heel region, a toe region opposite the heel region, a sole, and a crown. In some embodiments, the body further comprises a skirt extending from the crown to the sole. Method 900 further comprises providing an internal radius transition region from the strikeface to at least one of the sole, the crown, or the skirt (block 920). Method 900 further comprises providing a first tier of the internal radius transition region (block 930), providing a second tier of the internal transition region (block 940), and providing a tier transition region between the first tier and the second tier of the internal transition region (block 950). In some embodiments, each of blocks 910, 920, 930, 940, and 950 can be performed simultaneously with each other such as by casting the body of a club head. In other embodiments, one or more of blocks 920, 930, 940, and/or 950 can be performed after block 910 through a machining process, as an example.

II. Golf Club Head with Back Cavity

In one embodiment, the golf club head has a back cavity located in an upper crown area of the golf club. In many embodiments, the back cavity can provide a box spring affect when striking a golf ball. The back cavity can be combined with varying thicknesses of the internal radius of the sole of the club head (cascading sole) to provide a spring like effect.

Some embodiments are directed to a club head (hybrid or fairway wood or iron with hollow design) that features a hollowed construction club head that provides a more "iron-like" look and feel. In some embodiments, the golf club head can feature a flat strikeface and iron-like profile, which can provide improved workability and accuracy, similar to an iron. A back cavity located below a top rail and along the upper crown of the club head has been designed for hybrids, fairway woods and irons with a hollow construction. The back cavity may be a full channel from the heel to the toe just below the top rail and along the upper crown or back portion of the club head. The top rail and the cavity may be any design. In some embodiments, the cavity is angled at approximately 90 degrees and provides a targeted hinge point in the crown region of the golf club head. This hinge or buckling region enables the top rail to absorb more of the impact force over a wider volumetric area causing the cavity and the top rail to act as a springboard by returning more recoiled force back to the strikeface as it returns to its original orientation thereby imparting more force into the ball. This greater club face deflection by the cavity design can lead to less spin, a higher loft angle of the golf ball upon impact, and greater ball speed with the same club speed over standard golf club heads.

In a standard hybrid club head, the top rail and upper crown regions do not have a cavity of this design. In comparison to the present disclosure, there is less club strikeface bending or deflection in such a standard hybrid club head. Standard hybrids are unable to have as great a spring-back effect because less energy is transferred to the top rail of the club due to the lack of a cavity. The disclosed golf club head with back cavity allows more of the impact force of the golf ball to be absorbed and then returned to the strikeface. In many embodiments, the angle of the cavity can provide a buckling point, or plastic hinge, or targeted hinge, for the strikeface to deflect more over the standard golf club.

The recoiling effect of the cavity on the strikeface provides: (1) a higher golf ball speed relative to the same club head speed of a club head with an upper crown cavity (or back cavity) and one without, due in part to the spring effect that is transferred from the hinged region to the strikeface to the ball; (2) less spin of the golf ball after impact with the club, due in part to the hinge point above the cavity counters more force being absorbed by the club and instead transfers more force to the ball thereby preventing the ball from spinning backward off the strikeface; and/or (3) a higher loft angle to the golf ball upon impact, due to the hinge and strikeface acting as a diving board or catapult to the ball. In some embodiments, the cavity may provide an increase in ball speed of approximately 1.0-1.2%, and an increase in launch angle of approximately 0.4-0.7 degrees.

Figure 10:
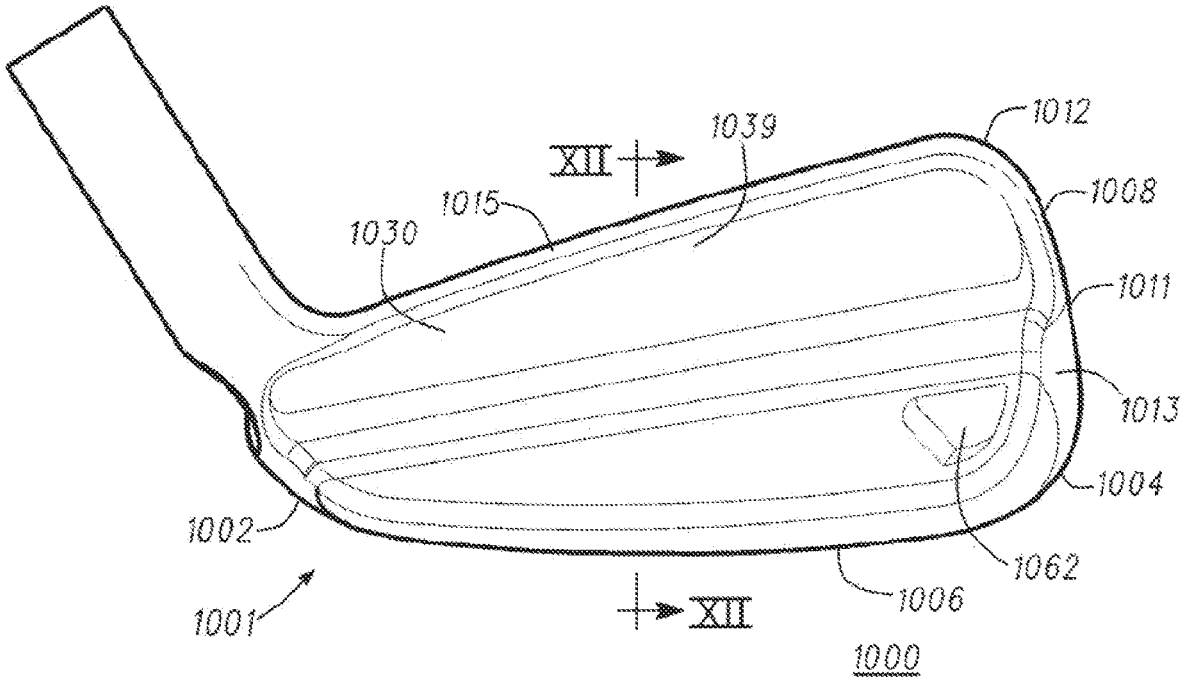
FIG. 10 depicts a back, toe-side perspective view of a golf club head according to an embodiment.
Figure 11:
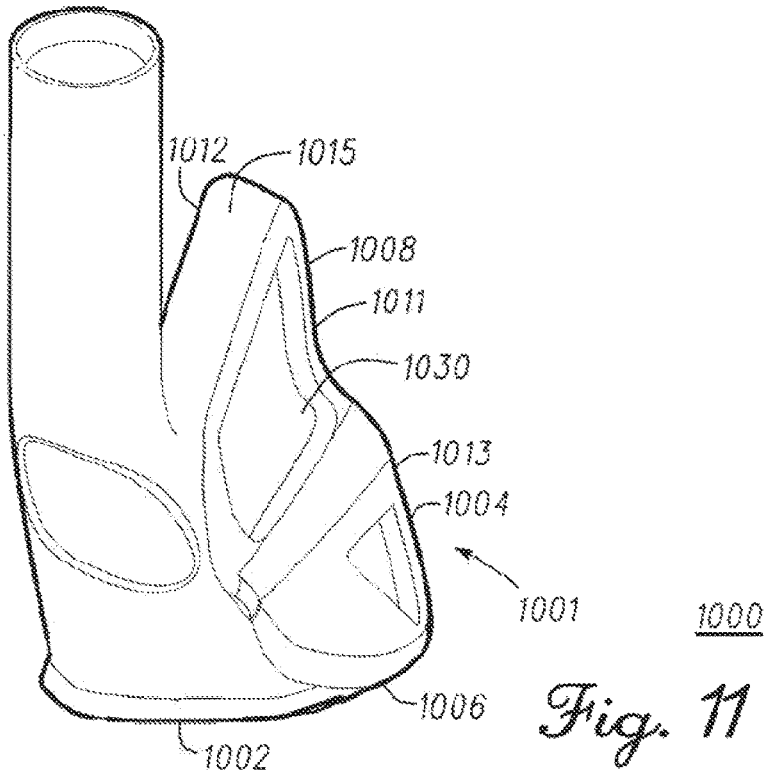
FIG. 11 depicts a back, heel-side perspective view of the golf club head according to the embodiment of FIG. 10.

Turning back to the drawings, FIG. 10 illustrates a back toe-side perspective view of an embodiment of golf club head 1000 and FIG. 11 illustrates a back heel-side perspective view of golf club head 1000 according to the embodiment of FIG. 10. Golf club head 1000 can be a hybrid-type golf club head. In other embodiments, golf club head 1000 can be an iron-type golf club head or a fairway wood-type golf club head. In many embodiments, golf club head 1000 does not include a badge or a custom tuning port.

Golf club head 1000 comprises a body 1001. In many embodiments, the body is hollow. In some embodiments, the body is at least partially hollow. Body 1001 comprises a strikeface 1012, a heel region 1002, a toe region 1004 opposite heel region 1002, a sole 1006, and a crown 1008. Crown 1008 comprises an upper region 1011 and a lower region 1013. Upper region 1011 comprises a top rail 1015. The top rail 1015 begins in the toe region 1004, adjacent a top edge of the strikeface 1012, and extends along the top of the golf club head 1000 towards the heel region 1002. From a cross-sectional side view, such as in FIG. 12, the top rail 1015 begins at the transition between the strikeface 1012 and a top of the golf club head 1000 and ends at the transition between the top of the crown 1008 of the golf club head 1000 and a section of the crown with a different orientation, such as a rear wall 1023. In some embodiments, top rail 1015 can be a flatter and taller top rail than in irons known to one skilled in the art. The flatter and taller top rail can compensate for mishits on strikeface 1012 to increase playability off the tee.

In some embodiments, body 1001 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, strikeface 1012 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, body 1001 can comprise the same material as strikeface 1012. In some embodiments, body 1001 can comprise a different material than strikeface 1012.

In many embodiments, a cavity 1030 is located below top rail 1015. In many embodiments, cavity 1030 comprises a top rail box spring design. In many embodiments, top rail 1015 and cavity 1030 provide an increase in the overall bending of strikeface 1012. In some embodiments, the bending of strikeface 1012 can allow for an approximately 2% to approximately 5% increase of energy. The cavity 1030 allows for the strikeface 1012 to be thinner and allow additional overall bending. For some fairway wood-type golf club head embodiments, cavity 1030 can be a reverse scoop or indentation of crown 1008 with body 1001 comprising a greater thickness or width toward sole 1006.

Referring to FIG. 10. in some embodiments, golf club head 1000 can further comprise an insert 1062 at lower region 1013 of crown 1008 towards toe region 1004. Some embodiments comprise an internal weight at sole 1006. In many embodiments, insert 1062 may be comprised of tungsten or some other high density material. In many embodiments, the insert shifts the center of gravity (CG) back from strikeface 1012 by approximately 0.04 inch (1 mm) to 0.10 inch (2.5 mm) and provides a 3.5% to 5.5% increase in launch angle, which can lead to an increase of playability off the tee and high or low mishits.

In many embodiments, the CG is in lower region 1013 of crown 1008, close to the intersection of toe region 1004 and sole 1006. In some embodiments, the CG of golf club head 1000 is 0.597 inches along the CGy plane and 0.541 inches along the CGz plane. For the moment of inertia, Ixx, there was a 20.5% increase over the G30 iron and a 28% increase over the Rapture DI by golf club head 1000. For Iyy, there was a 1.7% increase over the G30 iron and a 22% increase over Rapture DI.

In some embodiments, approximately 3 grams (g) to approximately 4 g is added to top rail 1015. In most embodiments, the overall mass of golf club head 1000 remains the same. In some embodiments, mass can be removed from sole 1006 or toe region 1004 to offset the addition of mass to top rail 1015. In some embodiments, adding the approximately 3 g to approximately 4 g of mass to top rail 1015 can assist in the golf club head resisting turning. In some embodiments, the CG of the golf club head is slightly raised.

Figure 12:
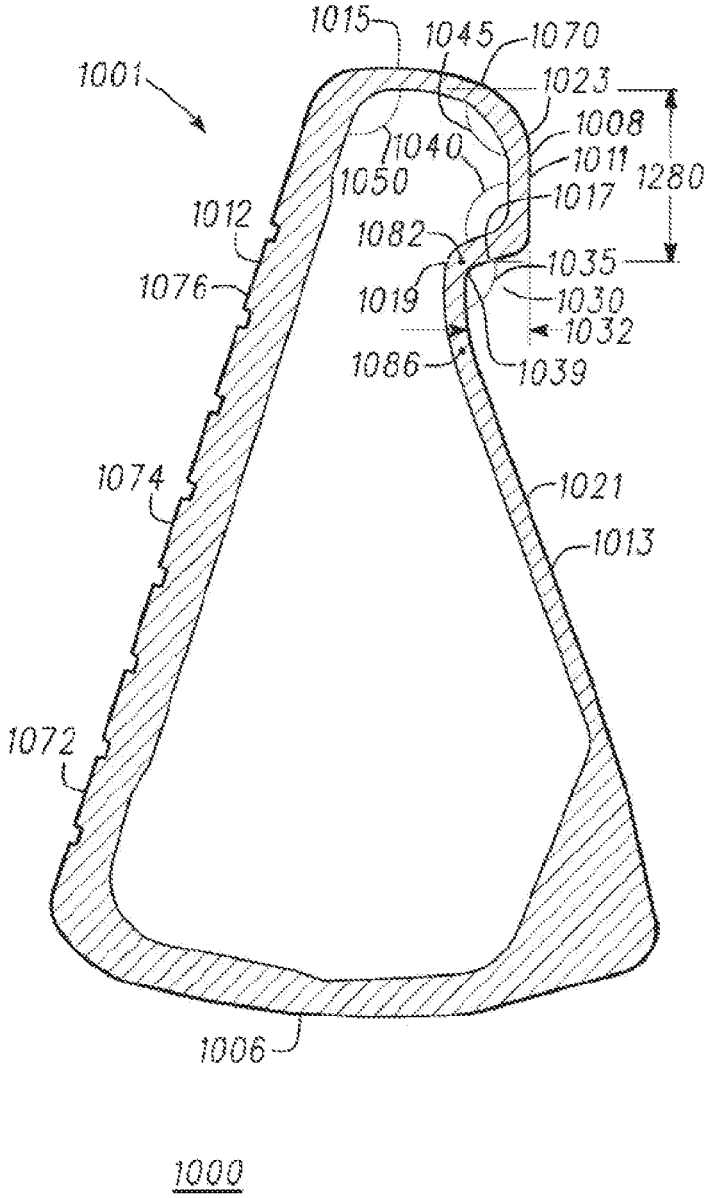
FIG. 12 depicts a cross-sectional view of the golf club head of FIG. 10 along the cross-sectional line XII-XII of FIG. 10.

FIG. 12 illustrates a cross-section of golf club head 1000 along the cross-sectional line XII-XII in FIG. 10, according to one embodiment. As seen in FIG. 12, strikeface 1012 comprises a high region 1076, a middle region 1074, and a low region 1072. In many embodiments, upper region 1011 of crown 1008 comprises the rear wall 1023, a top wall 1017 of cavity 1030 below and adjacent to rear wall 1023, and a back wall 1019 of cavity 1030 below and adjacent to top wall 1017.

In some embodiments, a height 1280 of rear wall 1023 of the upper region 1011 of crown 1008 can be approximately 0.125 inch (0.318 cm) to approximately 0.75 inch (1.91 cm), or approximately 0.150 inch (0.381 cm) to approximately 0.400 inch (1.02 cm). For example, in some embodiments, the height 1280 of rear wall 1023 of the upper region 1011 of crown 1008 can be approximately 0.175 inch (0.445 cm), 0.275 inch (0.699 cm), 0.375 inch (0.953 cm), 0.475 inch (1.21 cm), 0.575 inch (1.46 cm), or 0.675 inch (1.71 cm). In some embodiments, the height 1280 of rear wall 1023 of the upper region 1011 of crown 1008 can be approximately 5% to approximately 25% of the height of golf club head 1000. In some embodiments, the length of top rail 1015, measured from heel region 1002 to toe region 1004, can be approximately 70% to approximately 95% of the length of golf club head 1000.

The height 1280 of rear wall 1023 of the upper region 1011 of crown 1008, as described herein, allows cavity 1030 to absorb at least a portion of the stress on strikeface 1012 during impact with a golf ball. A golf club head having a rear wall height greater than the rear wall height 1280 described herein would absorb less stress (and allow less strikeface deflection) on impact than the golf club head 1000 described herein, due to increased dispersion of the impact stress along the top rail prior to reaching the cavity.

In some embodiments, cavity 1030 is located above lower region 1013 of crown 1008 and is defined at least in part by upper region 1011 and lower region 1013 of crown 1008. Cavity 1030 comprises a top wall 1017, a back wall 1019, and a bottom incline 1021. A first inflection point 1082 is located between top wall 1017 of cavity 1030 and rear wall 1019 of cavity. A second inflection point 1086 is located between rear wall 1019 of cavity 1030 and bottom incline 1021.

The top wall 1017 and the rear wall 1019 of the external cavity 1030 hinge about the first inflection point 1082. This hinge-like mobility at the first inflection point 1082 allows greater strikeface 1012 deflection &&&

In some embodiments, the height of back wall 1019, measured from first inflection point 1082 to second inflection point 1086, can be approximately 0.010 inch (0.25 mm) to approximately 0.138 inch (3.5 mm), or approximately 0.010 inch (0.25 mm) to approximately 0.059 inch (1.5 mm). For example, the height of back wall 1019 can be approximately 0.01 inch (0.25 mm), 0.02 inch (0.5 mm), 0.03 inch (0.75 mm), 0.04 inch (1.0 mm), 0.05 inch (1.25 mm), 0.06 inch (1.5 mm), 0.07 inch (1.75 mm), 0.08 inch (2.0 mm), 0.09 inch (2.25 mm), 0.10 inch (2.5 mm), 0.11 inch (2.75 mm), 0.012 inch (3.0 mm), 0.13 inch (3.25 mm), or 0.14 inch (3.5 mm). In many embodiments, an apex of top wall 1017 can be approximately 0.125 inch (0.318 cm) to approximately 1.25 inches (3.18 cm) or approximately 0.25 inch (0.635 cm) to approximately 1.25 inches (3.18 cm) below an apex of top rail 1015. For example, the apex of top wall 1017 can be approximately 0.125 inch (0.318 cm), 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), or 1.25 inches (3.18 cm) below the apex of top rail 1015.

In many embodiments, back wall 1019 of cavity 1030 can be substantially parallel to strikeface 1012. In other embodiments, back wall 1019 is not substantially parallel to strikeface 1012. In many embodiments, top wall 1017 of cavity is angled toward strikeface 1012 when moving toward the first inflection point 1082. This orientation of top wall 1017 creates a buckling point or hinge point or plastic hinge to direct the stress of impact toward cavity 1030 and allowing increased flexing of strikeface 1012 during impact.

Lower region 1013 of crown 1008 comprises bottom incline 1021 of cavity 1030. In many embodiments, the second inflection point 1086, adjacent to bottom incline 1021, can be at least approximately 0.25 inch (0.635 cm) to approximately 2.0 inches (5.08 cm), or approximately 0.5 inch (1.27 cm) to approximately 1.5 inches (3.81 cm) below the apex of top rail 1015. For example, the second inflection point 1086 can be at least approximately 0.25 inch (0.635 cm), 0.5 inch (1.27 cm), 0.75 inch (1.91 cm), 1.0 inch (2.53 cm), 1.25 inches (3.18 cm), 1.5 inches (3.81 cm), 1.75 inches (4.45 cm) or 2.0 inches (5.08 cm) below the apex of top rail 1015. In some embodiments, the maximum height of the bottom incline, measured from the sole 1006 of the club head 1000 to the second inflection point 1086, can be at least approximately 0.25 inch (0.635 cm) to approximately 3 inches (7.62 cm), or approximately 0.50 inch (1.27 cm) to approximately 2 inches (5.08 cm) above a lowest point of the sole 1006. For example, the second inflection point 1086 can be at least approximately 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1.625 inches (4.12 cm), 1.75 inches (4.45 cm), 1.875 inches (4.76 cm), 2.0 inches (5.08 cm), 2.125 inches 5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm), or 3.0 inches (7.62 cm) above a lowest point of the sole.

Cavity 1030 further comprises at least one channel 1039 (FIG. 10). In many embodiments, channel 1039 extends from heel region 1002 to toe region 1004. A channel width 1032 (FIG. 12) can be substantially constant throughout channel 1039. In some embodiments, channel width 1032 (FIG. 12) can be approximately 0.008 inch (0.2 mm) to approximately 1 inch (25 mm), or approximately 0.008 inch (0.2 mm) to approximately 0.31 inch (8 mm). For example, channel width 1032 can be approximately 0.008 inch (0.2 mm), 0.016 inch (0.4 mm), 0.024 inch (0.6 mm), 0.031 inch (0.8 mm), 0.039 inch (1.0 mm), 0.079 inch (2 mm), 0.12 inch (3 mm), 0.16 inch (4 mm), 0.20 inch (5 mm), 0.24 inch (6 mm), 0.28 inch (7 mm), 0.31 inch (8 mm), 0.39 inch (10 mm), 0.59 inch (15 mm), 0.79 inch (20 mm), or 0.98 inch (25 mm). In other embodiments, a channel toe region width of channel 1039 is smaller than a channel heel region width of channel. In other embodiments, the channel heel region width is smaller than the channel toe region width. In other embodiments, a channel middle region width of channel 1039 can be smaller than at least one of the channel heel region width or the channel toe region width. In other embodiments, the channel middle region width can be greater than at least one of the channel heel region width or the channel toe region width. In some embodiments, channel 1039 is symmetrical. In other embodiments, channel 1039 is non-symmetrical. In other embodiments, channel 1039 can further comprise at least two partial channels. In some embodiments, channel 1039 can comprise a series of partial channels interrupted by one or more bridges. In some embodiments, the one or more bridges can be approximately the same thickness as the thickness of upper region 1011 of crown 1008.

The channel width 1032, as described herein, allows absorption of stress from strikeface 1012 on impact. A golf club head having a channel width less than the channel width described herein (e.g. a golf club head with a less pronounced cavity) would allow less stress absorption from the strikeface on impact (due to less material on the upper region 1011 of crown 1008), and therefore would experience less strikeface deflection than the golf club head 1000 described herein.

In many embodiments, cavity 1030 further comprises a back cavity angle 1035. Back cavity angle is measured between top wall 1017 and back wall 1019 of cavity 1030. In many embodiments, back cavity angle 1035 can be approximately 70 degrees to approximately 110 degrees. In some embodiments, back cavity angle 1035 can be approximately 80 degrees to approximately 100 degrees. In some embodiments, back cavity angle 1035 is approximately 70, 75, 80, 85, 90, 95, 100, or 110 degrees. In many embodiments, back cavity angle 1035 provides a buckling point or plastic hinge or targeted hinge at a top rail hinge point 1070, upon golf club head 1000 impacting the golf ball. In some embodiments, the wall thickness at top rail hinge point 1070 is thinner than at top wall 1017 of cavity 1030

Figure 13:
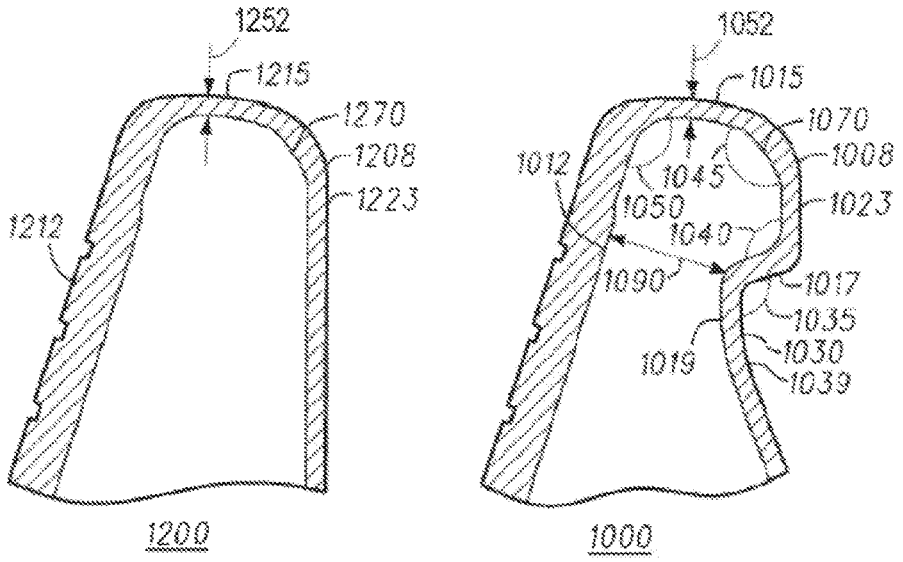
FIG. 13 depicts a view of a portion of the golf club head of FIG. 12 and a view of the same area of a standard golf club head.

FIG. 13 illustrates a view of crown 1008 of the cross-section of golf club head 1000 of FIG. 12 alongside a similar cross-section of a golf club head 1200 without a cavity along a similar cross-sectional line XII-XII in FIG. 10. Golf club head 1200 comprises a strikeface 1212, a crown 1208, a top rail 1215, a top rail hinge point 1270, and a rear wall 1223. In many embodiments, golf club head 1000 comprises a rear angle 1040, a top rail angle 1045, and a strikeface angle 1050. Upper region angle 1040 is measured from top wall 1017 to rear wall 1023 of upper region 1011. In many embodiments, rear angle 1040 can be approximately 70 degrees to approximately 110 degrees. In some embodiments, rear angle 1040 is approximately 90 degrees. Top rail angle 1045 is measured from rear wall 1023 of upper region 1011 to top rail 1015. In many embodiments, top rail angle 1045 can be approximately 35 degrees to approximately 120 degrees or 70 degrees to approximately 110 degrees. In some embodiments, top rail angle 1045 can be approximately 35, 40, 45, 50, 55, 60, 65, 70, 75, 80, 85, 90, 95, 100, 105, 110, 115, or 120 degrees. Strikeface angle 1050 is measured from strikeface 1012 to top rail 1015. In many embodiments, strikeface angle 1050 can be approximately 70 degrees to approximately 160 degrees or 70 degrees to approximately 110 degrees. In some embodiments, strikeface angle 1050 is approximately 70, 75, 80, 85, 90, 95, 100, 105, 110, 115, 120, 125, 130, 135, 140, 145, 150, 155, or 160 degrees.

Referring to FIG. 13, in some embodiments, a minimum gap 1090 between strikeface 1012 and back wall 1019 is approximately 0.079 inch (2 mm) to approximately 0.39 inch (10 mm). For example, the minimum gap 1090 between strikeface 1012 and back wall 1019 can be approximately 0.079 inch (2 mm), 0.16 inch (4 mm), 0.24 inch (6 mm), 0.31 inch (8 mm), or 0.39 inch (10 mm). In some embodiments, the minimum gap 1090 between the strikeface 1012 and back wall 1019 is less than approximately 0.55 inch (14 mm), less than approximately 0.47 inch (12 mm), less than approximately 0.39 inch (10 mm), less than approximately 0.31 inch (8 mm), less than approximately 0.24 inch (6 mm), or less than approximately 0.16 inch (4 mm). Further, in some embodiments, a maximum gap between strikeface 1012 and rear wall 1023 of upper region 1011 of golf club head 1000 is greater than minimum gap 1090. Further still, in some embodiments, a maximum gap between strikeface 1012 and bottom incline 1021 in lower region 1013 of golf club head 1000 is greater than minimum gap 1090 and maximum gap in upper region 1011.

Figure 21:
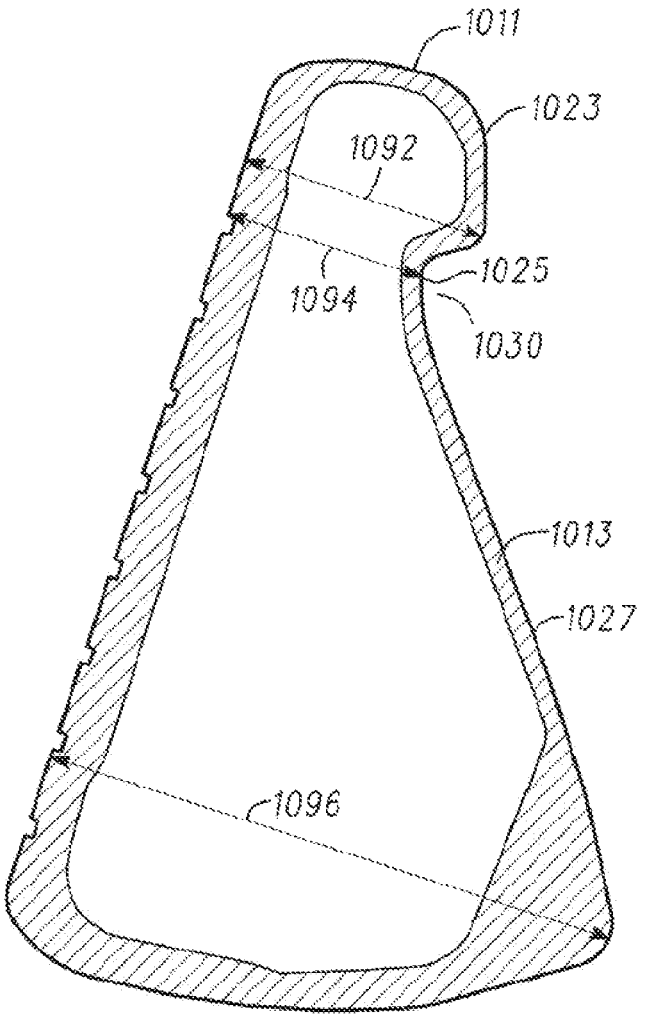
FIG. 21 depicts a cross sectional view of the golf club head of FIG. 10.

FIG. 21 illustrates a cross-sectional view of golf club head 1000, similar to the cross-section of the golf club head 1000 illustrated in FIG. 12. Golf club head 1000 includes cavity 1030, upper region 1011, and lower region 1013. Upper region 1011 includes upper exterior rear wall 1023, cavity 1030 includes cavity exterior wall 1025, and lower region 1013 includes lower exterior wall 1027. In many embodiments, a maximum upper distance 1092 measured as the perpendicular distance from the strikeface 1012 to the rear wall 1023 of upper region 1011 can be approximately 0.20-0.59 inch (5-15 mm). For example, maximum upper distance 1092 can be approximately 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), 0.47 inch (12 mm), 0.51 inch (13 mm), 0.55 inch (14 mm), or 0.59 inch (15 mm). Further, a minimum cavity distance 1094 measured as the perpendicular distance from the strikeface 1012 to the cavity exterior wall 1025 can be approximately 0.16-0.47 inch (4-12 mm). For example, minimum cavity distance 1094 can be approximately 0.16 inch (4 mm), 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), or 0.47 inch (12 mm). Further still, a maximum lower distance 1096 measured as the perpendicular distance from the strikeface 1012 to the lower exterior wall 1027 can be approximately 0.98-1.57 inch (25-40 mm). For example, maximum lower distance 1096 can be approximately 0.98 inch (25 mm), 1.02 inch (26 mm), 1.06 inch (27 mm), 1.10 inch (28 mm), 1.14 inch (29 mm), 1.18 inch (30 mm), 1.22 inch (31 mm), 1.26 inch (32 mm), 1.30 inch (33 mm), 1.34 inch (34 mm), 1.38 inch (35 mm), 1.42 inch (36 mm), 1.46 inch (37 mm), 1.50 inch (38 mm), 1.54 inch (39 mm), 1.57 inch or (40 mm). In many embodiments, maximum lower distance 1096 is greater than maximum upper distance 1092, and maximum upper distance 1092 is greater than minimum cavity distance 1094.

In many embodiments, cavity 1030 can provide an increase in golf ball speed over golf club head 1200 or other standard golf club heads, can reduce the spin rate of standard hybrids club heads, and can increase the launch angle over both the standard hybrid and iron club heads. In many embodiments, the shape of cavity 1035 determines the level of spring and timing of the response of golf club head 1000. When the golf ball impacts strikeface 1012 of club head 1000 with cavity 1030, strikeface 1012 springs back like a drum, and crown 1008 bends in a controlled buckle manner. In many embodiments, top rail 1015 can absorb more stress over greater volumetric space than a top rail in a golf club head without cavity 1030. The length, depth and width of cavity 1030 can vary. These parameters provide control regarding how much spring back is present in the overall design of club head 1000.

Upon impact with the golf ball, strikeface 1012 can bend inward at a greater distance than on a golf club without cavity 1030. In some embodiments, strikeface 1012 has an approximately 10% to approximately 50% greater deflection than a strikeface on a golf club head without cavity 1030. In some embodiments, strikeface 1012 has an approximately 5% to approximately 40% or approximately 10% to approximately 20% greater deflection than a strikeface on a golf club head without cavity 1035. For example, strikeface 1012 can have an approximately 5%, 10%, 15%, 20%, 25%, 30%, 35% or 40% greater deflection than a strikeface on a golf club head without cavity 1035. In many embodiments, there is both a greater distance of retraction by strikeface 1012 due to the hinge and bending of cavity 1030 over a standard strikeface that does not have a back portion of the club without the cavity.

In many embodiments, the face deflection is greater with club head 1000 having cavity 1030, as a greater buckling occurs along top rail hinge point 1070 upon impact with the golf ball. Cavity 1030, however, provides a greater dispersion of stress along top rail hinge point 1070 region of the top rail and the spring back force is transferred from cavity 1030 and top rail 1015 to strikeface 1012. A standard top rail without a cavity does not have this hinge/buckling effect, nor does it absorb a high level of stress over a large volumetric area of the top rail. Therefore, the standard strikeface does not contract and then recoil as much as strikeface 1012. Further, both a larger region of strikeface 1012 and top rail 1015 absorb more stress than the same crown region of a standard golf club head with a standard top rail and no cavity. In many embodiments, although there is greater stress along a greater area above cavity 1030 than the same area in a standard club without the cavity, the durability of the club head with and without the cavity is the same. By adding more spring to the back end of the club (due to the inward inclination of top wall 1017 toward strikeface 1012), more force is displaced throughout the volume of the structure. The stress is observed over a greater area of strikeface 1012 and top rail 1015 of golf club head 1000. Peak stresses can be seen in the standard top rail club head. However, more peak stresses are seen in golf club head 1000, but distributed over a large volume of the material. The hinge and bend regions of golf club head 1000 (i.e., the region above cavity 1030 and cavity 1030 itself) will not deform as long as the stress does not meet the critical buckling threshold. Cavity 1030 and its placement can be design to be under the critical K value of the buckling threshold.

Figure 22:
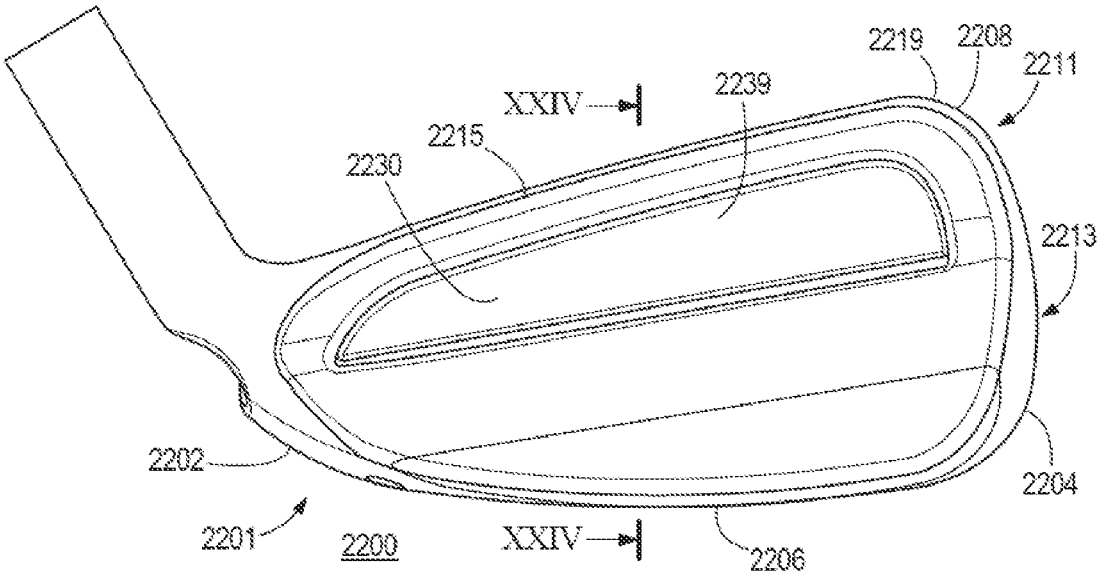
FIG. 22 depicts a back perspective view of a golf club head according to yet another embodiment.
Figure 23:
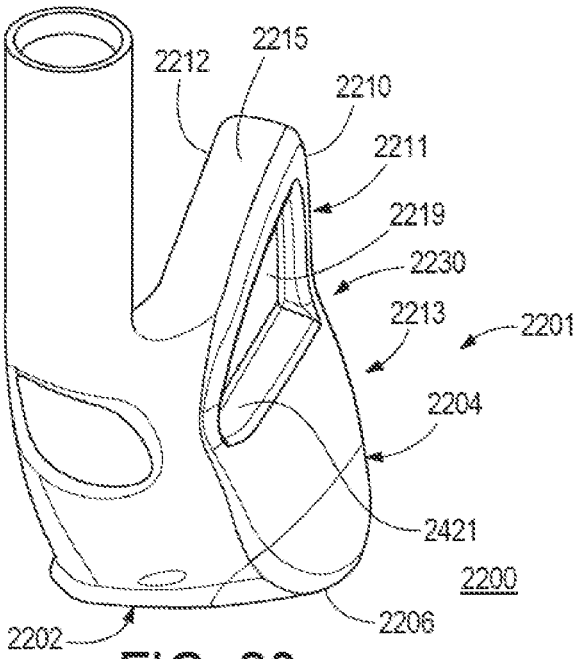
FIG. 23 depicts a back, heel-side perspective view of the golf club head according to the embodiment of FIG. 22.

Turning ahead in the drawings, FIG. 22 illustrates a back perspective view of an embodiment of golf club head 2200 and FIG. 23 illustrates a back heel-side perspective view of golf club head 2200 according to the embodiment of FIG. 22. In some embodiments, golf club head 2200 can be similar to golf club head 1000 (FIG. 10). Golf club head 2200 can be a hybrid-type golf club head. In other embodiments, golf club head 2200 can be an iron-type golf club head or a fairway wood-type golf club head. In many embodiments, golf club head 2200 does not include a badge or a custom tuning port.

Golf club head 2200 comprises a body 2201. In some embodiments, body 2201 can be similar to body 1001 (FIG. 10). In many embodiments, the body is hollow. In some embodiments, the body is at least partially hollow. Body 2201 comprises a strikeface 2212, a heel region 2202, a toe region 2204 opposite heel region 2202, a sole 2206, and a rear 2210. Rear 2210 comprises an upper region 2211 and a lower region 2213. Upper region 2211 comprises a top rail 2215. The top rail 2215 can be similar to the top rail 1015 of golf club head 1000. In some embodiments, top rail 2215 can be a flatter and taller top rail than in the in irons known to one skilled in the art. The flatter and taller top rail can compensate for mis-hits on strikeface 2212 to increase playability off the tee.

Body 2201 of FIGS. 22-26 further comprises a blade length. The blade length for body 2201 can be measured similar to blade length 3725 as shown and described in FIG. 43 (i.e., a measurement parallel to the flat surface of the strikeface 3712, from a toe edge 3726 of the strikeface 3712, to strikeface end 3727 right before the strikeface 3712 integrally curves into the hosel). The blade length of the body 2201 can range from 2.80 inch (7.11 cm) to 3.00 inch (7.62 cm). For example, in some embodiments, the body 2201 can comprise a blade length of 2.80 inch (7.11 cm), 2.82 inch (7.16 cm), 2.84 inch (7.21 cm), 2.86 inch (7.26 cm), 2.88 inch (7.32 cm), 2.90 inch (7.37 cm), 2.93 inch (7.44 cm), 2.94 inch (7.47 cm), 2.96 inch (7.52 cm), 2.98 inch (7.57 cm), or 3.00 inch (7.62 cm).

The body 2201 further comprises a uniform thinned region transitioning from the bottom of the strikeface 2212 to the sole 2206, toward a cascading sole portion of the sole (as described in greater detail below). In the illustrated embodiment, the uniform thinned region comprises a sole thickness measured perpendicular from the exterior surface 2225 to the interior surface at the uniform thinned region, which can remain constant from the bottom of the strikeface 2212 to adjacent the cascading sole portion of the sole. In some embodiments, the sole thickness of the uniform thinned region can be thinner than a conventional sole. For example, in some embodiments, the sole thickness of the uniform thinned region may range from approximately 0.040 inch to 0.080 inch. In other embodiments, the sole thickness of the uniform thinned region may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region can be 0.040 inch, 0.045 inch, 0.050 inch, 0.060 inch, 0.065 inch, 0.070 inch, 0.075 inch, or 0.080 inch.

In some embodiments, body 2201 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 2201 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 2212 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 2212 can comprise carpenter grade 455 steel, carpenter grade 475 steel, C300 steel, C350 steel, a Ni—Co—Cr steel alloy, a quench and tempered steel alloy, or 565 steel. In some embodiments, body 2201 can comprise the same material as strikeface 2212. In some embodiments, body 2201 can comprise a different material than strikeface 2212.

In many embodiments, a cavity 2230 is located below top rail 2215. In some embodiments, the length of top rail 2215, measured from heel region 2202 to toe region 2204, can be approximately 70% to approximately 95% of the length of golf club head 2200. In many embodiments, cavity 2230 comprises a top rail box spring design. In many embodiments, top rail 2215 and cavity 2230 provide an increase in the overall bending of strikeface 2212. In some embodiments, the bending of strikeface 2212 can allow for an approximately 2% to approximately 5% increase of energy. The cavity 2230 allows for the strikeface 2212 to be thinner and allow additional overall bending. For some fairway wood-type golf club head embodiments, cavity 2230 can be a reverse scoop or indentation of rear 2210 with body 2201 comprising a greater thickness or width sole 2206.

Figure 24:
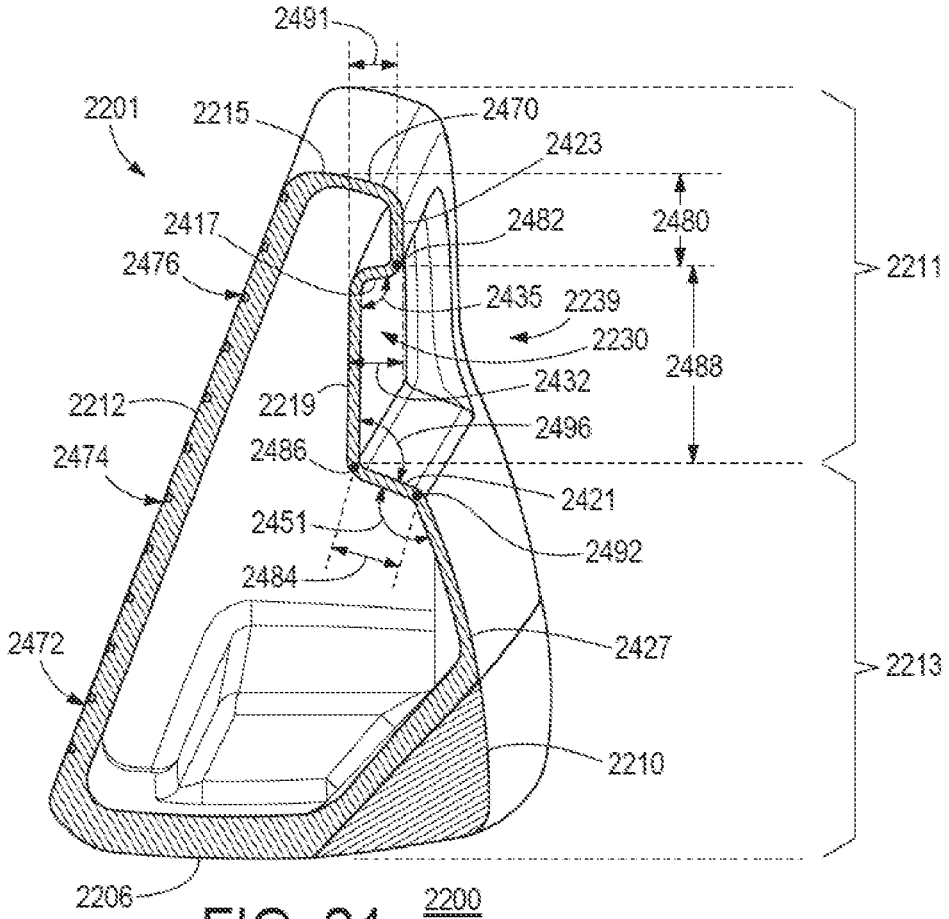
FIG. 24 depicts a cross-sectional view of the golf club head of FIG. 22 along the cross-sectional line XXIV-XXIV of FIG. 22.

FIG. 24 illustrates a cross-section of golf club head 2200 along the cross-sectional line XXIV-XXIV in FIG. 22, according to one embodiment. As seen in FIG. 24, strikeface 2212 comprises a high region 2476, a middle region 2474, and a low region 2472. In many embodiments, upper region 2211 of rear 2210 comprises a rear wall 2423, a top wall 2417 of cavity 2230 below and adjacent to rear wall 2423, and a back wall 2219 of cavity 2230 below and adjacent to top wall 2417. In some embodiments, a top wall length 2491 of top wall 2417 can be approximately 0.090 inch (0.229 cm) to approximately 0.130 inch (0.330 cm). In some embodiments, top wall length 2491 of top wall 2417 can be approximately 0.090 inch (0.229 cm), 0.100 inch (0.254 cm), 0.110 inch (0.279 cm), 0.120 inch (0.305 cm), or 0.130 inch (0.330 cm).

In some embodiments, a height 2480 of rear wall 2423 of the upper region 2211 of rear 2210 can be approximately 0.125 inch (0.318 cm) to approximately 0.75 inch (1.91 cm), or approximately 0.150 inch (0.381 cm) to approximately 0.400 inch (1.02 cm). For example, in some embodiments, the height 2480 of rear wall 2423 of the upper region 2211 of rear 2210 can be approximately 0.175 inch (0.445 cm), 0.275 inch (0.699 cm), 0.375 inch (0.953 cm), 0.475 inch (1.21 cm), 0.575 inch (1.46 cm), or 0.675 inch (1.71 cm). In some embodiments, the height 2480 of rear wall 2423 of the upper region 2211 of rear 2210 can be approximately 0.180 inch (0.4572 cm) to approximately 0.200 inch (0.508 cm). In some embodiments, the height 2480 of rear wall 2423 of the upper region 2211 of rear 2210 can be approximately 0.190 inch (0.4826 cm). In some embodiments, the height 2480 of rear wall 2423 of the upper region 2211 of rear 2210 can be approximately 5% to approximately 25% of the height of golf club head 2200.

The height 2480 of rear wall 2423 of the upper region 2211 of rear 2210, as described herein, allows cavity 2230 to absorb at least a portion of the stress on strikeface 2212 during impact with a golf ball. A golf club head having a rear wall height greater than rear wall height 2480 described herein would absorb less stress (and allow less strikeface deflection) on impact than the golf club head 2200 described herein, due to increased dispersion of the impact stress along the top rail prior to reaching the cavity.

In some embodiments, cavity 2230 is located above a lower region 2213 of rear 2210 and is defined at least in part by upper region 2211 and lower region 2213 of rear 2210. Cavity 2230 comprises the top wall 2417, the back wall 2219, and a bottom incline 2421. A first inflection point 2482 is located between top wall 2417 of cavity 2230 and rear wall 2219 of cavity. A second inflection point 2486 is located between rear wall 2219 of cavity 2230 and bottom incline 2421.

In some embodiments, a height 2488 of back wall 2219, measured from first inflection point 2482 to second inflection point 2486, can be approximately 0.100 inch (0.254 cm) to approximately 0.600 inch (1.524 cm). For example, height 2488 of back wall 2219 can be approximately 0.100 inch (0.254 cm), 0.150 inch (0.381 cm), 0.200 inch (0.508 cm), 0.250 inch (0.635 cm), 0.300 inch (0.762 cm), 0.350 inch (0.889 cm), 0.400 inch (1.016 cm), 0.450 inch (1.143 cm), 0.500 inch (1.27 cm), 0.550 inch (1.397 cm), or 0.600 inch (1.524 cm). In many embodiments, height 2488 of back wall 2219 can be approximately 0.420 inch (1.067 cm) to approximately 0.520 inch (1.321 cm). In some embodiments, height 2488 of back wall 2219 can be approximately 0.420 inch (1.067 cm), 0.430 inch (01.092 cm), 0.440 inch (1.118 cm), 0.450 inch (1.143 cm), 0.460 inch (1.168 cm), 0.470 inch (1.194 cm), 0.480 inch (1.219 cm), 0.490 inch (1.245 cm), 0.500 inch (1.27 cm), 0.510 inch (1.295 cm), or 0.520 inch (1.321 cm).

In many embodiments, an apex of top wall 2417 can be approximately 0.125 inch (0.318 cm) to approximately 1.25 inches (3.18 cm) or approximately 0.25 inch (0.635 cm) to approximately 1.25 inches (3.18 cm) below an apex of top rail 2215. For example, the apex of top wall 2417 can be approximately 0.125 inch (0.318 cm), 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), or 1.25 inches (3.18 cm) below the apex of top rail 2215.

In many embodiments, back wall 2219 of cavity 2230 can be substantially parallel to strikeface 2212. In other embodiments, back wall 2219 is not substantially parallel to strikeface 2212. In some embodiments, back wall 2219 of cavity 2230 is substantially parallel to rear wall 2423 of upper region 2211 of rear 2210. In many embodiments, back wall 2219 of cavity 2230 is angled away from strikeface 2212 when moving from first inflection point 2482 to second inflection point 2486. This orientation of back wall 2219 creates a buckling point or hinge point or plastic hinge to direct the stress of impact toward cavity 2230 and to allow increased flexing of strikeface 2212 during impact.

Lower region 2213 of rear 2210 comprises the bottom incline 2421 of cavity 2230 and a lower exterior wall 2427. In some embodiments, bottom incline 2421 of cavity 2230 can have a bottom incline length 2484 measured from second inflection point 2486 to a third inflection point 2492 positioned between bottom incline 2421 and lower exterior wall 2427. In a number of embodiments, bottom incline length 2484 can be approximately 0.150 inch (0.381 cm) to approximately 0.210 inch (0.533 cm). In many embodiments, bottom incline length 2484 can be approximately 0.150 inch (0.381 cm), 0.160 inch (0.406 cm), 0.170 inch (0.432 cm), 0.180 inch (0.457 cm), 0.190 inch (0.483 cm), 0.200 inch (0.508 cm), or 0.210 inch (0.533 cm).

In some embodiments, a lower angle 2451 can be measured from the between the bottom incline 2421 and the lower exterior wall 2427. In some embodiments, lower angle 2451 can be less than 180 degrees. In a number of embodiments, lower angle 2451 can be approximately 30 degrees to less than 180 degrees. In various embodiments, lower angle 2451 can be approximately 70 degrees to approximately 130 degrees. In some embodiments, lower angle 2451 can be approximately 70, 75, 80, 85, 90, 95, 100, 105, 110, 115, 120, 125, or 130 degrees.

In some embodiments, an inflection angle 2496 measured from back wall 2219 to bottom incline 2421 can be approximately 70 degrees to approximately 150 degrees. In some embodiments, inflection angle 2496 can be approximately 90 degrees to approximately 130 degrees. In some embodiments, inflection angle 2496 is approximately 70, 75, 80, 85, 90, 95, 100, 110, 115, 120, 125, 130, 135, 140, 145, or 150 degrees.

In many embodiments, second inflection point 2486, adjacent to bottom incline 2421, can be at least approximately 0.25 inch (0.635 cm) to approximately 2.0 inches (5.08 cm), or approximately 0.5 inch (1.27 cm) to approximately 1.5 inches (3.81 cm) below the apex of top rail 2215. For example, the second inflection point 2486 can be at least approximately 0.25 inch (0.635 cm), 0.5 inch (1.27 cm), 0.75 inch (1.91 cm), 1.0 inch (2.53 cm), 1.25 inches (3.18 cm), 1.5 inches (3.81 cm), 1.75 inches (4.45 cm) or 2.0 inches (5.08 cm) below the apex of top rail 2215. In some embodiments, the maximum height of the bottom incline, measured from the sole 2206 of the club head 2200 to second inflection point 2486, can be at least approximately 0.25 inch (0.635 cm) to approximately 3 inches (7.62 cm), or approximately 0.50 inch (1.27 cm) to approximately 2 inches (5.08 cm) above a lowest point of the sole 2206. For example, the second inflection point 2486 can be at least approximately 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1.625 inches (4.12 cm), 1.75 inches (4.45 cm), 1.875 inches (4.76 cm), 2.0 inches (5.08 cm), 2.125 inches 5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm), or 3.0 inches (7.62 cm) above a lowest point of the sole.

Cavity 2230 further comprises at least one channel 2239 (FIG. 22). In many embodiments, channel 2239 extends from heel region 2202 to toe region 2204. A channel width 2432 (FIG. 24) measured from back wall 2219 (FIG. 24) to rear wall 2423 (FIG. 24) and substantially perpendicular to a ground plane when golf club head 2200 is at address, can be substantially constant throughout channel 2239. In some embodiments, channel width 2432 (FIG. 24) can be approximately 0.008 inch (0.2 mm) to approximately 1 inch (25 mm), or approximately 0.008 inch (0.2 mm) to approximately 0.31 inch (8 mm). For example, channel width 2432 can be approximately 0.008 inch (0.2 mm), 0.016 inch (0.4 mm), 0.024 inch (0.6 mm), 0.031 inch (0.8 mm), 0.039 inch (1.0 mm), 0.079 inch (2 mm), 0.12 inch (3 mm), 0.16 inch (4 mm), 0.20 inch (5 mm), 0.24 inch (6 mm), 0.28 inch (7 mm), 0.31 inch (8 mm), 0.39 inch (10 mm), 0.59 inch (15 mm), 0.79 inch (20 mm), or 0.98 inch (25 mm). In other embodiments, a channel toe region width of channel 2239 is smaller than a channel heel region width of channel. In other embodiments, the channel heel region width is smaller than the channel toe region width. In other embodiments, a channel middle region width of channel 2239 can be smaller than at least one of the channel heel region width or the channel toe region width. In other embodiments, the channel middle region width can be greater than at least one of the channel heel region width or the channel toe region width. In some embodiments, channel 2239 is symmetrical from heel region 2202 to toe region 2204. In other embodiments, channel 2239 is non-symmetrical. In other embodiments, channel 2239 can further comprise at least two partial channels. In some embodiments, channel 2239 can comprise a series of partial channels interrupted by one or more bridges. In some embodiments, the one or more bridges can be approximately the same thickness as the thickness of upper region 2211 of rear 2210.

The channel width 2432, as described herein, allows absorption of stress from strikeface 2212 on impact. A golf club head having a channel width less than the channel width described herein (e.g. a golf club head with a less pronounced cavity) would allow less stress absorption from the strikeface on impact (due to less material on the upper region 2211 of rear 2210), and therefore would experience less strikeface deflection than the golf club head 2200 described herein.

In many embodiments, cavity 2230 further comprises a back cavity angle 2435. Back cavity angle is measured between top wall 2417 and back wall 2219 of cavity 2230. In many embodiments, back cavity angle 2435 can be approximately 70 degrees to approximately 110 degrees. In some embodiments, back cavity angle 2435 can be approximately 80 degrees to approximately 100 degrees. In some embodiments, back cavity angle 2435 is approximately 70, 75, 80, 85, 90, 95, 100, or 110 degrees. In many embodiments, back cavity angle 2435 provides a buckling point or plastic hinge or targeted hinge at a top rail hinge point 2470, upon golf club head 2200 impacting the golf ball at strike face 2212. In some embodiments, the wall thickness at top rail hinge point 2470 is thinner than at top wall 2417 of cavity 2230

Figure 25:
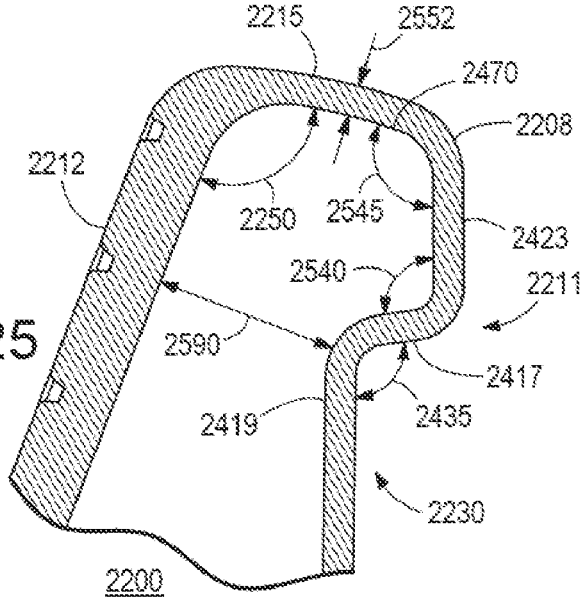
FIG. 25 depicts a view of a portion of the golf club head of FIG. 24 and a view of the same area of a standard golf club head.

FIG. 25 illustrates a view of top rail 2215 and a portion of rear 2210 of the cross-section of golf club head 2200 of FIG. 22 different from cross-section of golf club head 1200 as shown in FIG. 13. In many embodiments, golf club head 2200 comprises a rear angle 2540, a top rail angle 2545, and a strikeface angle 2550. Rear angle 2540 is measured from top wall 2417 to rear wall 2423 of upper region 2211. In many embodiments, rear angle 2540 can be approximately 70 degrees to approximately 110 degrees. In some embodiments, rear angle 2540 is approximately 70, 75, 80, 85, 90, 95, 100, 105, or 110 degrees. Top rail angle 2545 is measured from rear wall 2423 of upper region 2211 to top rail 2215. In many embodiments, top rail angle 2545 can be approximately 35 degrees to approximately 120 degrees or 70 degrees to approximately 110 degrees. In some embodiments, top rail angle 2545 can be approximately 35, 40, 45, 50, 55, 60, 65, 70, 75, 80, 85, 90, 95, 100, 105, 110, 115, or 120 degrees. Strikeface angle 2550 is measured from strikeface 2212 to top rail 2215. In many embodiments, strikeface angle 2550 can be approximately 70 degrees to approximately 160 degrees or 70 degrees to approximately 110 degrees. In some embodiments, strikeface angle 2550 is approximately 70, 75, 80, 85, 90, 95, 100, 105, 110, 115, 120, 125, 130, 135, 140, 145, 150, 155, or 160 degrees.

In some embodiments, a minimum gap 2590 measured perpendicularly to the strikeface 2212 to the back wall 2219 is approximately 0.079 inch (2 mm) to approximately 0.39 inch (10 mm). For example, the minimum gap 2590 between strikeface 2212 and back wall 2219 can be approximately 0.079 inch (2 mm), 0.16 inch (4 mm), 0.24 inch (6 mm), 0.31 inch (8 mm), or 0.39 inch (10 mm). In some embodiments, the minimum gap 2590 between the strikeface 2212 and back wall 2219 is less than approximately 0.55 inch (14 mm), less than approximately 0.47 inch (12 mm), less than approximately 0.39 inch (10 mm), less than approximately 0.31 inch (8 mm), less than approximately 0.24 inch (6 mm), or less than approximately 0.16 inch (4 mm). Further, in some embodiments, a maximum gap between strikeface 2212 and rear wall 2423 of upper region 2211 of golf club head 2200 is greater than minimum gap 2590. Further still, in some embodiments, a maximum gap between strikeface 2212 and bottom incline 2421 (FIG. 24) in lower region 2213 (FIG. 24) of golf club head 2200 is greater than minimum gap 2590 and the maximum gap in upper region 2211.

Figure 26:
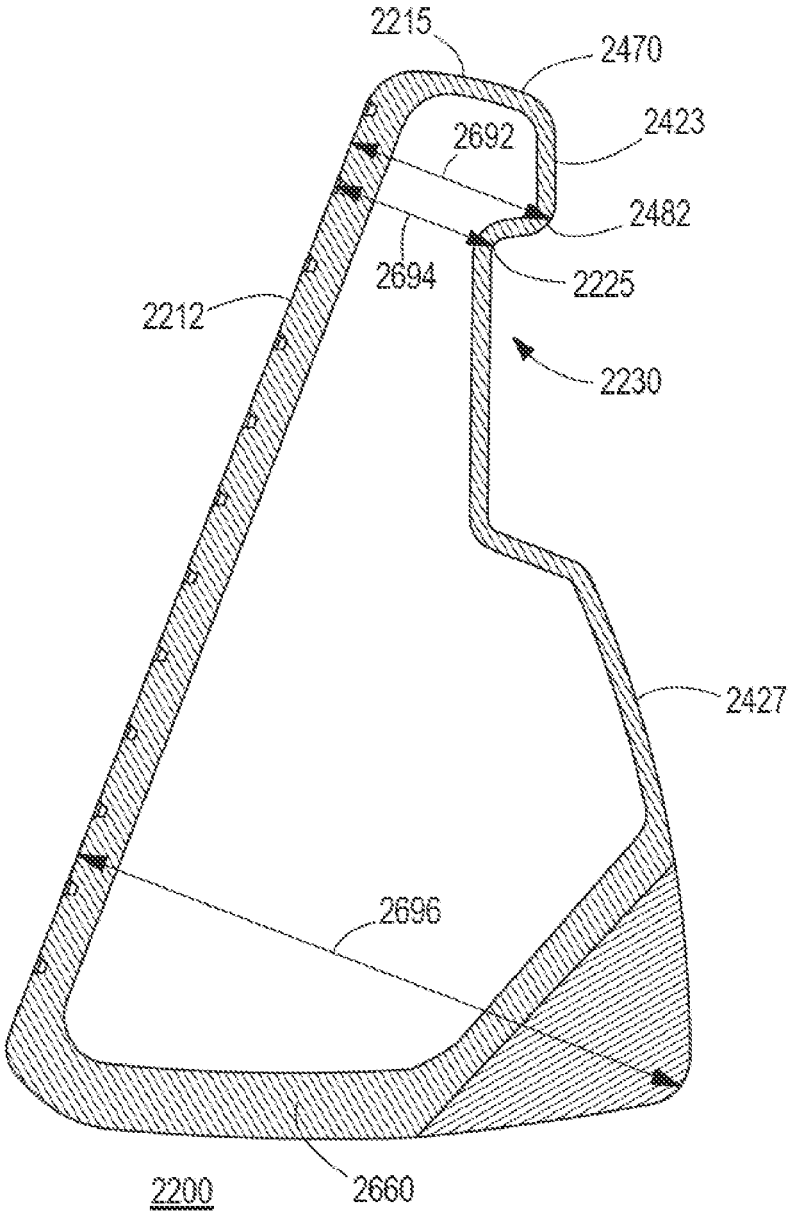
FIG. 26 depicts a simplified cross sectional view of the golf club head of FIG. 22, similar to the detailed cross-sectional view of the golf club head in FIG. 24.

FIG. 26 illustrates a simplified cross-sectional view of golf club head 2200, similar to the detailed cross-section of the golf club head 2200 illustrated in FIG. 24. Golf club head 2200 includes the cavity 2230, an exterior surface 2225, the upper region 2211, and the lower region 2213. Upper region 2211 includes rear wall 2423, cavity 2230 includes cavity exterior wall 2225, top wall 2417, and back wall 221, while the lower region 2213 includes bottom incline 2421 and lower exterior wall 2427. In many embodiments, a maximum upper distance 2692 measured as the perpendicular distance from the exterior surface 2225 of the strikeface 2212 to the exterior surface 2225 of the rear wall 2423 of upper region 2211 can be approximately 0.20-0.59 inch (5-15 mm). For example, maximum upper distance 2692 can be approximately 0.20 inch (5 mm), 0.24 inch (6 mm), 0.28 inch (7 mm), 0.31 inch (8 mm), 0.35 inch (8.89 mm), 0.39 inch (10 mm), 0.43 inch (11 mm), 0.47 inch (12 mm), 0.51 inch (13 mm), 0.55 inch (14 mm), or 0.59 inch (15 mm). In some embodiments, maximum upper distance 2692 can be approximately 0.355 inch (9.02 mm).

Further, a minimum upper distance 2694 measured as the perpendicular distance from the exterior surface 2225 of the strikeface 2212 to the exterior surface 2225 of the back wall 2219 can be approximately 0.16-0.47 inch (4-12 mm). For example, minimum upper distance 2694 can be approximately 0.16 inch (4 mm), 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), or 0.47 inch (12 mm). In some embodiments, minimum upper distance 2694 can be approximately 0.284 inch (7.21 mm).

Further still, a maximum lower distance 2696 measured as the perpendicular distance from the exterior surface 2225 of the strikeface 2212 to the exterior surface 2225 of the lower exterior wall 2427 can be approximately 0.98-1.57 inch (25-40 mm). For example, maximum lower distance 2696 can be approximately 0.98 inch (25 mm), 1.02 inch (26 mm), 1.06 inch (27 mm), 1.10 inch (28 mm), 1.14 inch (29 mm), 1.18 inch (30 mm), 1.22 inch (31 mm), 1.26 inch (32 mm), 1.30 inch (33 mm), 1.34 inch (34 mm), 1.38 inch (35 mm), 1.42 inch (36 mm), 1.46 inch (37 mm), 1.50 inch (38 mm), 1.54 inch (39 mm), 1.57 inch or (40 mm). In some embodiments, maximum lower distance 2696 can be approximately 1.043 inch (26.5 mm). In many embodiments, maximum lower distance 2696 is greater than maximum upper distance 2692, and maximum upper distance 2692 is greater than minimum upper distance 2694.

In many embodiments, cavity 2230 can provide an increase in golf ball speed over golf club head 1200 (FIG. 25) or other standard golf club heads, can reduce the spin rate of standard hybrids club heads, and can increase the launch angle over both the standard hybrid and iron club heads. In many embodiments, the shape of cavity 2230 determines the level of spring and timing of the response of golf club head 2200. When the golf ball impacts strikeface 2212 of club head 2200 with cavity 2230, strikeface 2212 springs back like a drum, and rear 2210 bends in a controlled buckle manner. In many embodiments, top rail 2215 can absorb more stress over greater volumetric space than a top rail in a golf club head without cavity 2230. The length, depth and width of cavity 2230 can vary. These parameters provide control regarding how much spring back is present in the overall design of club head 2200.

Upon impact with the golf ball, strikeface 2212 can bend inward at a greater distance than on a golf club without cavity 2230. In some embodiments, strikeface 2212 has an approximately 10% to approximately 50% greater deflection than a strikeface on a golf club head without cavity 2230. In some embodiments, strikeface 2212 has an approximately 5% to approximately 40% or approximately 10% to approximately 20% greater deflection than a strikeface on a golf club head without cavity 2230. For example, strikeface 2212 can have an approximately 5%, 10%, 15%, 20%, 25%, 30%, 35% or 40% greater deflection than a strikeface on a golf club head without cavity 2230. In many embodiments, there is both a greater distance of retraction by strikeface 2212 due to the hinge and bending of cavity 2230 over a standard strikeface that does not have a back portion of the club without the cavity.

In many embodiments, the face deflection is greater with club head 2200 having cavity 2230, as a greater buckling occurs along top rail hinge point 2470 upon impact with the golf ball. Cavity 2230, however, provides a greater dispersion of stress along top rail hinge point 2470 region of the top rail, and the spring back force is transferred from cavity 2230 and top rail 2215 to strikeface 2212. A standard top rail without a cavity does not have this hinge/buckling effect, nor does it absorb a high level of stress over a large volumetric area of the top rail. Therefore, the standard strikeface does not contract and then recoil as much as strikeface 2212. Further, both a larger region of strikeface 2212 and top rail 2215 absorb more stress than the same crown region of a standard golf club head with a standard top rail and no cavity. In many embodiments, although there is greater stress along a greater area above cavity 2230 than the same area in a standard club without the cavity, the durability of the club head with and without the cavity is the same. By adding more spring to the back end of the club (due to the inward inclination of top wall 2417 toward strikeface 2212), more force is displaced throughout the volume of the structure. The stress is observed over a greater area of strikeface 2212 and top rail 2215 of golf club head 2200. Peak stresses can be seen in the standard top rail club head. However, more peak stresses are seen in golf club head 2200, but distributed over a large volume of the material. The hinge and bend regions of golf club head 2200 (i.e., the region above cavity 2230 and cavity 2230 itself) will not deform as long as the stress does not meet the critical buckling threshold. Cavity 2230 and its placement can be design to be under the critical K value of the buckling threshold.

As shown in FIG. 26, a further deflection feature of the golf club head 2200 can be the uniform thinned region 2660, located at the sole 2206 and stretching between the rear 2210 of the body 2201 and the strikeface 2212, toward a cascading sole portion of the sole (as described in greater detail below). The uniform thinned region 2660 can provide multiple benefits. First, the uniform thinned region 2660 can reduce stress on the strikeface 2212 caused during impact with the golf ball. Second, the uniform thinned region 2660 can bend allowing the strikeface 2212 to experience greater deflection. Third, the uniform thinned region 2660 removes weight from the sole area, allowing the weight to be redistributed more toward the rear of the golf club head 2200. At impact, the energy imparted to the strikeface 2212 by the golf ball can cause the uniform thinned region 2660 to bend outward, which in turn increases the strikeface 2212 deflection. After bending, the uniform thinned region 2660 rebounds back to its original position returning the majority of the energy from impact back to the golf ball. The result is the golf club head 2200 imparts increased ball speeds and greater travel distances to the golf ball after impact.

Figure 27:
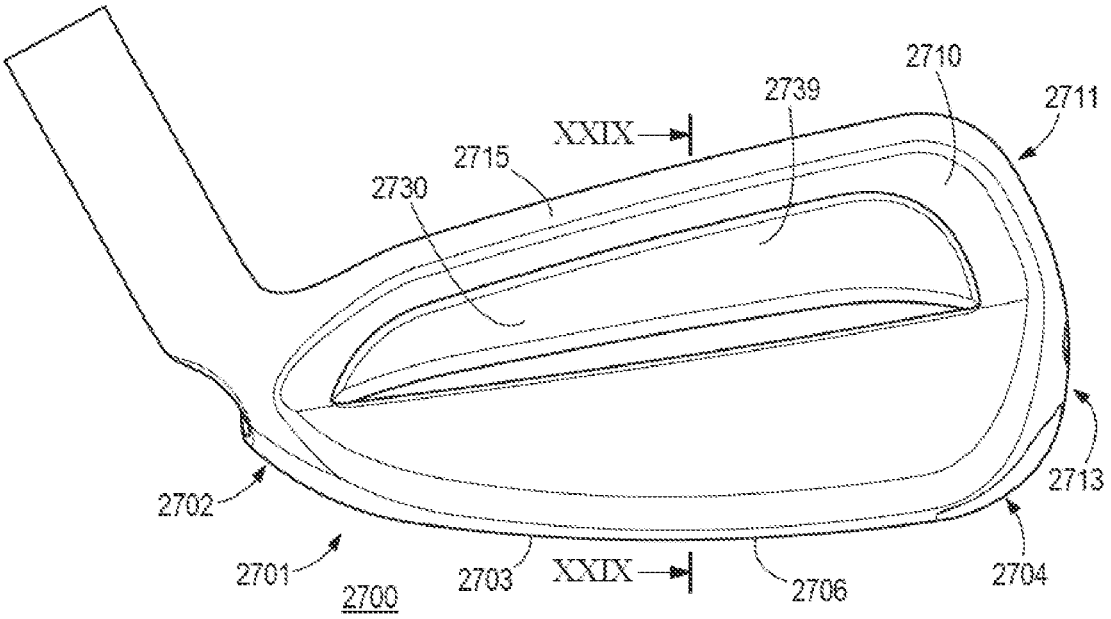
FIG. 27 depicts a back perspective view of a golf club head according to still yet another embodiment.
Figure 28:
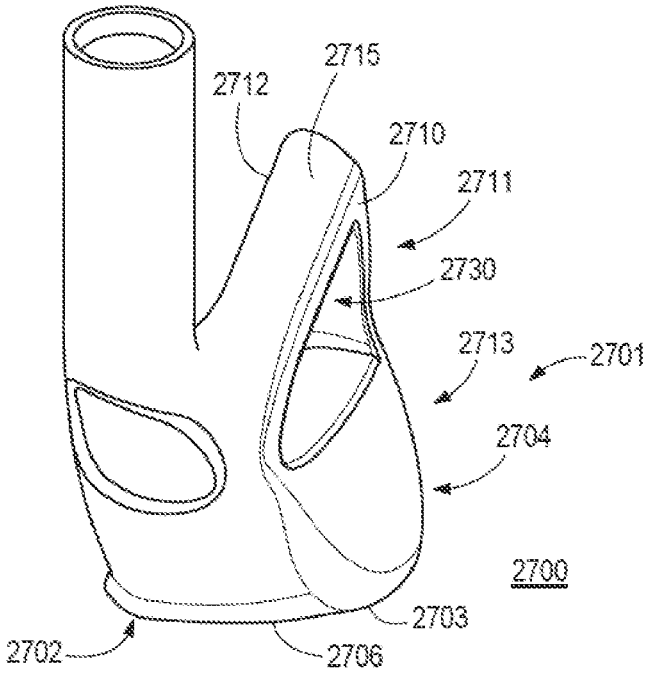
FIG. 28 depicts a back, heel-side perspective view of the golf club head according to the embodiment of FIG. 27.

Turning ahead in the drawings, FIG. 27 illustrates a back perspective view of an embodiment of golf club head 2700 and FIG. 28 illustrates a back heel-side perspective view of golf club head 2700 according to the embodiment of FIG. 27. In some embodiments, golf club head 2700 can be similar to golf club head 1000 (FIG. 10), and/or golf club head 2200 (FIG. 22). Golf club head 2700 can be a hybrid-type golf club head. In other embodiments, golf club head 2700 can be an iron-type golf club head or a fairway wood-type golf club head. In many embodiments, golf club head 2700 does not include a badge or a custom tuning port.

Golf club head 2700 comprises a body 2701. In some embodiments, body 2701 can be similar to body 1001 (FIG. 10), and/or body 2201 (FIG. 22). In many embodiments, the body is hollow. In some embodiments, the body is at least partially hollow. Body 2701 comprises an exterior surface 2703, a strikeface 2712, a heel region 2702, a toe region 2704 opposite heel region 2702, a sole 2706, and a rear 2710.

Body 2701 of FIGS. 27-31 further comprises a blade length. The blade length for body 2701 can be measured similar to blade length 3725 as shown and described in FIG. 43 (i.e., a measurement parallel to the flat surface of the strikeface 3712, from a toe edge 3726 of the strikeface 3712, to strikeface end 3727 right before the strikeface 3712 integrally curves into the hosel). The blade length of the body 2701 can range from 2.80 inch (7.11 cm) to 3.00 inch (7.62 cm). For example, in some embodiments, the body 2701 can comprise a blade length of 2.80 inch (7.11 cm), 2.82 inch (7.16 cm), 2.84 inch (7.21 cm), 2.86 inch (7.26 cm), 2.88 inch (7.32 cm), 2.90 inch (7.37 cm), 2.93 inch (7.44 cm), 2.94 inch (7.47 cm), 2.96 inch (7.52 cm), 2.98 inch (7.57 cm), or 3.00 inch (7.62 cm).

The body 2701 further comprises a uniform thinned region transitioning from the bottom of the strikeface 2712 to the sole 2706, toward a cascading sole portion of the sole (as described in greater detail below). In the illustrated embodiment, the uniform thinned region comprises a sole thickness measured perpendicular from the exterior surface 2703 to the interior surface at the uniform thinned region, which can remain constant from the bottom of the strikeface 2712 to adjacent the cascading sole portion of the sole. In some embodiments, the sole thickness of the uniform thinned region can be thinner than a conventional sole. For example, in some embodiments, the sole thickness of the uniform thinned region may range from approximately 0.040 inch to 0.080 inch. In other embodiments, the sole thickness of the uniform thinned region may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region can be 0.040 inch, 0.045 inch, 0.050 inch, 0.060 inch, 0.065 inch, 0.070 inch, 0.075 inch, or 0.080 inch.

Figure 29:
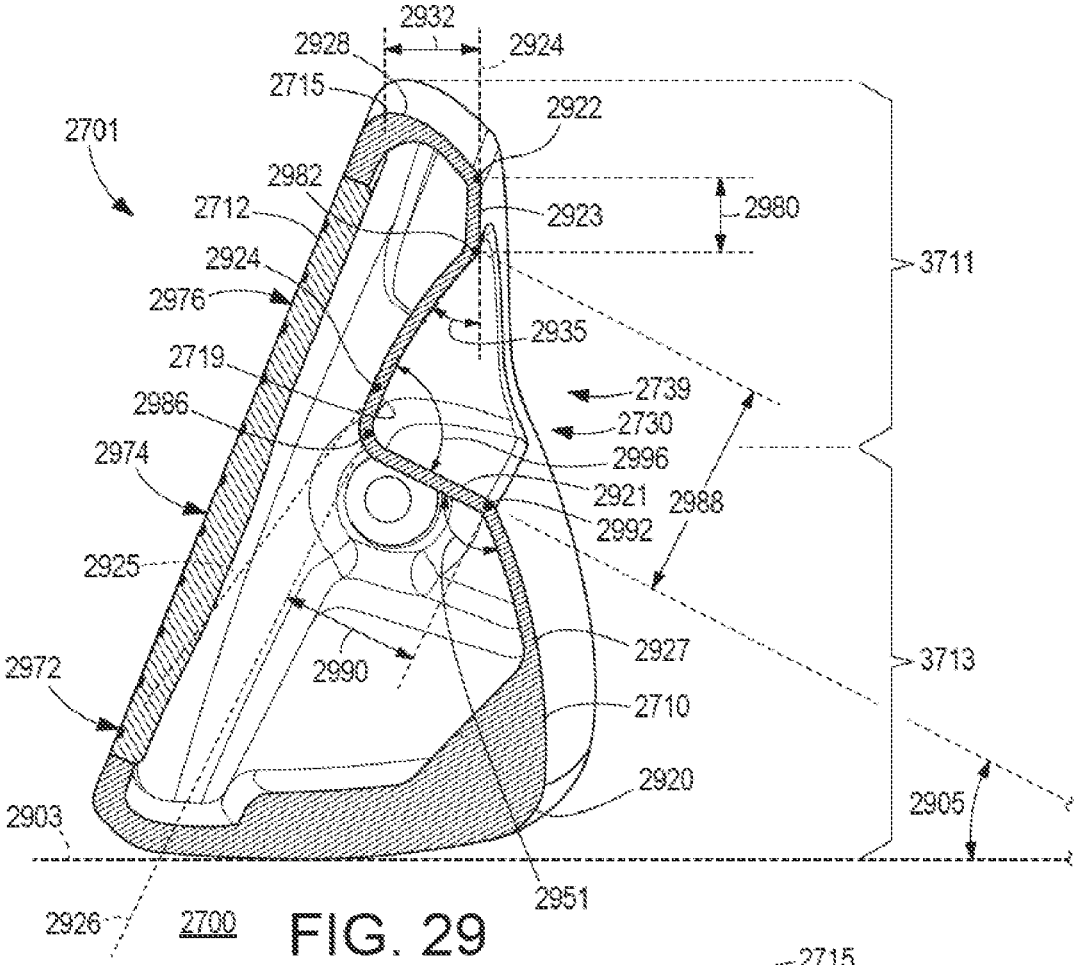
FIG. 29 depicts a cross-sectional view of the golf club head of FIG. 27 along the cross-sectional line XXIX-XXIX of FIG. 27.

FIG. 29 illustrates a cross-section of golf club head 2700 along the cross-sectional line XXIX-XXIX in FIG. 27, according to one embodiment. As seen in FIG. 29, strikeface 2712 comprises a high region 2976, a middle region 2974, and a low region 2972. Rear 2710 comprises an upper region 2711 and a lower region 2713 (FIG. 29). Upper region 2711 comprises a top rail 2715, a rear wall 2923, and a top wall 2719. The top rail 2715 can be similar to the top rail 1015 of golf club head 1000. In many embodiments, rear wall 2923 of rear 2710 is located below and adjacent to top rail 2715, and a top wall 2719 of rear 2710 is located below and adjacent to rear wall 2923. Lower region 2713 comprises a back wall 2921, and a lower exterior wall 2927, wherein back wall 2921 is located below an adjacent the top wall 2719, and the lower exterior wall 2927 is located below and adjacent the back wall 2921. Cavity 2730 is located on the exterior surface 2703, below the top rail 2715 and rear wall 2923, above the lower region 2713 of rear 2710, and is defined by at least in part by upper region 2711 and lower region 2713.

In some embodiments, top rail 2715 of the upper region 2711 of the rear 2710 can be a flatter and taller top rail or skirt than in the in irons known to one skilled in the art. The flatter and taller top rail can compensate for mis-hits on strikeface 2712 to increase playability off the tee. In some embodiments, the length of top rail 2715, measured from heel region 2702 to toe region 2704, can be 70% to 95% of the length of golf club head 2700. In many embodiments, cavity 2730 comprises a top rail box spring design. In many embodiments, top rail 2715 and cavity 2730 provide an increase in the overall bending of strikeface 2712. In some embodiments, the bending of strikeface 2712 can allow for a 2% to 5% increase of energy. Cavity 2730 allows for strikeface 2712 to be thinner and allow additional overall bending. For some fairway wood-type golf club head embodiments, cavity 2730 can be a reverse scoop or indentation of rear 2710 with body 2701 comprising a greater thickness or width toward sole 2706.

In some embodiments, a height 2980 of rear wall 2923 of the upper region 2711 of rear 2710 can range from 0.125 inch (0.318 cm) to 0.75 inch (1.91 cm), or 0.150 inch (0.381 cm) to 0.400 inch (1.02 cm). For example, in some embodiments, the height 2980 of rear wall 2923 of the upper region 2711 of rear 2710 can be 0.175 inch (0.445 cm), 0.275 inch (0.699 cm), 0.375 inch (0.953 cm), 0.475 inch (1.21 cm), 0.575 inch (1.46 cm), or 0.675 inch (1.71 cm). In some embodiments, the height 2980 of rear wall 2923 of the upper region 2711 of rear 2710 can range from 0.150 inch (0.381 cm) to 0.200 inch (0.508 cm). In some embodiments, the height 2980 of rear wall 2923 of the upper region 2711 of rear 2710 can be 0.170 inch (0.432 cm). In some embodiments, the height 2980 of rear wall 2923 of the upper region 2711 of rear 2710 can be 5% to 25% of the height of golf club head 2700.

The height 2980 of rear wall 2923 of the upper region 2711 of rear 2710, as described herein, allows cavity 2730 to absorb at least a portion of the stress on strikeface 2712 during impact with a golf ball. A golf club head having a rear wall height greater than rear wall height 2980 described herein would absorb less stress (and allow less strikeface deflection) on impact than golf club head 2700 described herein, due to increased dispersion of the impact stress along the top rail prior to reaching the cavity.

In some embodiments, cavity 2730 is located above a lower region 2713 of rear 2710 and is defined at least in part by upper region 2711 and lower region 2713 of rear 2710. Cavity 2730 comprises top wall 2719, and a back wall 2921. A first reference point 2922 is located between the top rail 2715 and rear wall 2923. A second reference point 2982 is located between rear wall 2923 and top wall 2719. A first inflection point 2986 is located between top wall 2719 of cavity 2730 and back wall 2921. A third reference point 2924 is a point located on top wall 2719 closest to the strikeface 2712. First reference point 2922 and second reference point 2982 create a first reference line 2929. Second reference point 2982 and third reference point 2924 create a second reference line 2925. Third reference point 2924 and first inflection point 2986 create a third reference line 2926.

Golf club head 2700 further comprises a height 2988 of top wall 2719, measured parallel to strikeface 2712 and from the second reference point 2982 to first inflection point 2986. In many embodiments, height 2988 can range from 0.100 inch (0.254 cm) to 0.600 inch (1.524 cm). For example, height 2988 can be 0.100 inch (0.254 cm), 0.150 inch (0.381 cm), 0.200 inch (0.508 cm), 0.250 inch (0.635 cm), 0.300 inch (0.762 cm), 0.350 inch (0.889 cm), 0.400 inch (1.016 cm), 0.450 inch (1.143 cm), 0.500 inch (1.27 cm), 0.550 inch (1.397 cm), or 0.600 inch (1.524 cm). In many embodiments, height 2988 can range from 0.500 inch (1.27 cm) to 0.600 inch (1.524 cm). In some embodiments, height 2488 of top wall 2719 can be 0.500 inch (1.27 cm), 0.510 inch (1.295 cm), 0.520 inch (1.321 cm), 0.530 inch (1.346 cm), 0.540 inch (1.372 cm), 0.550 inch (1.397 cm), 0.560 inch (1.422 cm), 0.570 inch (1.448 cm), 0.580 inch (1.473 cm), 0.590 inch (1.499 cm), or 0.600 inch (1.524 cm).

In many embodiments, second reference point 2982 can be 0.125 inch (0.318 cm) to 1.25 inches (3.18 cm) or 0.25 inch (0.635 cm) to 1.25 inches (3.18 cm) to apex 2928 of top rail 2715. For example, the second reference point 2982 can be 0.125 inch (0.318 cm), 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), or 1.25 inches (3.18 cm) below the apex 2928 of top rail 2715.

In many embodiments, top wall 2719 of cavity 2730 can be substantially parallel to strikeface 2712. In other embodiments, top wall 2719 is not substantially parallel to strikeface 2712. In some embodiments, top wall 2719 of cavity 2730 is substantially parallel to rear wall 2923 of upper region 2711 of rear 2710. In a number of embodiments, a portion of top wall 2719 extends away from rear wall 2923 toward strikeface 2712 from second reference point 2982 to third reference point 2924. In some embodiments, the portion of top wall 2719 extending away from rear wall 2923 toward strikeface 2712 from second reference point 2982 to third reference point 2924 can be straight, curved upward, or curved downward. In many embodiments, a portion of top wall 2719 of cavity 2730 is angled away from strikeface 2712 from third reference point 2924 to first inflection point 2986. In some embodiments, the portion of top wall 2719 angled away from strikeface 2712 from third reference point 2924 to first inflection point 2986 can be straight, curved upward, or curved downward. This orientation of top wall 2719 creates a buckling point, hinge point or plastic hinge to direct the stress of impact toward cavity 2730 and to allow increased flexing of strikeface 2712 during impact.

Lower region 2713 of rear 2710 comprises back wall 2921 of cavity 2730 and the lower exterior wall 2927. In some embodiments, back wall 2921 of cavity 2730 can have a back wall length 2990 measured from first inflection point 2986 to a second inflection point 2992 located between the back wall 2921, and the lower exterior wall 2927. In a number of embodiments, back wall length 2990 can range from 0.150 inch (0.381 cm) to 0.400 inch (1.02 cm). In many embodiments, back wall length 2990 can be 0.150 inch (0.381 cm), 0.160 inch (0.406 cm), 0.170 inch (0.432 cm), 0.180 inch (0.457 cm), 0.190 inch (0.483 cm), 0.200 inch (0.508 cm), 0.210 inch (0.533 cm), 0.220 inch (0.559 cm), 0.230 inch (0.584 cm), 0.240 inch (0.61 cm), 0.250 inch (0.635 cm), 0.260 inch (0.660 cm), 0.270 inch (0.686 cm), 0.280 inch (0.711 cm), 0.290 inch (0.737 cm), 0.300 inch (0.762 cm), 0.310 inch (0.787 cm), 0.320 inch (0.813 cm), 0.330 inch (0.838 cm), 0.340 inch (0.864 cm), 0.350 inch (0.889 cm), 0.360 inch (0.914 cm), 0.370 inch (0.94 cm), 0.380 inch (0.965 cm), 0.390 inch (0.991 cm), or 0.400 inch (1.02 cm).

In some embodiments, a lower angle 2951 can be measured from between the back wall 2921 and the lower exterior wall 2927. In some embodiments, lower angle 2951 can be less than 180 degrees. In a number of embodiments, lower angle 2951 can range from 30 degrees to 180 degrees. In various embodiments, lower angle 2951 can range from 70 degrees to 130 degrees. In some embodiments, lower angle 2951 can be 70 degrees, 75 degrees, 80 degrees, 85 degrees, 90 degrees, 95 degrees, 100 degrees, 105 degrees, 110 degrees, 115 degrees, 120 degrees, 125 degrees, or 130 degrees.

In some embodiments, an inflection angle 2996 measured from third reference line 2926 to back wall 2921 can range from 70 degrees to 150 degrees. In some embodiments, inflection angle 2996 can range from 90 degrees to 130 degrees. In some embodiments, inflection angle 2996 can be 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, or 150 degrees. In many embodiments, inflection angle 2996 allows first inflection point 2986 to act as a buckling point or plastic hinge upon golf club head 2700 impacting the golf ball at strike face 2712. In some embodiments, the wall thickness at the first inflection point 2986 can be thinner than at the top wall 2719 and back wall 2921.

In many embodiments, first inflection point 2986, adjacent to back wall 2921, can range from 0.25 inch (0.635 cm) to 2.0 inches (5.08 cm), or 0.5 inch (1.27 cm) to 1.5 inches (3.81 cm) below the apex 2928 of top rail 2715. For example, the first inflection point 2986 can be 0.25 inch (0.635 cm), 0.5 inch (1.27 cm), 0.75 inch (1.91 cm), 1.0 inch (2.53 cm), 1.25 inches (3.18 cm), 1.5 inches (3.81 cm), 1.75 inches (4.45 cm) or 2.0 inches (5.08 cm) below the apex 2928 of top rail 2715. In some embodiments, the maximum height of the back wall 2921, measured perpendicular to a ground plane 2903 when golf club head 2700 is at address from a lowest point of sole 2706 to first inflection point 2986, can range from 0.25 inch (0.635 cm) to 3 inches (7.62 cm), or 0.50 inch (1.27 cm) to 2 inches (5.08 cm). For example, the first inflection point 2986 can be 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1.625 inches (4.12 cm), 1.75 inches (4.45 cm), 1.875 inches (4.76 cm), 2.0 inches (5.08 cm), 2.125 inches (5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm), or 3.0 inches (7.62 cm) above a lowest point of sole 2706 perpendicular to the ground plane 2903 when golf club head 2700 is at address.

In some embodiments, a back wall angle 2905 measured from back wall 2921 to ground plane 2903 can range from 15 degrees to 45 degrees. In some embodiments, back wall angle 2905 can be 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees 30 degrees, 31 degrees, 32 degrees, 33 degrees, 34 degrees, 35 degrees, 36 degrees, 37 degrees, 38 degrees, 39 degrees, 40 degrees, 41 degrees, 42 degrees, 43 degrees, 44 degrees, or 45 degrees.

In some embodiments, cavity 2730 can further comprise at least one channel 2739 (FIG. 27). In many embodiments, channel 2739 extends from heel region 2702 (FIG. 27) to toe region 2704 (FIG. 27). Channel 2739 comprises a channel width measured from second reference point 2982 to top wall 2719 substantially parallel to ground plane 2903, where channel width can vary in a direction from top rail 2715 to sole 2706. In some embodiments, a maximum channel width 2932, measured from first inflection point 2986 to second reference point 2982 substantially parallel to ground plane 2903, can be substantially constant throughout channel 2739 from heel region 2702 to toe region 2704. In some embodiments, maximum channel width 2932 (FIG. 29) can range from 0.008 inch (0.2 mm) to 1 inch (25 mm), or 0.008 inch (0.2 mm) to 0.31 inch (8 mm). For example, maximum channel width 2932 can be 0.008 inch (0.2 mm), 0.016 inch (0.4 mm), 0.024 inch (0.6 mm), 0.031 inch (0.8 mm), 0.039 inch (1.0 mm), 0.079 inch (2 mm), 0.12 inch (3 mm), 0.16 inch (4 mm), 0.20 inch (5 mm), 0.24 inch (6 mm), 0.28 inch (7 mm), 0.31 inch (8 mm), 0.39 inch (10 mm), 0.59 inch (15 mm), 0.79 inch (20 mm), or 0.98 inch (25 mm). In other embodiments, a channel toe region width of channel 2739 is less than a channel heel region width of channel 2739. In other embodiments, the channel heel region width is less than the channel toe region width. In other embodiments, a channel middle region width of channel 2739 can be less than at least one of the channel heel region width or the channel toe region width. In other embodiments, the channel middle region width can be greater than at least one of the channel heel region width or the channel toe region width. In some embodiments, channel 2739 is symmetrical from heel to toe. In other embodiments, channel 2739 is non-symmetrical. In other embodiments, channel 2739 can further comprise at least two partial channels. In some embodiments, channel 2739 can comprise a series of partial channels interrupted by one or more bridges. In some embodiments, the one or more bridges can be approximately the same thickness as the thickness of top rail 2715.

Maximum channel width 2932, as described herein, allows absorption of stress from strikeface 2712 on impact. A golf club head having a channel width less than the maximum channel width described herein (e.g. a golf club head with a less pronounced cavity) would allow less stress absorption from the strikeface on impact (due to less material on the upper region 2711 of rear 2710), and therefore would experience less strikeface deflection than golf club head 2700 described herein.

In many embodiments, cavity 2730 further comprises a back cavity angle 2935. Back cavity angle 2935 is measured from first reference line 2929 to second reference line 2925. In many embodiments, back cavity angle 2935 can range from 15 degrees to 80 degrees. In some embodiments, back cavity angle 2935 is 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees or 80 degrees.

Figure 30:
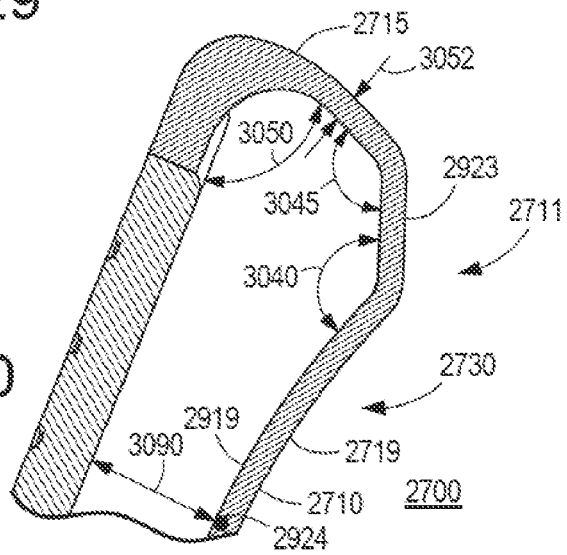
FIG. 30 depicts a view of a portion of the golf club head of FIG. 29 and a view of the same area of a standard golf club head.

FIG. 30 illustrates a view of top rail 2715 and a portion of rear 2710 of the cross-section of golf club head 2700 of FIG. 27 different from cross-section of golf club head 1200 as shown in FIG. 13. In many embodiments, golf club head 2700 comprises a rear angle 3040, a top rail angle 3045, and a strikeface angle 3050. Rear angle 3040 is measured from second reference line 2925 to rear wall 2923 of upper region 2711. In many embodiments, rear angle 3040 can range from 70 degrees to 140 degrees. In some embodiments, rear angle 3040 can be 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, or 140 degrees. Top rail angle 3045 is measured from rear wall 2923 of upper region 2711 to top rail 2715. In many embodiments, top rail angle 3045 can range from 35 degrees to 120 degrees or 70 degrees to 110 degrees. In some embodiments, top rail angle 3045 can be 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, or 120 degrees. Strikeface angle 3050 is measured from strikeface 2712 to top rail 2715. In many embodiments, strikeface angle 3050 can range from 70 degrees to 160 degrees or 70 degrees to 110 degrees. In some embodiments, strikeface angle 3050 can be 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees.

Upper region 2711 further comprises a minimum gap 3090 measured from third reference point 2924 of an inner surface 2919 of top wall 2719 to an inner surface 2919 of strikeface 2712, perpendicular to strikeface 2712. In some embodiments, minimum gap 3090 can range from 0.079 inch (2 mm) to 0.39 inch (10 mm). For example, the minimum gap 3090 can be 0.079 inch (2 mm), 0.16 inch (4 mm), 0.24 inch (6 mm), 0.31 inch (8 mm), or 0.39 inch (10 mm). In other embodiments, the minimum gap 3090 can range from 0.16 inch (4 mm) to 0.55 inch (14 mm). In some embodiments, the minimum gap 3090 can be 0.55 inch (14 mm), 0.47 inch (12 mm), 0.39 inch (10 mm), 0.31 inch (8 mm), 0.24 inch (6 mm), or 0.16 inch (4 mm).

Figure 31:
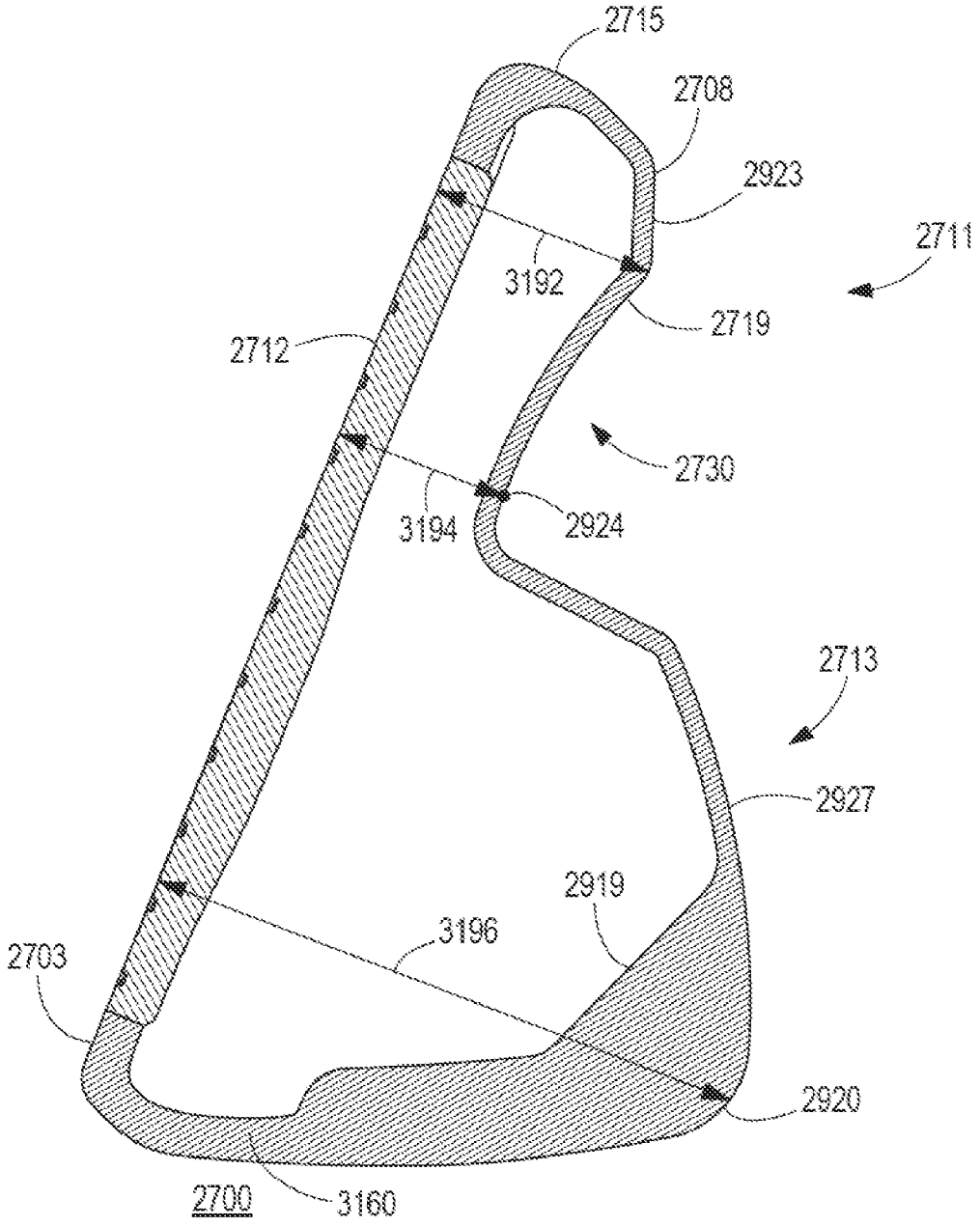
FIG. 31 depicts a simplified cross-sectional view of the golf club head of FIG. 27, similar to the detailed cross-sectional view of the golf club head in FIG. 29.

FIG. 31 illustrates a simplified cross-sectional view of golf club head 2700, similar to the detailed cross-section of golf club head 2700 illustrated in FIG. 29. Golf club head 2700 includes cavity 2730, upper region 2711, lower region 2713, and exterior surface 2703. In many embodiments, a maximum upper distance 3192 measured as the perpendicular distance from exterior surface 2703 of strikeface 2712 to exterior surface 2703 of second reference point 2982 of upper region 2711 can range from 0.20 inch to 0.59 inch (5 mm to 15 mm). For example, maximum upper distance 3192 can be 0.20 inch (5 mm), 0.24 inch (6 mm), 0.28 inch (7 mm), 0.31 inch (8 mm), 0.35 inch (8.89 mm), 0.39 inch (10 mm), 0.43 inch (11 mm), 0.47 inch (12 mm), 0.51 inch (13 mm), 0.55 inch (14 mm), or 0.59 inch (15 mm). In some embodiments, maximum upper distance 3192 can be 0.358 inch (9.09 mm). Further, a minimum upper distance 3194 measured as the perpendicular distance from exterior surface 2703 of strikeface 2712 to exterior surface 2703 of third inflection point 2924 can range from 0.09 inch to 0.47 inch (2.28 mm to 12 mm). For example, minimum upper distance 3194 can be 0.16 inch (4 mm), 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), or 0.47 inch (12 mm). In some embodiments, minimum upper distance 3194 can be 0.309 inch (7.85 mm). Further still, a maximum lower distance 3196 measured as the perpendicular distance from exterior surface 2703 of strikeface 2712 to exterior surface 2703 of a fourth reference point 2920 located between the lower exterior wall 2927 and the sole 2706 can range from 0.98 inch to 1.57 inch (25 mm to 40 mm). For example, maximum lower distance 3196 can be 0.98 inch (25 mm), 1.02 inch (26 mm), 1.06 inch (27 mm), 1.10 inch (28 mm), 1.14 inch (29 mm), 1.18 inch (30 mm), 1.22 inch (31 mm), 1.26 inch (32 mm), 1.30 inch (33 mm), 1.34 inch (34 mm), 1.38 inch (35 mm), 1.42 inch (36 mm), 1.46 inch (37 mm), 1.50 inch (38 mm), 1.54 inch (39 mm), 1.57 inch or (40 mm). In some embodiments, maximum lower distance 3196 can be 1.302 inch (33.1 mm). In many embodiments, maximum lower distance 3196 is greater than maximum upper distance 3192, and maximum upper distance 3192 is greater than minimum upper distance 3194.

In many embodiments, cavity 2730 can provide an increase in golf ball speed over golf club head 1200 (FIG. 30) or other standard golf club heads, can reduce the spin rate of standard hybrids club heads, and can increase the launch angle over both the standard hybrid and iron club heads. In many embodiments, the shape of cavity 2730 determines the level of spring and timing of the response of golf club head 2700. When the golf ball impacts strikeface 2712 of club head 2700 with cavity 2730, strikeface 2712 springs back like a drum, and rear 2710 bends in a controlled buckle manner. In many embodiments, top rail 2715 can absorb more stress over greater volumetric space than a top rail in a golf club head without cavity 2730. The length, depth and width of cavity 2730 can vary. These parameters provide control regarding how much spring back is present in the overall design of club head 2700.

Upon impact with the golf ball, strikeface 2712 can bend inward at a greater distance than on a golf club without cavity 2730. In some embodiments, strikeface 2712 has a 10% to a 50% greater deflection than a strikeface on a golf club head without cavity 2730. In some embodiments, strikeface 2712 has a 5% to a 40% or a 10% to a 20% greater deflection than a strikeface on a golf club head without cavity 2730. For example, strikeface 2712 can have a 5%, 10%, 15%, 20%, 25%, 30%, 35% or 40% greater deflection than a strikeface on a golf club head without cavity 2730. In many embodiments, there is both a greater distance of retraction by strikeface 2712 due to the hinge and bending of cavity 2730 over a standard strikeface that does not have a back portion of the club without the cavity.

In many embodiments, the face deflection is greater with club head 2700 having cavity 2730, as a greater buckling occurs at first inflection angle 2986 of top wall 2719 upon impact with a golf ball. Cavity 2730, however, provides a greater dispersion of stress along top rail 2715, rear wall 2923, and top wall 2719, and the spring back force is transferred from cavity 2730 and first inflection point 2986 of top wall 2719 to strikeface 2712. A standard top rail, rear wall and top wall without a cavity does not have this hinge/buckling effect, nor does it absorb a high level of stress over a large volumetric area of the top rail, rear wall and top wall. Therefore, the standard strikeface does not contract and then recoil as much as strikeface 2712. Further, both a larger region of strikeface 2712, top rail 2715, rear wall 2923, and top wall 2719 absorb more stress than the same crown region of a standard golf club head with a standard top rail, top wall and no cavity. In many embodiments, although there is greater stress along a greater area above cavity 2730 than the same area in a standard club without the cavity, the durability of the club head with and without the cavity is the same. By adding more spring to the back end of the club (due to the inward inclination of a portion of top wall 2719 toward strikeface 2712), more force is displaced throughout the volume of the structure. The stress is observed over a greater area of strikeface 2712, top rail 2715, rear wall 2923, and top wall 2719 of golf club head 2700. Peak stresses can be seen in the standard top rail club head. However, more peak stresses are seen in golf club head 2700, but distributed over a large volume of the material. The hinge and bend regions of golf club head 2700 (i.e., the region above cavity 2730 and cavity 2730 itself) will not deform as long as the stress does not meet the critical buckling threshold. Cavity 2730 and its placement can be design to be under the critical K value of the buckling threshold.

As shown in FIG. 31, a further deflection feature of the golf club head 2700 can be the uniform thinned region 3160, located at the sole 2706 and stretching between the rear 2710 of the body 2701 and the strikeface 2712, toward a cascading sole portion of the sole (as described in greater detail below). The uniform thinned region 3160 can provide multiple benefits. First, the uniform thinned region 3160 can reduce stress on the strikeface 2712 caused during impact with the golf ball. Second, the uniform thinned region 3160 can bend allowing the strikeface 2712 to experience greater deflection. Third, the uniform thinned region 3160 removes weight from the sole area, allowing the weight to be redistributed more toward the rear of the golf club head 2700. At impact, the energy imparted to the strikeface 2712 by the golf ball can cause the uniform thinned region 3160 to bend outward, which in turn increases the strikeface 2712 deflection. After bending, the uniform thinned region 3160 rebounds back to its original position returning the majority of the energy from impact back to the golf ball. The result is the golf club head 2700 imparts increased ball speeds and greater travel distances to the golf ball after impact.

In some embodiments, body 2701 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 2701 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 2712 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 2712 can comprise carpenter grade 455 steel, carpenter grade 475 steel, C300 steel, C350 steel, a Ni—Co—Cr steel alloy, a quench and tempered steel alloy, or 565 steel. In some embodiments, body 2701 can comprise the same material as strikeface 2712. In some embodiments, body 2701 can comprise a different material than strikeface 2712.

Figure 32:
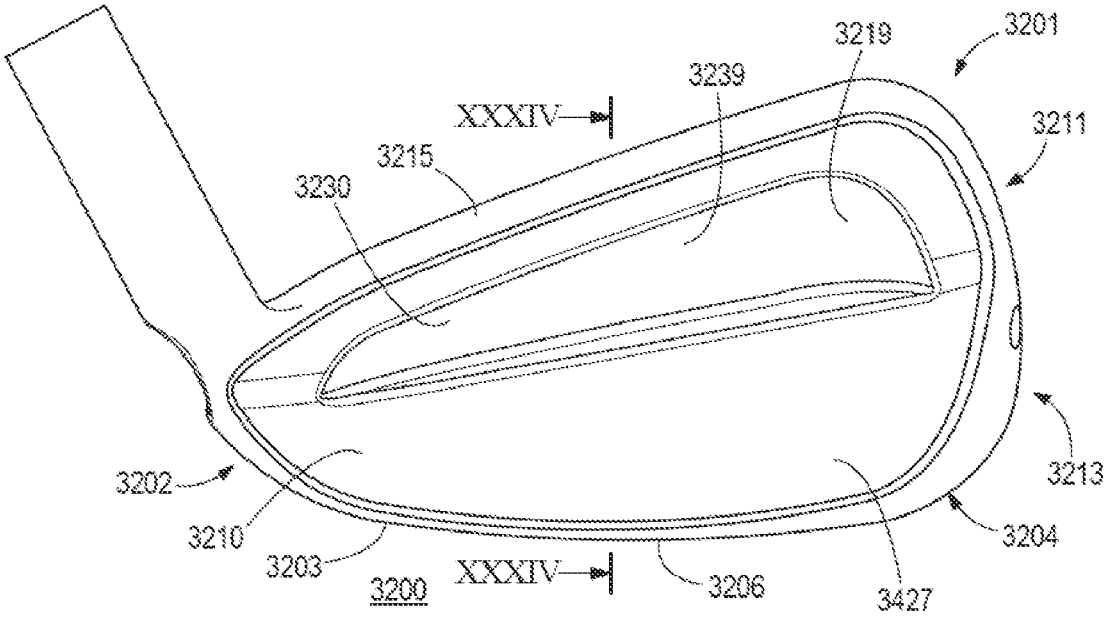
FIG. 32 depicts a back perspective view of a golf club head according to still yet another embodiment.
Figure 33:
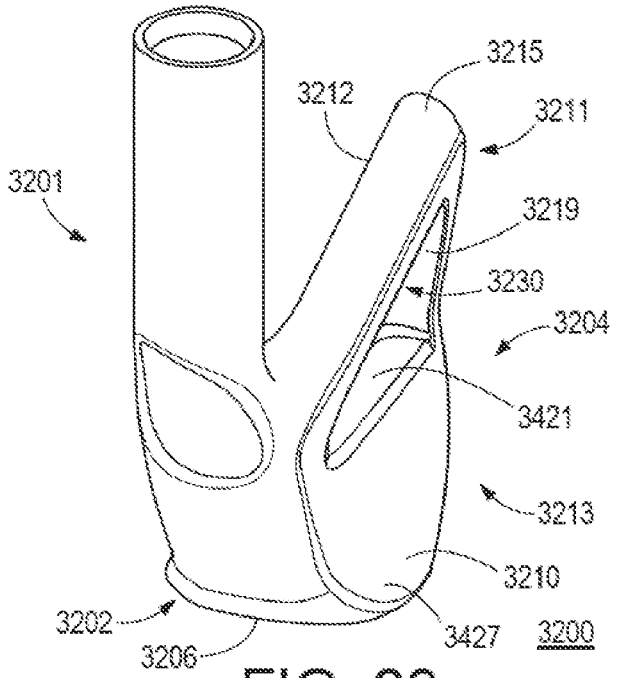
FIG. 33 depicts a back, heel-side perspective view of the golf club head according to the embodiment of FIG. 32.

FIG. 32 illustrates a back perspective view of an embodiment of golf club head 3200, and FIG. 33 illustrates a back heel-side perspective view of golf club head 3200 according to the embodiment of FIG. 32. In some embodiments, golf club head 3200 can be similar to golf club head 1000 (FIG. 10), golf club head 2200 (FIG. 22), and/or golf club head 2700 (FIG. 27). Golf club head 3200 can be an iron-type golf club head. In other embodiments, golf club head 3200 can be a hybrid-type, or a fairway wood-type golf club head. In some embodiments, golf club head 3200 does not comprise a badge or a custom tuning port.

Golf club head 3200 comprises a body 3201. In some embodiments, body 3201 can be similar to body 1001 (FIG. 10), body 2201 (FIG. 22), and/or body 2701 (FIG. 27). In some embodiments, the body 3201 is hollow. In other embodiments, the body is at least partially hollow. Body 3201 comprises an exterior surface 3203, a strikeface 3212, a heel region 3202, a toe region 3204 opposite the heel region 3202, a sole 3206, a top rail 3215, and a rear 3210.

Body 3201 of FIGS. 32-36 further comprises a blade length. The blade length for body 3201 can be measured similar to blade length 3725 as shown and described in FIG. 43 (i.e., a measurement parallel to the flat surface of the strikeface 3712, from a toe edge 3726 of the strikeface 3712, to strikeface end 3727 right before the strikeface 3712 integrally curves into the hosel). The blade length of the body 3201 can range from 2.70 inch (6.86 cm) to 3.00 inch (7.62 cm). For example, in some embodiments, the body 3201 can comprise a blade length of 2.74 inch (6.96 cm), 2.78 inch (7.06 cm), 2.82 inch (7.16 cm), 2.86 inch (7.26 cm), 2.90 inch (7.37 cm), 2.94 inch (7.47 cm), 2.98 inch (7.57 cm), or 3.00 inch (7.62 cm).

The body 3201 further comprises a uniform thinned region transitioning from the bottom of the strikeface 3212 to the sole 3206, toward a cascading sole portion of the sole (as described in greater detail below). In the illustrated embodiment, the uniform thinned region comprises a sole thickness measured perpendicular from the exterior surface 3203 to the interior surface at the uniform thinned region, which can remain constant from the bottom of the strikeface 3212 to adjacent the cascading sole portion of the sole. In some embodiments, the sole thickness of the uniform thinned region can be thinner than a conventional sole. For example, in some embodiments, the sole thickness of the uniform thinned region may range from approximately 0.040 inch to 0.080 inch. In other embodiments, the sole thickness of the uniform thinned region may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region can be 0.040 inch, 0.045 inch, 0.050 inch, 0.060 inch, 0.065 inch, 0.070 inch, 0.075 inch, or 0.080 inch.

Figure 34:
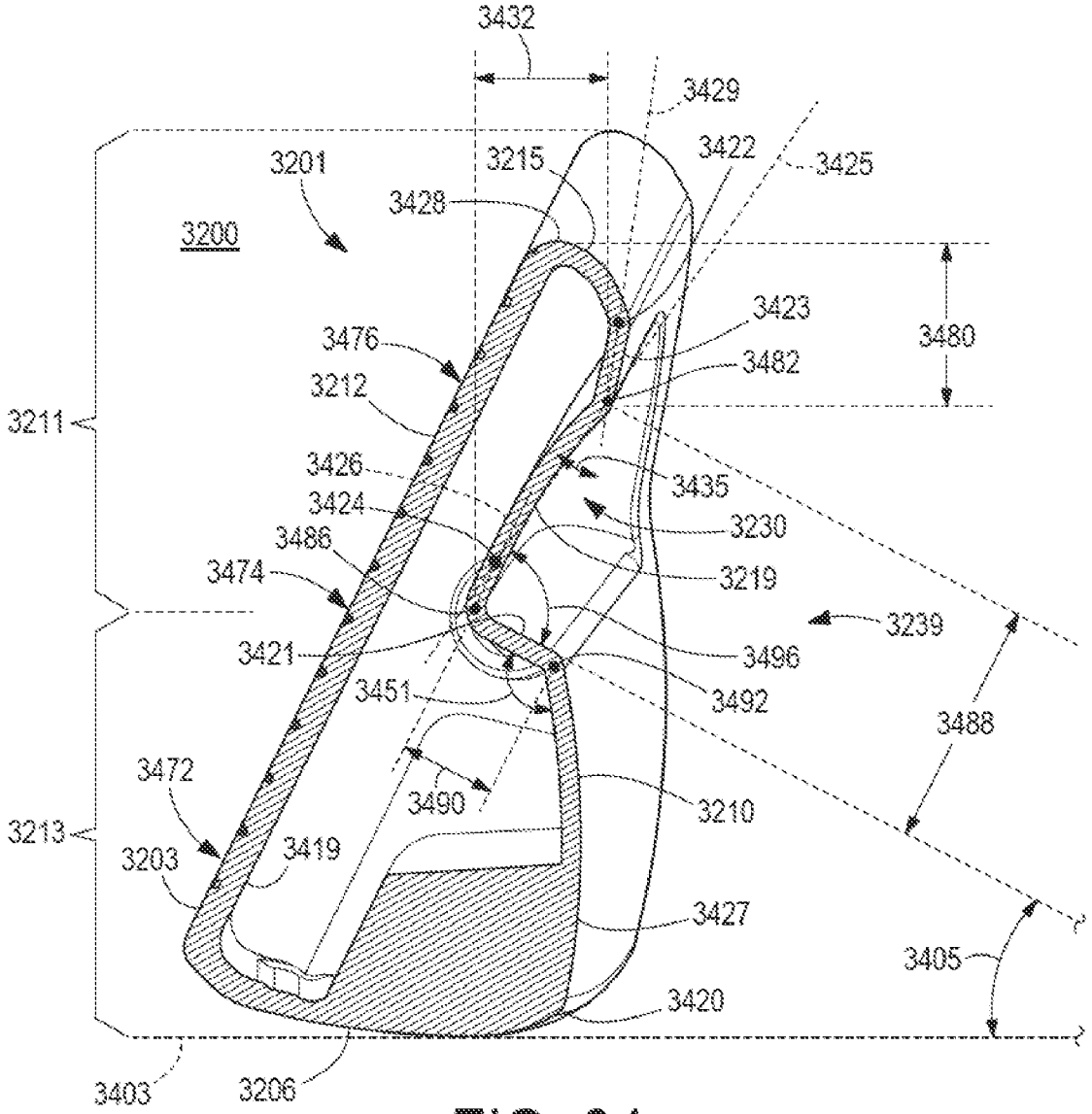
FIG. 34 depicts a cross-sectional view of the golf club head of FIG. 32 along the cross-sectional line XXXIV-XXXIV of FIG. 32.

FIG. 34 illustrates a cross-section of golf club head 3200 along the cross-sectional line XXXIV-XXXIV in FIG. 32, according to one embodiment. As seen in FIG. 32, strikeface 3212 comprises a high region 3476, a middle region 3474, and a low region 3472. Rear 3210 can comprises an upper region 3211, a lower region 3213, and a cavity 3230. Upper region 3211 comprises top rail 3215, a rear wall 3423, and a top wall 3219. In many embodiments, the rear wall 3423 of rear 3210 is located below and adjacent to the top rail 3215, and the top wall 3219 of rear 3210 is located below and adjacent to rear wall 3423. Lower region 3213 comprises a back wall 3421, and a lower exterior wall 3427. Cavity 3230 is located on the exterior surface 3203, below the top rail 3215 and rear wall 3423, above the lower exterior wall 3427 of rear 3210, and is defined by at least in part by upper region 3211 and lower region 3213.

In some embodiments, top rail 3215 of the upper region 3211 can be a flatter and taller top rail or skirt than in irons known to one skilled in the art. The flatter and taller rail 3215 can compensate for mis-hits on strikeface 3212 to increase playability off the tee. In some embodiments, the length of top rail 3215, measured from heel region 3202 to toe region 3204, can be 70% to 95% of the length of golf club head 3200. In many embodiments, cavity 3230 comprises a top rail box spring design. In many embodiments, top rail 3215 and cavity 3230 provide an increase in the overall bending of strikeface 3212. In some embodiments, the bending of strikeface 3212 can allow for a 2% to 5% increase of energy. Cavity 3230 allows for strikeface 3212 to be thinner and allow additional overall bending. For some fairway iron-golf club head embodiments, cavity 3230 can be a reverse scoop or indentation of rear 3210 with body 3201 comprising a greater thickness toward sole 3206.

In some embodiments, a height 3480 of rear wall 3423 of upper region 3211 of rear 3210 can range from 0.115 inch (0.292 cm) to 0.25 inch (0.635 cm), or 0.130 inch (0.330 cm) to 0.20 inch (0.508 cm). For example, in some embodiments, the height 3480 of rear wall 3423 of the upper region 3211 of rear 3210 can be 0.115 inch (0.292 cm), 0.125 inch (0.318 cm), 0.135 inch (0.343 cm), 0.145 inch (0.368 cm), 0.155 inch (0.394 cm), 0.165 inch (0.419 cm), 0.175 inch (0.445 cm), 0.185 inch (0.470 cm), 0.195 (0.495 cm), or 0.250 inch (0.635 cm). In some embodiments, the height 3480 of rear wall 3423 of the upper region 3211 of rear 3210 can range from 0.150 inch (0.381 cm) to 0.210 inch (0.533 cm). In some embodiments, the height 3480 of rear wall 3423 of the upper region 3211 of rear 3210 can be 0.166 inch (0.422 cm). In some embodiments, the height 3480 of rear wall 3423 of upper region 3211 of rear 3210 can range from 3% to 15% of the height of the golf club head 3200.

The height 3480 of rear wall 3423 of the upper region 3211 of rear 3210, as described herein, allows cavity 3230 to absorb at least a portion of the stress on strikeface 3212 during impact with a golf ball. A golf club head having a rear wall height greater than rear wall height 3480 described herein would absorb less stress (and allow less strikeface deflection) in impact than golf club head 3200 described herein, due to increased dispersion of the impact stress along the top rail prior to reaching the cavity.

In some embodiments, cavity 3230 is located above a lower region 3213 of rear 3210 and is defined at least in part by upper region 3211 and lower region 3213 of rear 3210. Cavity 3230 comprises top wall 3219, and back wall 3421. A first reference point 3422 is located between the top rail 3215 and rear wall 3423. A second reference point 3482 is located between rear wall 3423 and top wall 3219. A first inflection point 3486 is located between top wall 3219 of cavity 3230 and back wall 3421. A third reference point 3424 is point located on top wall 3219 closest to the strikeface 3212. First reference point 3422 and second reference point 3482 create a first reference line 3429. Second reference point 3482 and third reference point 3424 create a second reference line 3425. Third reference point 3424 and first inflection point 3486 create a third reference line 3426.

Golf club head 3200 further comprises a height 3488 of top wall 3219, measured parallel to strikeface 3212 and from the second reference point 3482 to first inflection point 3486. In many embodiments, height 3488 can range from 0.100 inch (0.254 cm) to 0.700 inch (1.778 cm). For example, height 3488 can be 0.100 inch (0.254 cm), 0.150 inch (0.381 cm), 0.200 inch (0.508 cm), 0.250 inch (0.635 cm), 0.300 inch (0.762 cm), 0.350 inch (0.899 cm), 0.400 inch (1.016 cm), 0.450 inch (1.143 cm), 0.500 inch (1.270 cm), 0.550 inch (1.397 cm), 0.600 inch (1.524 cm), 0.650 inch (1.651 cm), or 0.700 inch (1.778 cm). In many embodiments, height 3488 can range from 0.300 inch (0.762 cm) to 0.550 inch (1.397 cm). In some embodiments, height 3488 of top wall 3219 can be 0.300 inch (0.762 cm), 0.330 inch (0.838 cm), 0.360 inch (0.914 cm), 0.390 inch (0.991 cm), 0.420 inch (1.067 cm), 0.450 inch (1.143 cm), 0.480 inch (1.219 cm), 0.510 inch (1.295 cm), or 0.540 inch (1.312 cm).

In many embodiments, second reference point 3482 can range from 0.075 inch (0.191 cm) to 1.00 inches (2.54 cm) or 0.150 inch (0.381 cm) to 0.180 inches (0.457 cm) to apex 3428 of top rail 3215. For example, the second reference point 3482 can be 0.075 inch (0.191 cm), 0.095 inch (0.241 cm), 0.115 inch (0.292 cm), 0.135 inch (0.343 cm), 0.155 inch (0.394 cm), 0.175 inch (0.445 cm), 0.190 inch (0.483 cm), or 1.000 inch (2.54 cm) below the apex 3428 of top rail 3215.

In many embodiments, top wall 3219 of cavity 3230 can be substantially parallel to strikeface 3212. In other embodiments, top wall 3219 is not substantially parallel to strikeface 3212. In some embodiments, top wall 3219 of cavity 3230 is substantially parallel to rear wall 3423 of upper region 3211 of rear 3210. In a number of embodiments, a portion of top wall 3219 extends away from top rail 3215 toward strikeface 3212 from second reference point 3482 to third reference point 3424. In some embodiments, the portion of top wall 3219 extending away from top rail 3215 toward strikeface 3212 from second reference point 3482 to third reference point 3424 can be straight, curved upward, or curved downward. In many embodiments, a portion of top wall 3219 of cavity 3230 is angled away from strikeface 3212 from third reference point 3424 to first inflection point 3486. In some embodiments, the portion of top wall 3219 angled away from strikeface 3212 from third reference point 3424 to first inflection point 3486 can be straight, curved upward, or curved downward. This orientation of top wall 3219 creates a buckling point, hinge point or plastic hinge to direct the stress of impact toward cavity 3230 and to allow increased flexing of strikeface 3212 during impact.

Lower region 3213 of rear 3210 comprises back wall 3421 of cavity 3230 and lower exterior wall 3427. In some embodiments, back wall 3421 of cavity 3230 can have a back wall length 3490 measured from first inflection point 3486 to a second inflection point 3492 located between the back wall 3421 and the lower exterior wall 3427. In a number of embodiments, back wall length 3490 can range from 0.100 inch (0.254 cm) to 0.350 inch (0.889 cm). In many embodiments, back wall length 3490 can be 0.100 inch (0.254 cm), 0.125 inch (0.318 cm), 0.150 inch (0.381 cm), 0.175 inch (0.445 cm), 0.200 inch (0.508 cm), 0.225 inch (0.572 cm), 0.250 inch (0.635 cm), 0.275 inch (0.699 cm), 0.300 inch (0.762 cm), 0.325 inch (0.826 cm), or 0.350 inch (0.889 cm).

In some embodiments, a lower angle 3451 can be measured from between the back wall 3421 and the lower exterior wall 3427. In some embodiments, lower angle 3451 can be less than 180 degrees. In a number of embodiments, lower angle 3451 can range from 30 degrees to 180 degrees. In various embodiments, lower angle 3451 can range from 70 degrees to 130 degrees. In some embodiments, lower angle 3451 can be 70 degrees, 75 degrees, 80 degrees, 85 degrees, 90 degrees, 95 degrees, 100 degrees, 105 degrees, 110 degrees, 115 degrees, 120 degrees, 125 degrees, or 130 degrees.

In some embodiments, an inflection angle 3496 measured from third reference line 3426 to back wall 3421 can range from 70 degrees to 150 degrees. In some embodiments, inflection angle 3496 can range from 90 degrees to 130 degrees. In some embodiments, inflection angle 3496 can be 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, or 150 degrees. In many embodiments, inflection angle 3496 allows first inflection point 3486 to act as a buckling point or plastic hinge upon golf club head 3200 impacting the golf ball at strikeface 3212. In some embodiments, the wall thickness at the first inflection point 3486 can be thinner than at the top wall 3219 and back wall 3421.

In many embodiments, first inflection point 3486, adjacent to back wall 3421 can range from 0.20 inch (0.508 cm) to 1.0 inch (2.54 cm), or 0.5 inch (1.27 cm) to 0.7 inch (1.778 cm) below the apex 3428 of top rail 3215. For example, the first inflection point 3486 can be 0.20 inch (0.508 cm), 0.25 inch (0.635 cm), 0.30 inch (0.762 cm), 0.35 inch (0.889 cm), 0.40 inch (1.016 cm), 0.45 inch (1.143 cm), 0.50 inch (1.27 cm), 0.55 inch (1.397 cm), 0.60 inch (1.524 cm), 0.65 inch (1.651 cm), 0.70 inch (1.778 cm), 0.75 inch (1.905 cm), 0.80 inch (2.032 cm), 0.85 inch (2.159 cm), 0.90 inch (2.286 cm), 0.95 inch (2.413 cm), or 1.0 inch (2.54 cm) below the apex 3428 of top rail 3215. In some embodiments, the maximum height of the back wall 3421, measured perpendicular to a ground 3403 when golf club head 3200 is at address, from a lowest point of sole 3206 to first inflection point 3486, can range from 0.25 inch (0.635 cm) to 3 inches (7.62 cm), or 0.50 inch (1.27 cm) to 2 inches (5.08 cm). For example, the first inflection point 3486 can be 0.25 inch (0.635 cm), 0.375 inch (0.953 cm), 0.5 inch 1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1,625 inches (4.12 cm), 1.75 inches (4.45 cm), 1.875 inches (4.76 cm), 2.0 inches (5.08 cm), 2.125 inches (5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm) or 3.0 inches (7.62 cm) above a lowest point of sole 3206 to the ground 3403 when golf club head 3200 is at address.

In some embodiments, a back wall angle 3405 measured from back wall 3421 to ground plane 3403 can range from 15 degrees to 45 degrees. In some embodiments, back wall angle 3405 can be 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, 37 degrees, 38 degrees, 39 degrees, 40 degrees, 41 degrees, 42 degrees, 43 degrees, 44 degrees, or 45 degrees.

In some embodiments as illustrated in FIG. 32, cavity 3230 can further comprise at least one channel 3239. In many embodiments, channel 3239 extends from heel region 3202 to toe region 3204. Channel 3239 comprises a channel width measured from second reference point 3482 to top wall 3219 substantially parallel to ground plane 3403, where channel width can vary in a direction from top rail 3215 to sole 3206. In some embodiments, a maximum channel width 3432, measured from first inflection point 3486 to second reference point 3482 substantially parallel to ground plane 3403, can be substantially constant throughout the channel 3230 from heel region 3202 to toe region 3204. In some embodiments as illustrated in FIG. 34, maximum channel width 3432 can range from 0.039 inch (1 mm) to 0.590 inch (15 mm), or 0.150 inch (3.81 mm) to 0.400 inch (10.16 mm). For example, maximum channel width 3432 can be 0.039 inch (1.0 mm), 0.079 inch (2 mm), 0.12 inch (3 mm), 0.16 inch (4 mm), 0.20 inch (5 mm), 0.24 inch (6 mm), 0.28 inch (7 mm), 0.31 inch (8 mm), 0.39 inch (10 mm), or 0.59 inch (15 mm). In other embodiments, a channel toe region width of channel 3239 is less than a channel heel region width of channel 3239. In other embodiments, the channel heel region width is less than the channel toe region width. In other embodiments, a channel middle region width of channel 3239 can be less than at least one of the channel heel region width or the channel toe region width. In other embodiments, the channel middle region width can be greater than at least one of the channel heel region width or the channel toe region width. In some embodiments, channel 3239 is symmetrical from heel to toe. In other embodiments, channel 3239 is non-symmetrical. In other embodiments, channel 3239 can further comprise at least two partial channels. In some embodiments, channel 3239 can comprise a series of partial channels interrupted by one or more bridges. In some embodiments, the one or more bridges can be approximately the same thickness as the thickness of upper region 3211 of top rail 3215.

Maximum channel width 3432, as described herein, allows absorption of stress from strikeface 3212 on impact. A golf club head having a channel width less than the maximum channel width 3432 described here (e.g., a golf club head with a less pronounced cavity) would allow less stress absorption from the strikeface on impact (due to less material on the upper region 3211 of rear 3210), and therefore would experience less strikeface deflection than golf club head 3200 described herein.

In many embodiments, back cavity 3230 further comprises a cavity angle 3435. Back cavity angle 3435 is measured from first reference line 3429 to second reference line 3425. In many embodiments, back cavity angle 3435 can range from 15 degrees to 80 degrees. In some embodiments, back cavity angle 3435 can be 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, or 80 degrees.

Figure 35:
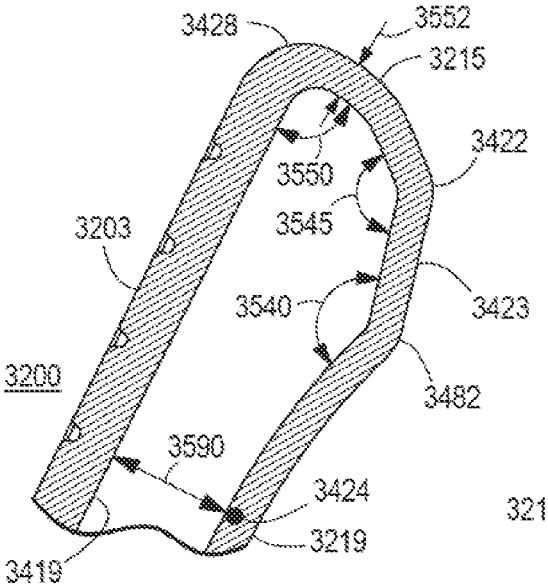
FIG. 35 depicts a portion of the golf club head of FIG. 34.

FIG. 35 illustrates a view of top rail 3215 and a portion of rear 3210 of the cross-section of golf club head 3200 of FIG. 32 different from cross-section of golf club head 1200 as shown in FIG. 13. In many embodiments, golf club head 3200 comprises a rear angle 3540, a top rail angle 3545, and a strikeface angle 3550. Rear angle 3540 is measured from second reference line 3425 to rear wall 3423 of upper region 3211. In many embodiments, rear angle 3540 can range from 70 degrees to 140 degrees. In some embodiments, rear angle 3540 can be 70 degrees, 75 degrees, 80 degrees, 85 degrees, 90 degrees, 100 degrees, 105 degrees, 110 degrees, 115 degrees, 120 degrees, 125 degrees, 130 degrees, 135 degrees, or 140 degrees. Top rail angle 3545 is measured from rear wall 3423 of upper region 3211 to top rail 3215. In many embodiments, top rail 3545 can range from 35 degrees to 120 degrees or 70 degrees to 110 degrees. In some embodiments, top rail angle 3545 can be 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, or 120 degrees. Strikeface angle 3550 is measured from strikeface 3212 to top rail 3215. In many embodiments, strikeface angle 3550 can range from 70 degrees to 160 degrees or 70 degrees to 110 degrees. In some embodiments, strikeface angle 3550 can be 70 degrees, 75 degrees, 80 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees.

Upper region 3211 further comprises a minimum gap 3590 measured from third reference point 3424 of an inner surface 3419 of top wall 3219 to an inner surface 3419 of strikeface 3212, perpendicular to strikeface 3212. In some embodiments, minimum gap 3590 can range from 0.079 inch (2 mm) to 0.24 inch (6 mm). For example, the minimum gap 3590 can be 0.079 inch (2 mm), 0.118 inch (3 mm), 0.16 inch (4 mm), 0.197 inch (5 mm) or 0.24 inch (6 mm). In other embodiments, the minimum gap 3590 can range from 0.118 inch (3 mm) to 0.16 inch (4 mm). In some embodiments, the minimum gap 3590 can be 0.135 inch (3.429 mm).

Figure 36:
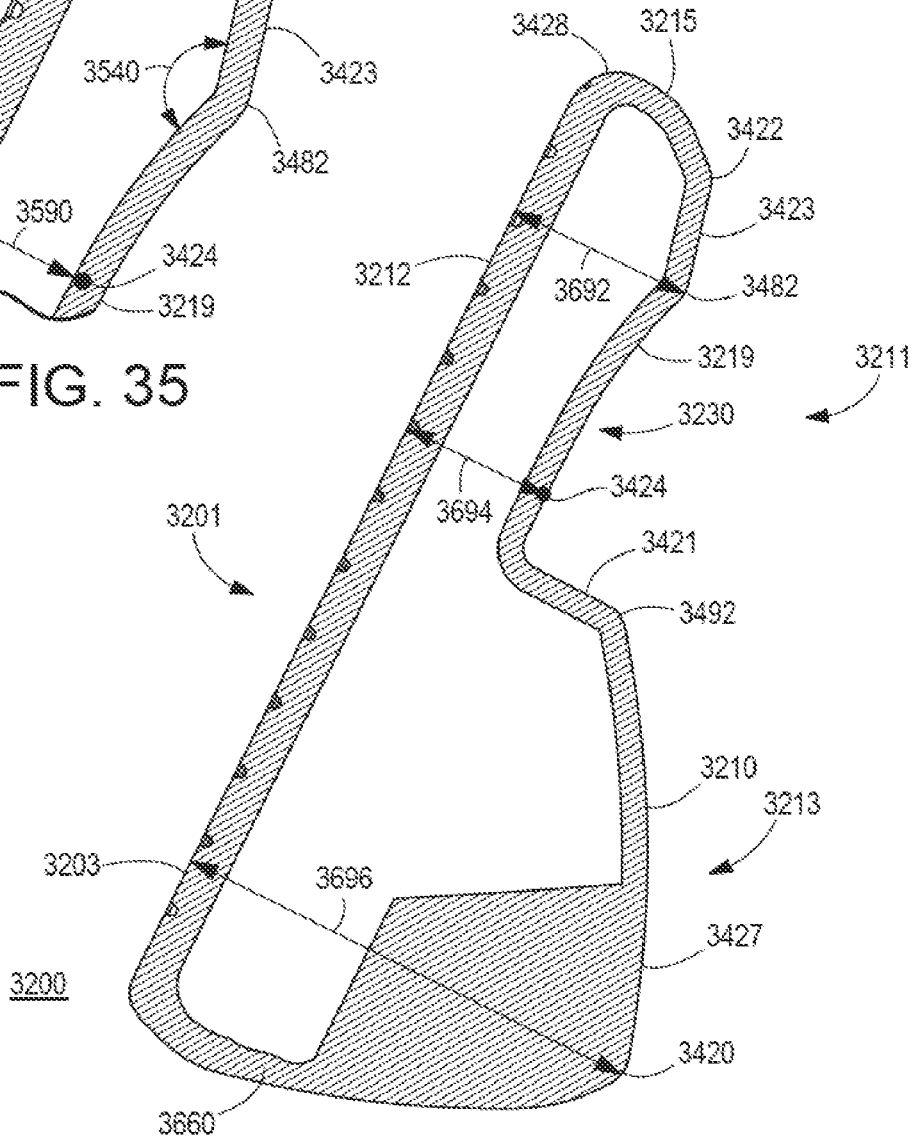
FIG. 36 depicts a simplified cross-sectional view of the golf club head of FIG. 32, similar to the detailed cross-sectional view of the golf club head in FIG. 34.

FIG. 36 illustrates a simplified cross-sectional view of golf club head 3200, similar to the detailed cross-section of golf club head 3200 illustrated in FIG. 34. Golf club head 3200 include cavity 3230, upper region 3211, lower region 3213, and exterior surface 3203. In many embodiments, a maximum upper distance 3692 measured as the perpendicular distance from exterior surface 3203 of strikeface 3212 to exterior surface 3203 of second reference point 3482 of upper region 3211 can range from 0.20 inch to 0.59 inch (5 mm to 15 mm). For example, maximum upper distance 3692 can be 0.20 inch (5 mm), 0.24 inch (6 mm), 0.28 inch (7 mm), 0.31 inch (8 mm), 0.35 inch (8.89 mm), 0.39 inch (10 mm), 0.43 inch (11 mm), 0.47 inch (12 mm), 0.51 inch (13 mm), 0.55 inch (14 mm), or 0.59 inch (15 mm). In some embodiments, maximum upper distance 3692 can be 0.348 inch (9.09 mm). Further, a minimum upper distance 3694 measured as the perpendicular distance from exterior surface 3203 of strikeface 3212 to exterior surface 3203 of third reference point 3424 can range from 0.10 inch to 0.47 inch (.54 mm to 12 mm). For example, minimum upper distance

3694 can be 0.10 inch (2.54 mm), 0.16 inch (4 mm), 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), or 0.47 inch (12 mm). In some embodiments, minimum upper distance 3694 can be 0.309 inch (7.85 mm). Further still, a maximum lower distance 3696 measured as the perpendicular distance from exterior surface 3203 of strikeface 3212 to exterior surface 3203 of a fourth reference point 3420 located between the lower exterior wall 3427 and the sole 3206 can range from 0.670 inch to 0.98 inch (17 mm to 25 mm). For example, maximum lower distance 3696 can be 0.670 inch (17 mm), 0.709 inch (18 mm), 0.748 inch (19 mm), 0.787 inch (20 mm), 827 inch (21 mm), 0.866 inch (22 mm), 0.906 inch (23 mm), 0.945 inch (24 mm), or 0.98 inch (25 mm). In some embodiments, maximum lower distance 3696 can be 0.863 inch (21.9 mm). In many embodiments, maximum lower distance 3696 is greater than maximum upper distance 3692 and maximum upper distance 3692 is greater than minimum upper distance 3694.

In many embodiments, cavity 3230 can provide an increase in golf ball speed over golf club head 1200, or other standard golf club heads, can reduce the spin rate of standard hybrids club heads, and can increase the launch angle over both the standard hybrid and iron club heads. In many embodiments, the shape of cavity 3230 determines the level of spring and timing of the response of golf club head 3200. When the golf club ball impacts strikeface 3212 of club head 3200 with cavity 3230, strikeface 3212 springs back like a drum, and a rear 3210 bends in a controlled buckle manner. In many embodiments, top rail 3215 can absorb more stress over greater volumetric space than a top rail in a golf club head without cavity 3230. The length, depth and width of cavity 3230 can vary. These parameter provide control regarding how much spring back is present in the overall design of club head 3200.

Upon impact with the golf ball, strikeface 3212 can bend inward at a greater distance than on a golf club without cavity 3230. In some embodiments, strikeface 3212 has a 10% to a 50% greater deflection than a strikeface on a golf club head without cavity 3230. In some embodiments, strikeface 3212 has a 5% to 40% or a 10% to a 20% greater deflection than a strikeface on a golf club head without cavity 3230. For example, strikeface 3212 can have a 5%, 10%, 15%, 20%, 25%, 30%, 35%, or 40% greater deflection than a strikeface on a golf club head without cavity 3230. In many embodiments, there is both a greater distance of retraction by strikeface 3212 due to the hinge and bending of cavity 3230 over a standard strikeface that does not have a back portion of the club with the cavity.

In many embodiments, the face deflection is greater with club head 3200 having cavity 3230, as a greater buckling occurs at first inflection angle 3486 of top wall 3219 upon impact with a golf ball. Cavity 3230, however, provides a greater dispersion of stress along top rail 3215, rear wall 3423, and top wall 3219, and the spring back force is transferred from cavity 3230 and first inflection point 3486 of top wall 3219 to strikeface 3212. A standard top rail, rear wall and top wall without a cavity does not have this hinge/buckling effect, nor does it absorb a high level of stress over a large volumetric area of the top rail, rear wall and top wall. Therefore, the standard strikeface does not contract and then recoil as much as strikeface 3212. Further, both a larger region of srikeface 3212, top rail 3215, rear wall 3423, and top wall 3219 absorb more stress than the same crown region of a standard golf club head with a standard top rail, top wall and no cavity. In many embodiments, although there is greater stress along a greater area above cavity 3230 that the same area in a standard club without the cavity, the durability of the club head with without the cavity is the same. By adding more spring to the back end of the club (due to inward inclination of a portion of top wall 3219 toward strikeface 3212), more force is displace throughout the volume of the structure. The stress is observed over a greater area of strikeface 3212, top rail 3215, rear wall 3423, and top wall 3219 of golf club head 3200. Peak stresses can be seen in the standard top rail club head. However, more peak stresses are seen in golf club head 3200, but distributed over a large volume of the material. The hinge and bend regions of golf club head 3200 (i.e., the region above cavity 3230 and cavity 3230 itself) will not deform as long as the stress does not meet the critical buckling threshold. Cavity 3230 and its placement can be design to be under the critical K value of the buckling threshold.

As shown in FIG. 36, a further deflection feature of the golf club head 3200 can be the uniform thinned region 3660, located at the sole 3206 and stretching between the rear 3210 of the body 3201 and the strikeface 3212, toward a cascading sole portion of the sole (as described in greater detail below). The uniform thinned region 3660 can provide multiple benefits. First, the uniform thinned region 3660 can reduce stress on the strikeface 3212 caused during impact with the golf ball. Second, the uniform thinned region 3660 can bend allowing the strikeface 3212 to experience greater deflection. Third, the uniform thinned region 3660 removes weight from the sole area, allowing the weight to be redistributed more toward the rear of the golf club head 3200. At impact, the energy imparted to the strikeface 3212 by the golf ball can cause the uniform thinned region 3660 to bend outward, which in turn increases the strikeface 3212 deflection. After bending, the uniform thinned region 3660 rebounds back to its original position returning the majority of the energy from impact back to the golf ball. The result is the golf club head 3200 imparts increased ball speeds and greater travel distances to the golf ball after impact.

In some embodiments, body 3201 can comprises stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 3201 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 3212 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 3212 can comprise carpenter grade 455 steel, carpenter grade 475 steel, C300 steel, C350 steel, a Ni—Co—Cr steel alloy, a quench and tempered steel alloy, or 565 steel. In some embodiments, body 2701 can comprise the same material as strikeface 3212. In some embodiments, body 2701 can comprise a different material than strikeface 3212.

Figure 37:
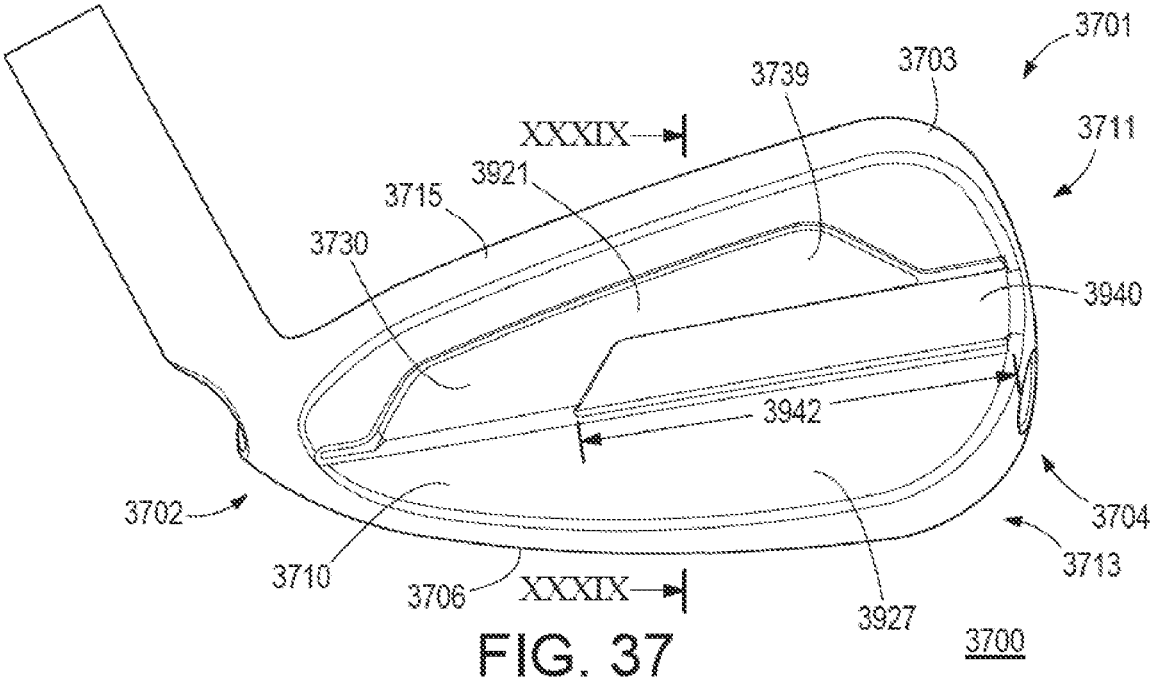
FIG. 37 depicts a back perspective view of a golf club head according to still yet another embodiment.
Figure 38:
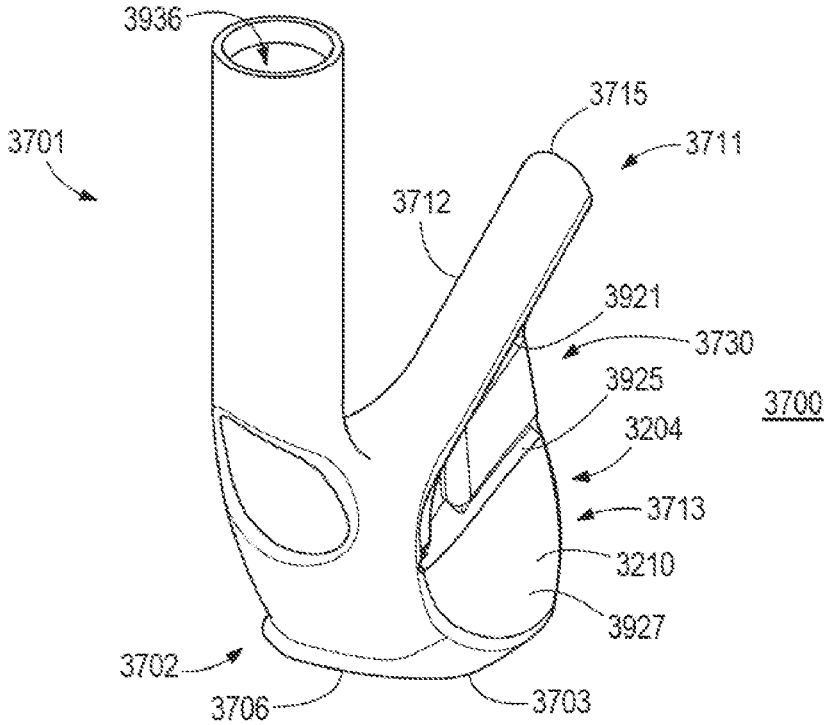
FIG. 38 depicts a back, heel-side perspective view of the golf club head according to the embodiment of FIG. 37.

FIG. 37 illustrates a back perspective view of an embodiment of golf club head 3700 and FIG. 38 illustrates a back heel-side perspective view of golf club head 3700 according to the embodiment of FIG. 37. In some embodiments, golf club head 3700 can be similar to golf club head 1000 (FIG.

10), golf club head 2200 (FIG. 22), golf club head 2700 (FIG. 27), and/or golf club head 3200 (FIG. 32). Golf club head 3700 can be an iron-type golf club head. In other embodiments, golf club head 3700 can be a hybrid-type, or a fairway wood-type golf club head. In some embodiments, golf club head 3700 does not comprise a badge or a custom tuning port.

Golf club head 3700 comprises a body 3701. In some embodiments, body 3701 can be similar to body 1001 (FIG. 10), body 2201 (FIG. 22), body 2701 (FIG. 27), and/or body 3201 (FIG. 32). In some embodiments, the body 3701 is hollow with an internal cavity 3716. In other embodiments, the body is at least partially hollow. In embodiments wherein body 3701 is hollow or partially hollow, body 3701 can comprises a volume void of internal cavity 3716 ranging from 1.71 inches$^3$ (28 cc) to 2.3 inches$^3$ (37.69 cc). In some hollow and partially hollow embodiments, body 3701 can comprise a volume of 1.70 inches$^3$ (27.86 cc), 1.80 inches$^3$ (29.50 cc), 1.90 inches$^3$ (31.14 cc), 2.00 inches$^3$ (32.77 cc), 2.10 inches$^3$ (34.41 cc) 2.20 inches$^3$ (36.05 cc), or 2.30 inches$^3$ (37.69 cc). Body 3701 further comprises an exterior surface 3703, a strikeface 3712, a heel region 3702, a toe region 3704 opposite the heel region 3702, a sole 3706, a top rail 3715, and a rear 3710.

Figure 41:
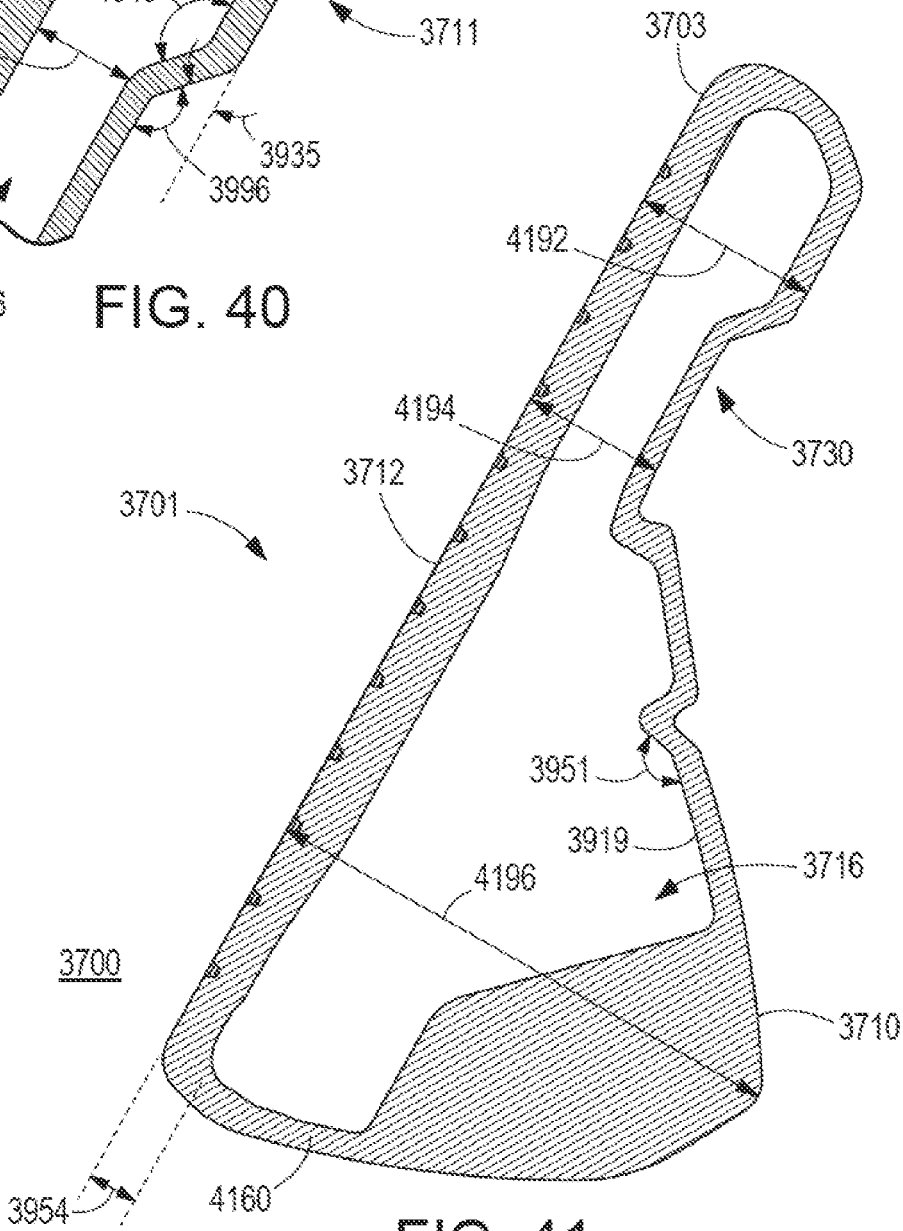
FIG. 41 depicts a simplified cross-sectional view of the golf club head of FIG. 37, similar to the detailed cross-sectional view of the golf club head in FIG. 39.
Figure 42:
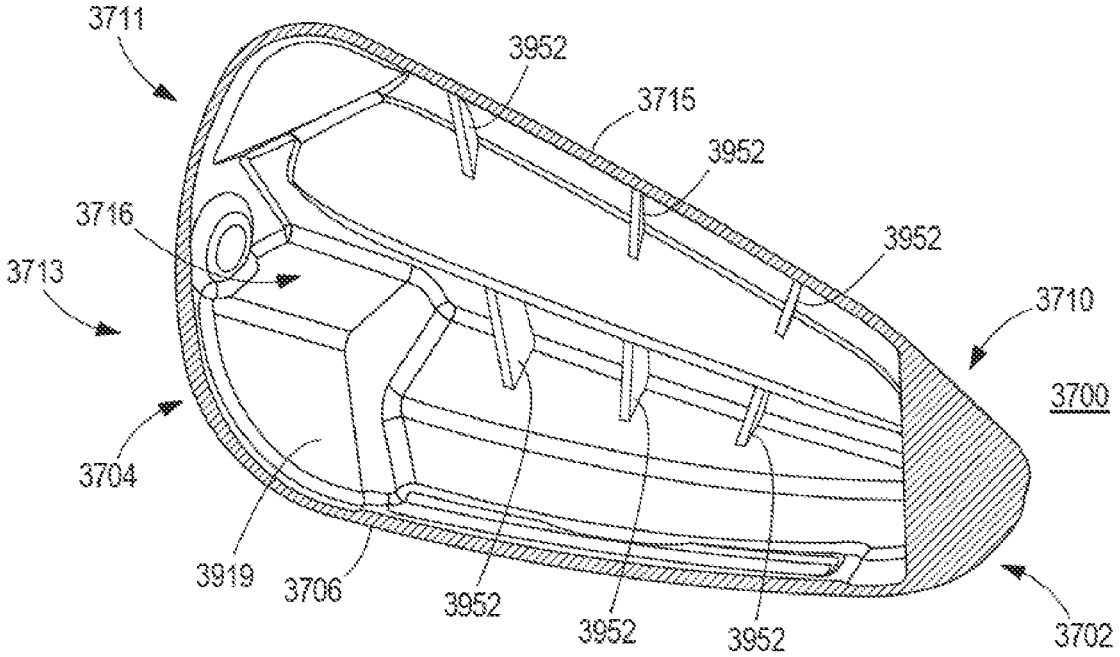
FIG. 42 depicts an interior view of a portion of the golf club head of FIG. 37.
Figure 43:
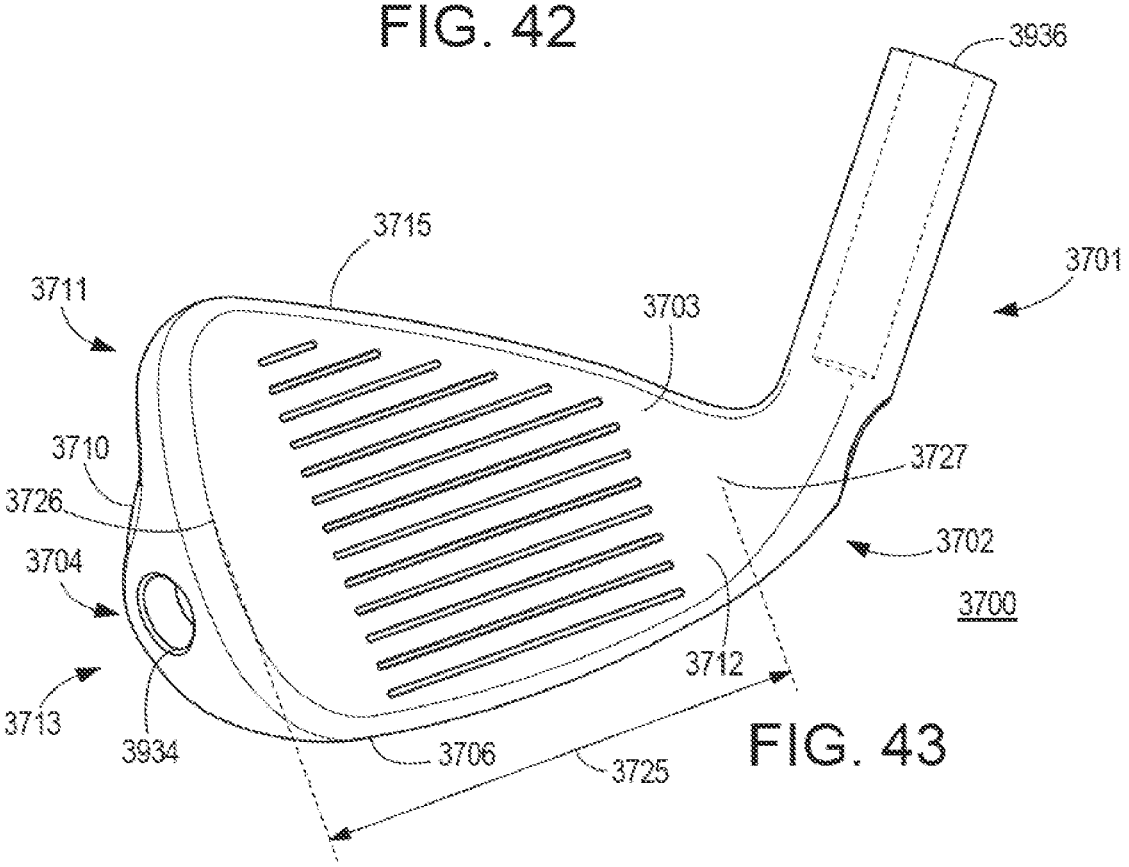
FIG. 43 depicts a front perspective view of the golf club head of FIG. 37.

Body 3701 of FIGS. 37-43 further comprises a blade length 3725, a toe edge 3726, and a strikeface end 3727. The toe edge 3726 is the farthest edge of the strikeface 3712 at the toe region 3704, and the strikeface end 3727 is the end of the strikeface 3712 at the heel region 3702, right before the strikeface 3712 integrally curves into the hosel. As illustrated in FIG. 43, blade length 3725 is the distance measured from the toe edge 3726 to the strikeface end 3727. The blade length 3725 is measured parallel to the flat surface of the strikeface 3712 between the toe edge 3726 and the strikeface end 3727 at the heel end 3702 before the strikeface 3712 integrally curves with the hosel. The blade length of the body 3701 can range from 2.70 inch (6.86 cm) to 3.00 inch (7.62 cm). For example, in some embodiments the body 3701 can comprise a blade length of 2.74 inch (6.96 cm), 2.78 inch (7.06 cm), 2.82 inch (7.16 cm), 2.86 inch (7.26 cm), 2.90 inch (7.37 cm), 2.94 inch (7.47 cm), 2.98 inch (7.57 cm), or 3.00 inch (7.62 cm).

The body 3701 further comprises a uniform thinned region transitioning from the bottom of the strikeface 3712 to the sole 3706, toward a cascading sole portion of the sole (as described in greater detail below). In the illustrated embodiment, the uniform thinned region comprises a sole thickness measured perpendicular from the exterior surface 3703 to an interior surface 3919 at the uniform thinned region, which can remain constant from the bottom of the strikeface 3712 to adjacent the cascading sole portion of the sole. In some embodiments, the sole thickness of the uniform thinned region can be thinner than a conventional sole. For example, in some embodiments, the sole thickness of the uniform thinned region may range from approximately 0.040 inch to 0.080 inch. In other embodiments, the sole thickness of the uniform thinned region may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region can be 0.040 inch, 0.045 inch, 0.050 inch, 0.060 inch, 0.065 inch, 0.070 inch, 0.075 inch, or 0.080 inch.

Figure 39:
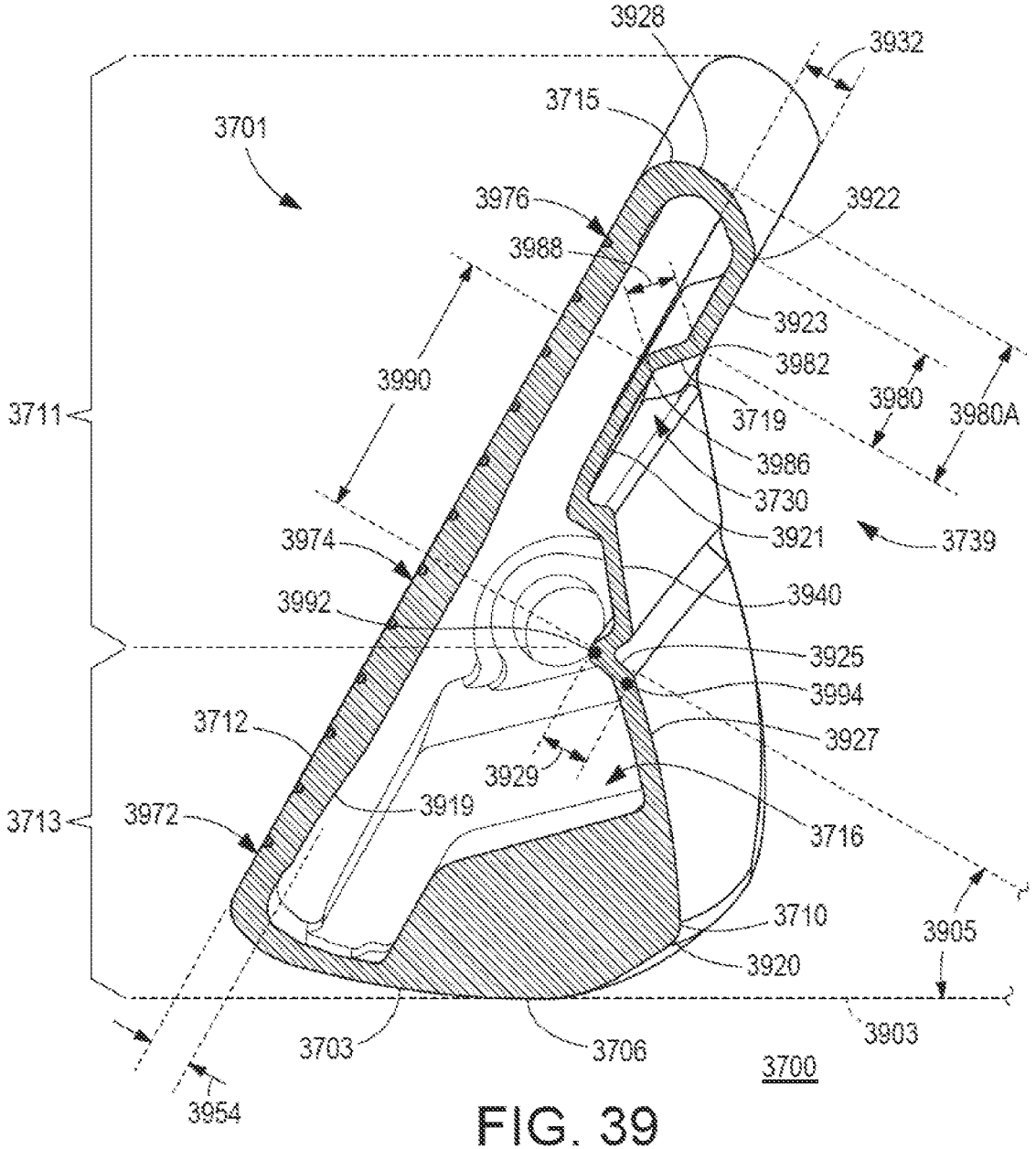
FIG. 39 depicts a cross-sectional view of the golf club head of FIG. 37 along the cross-sectional line XXXIX-XXXIX of FIG. 37.

FIG. 39 illustrates a cross-section of golf club head 3700 along the cross-sectional line XXXIX-XXXIX in FIG. 37, according to one embodiment. As seen in FIG. 39, strikeface 3712 comprises a high region 3976, a middle region 3974, and a low region 3972. Rear 3710 can comprise an upper region 3711, a lower region 3713, and a cavity 3730.

Figure 40:
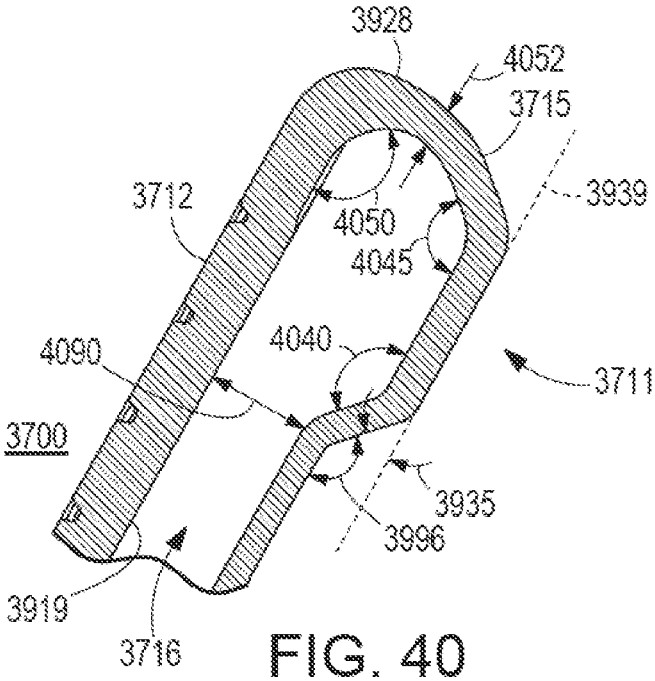
FIG. 40 depicts a portion of the golf club head of FIG. 39.

Upper region 3711 of rear 3710 comprises top rail 3715, a rear wall 3923, a top wall 3719, and a back wall 3921. In many embodiments, the rear wall 3923 of rear 3710 is located below and adjacent to the top rail 3715, the top wall 3719 of rear 3710 is located below and adjacent to the rear wall 3923, and the back wall 3721 is located below and adjacent to the top wall 3719. Upper region further comprises a first reference point 3922 located between top rail 3715 and rear wall 3923, a second reference point 3982 located between rear wall 3923 and top wall 3719, a first inflection point 3986 located between top wall 3719 and back wall 3921, and a second inflection point 3992 located between the back wall 3921, and a bottom incline 3925 of the lower region 3713. First reference point 3922 and second reference point 3982 create a reference line 3939 as illustrated in FIG. 40.

The top wall 3719 is angled toward the strikeface and away from the top rail 3715 in a direction toward the first inflection point 3986. The described configuration of the top wall 3719 allows increased bending of the top rail 3715 of the club head 3700 on impact with a golf ball, compared with a club head devoid of the described top wall configuration.

Cavity 3730 is located on the exterior surface 3703, below top rail 3715 and rear wall 3923, above the lower region 3713 of rear 3710, and is defined by at least in part by upper region 3711 and lower region 3713.

In some embodiments, top rail 3715 of the upper region 3711 can be a flatter and taller top rail or skirt than in irons known to one skilled in the art. The flatter and taller rail can compensate for mishits of strikeface 3712 to increase playability off the tee. In some embodiments, the length of top rail 3715, measured from heel region 3702 to toe region 3704, can be 70% to 95% of the length of golf club head 3700. In many embodiments, cavity 3730 comprises a top rail box spring design. For some fairway iron-type golf club head embodiments, cavity 3730 can be a reverse scoop or indentation of rear 3710 with body 3701 comprising a greater thickness toward sole 3706. In many embodiments, top rail 3715 and cavity 3730 provide an increase in the overall bending of strikeface 3712. In some embodiments, the bending of strikeface 3712 can allow for a 2% to 5% increase of energy. Cavity 3730 allows for strikeface 3712 to be thinner and allow additional overall bending.

Strikeface 3712 of body 3701 comprises a thickness 3954 measured perpendicularly to strikeface 3712 from the exterior surface 3703 to the interior surface 3919. The thickness 3954 of the strikeface 3712 can range from 0.060 inch to 0.110 inch. For example, the thickness 3954 of the strikeface 3712 can be 0.060 inch, 0.065 inch, 0.070 inch, 0.075 inch, 0.080 inch, 0.085 inch, 0.090 inch, 0.095 inch, 0.100 inch, 0.105 inch, or 0.110 inch. In some embodiments, thickness 3954 of strikeface 3712 can remain constant from heel region 3702 to toe region 3704, and/or from top rail 3715 to sole 3706. In other embodiments, thickness 3954 of strikeface 3712 can vary from heel region 3702 to toe region 3704, and/or from top rail 3715 to sole 3706. For example, the thickness 3954 of strikeface 3712 can be greatest at a central portion of strikeface 3712 near the middle region 3974, and taper along the periphery of strikeface 3712 near the high region 3976, and the low region 3972. In many embodiments, the center of the strikeface 3712 near the middle region 3974 can have a thickness 3954 of 0.100 inch and the periphery of the strikeface 3712 can have a thickness 3954 of 0.080 inch. In other examples, the thickness 3954 can increase, or decreases, or any variation thereof starting at a central region near the middle region 3974 of strikeface 3712 and extending toward the periphery near the high region 3976 and the low region 3972.

Golf club head 3700 further comprises a height 3980 for rear wall 3923 of upper region 3711 of rear 3710 measured from first reference point 3922 to second reference point 3982. In some embodiments, height 3980 of rear wall 3923 of upper region 3711 of rear 3710 can range from 0.115 inch (0.292 cm) to 0.250 inch (0.635 cm), 0.130 inch (0.330 cm) to 0.200 inch (0.508 cm), or 0.150 inch (0.381 cm) to 0.180 inch (0.457 cm). For example, in some embodiments, the height 3980 of rear wall 3923 of the upper region 3711 of rear 3710 can be 0.115 inch (0.292 cm), 0.125 inch (0.318 cm), 0.135 inch (0.343 cm), 0.145 inch (0.368 cm), 0.155 inch (0.394 cm), 0.165 inch (0.419 cm), 0.175 inch (0.445 cm), 0.185 inch (0.470 cm), 0.195 (0.495 cm), or 0.250 inch (0.635 cm). In some embodiments, the height 3980 of rear wall 3923 of the upper region 3711 of rear 3710 can range from 0.150 inch (0.381 cm) to 0.210 inch (0.533 cm). In some embodiments, the height 3980 of rear wall 3923 of the upper region 3711 of rear 3710 can be 0.166 inch (0.422 cm). In some embodiments, the height 3980 of rear wall 3923 of upper region 3711 of rear 3710 can range from 3% to 15% of the height of the golf club head 3700.

The height 3980 of rear wall 3923 of the upper region 3211 of rear 3210, as described herein, allows cavity 3730 to absorb at least a portion of the stress on strikeface 3712 during impact with a golf ball. A golf club head having a rear wall height greater than rear wall height 3980 described herein would absorb less stress (and allow less strikeface deflection) in impact than golf club head 3700 described herein, due to increased dispersion of the impact stress along the top rail prior to reaching the cavity.

Rear wall 3923 further comprises a thickness measured perpendicularly from the exterior surface 3703 to the interior surface 3919 of the rear wall 3923. The thickness of the rear wall 3923 can range from 0.037 inch to 0.058 inch, 0.037 inch to 0.048 inch, or 0.042 inch to 0.058 inch. For example, the thickness of the rear wall 3923 can be 0.037 inch, 0.040 inch, 0.043 inch, 0.046 inch, 0.049 inch, 0.052 inch, 0.055 inch, or 0.058 inch. The thickness of the rear wall 3923 can aid in stress distribution as well as increase the bending of the strikeface 3712.

In many embodiments, second reference point 3982 of upper region 3711 of rear 3710 can have a distance ranging from 0.150 inch (0.381 cm) to 1.00 inch (2.54 cm), 0.150 inch (0.381 cm) to 0.350 inches (0.457 cm), 0.300 inch (0.457 cm) to 0.500 inch (1.27 cm), 0.450 inch (1.14 cm) to 0.650 inch (1.65 cm), 0.600 inch (1.52 cm) to 0.800 inch (2.03 cm), or 0.750 inch (1.91 cm) to 1.00 inch (2.54 cm) from apex 3928 of top rail 3715. For example, the second reference point 3982 of upper region 3711 can be 0.150 inch (0.381 cm), 0.450 inch (1.14 cm), 0.600 inch (1.52 cm), 0.750 inch (1.91 cm), 0.900 inch (2.29 cm), or 1.000 inch (2.54 cm) below the apex 3428 of top rail 3215.

Golf club head 3700 further comprises a length 3988 of top wall 3719 of upper region 3711, measured from the second reference point 3982 to first inflection point 3986. In many embodiments, top wall length 3988 can range from 0.030 inch (0.076 cm) to 0.100 inch (0.254 cm). In many embodiments, top wall length 3988 can range from 0.030 inch (0.076 cm) to 0.050 inch (0.127 cm), 0.040 inch (0.102 cm) to 0.060 inch (0.152 cm), 0.050 (0.127 cm) to 0.080 inch (0.203 cm), or 0.070 inch (0.178 cm) to 0.100 inch (0.254 cm). For example, top wall length 3988 can be 0.030 inch (0.076 cm), 0.035 inch (0.089 cm), 0.040 inch (0.102 cm), 0.045 inch (0.114 cm), 0.050 inch (0.127 cm), 0.055 inch (0.140 cm), 0.060 inch (0.152 cm), 0.065 inch (0.165 cm), 0.070 inch (0.178 cm), 0.075 inch (0.191 cm), 0.080 inch (0.203 cm), 0.085 inch (0.216 cm), 0.090 inch (0.229 cm), 0.095 inch (0.241 cm), or 0.100 inch (0.254 cm).

In a number of embodiments, a portion of top wall 3719 of upper region 3711 extends away from rear wall 3923 at second reference point 3982, toward strikeface 3712 at first inflection point 3986. In some embodiments, the portion of top wall 3719 extending away from rear wall 3923 toward strikeface 3712 can be straight, curved upward, or curved downward. This orientation of top wall 3719 creates a buckling point, hinge point or plastic hinge to direct the stress of impact toward cavity 3730 and to allow increased flexing of strikeface 3712 during impact.

The first inflection point 3986 of the upper region 3711, can have a distance from the first reference point 3922 ranging from 0.20 inch (0.508 cm) to 1.0 inch (2.54 cm), or 0.5 inch (1.27 cm) to 0.7 inch (1.778 cm). For example, the first inflection point 3986 can be 0.20 inch (0.508 cm), 0.25 inch (0.635 cm), 0.30 inch (0.762 cm), 0.35 inch (0.889 cm), 0.40 inch (1.016 cm), 0.45 inch (1.143 cm), 0.50 inch (1.27 cm), 0.55 inch (1.397 cm), 0.60 inch (1.524 cm), 0.65 inch (1.651 cm), 0.70 inch (1.778 cm), 0.75 inch (1.905 cm), 0.80 inch (2.032 cm), 0.85 inch (2.159 cm), 0.90 inch (2.286 cm), 0.95 inch (2.413 cm), or 1.0 inch (2.54 cm) below the first reference point 3922.

In some embodiments, upper region 3711 further comprises an inflection angle 3996 measured from top wall 3719 to back wall 3921, wherein inflection angle 3996 can range from 70 degrees to 150 degrees. In some embodiments, inflection angle 3996 of upper region can range from 90 degrees to 130 degrees. In some embodiments, inflection angle 3996 of upper region can be 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, or 150 degrees. In many embodiments, inflection angle 3996 of upper region allows first inflection point 3986 to act as a buckling point or plastic hinge upon golf club head 3700 impacting the golf ball at strikeface 3712. In some embodiments, the wall thickness at the first inflection point 3986 can be thinner than at the top wall 3719 and back wall 3921.

In some embodiments, back wall 3921 of cavity 3730 of upper region 3711 can have a back wall length 3990 measured from first inflection point 3986 to second inflection point 3992. In a number of embodiments, back wall length 3990 can range from 0.100 inch (0.254 cm) to 0.350 inch (0.889 cm). In many embodiments, back wall length 3990 can be 0.100 inch (0.254 cm), 0.125 inch (0.318 cm), 0.150 inch (0.381 cm), 0.175 inch (0.445 cm), 0.200 inch (0.508 cm), 0.225 inch (0.572 cm), 0.250 inch (0.635 cm), 0.275 inch (0.699 cm), 0.300 inch (0.762 cm), 0.325 inch (0.826 cm), or 0.350 inch (0.889 cm).

The back wall 3921 of the cavity 3730 can further comprise a thickness measured perpendicularly from the interior surface 3919 to the exterior surface 3703 of the back wall 3921. The thickness of the back wall 3921 can range from 0.028 inch to 0.039 inch, 0.028 inch to 0.032 inch, or 0.032 inch to 0.039 inch. For example, the thickness of the back wall 3921 can be 0.028 inch, 0.030 inch, 0.032 inch, 0.034 inch, 0.035 inch, 0.037 inch, or 0.039 inch. The thickness of the back wall 3921 can help distribute stress and increase the bending of the strikeface 3712.

In some embodiments, the maximum height of the back wall 3921 of the upper region 3711, measured perpendicular to a ground plane 3903 when golf club head 3700 is at address, to first inflection point 3986, can range from 0.25 inch (0.635 cm) to 3 inches (7.62 cm), or 0.50 inch (1.27 cm) to 2 inches (5.08 cm). For example, the first inflection point 3986 can be 0.25 inch (0.635 cm), 0.375 inch (0.953 cm), 0.5 inch 1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1.625 inches (4.12 cm), 1.75 inches (4.45 cm), 1.875 inches (4.76 cm), 2.0 inches (5.08 cm), 2.125 inches (5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm) or 3.0 inches (7.62 cm) above a lowest point of sole 3706 to the ground plane 3903 when golf club head 3700 is at address.

In many embodiments, second inflection point 3992 of cavity 3730 of upper region 3711, adjacent to bottom incline 3925 of lower region 3713, can have a distance from apex 3928 of top rail 3715 ranging from at least 0.25 inch (0.635 cm) to 2.0 inches (5.08 cm), or 0.5 inch (1.27 cm) to 1.5 inches (3.81 cm). For example, the second inflection point 3992 can be at least 0.25 inch (0.635 cm), 0.5 inch (1.27 cm), 0.75 inch (1.91 cm), 1.0 inch (2.53 cm), 1.25 inches (3.18 cm), 1.75 inches (4.45 cm), or 2.0 inches (5.08 cm) below the apex 3928 of top rail 3715.

In some embodiments as illustrated in FIG. 37, cavity 3730 of upper region 3711 can comprise at least one channel 3739. In many embodiments, channel 3739 extends from heel region 3702 to toe region 3704. Channel 3739 comprises a channel width 3932 measured from back wall 3921 to the second reference point 3982 substantially parallel to ground plane 3903, where channel width can vary in a direction from top rail 3215 to sole 3206. In some embodiments as illustrated in FIG. 37, channel width 3932 can range from 0.039 inch (1 mm) to 0.590 inch (15 mm), or 0.150 inch (3.81 mm) to 0.400 inch (10.16 mm). For example, channel width 3932 can be 0.039 inch (1.0 mm), 0.079 inch (2 mm), 0.12 inch (3 mm), 0.16 inch (4 mm), 0.20 inch (5 mm), 0.24 inch (6 mm), 0.28 inch (7 mm), 0.31 inch (8 mm), 0.39 inch (10 mm), or 0.59 inch (15 mm). In other embodiments, a channel toe region width of channel 3739 is less than a channel heel region width of channel 3739. In other embodiments, the channel heel region width is less than the channel toe region width. In other embodiments, a channel middle region width of channel 3739 can be less than at least one of the channel heel region width or the channel toe region width. In other embodiments, the channel middle region width can be greater than at least one of the channel heel region width or the channel toe region width. In some embodiments, channel 3739 is symmetrical from heel to toe. In other embodiments, channel 3739 is non-symmetrical. In other embodiments, channel 3739 can further comprise at least toe partial channels. In some embodiments, channel 3739 can comprise a series of partial channels interrupted by one or more bridges. In some embodiments, the one or more bridges can be approximately the same thickness as the thickness of top rail 3715.

Channel width 3932, as described herein, allows absorption of stress from strikeface 3712 on impact. A golf club head having a channel width less than the channel width 3932 described here (e.g., a golf club head with a less pronounced cavity) would allow less stress absorption from the strikeface on impact (due to less material on the upper region 3711 of rear 3710), and therefore would experience less strikeface deflection than golf club head 3700 described herein.

In many embodiments, back cavity 3730 further comprises a back cavity angle 3935.

Back cavity angle 3935 is measured from reference line 3939 to top wall 3719. In many embodiments, back cavity angle 3935 can range from 5 degrees to 80 degrees. In some embodiments, back cavity angle 3935 can be 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, or 80 degrees.

In some embodiments, back wall 3921 of cavity 3730 of upper region 3711 can further comprise a planar surface. In other embodiments, at least a portion of back wall 3921 can comprise a protrusion 3940 extending outward, away from strike face 3712. At least a portion of back wall 3921 comprising protrusion 3940 can range from 15% to 100%. For example, at least 15%, 20%, 25%, 30%, 35%, 40%, 45%, 50%, 55%, 60%, 65%, 70%, 75%, 80%, 85%, 90%, 95%, or 100% of back wall 3921 can comprise protrusion 3940. Protrusion 3940 can be positioned on at least a portion of back wall 3921 closer to toe region 3704, closer to heel region 3702, closer to lower exterior wall 3927, closer to top wall 3719, or centered on the back wall 3921. Protrusion 3940 comprises a length 3942, measured from heel region 3702 to toe region 3704, and a width 3944, measured from top rail 3715 to sole 3706.

The protrusion 3940 can comprise a thickness measured perpendicularly from the interior surface 3919 to the exterior surface 3703 of the protrusion 3940. The thickness of the protrusion 3940 can range from 0.028 inch to 0.045 inch, 0.028 inch to 0.032 inch, 0.032 inch to 0.039 inch, or 0.039 inch to 0.045 inch. For example, the thickness of the back wall 3921 can be 0.028 inch, 0.030 inch, 0.032 inch, 0.034 inch, 0.035 inch, 0.037 inch, 0.039 inch, 0.041 inch, 0.043 inch, or 0.045 inch. The thickness of the protrusion 3940 can help distribute stress and increase the bending of the strikeface 3712.

FIG. 40 illustrates a view of top rail 3715 and a portion of rear 3710 of the cross-section of golf club head 3700 of FIG. 37, along a cross-sectional line IX-IX in FIG. 37 that is similar to the cross-section of FIG. 39. In many embodiments, golf club head 3700 comprises a rear angle 4040, a top rail angle 4045, and a strikeface angle 4050. Rear angle 4040 is measured from top wall 3719 to rear wall 3923 of upper region 3711. In many embodiments, rear angle 4040 can range from 70 degrees to 140 degrees. In some embodiments, rear angle 4040 can be 70 degrees, 75 degrees, 80 degrees, 85 degrees, 90 degrees, 100 degrees, 105 degrees, 110 degrees, 115 degrees, 120 degrees, 125 degrees, 130 degrees, 135 degrees, or 140 degrees. Top rail angle 4045 is measured from rear wall 3923 of upper region 3711 to top rail 3715. In many embodiments, top rail angle 4045 can range from 35 degrees to 120 degrees or 70 degrees to 110 degrees. In some embodiments, top rail angle 4045 can be 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, or 120 degrees. Strikeface angle 4050 is measured from strikeface 3712 to top rail 3715. In many embodiments, strikeface angle 4050 can range from 70 degrees to 160 degrees or 70 degrees to 110 degrees. In some embodiments, strikeface angle 4050 can be 70 degrees, 75 degrees, 80 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees.

The upper region 3711 further comprises a minimum gap 4090 measured as a perpendicular distance from an inner surface of the cavity at the first inflection point 3986 to the inner surface 3919 of strikeface 3712. In some embodiments, minimum gap 4090 can range from 0.079 inch (2 mm) to 0.24 inch (6 mm). For example, minimum gap 4090 can be 0.079 inch (2 mm), 0.118 inch (3 mm), 0.16 inch (4 mm), 0.197 inch (5 mm) or 0.24 inch (6 mm). In other embodiments, minimum gap 4090 can range from 0.118 inch (3 mm) to 0.16 inch (4 mm). In some embodiments, minimum gap 4090 can be 0.135 inch (3.429 mm).

Lower region 3713 of rear 3710 of body 3701 comprises the bottom incline 3925, and a lower exterior wall 3927. The lower exterior wall 3927 is located below and adjacent the bottom incline 3925. A third inflection point 3994 is located between the bottom incline 3925 and the lower exterior wall 3927. A third reference point 3920 is located between lower exterior wall 3927 and sole 3706.

A top portion of the lower exterior wall 3927 of the lower region 3713 can comprise a thickness. The thickness of the top portion of the lower exterior wall 3927 can be measured perpendicular from the interior surface 3919 to the exterior surface 3703 of the top portion of the lower exterior wall 3927. The thickness of the top portion of the lower exterior wall 3827 can range from 0.037 inch to 0.058 inch, 0.037 inch to 0.048 inch, or 0.042 inch to 0.058 inch. For example, the thickness of the top portion of the lower exterior wall 3827 can be 0.037 inch, 0.040 inch, 0.043 inch, 0.046 inch, 0.049 inch, 0.052 inch, 0.055 inch, or 0.058 inch. The thickness of the top portion of the lower exterior wall 3827 can aid in stress distribution as well as increase the bending of the strikeface 3712.

In some embodiments, bottom incline 3925 of lower region 3713 comprises a bottom incline length 3929. Bottom incline length 3929 is measured from second inflection point 3992 to the third inflection point 3994. In a number of embodiments, bottom incline length 3994 can range from 0.010 inch (0.025 cm) to 0.210 inch (0.533 cm), 0.010 inch (0.025 cm) to 0.050 inch (0.127 cm), 0.050 inch (0.127 cm) to 0.100 inch (0.254 cm), 0.100 inch (0.254 cm) to 0.150 inch (0.381 cm), or 0.150 inch (0.381 cm) to 0.210 inch (0.533 cm). In many embodiments, bottom incline length 3929 can be 0.010 inch (0.025 cm), 0.030 inch (0.076 cm), 0.050 inch (0.127 cm), 0.070 inch (0.178 cm), 0.090 inch (0.229 cm), 0.110 inch (0.279 cm), 0.130 inch (0.330 cm), 0.150 inch (0.381 cm), 0.160 inch (0.406 cm), 0.170 inch (0.432 cm), 0.180 inch (0.457 cm), 0.190 inch (0.483 cm), 0.200 inch (0.508 cm), or 0.210 inch (0.533 cm). In some embodiments, the bottom incline length 3929 can vary from heel region 3702 to toe region 3704. In other embodiments, the bottom incline length 3929 can remain constant from heel region 3702 to toe region 3704.

In some embodiments, the maximum height of bottom incline 3925, measured perpendicular from ground plane 3903 when body 3701 is at address, to second inflection point 3992, can be 0.25 inches (0.635 cm) to 3 inches (7.62 cm), 0.05 inch (1.27 cm) to 2 inches (5.08 cm) above ground 3903. For example, the second inflection point 3992 can be 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1.625 inches (4.12 cm), 1.75 inches (4.45 cm), 1.875 inches (4.76 cm), 2.0 inches (5.08 cm), 2.125 inches 5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm), or 3.0 inches (7.62 cm) above ground 3903.

In some embodiments, lower region 3713 further comprises a lower angle 3951 measured from between the bottom incline 3925 of lower region 3713 and lower exterior wall 3927 of lower region 3710, as illustrated in FIG. 41. In some embodiments, lower angle 3951 can be less than 180 degrees. In a number of embodiments, lower angle 3951 can be 30 degrees to 160 degrees, or 70 degrees to 130 degrees. For example, lower angle 3951 can be 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, or 160 degrees.

In some embodiments, lower region 3713 further comprises a bottom incline angle 3905 measured from bottom incline 3925 to ground 3903. Bottom incline angle 3905 can range from 15 degrees to 45 degrees. In some embodiments, bottom incline angle 3905 can be 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, 37 degrees, 38 degrees, 39 degrees, 40 degrees, 41 degrees, 42 degrees, 43 degrees, 44 degrees, or 45 degrees.

FIG. 41 illustrates a simplified cross-sectional view of golf club head 3700, similar to the detailed cross-section of golf club head 3700 illustrated in FIG. 39. Golf club head 3700 include cavity 3730, upper region 3711, lower region 3713, and exterior surface 3703. In many embodiments, a maximum upper distance 4192 measured as the perpendicular distance from exterior surface 3703 of strikeface 3712 to exterior surface 3703 of second reference point 3982 of upper region 3711 can range from 0.20 inch to 0.59 inch (5 mm to 15 mm). For example, maximum upper distance 4192 can be 0.20 inch (5 mm), 0.24 inch (6 mm), 0.28 inch (7 mm), 0.31 inch (8 mm), 0.35 inch (8.89 mm), 0.39 inch (10 mm), 0.43 inch (11 mm), 0.47 inch (12 mm), 0.51 inch (13 mm), 0.55 inch (14 mm), or 0.59 inch (15 mm). In some embodiments, maximum upper distance 4192 can be 0.348 inch (9.09 mm). Further, a minimum upper distance 4194 measured as the perpendicular distance from exterior surface 3703 of strikeface 3712 to the exterior surface 3703 of the back wall 3921 at the first inflection point 3986 can range from 0.16 inch to 0.47 inch (4 mm to 12 mm). For example, minimum upper distance 4194 can be 0.16 inch (4 mm), 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), or 0.47 inch (12 mm). In some embodiments, minimum upper distance 4194 can be 0.309 inch (7.85 mm). Further still, a maximum lower distance 4196 measured as the perpendicular distance from exterior surface 3703 of strikeface 3712 to exterior surface 3703 of third reference point 3920 of lower region 3713 can range from 0.670 inch to 0.98 inch (17 mm to 25 mm). For example, maximum lower distance 4196 can be 0.670 inch (17 mm), 0.709 inch (18 mm), 0.748 inch (19 mm), 0.787 inch (20 mm), 827 inch (21 mm), 0.866 inch (22 mm), 0.906 inch (23 mm), 0.945 inch (24 mm), or 0.98 inch (25 mm). In some embodiments, maximum lower distance 4196 can be 0.863 inch (21.9 mm). In many embodiments, maximum lower distance 4196 is greater than maximum upper distance 4192 and maximum upper distance 4192 is greater than minimum upper distance 4194.

As illustrated in FIGS. 39-41, body 3701 is a hollow body club head that further comprises internal cavity 3716. Internal cavity 3716 of the body 3701 comprises a volume. The volume of the internal cavity 3716 can range from 0.70 $inch^3$ (11.47 cc) to 1.70 $inches^3$ (27.86 cc). In some embodiments, the internal cavity 3716 can comprise a volume of be 0.70 $inch^3$ (11.47 cc), 0.80 $inch^3$ (13.11 cc), 0.90 $inch^3$ (14.75 cc), 1.00 $inch^3$ (16.39 cc), 1.10 $inches^3$ (18.03 cc), 1.20 $inches^3$ (19.66 cc), 1.30 $inches^3$ (21.30 cc), 1.40 $inches^3$ (22.94 cc), or 1.50 $inches^3$ (24.58 cc), 1.60 $inches^3$ (26.22 cc), or 1.70 $inches^3$ (27.86 cc).

The internal cavity 3716 of the body 3701 further comprises interior surface 3919. In some embodiments, interior surface 3919 of rear 3710 is a planar and smooth surface. In other embodiments as illustrated in FIG. 42, the interior surface 3919 of the internal cavity 3716 of rear 3710 comprises a plurality of ribs 3952. The plurality of ribs 3952 extend in a direction from top rail 3715 toward sole 3706. Plurality of ribs 3952 can be located anywhere on interior surface 3919 of rear 3710. In some examples, plurality of ribs 3952 can be positioned onto a portion of interior surface 3919 of lower exterior wall 3927. In other examples, plurality of ribs 3952 can be position on a portion of interior surface 3919 of rear wall 3923. In some embodiments, plurality of ribs 3952 can be positioned on a portion of interior surface 3919 of rear 3710 and can extend into another portion of the rear 3710. For example, plurality of ribs 3952 are positioned on a portion of interior surface 3919 of rear wall 3923 and can extend up to at least a portion of the interior surface 3919 of top wall 3719, at least a portion of back wall 3921, or at least a portion of lower exterior wall 3927. The plurality of ribs 3952 can comprise between 1 to 8 ribs. For example, the plurality of ribs 3952 can comprise one rib 3952, two ribs 3952, three ribs 3952, four ribs 3952, five ribs 3952, six ribs 3952, seven ribs 3952, or eight ribs 3952. In embodiments having one or more plurality of ribs 3952, the plurality of ribs 3952 can be spaced equidistance from each other or more concentrated near heel region 3702, toe region 3704, top rail 3715, or sole 3706. The plurality of ribs 3952 and the location of the plurality of ribs 3952 can help optimize the frequency and amplitude of sound response.

In many embodiments, internal cavity 3716 of body 3701 can be void of any substances. In other embodiments, internal cavity 3716 of body 3701 can further comprise a polymer, wherein the polymer can at least partially fill the internal cavity 3716. The polymer can be polyethylene terephthalate, high-density polyethylene, polyvinyl chloride, polycarbonate, polypropylene, other thermoplastics, composite polymers or any combination thereof. The polymer can fill 10% to 80% 10% to 25%, 15% to 30%, 30% to 45%, 45% to 60%, 60% to 75%, 75% to 80%, 10% to 40%, 30% to 60%, or 40% to 80% of the internal cavity 3716 of the body 3701. For example, the polymer can fill 10%, 15%, 20%, 25%, 30%, 35%, 40%, 45%, 50%, 55%, 60%, 65%, 70%, 75%, 80%, or 85% of the internal cavity 3716 of the body 3701. In some embodiments, the polymer fills 80% of the internal cavity 3716 of the body 3701.

The polymer comprises a specific gravity ranging from 0.5 to 4. For example, the specific gravity of the polymer can be 0.5, 1, 1.5, 2, 2.5, 3, 3.5, or 4. In some embodiments, the specific gravity of the polymer is proportional to the mass of the polymer, wherein 1 specific gravity of the polymer is equal to 1 gram, 2 specific gravity of the polymer is equal to 2 grams and etc. Similarly, in some embodiments, the volume of the polymer is proportional to the polymer specific gravity. For example, the ratio of polymer mass to polymer volume can be 1 g to 1 cc, 2 g to 2 cc, 3 g to 3 cc, or 4 g to 4 cc. However, in other embodiments, while the specific gravity of the polymer is proportional to the polymer mass, the volume does not correlate to the specific gravity. For example, the ratio of polymer mass to polymer volume can be 1 g to 1 cc, 2 g to 0 cc, 3 g to 1 cc, 4 g to 2 cc, 4 g to 3 cc, 3 g to 2 cc, 3 g to 4 cc, or any other suitable ratio.

The mass of the polymer allows for the swing weight of the golf club head 3700 to be customizable for each player. Increasing the volume of polymer, and thus the mass, increases the swing weight, while decreasing the volume of polymer decreases the swing weight. Having the appropriate swing weight for each individual player improves feel during a swing and can improve performance such as swing speed, swing path and this ball speed, and ball trajectory. The polymer can further increase the overall mass of the golf club head 3700 more toward the rear 3710 and sole 3706. Increasing the mass more toward the rear 3710 and sole 3706 can keep the center of gravity low and back, and there improve the moment of the inertia. The polymer can further still act as a dampener to improve sound, and absorb shock during impact.

The polymer volume when filled within the internal cavity 3716 can range from 0 $inch^3$ (0 cc) to 1.53 $inches^3$ (25 cc), 0.244 $inch^3$ (4 cc) to 1.22 $inches^3$ (20 cc), 0.305 $inch^3$ (5 cc) to 0.915 $inch^3$ (15 cc), 0.122 $inch^3$ (2 cc) to 0.488 $inch^3$ (12 cc), or 0.854 $inch^3$ (14 cc) to 1.34 $inch^3$ (22 cc). In some embodiments, the polymer volume inside the internal cavity 3716 can be 0 $inch^3$ (0 cc), 0.244 $inch^3$ (4 cc), 0.244 $inch^3$ (8 cc), 0.488 $inch^3$ (12 cc), 0.976 $inch^3$ (16 cc), 1.22 $inches^3$ (20 cc), or 1.53 $inches^3$ (25 cc). The polymer filled within the internal cavity 3716 can cover a percentage of the interior surface 3919 of the strikeface 3712 ranging from 0% to 100%, 15% to 85%, 30% to 70%, 45% to 60%, 20% to 40%, or 60% to 80%. In some embodiments, the polymer covers 0%, 15%, 30%, 45%, 60%, 75%, 90% or 100% of the interior surface 3919 of the strikeface 3712. Increasing the percent coverage of the polymer on the interior surface 3919 of the strikeface 3712 increases the support for the strikeface 3712, thereby allowing for a thinner strikeface 3712. Thinning the strikeface 3712 can increase the deflection of the strikeface 3712 upon impact with a ball which can impart the ball with increases speed and spin. Thinning the strikeface 3716 also allows for weight to be redistributed elsewhere on the body 3701 to optimize center of gravity and moment of inertia.

In some embodiments as illustrated in FIG. 43, the golf club head 3700 can further comprise a first aperture 3934 located on toe region 3704 and a second aperture 3936 located in a hosel of the golf club head 3700. The first aperture 3924 is configured to receive a toe weight (not pictured), wherein the toe weight can range from 2 grams to 7 grams. In some embodiments, the toe weight can be 2 grams, 3 grams, 4 grams, 5 grams, 6 grams, or 7 grams. The second aperture 3936 is configured to receive a tip weight (not pictured), wherein the tip weight can range from 2 grams to 7 grams. In some embodiments, the tip weight can be 2 grams, 3 grams, 4 grams, 5 grams, 6 grams, or 7 grams. In many embodiments, the first aperture 3934 and the second aperture 3936 can further be configured to receive the polymer. The first aperture 3934 can receive 1 gram to 9 grams of polymer (e.g., 1 gram, 2 grams, 3 grams, 4 grams, 5 grams, 6 grams, 7 grams, 8 grams, or 9 grams). Similarly, the second aperture 3936 can receive 1 gram to 9 grams of polymer (e.g., 1 gram, 2 grams, 3 grams, 4 grams, 5 grams, 6 grams, 7 grams, 8 grams, or 9 grams). The toe and tip weight, and the polymer housed within the first aperture 3934 and the second aperture 3936 can affect the swing weight to optimize CG and MOI.

In many embodiments, cavity 3730 can provide an increase in golf ball speed over golf club head 1200, or other standard golf club heads, can reduce the spin rate of standard hybrids club heads, and can increase the launch angle over both the standard hybrid and iron club heads. In many embodiments, the shape of cavity 3730 determines the level of spring and timing of the response of golf club head 3200. When the golf club ball impacts strikeface 3712 of club head 3700 with cavity 3730, strikeface 3712 springs back like a drum, and a rear 3710 bends in a controlled buckle manner. In many embodiments, top rail 3715 can absorb more stress over greater volumetric space than a top rail in a golf club head without cavity 3730. The length, depth and width of cavity 3730 can vary. These parameter provide control regarding how much spring back is present in the overall design of club head 3700.

Upon impact with the golf ball, strikeface 3712 can bend inward at a greater distance than on a golf club without cavity 3730. In some embodiments, strikeface 3712 has a 10% to a 50% greater deflection than a strikeface on a golf club head without cavity 3730. In some embodiments, strikeface 3712 has a 5% to 40% or a 10% to a 20% greater deflection than a strikeface on a golf club head without cavity 3730. For example, strikeface 3712 can have a 5%, 10%, 15%, 20%, 25%, 30%, 35%, or 40% greater deflection than a strikeface on a golf club head without cavity 3730. In many embodiments, there is both a greater distance of retraction by strikeface 3712 due to the hinge and bending of cavity 3730 over a standard strikeface that does not have a back portion of the club with the cavity.

In many embodiments, the face deflection is greater with club head 3700 having cavity 3730, as a greater buckling occurs at first inflection angle 3986 of top wall 3219 upon impact with a golf ball. Cavity 3730, however, provides a greater dispersion of stress along top rail 3715, rear wall 3923, and top wall 3719, and the spring back force is transferred from cavity 3730 and first inflection point 3986 of top wall 3719 to strikeface 3712. A standard top rail, rear wall and top wall without a cavity does not have this hinge/buckling effect, nor does it absorb a high level of stress over a large volumetric area of the top rail, rear wall and top wall. Therefore, the standard strikeface does not contract and then recoil as much as strikeface 3712. Further, both a larger region of srikeface 3712, top rail 3715, rear wall 3923, and top wall 3719 absorb more stress than the same crown region of a standard golf club head with a standard top rail, top wall and no cavity. In many embodiments, although there is greater stress along a greater area above cavity 3730 that the same area in a standard club without the cavity, the durability of the club head with and without the cavity is the same. By adding more spring to the back end of the club (due to inward inclination of a portion of top wall 3719 toward strikeface 3712), more force is displace throughout the volume of the structure. The stress is observed over a greater area of strikeface 3712, top rail 3715, rear wall 3923, and top wall 3719 of golf club head 3700. Peak stresses can be seen in the standard top rail club head. However, more peak stresses are seen in golf club head 3700, but distributed over a large volume of the material. The hinge and bend regions of golf club head 3700 (i.e., the region above cavity 3730 and cavity 3730 itself) will not deform as long as the stress does not meet the critical buckling threshold. Cavity 3730 and its placement can be designed to be under the critical K value of the buckling threshold.

As shown in FIG. 41, a further deflection feature of the golf club head 3700 can be the uniform thinned region 4160, located at the sole 3706 and stretching between the rear 3710 of the body 3701 and the strikeface 3712, toward a cascading sole portion of the sole (as described in greater detail below). The uniform thinned region 4160 can provide multiple benefits. First, the uniform thinned region 4160 can reduce stress on the strikeface 3712 caused during impact with the golf ball. Second, the uniform thinned region 4160 can bend allowing the strikeface 3712 to experience greater deflection. Third, the uniform thinned region 4160 removes weight from the sole area, allowing the weight to be redistributed more toward the rear of the golf club head 3700. At impact, the energy imparted to the strikeface 3712 by the golf ball can cause the uniform thinned region to bend outward, which in turn increases the strikeface 3712 deflection. After bending, the uniform thinned region 4160 rebounds back to its original position returning the majority of the energy from impact back to the golf ball. The result is the golf club head 3700 imparts increased ball speeds and greater travel distances to the golf ball after impact.

In some embodiments, body 3701 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 3701 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 3712 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 3712 can comprise carpenter grade 455 steel, carpenter grade 475 steel, C300 steel, C350 steel, a Ni—Co—Cr steel alloy, a quench and tempered steel alloy, or 565 steel. In some embodiments, body 3701 can comprise the same material as strikeface 3712. In some embodiments, body 3701 can comprise a different material than strikeface 3712.

Figure 44:
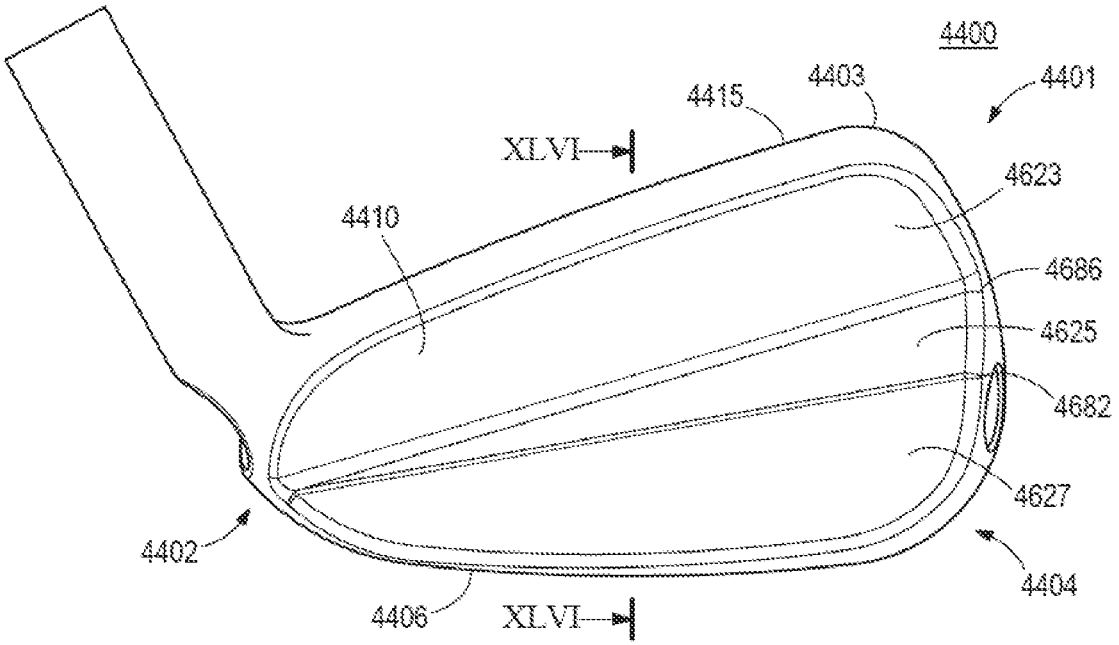
FIG. 44 depicts a back perspective view of a golf club head according to still yet another embodiment.
Figure 45:
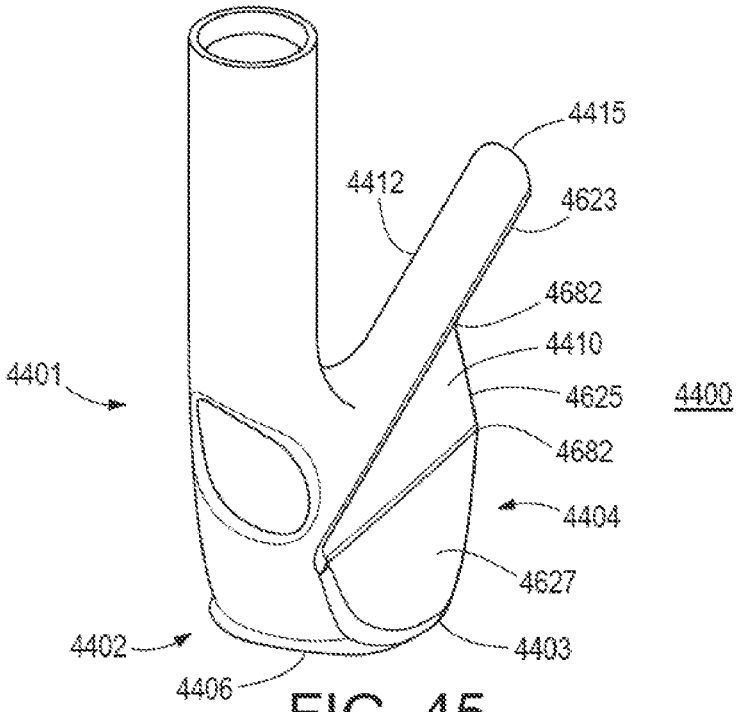
FIG. 45 depicts a back, heel-side perspective view of the golf club head according to the embodiment of FIG. 44.

FIG. 44 illustrates a back perspective view of an embodiment of golf club head 4400 and FIG. 45 illustrates a back heel-side perspective view of golf club head 4400 according to the embodiment of FIG. 44. In some embodiments, golf club head 4400 can be similar to golf club head 1000 (FIG. 10), golf club head 2200 (FIG. 22), golf club head 2700 (FIG. 27), golf club head 3200 (FIG. 32), and/or golf club head 3700 (FIG. 37). Golf club head 4400 can be an iron-type golf club head. In other embodiments, golf club head 4400 can be a hybrid-type, or a fairway wood-type golf club head. In some embodiments, golf club head 4400 does not comprise a badge or a custom tuning port.

Golf club head 4400 comprises a body 4401. In some embodiments, body 4401 can be similar to body 1001 (FIG. 10), body 2201 (FIG. 22), body 2701 (FIG. 27), body 3201 (FIG. 32), and/or body 3701 (FIG. 37). Body 4401 further comprises an exterior surface 4403, a strikeface 4412, a heel region 4402, a toe region 4404 opposite the heel region 4402, a sole 4406, a top rail 4415, and a rear 4410.

Body 4401 of FIGS. 44-48 further comprises a blade length. The blade length for body 4401 can be measured similar to blade length 3725 as shown and described in FIG.

43 (i.e., a measurement parallel to the flat surface of the strikeface 3712, from a toe edge 3726 of the strikeface 3712, to strikeface end 3727 before the strikeface 3712 integrally curves into the hosel). The blade length of the body 4401 can range from 2.50 inches (6.35 cm) to 2.90 inches (7.37 cm). For example, in some embodiments, the body 3701 can comprise a blade length of 2.50 inch (6.35 cm), 2.54 inch (6.45 cm), 2.58 inch (6.55 cm), 2.62 inch (6.65 cm), 2.66 inch (6.76 cm), 2.70 inch (6.86 cm), 2.74 inch (6.96 cm), 2.78 inch (7.06 cm), 2.82 inch (7.16 cm), 2.86 inch (7.264 cm), or 2.90 inch (7.37 cm).

Figure 48:
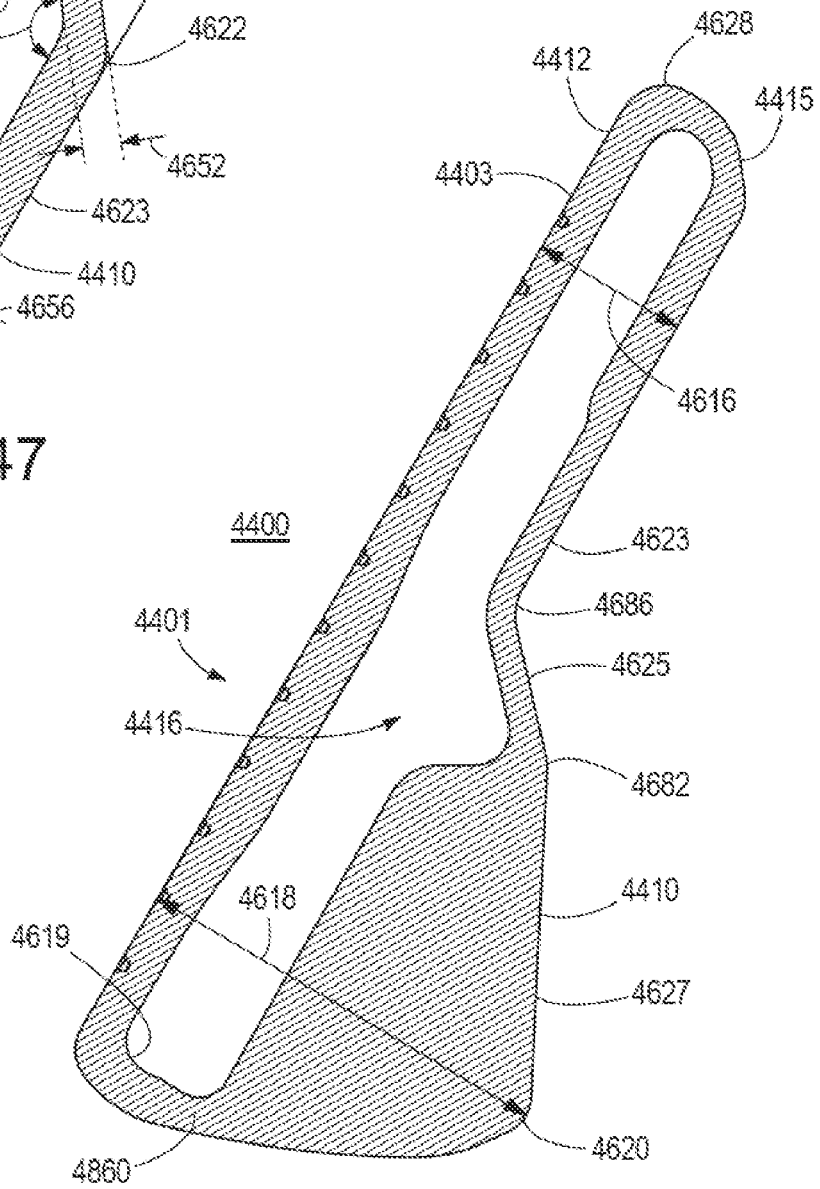
FIG. 48 depicts a simplified cross-sectional view of the golf club head of FIG. 44, similar to the detailed cross-sectional view of the golf club head in FIG. 47

As shown in FIG. 48, a further deflection feature of the golf club head 4400 can be the uniform thinned region 4860, located at the sole 4406 and stretching between the rear 4410 of the body 4401 and the strikeface 4412, toward a cascading sole portion of the sole (as described in greater detail below). In the illustrated embodiment, the uniform thinned region 4860 comprises a sole thickness measured perpendicular from the exterior surface 4403 to an interior surface 4619 at the uniform thinned region 4860, which can remain constant from the bottom of the strikeface 4412 to adjacent the cascading sole portion of the sole. In some embodiments, the sole thickness of the uniform thinned region 4860 can be thinner than a conventional sole. For example, in some embodiments, the sole thickness of the uniform thinned region 4860 may range from approximately 0.040 inch to 0.080 inch. In other embodiments, the sole thickness of the uniform thinned region 4860 may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region 4860 can be 0.040 inch, 0.045 inch, 0.050 inch, 0.060 inch, 0.065 inch, 0.070 inch, 0.075 inch, or 0.080 inch.

Figure 46:
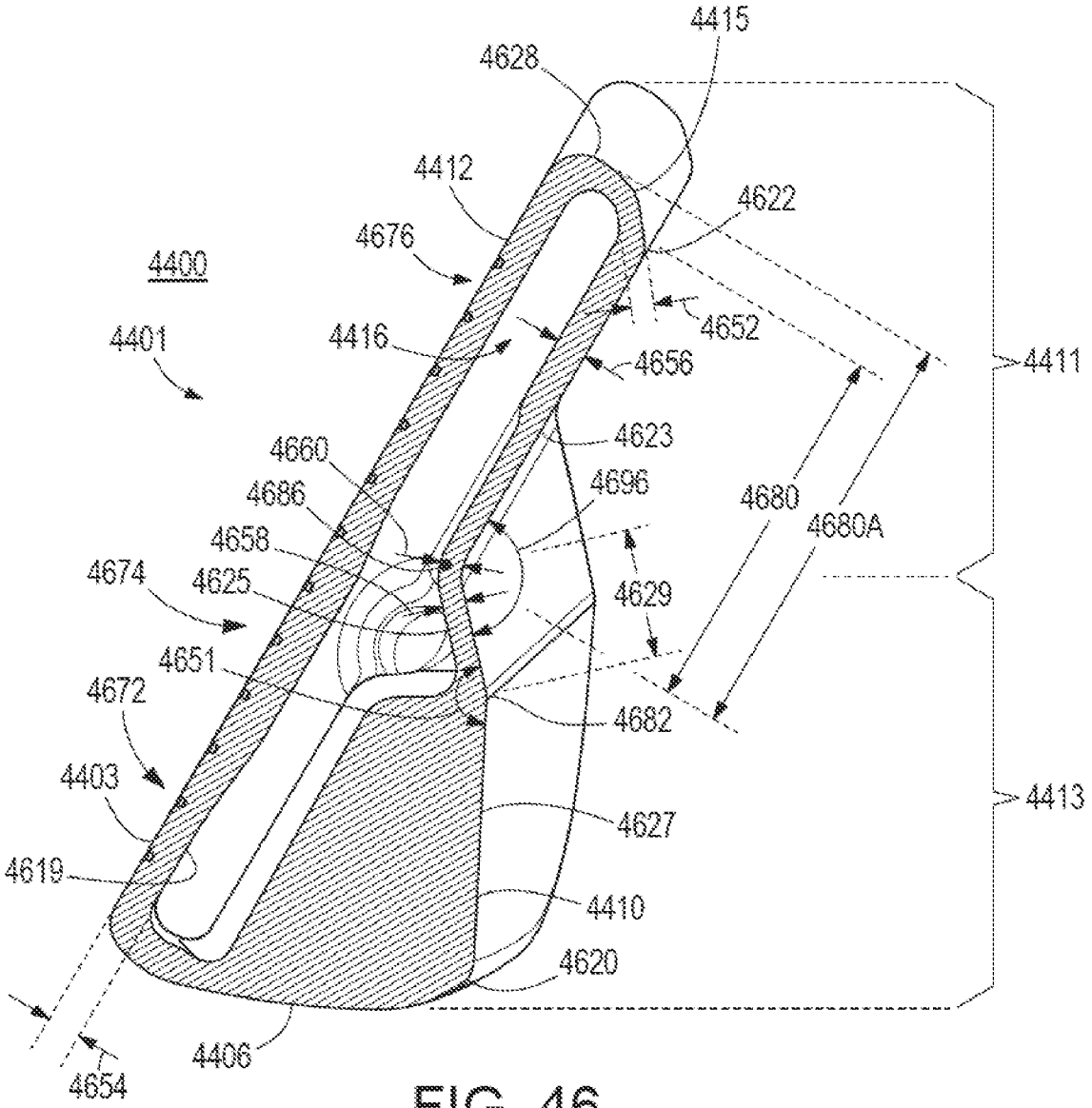
FIG. 46 depicts a cross-sectional view of the golf club head of FIG. 44 along the cross-sectional line XLVI-XLVI of FIG. 44.

FIG. 46 illustrates a cross-section of golf club head 4400 along the cross-sectional line XLVI-XLVI in FIG. 44, according to one embodiment. As seen in FIG. 46, strikeface 4412 comprises a high region 4676, a middle region 4674, and a low region 4672.

The strikeface 4412 of the body 4401 further comprises a thickness 4654 measured perpendicularly to the strikeface 4412 from the exterior surface 4403 to an interior surface 4619. The thickness 4654 of the strikeface 4412 can range from 0.040 inch to 0.100 inch. For example, the thickness 4654 of the strikeface 4412 can be 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. In some embodiments, thickness 4654 of the strikeface 4412 can vary from the heel region 4402 to the toe region 4404, and/or from the top rail 4415 to the sole 4406. For example, the thickness 4654 of the strikeface 4412 can be greatest at the central portion near the middle region 4674 of the strikeface 4412, and taper along the periphery near the high region 4676 and the low region 4672 of strikeface 4412. In many embodiments, the center of the strikeface 4412 can have a thickness 4654 of 0.090 inch and the periphery of the strikeface 4412 can have a thickness 4654 of 0.070 inch. In other examples, the thickness 4654 can increase, decrease, or any variation thereof starting at the central region near the middle region 4674 of the strikeface 4412 and extending toward the periphery near the high region 4676 and the low region 4672.

The cross-section of golf club head 4400 in FIG. 46 further illustrates the rear 4410. The rear 4410 can comprise an upper region 4411, a lower region 4413, and an inflection point 4686 disposed between the upper region 4411 and the lower region 4413. The inflection point 4686 is further located at the junction between the rear wall 4623 and the bottom incline 4625. The inflection point 4686 is located nearer to the sole of the club head than the top rail 4415.

The upper region 4411 of rear 4410 comprises a top rail 4415, an apex 4628 of top rail, a rear wall 4623 orientated parallel to the strikeface 4412, and a first reference point 4622 disposed between the top rail 4415 and the rear wall 4623. The first reference point 4622 is located at the junction between the top rail 4415 and the rear wall 2623 parallel to the strikeface 4412. In many embodiments, the rear wall 4623 of upper region 4411 is located below and adjacent the top rail 4415.

In some embodiments, top rail 4415 of the upper region 4411 can be a flatter and taller top rail or skirt than in irons known to one skilled in the art. The flatter and taller rail can compensate for mishits or strikeface 4412 to increase playability off the tee. In some embodiments. The length of top rail 4415, measured from heel region 4402 to toe region 4404, can be 70% to 95% of the length of the golf club head 4400.

The top rail 4415 of the upper region 4411 comprises a thickness 4652. The thickness 4652 of the top rail 4415 can range from 0.040 inch to 0.080 inch. For example, the thickness 4652 of the top rail 4415 can be 0.040 inch, 0.043 inch, 0.046 inch, 0.049 inch, 0.051 inch, 0.054 inch, 0.057 inch, 0.060 inch, 0.063 inch, 0.066 inch, 0.069 inch, 0.071 inch, 0.074 inch, 0.077 inch, or 0.080 inch. In many embodiments, the thickness 4652 of the top rail 4415 is constant throughout. In other embodiments, the thickness 4652 of the top rail 4415 can vary. In the exemplary embodiment, the thickness 4652 of the top rail 4415 decreases from the strikeface 4412 toward the rear wall 4623. In many embodiments due to the thickness 4652 of the top rail, top rail 4415 can provide an increase in the overall bending of strikeface 4412. In some embodiments, the bending of strikeface 4412 can allow for a 2% to 5% increase of energy.

Figure 47:
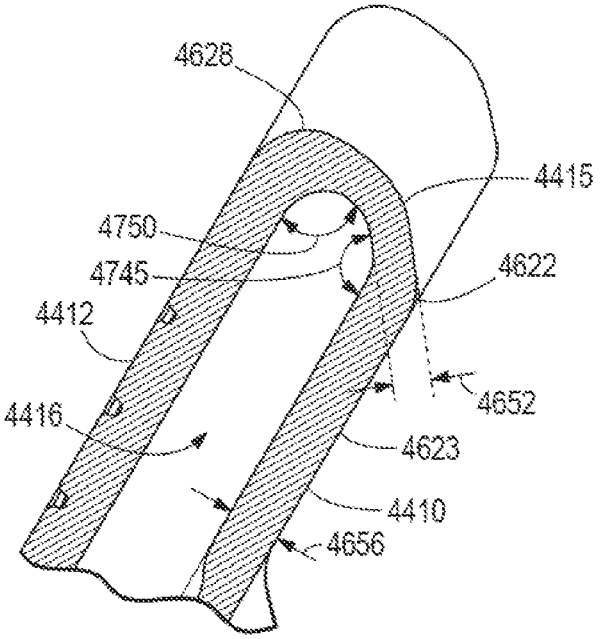
FIG. 47 depicts a portion of the golf club head of FIG. 46.

FIG. 47 illustrated the top rail 4415 and a portion of the rear 4410 of the cross-section of the golf club head 4400 of FIG. 46, different from cross-section of golf club head 1200 as shown in FIG. 13. The strike face 4412 further comprises a strikeface angle 4750. Strikeface angle 4750 is measured from the strikeface 4412 to the top rail 4415, wherein the strikeface angle 4750 can range from 70 degrees to 160 degrees or 70 degrees to 110 degrees. In some embodiments, strikeface angle 4050 can be 70 degrees, 75 degrees, 80 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees.

FIG. 47 further illustrates the top rail 4415 comprising a top rail angle 4745. The top rail angle 4745 is measured from rear wall 4623 to the top rail 4415. In many embodiments, the top rail angle 4745 can range from 35 degrees to 120 degrees or 70 degrees to 110 degrees. In some embodiments, top rail angle 4745 can be 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, or 120 degrees.

The rear wall 4623 of the upper region 4411 comprises a height 4680. The height 4680 of the rear wall 4623 is measured from the first reference point 4622 to the inflection point 4686, wherein the first reference point 4622 is positioned at the junction between the top rail 4415 and the rear wall 4623 parallel to the strikeface 4412. The height 4680 of the rear wall 4623 can range from 0.055 inch to 0.060 inch, 0.060 inch to 0.070 inch, 0.070 inch to 0.080 inch, 0.080 in to 0.085 or 0.55 inch to 0.85 inch. For example, the height 4680 of the rear wall 4623 can be 0.55 inch, 0.58 inch, 0.61 inch, 0.64 inch, 0.67 inch, 0.70 inch, 0.73 inch, 0.76 inch, 0.79 inch, 0.82 inch, or 0.85 inch. In some embodiments, the height 4680 of the rear wall 4623 range from 35% to 60%, 35% to 45%, 45% to 68%, 40% to 55%, 30% to 40%, 35% to 45%, 40% to 50%, 45% to 55%, or 50% to 60% of the total height of the golf club head 4400. For example, the height 4680 of the rear wall 4623 can be 35%, 38%, 41%, 44%, 47%, 50%, 53%, 56%, or 60% of the total height of the golf club head 4400.

The rear wall 4623 of the upper region 4411 can also comprise a height 4680A. The height 4680A is measured from the apex 4628 of the top rail 4415 to the inflection point 4686. The height 4680A can range from 0.60 inch to 1.0 inch. For example, the height 4680A can be 0.60 inch, 0.61 inch, 0.64 inch, 0.67 inch, 0.70 inch, 0.73 inch, 0.76 inch, 0.79 inch, 0.82 inch, 0.85 inch, 0.90 inch, 0.95 inch, or 1.0 inch. In some embodiments, the height 4680A can range from 40% to 75% of the total height of the golf club head 4400. For example, the height 4680A can be 40%, 44%, 47%, 50%, 53%, 56%, 60%, 65%, 70%, or 75% of the total height of the golf club head 4400.

The rear wall 4623 of the upper region 4411 further comprises a thickness 4656. The thickness 4656 is the perpendicular distance of the rear wall 4623 from the outer surface 4403 to the inner surface 4619. The thickness 4656 of the rear wall 4623 can range from 0.040 inch to 0.080 inch. For example, the thickness 4656 of the rear wall 4623 can be 0.040 inch, 0.043 inch, 0.046 inch, 0.049 inch, 0.051 inch, 0.054 inch, 0.057 inch, 0.060 inch, 0.063 inch, 0.066 inch, 0.069 inch, 0.071 inch, 0.074 inch, 0.077 inch, or 0.080 inch. In many embodiments, the thickness 4656 of the rear wall 4623 is constant throughout. In other embodiments, the thickness 4656 of the rear wall 4623 can vary. In the exemplary embodiment, the thickness 4656 of the rear wall 4623 is a constant 0.05 inch. The thickness 4656 of the rear wall 4623 allows energy from an impact to transfer to the inflection point 4686 to help induce a buckling effect.

The lower region 4413 of the body 4401 comprises a bottom incline 4625, a lower exterior wall 4627, a second reference point 4682, and a third reference point 4620. The bottom incline 4625 is below and adjacent the inflection point 4686. The lower exterior wall 4627 is below and adjacent the bottom incline 4625. The second reference point 4682 is disposed between or positioned at the junction between the bottom incline 4625 and the lower exterior wall 4627. The third reference point 4620 is disposed between the lower exterior wall 4727 and the sole 4406. The bottom incline 4625 is angled away from the top rail 4415 and away from the strikeface 4412 in a direction toward the second reference point 4682.

In some embodiments, bottom incline 4625 of the lower region 4413 comprises a bottom incline length 4629. Bottom incline length 4629 is measured from the inflection point 4686 to the second reference point 4682. The bottom incline length 4629 can range from 0 inch to 0.45 inch. For example, the bottom incline length 4629 can be 0 inch, 0.05 inch, 0.10 inch, 0.15 inch, 0.20 inch, 0.20 inch, 0.25 inch, 0.30 inch, 0.35 inch, 0.40 inch, or 0.45 inch. In some embodiments, the bottom incline length 4629 can remain constant from the heel region 4402 to the toe region 4404. In other embodiments, the bottom incline length 4629 can vary from the heel region 4402 to the toe region 4404. For example, the bottom incline length 4629 can increase from the heel region 4402 to the toe region 4404 as illustrated in FIG. 44. In other embodiments, the bottom incline length 4629 can decrease from the heel region 4402 to the toe region 4404.

In some embodiments, the lower region 4413 further comprises a lower angle 4651 measured from between the bottom incline 4625 to the lower exterior wall 4627. In some embodiments, the lower angle 4651 can be less than 180 degrees. In a number of embodiments, the lower angle 4651 can be 130 degrees to 175 degrees. For example, the lower angle 4651 of the lower region 4413 can be 130 degrees, 135 degrees, 140 degrees, 145 degrees, 150 degrees, 155 degrees, 160 degrees, 165 degrees, 170 degrees, or 175 degrees.

The upper region 4411 and the lower region 4413 of the rear 4410 is separated by the inflection point 4686. Due to the height 4680 of the rear wall 4623, the inflection point 4686 is positioned low on the body 4401. In many embodiments, the inflection point 4686 is positioned at least 40% down on the body 4401 below the apex 4628. For example, the inflection point 4686 can be positioned 40%, 42%, 44%, 46%, 48%, 50%, 52%, 54%, 56%, 58%, or 60% down on the body 4401 below the apex 4628. The low positioned inflection point 4686 allows for more leverage on the upper region 4411 to experience increased bending during impact with a ball, compared to a similar golf club head having a higher inflection point position.

The inflection point 4686 comprises an inflection angle 4696 measured from the rear wall 4623 of the upper region 4411, to the bottom incline 4625 of the lower region 4413. In some embodiments, the inflection angle 4696 can be measured from the rear wall 4623 to the lower exterior wall 4627 in the absence of the bottom incline 4625 (i.e., the bottom incline length 4629 is 0 inch). The inflection angle 4696 of the inflection point 4686 can range from at least 95 degrees to 150 degrees. In some embodiments, the inflection angle 4696 can be at least 95 degrees, 100 degrees, 105 degrees, 110 degrees, 115 degrees, 120 degrees, 125 degrees, 130 degrees, 135 degrees, 140 degrees, 145 degrees, or 150 degrees. In some embodiments, the inflection angle 4696 can be consistent from the heel region 4402 to the toe region 4404. In other embodiments, the inflection angle 4696 can vary from the heel region 4402 to the toe region 4404. In many embodiments, the inflection angle 4696 allows for inflection point 4686 to act as a buckling point or plastic hinge upon the golf club head 4400 impacting the golf ball at strikeface 4412. In other examples of a similar golf club head having an inflection angle, wherein the inflection angle is less than 95 degrees (i.e., 90 degrees, or the bottom incline is oriented approximately perpendicular to the strikeface), the inflection angle would impede energy transfer and prevent bending at the inflection point.

The inflection point 4686 further comprises a thickness 4660. The thickness 4660 of the inflection point 4686 is measured perpendicularly of the inflection point 4686 from the exterior surface 4403 to the interior surface 4619. The thickness 4660 of the inflection point 4686 can range from 0.040 inch, to 0.080 inch. For example, the thickness 4660 can be 0.040 inch, 0.045 inch, 0.050 inch, 0.055 inch, 0.060 inch, 0.65 inch, 0.065 inch, 0.070 inch, 0.075 inch, or 0.080 inch. In many embodiments, the thickness 4660 at the inflection point 4686 is constant with the thickness 4656 of the rear wall 4623 and the thickness 4658 of the bottom incline 4625. In other embodiments, the thickness 4660 at the inflection point 4686 can be less than the thickness 4656 of the rear wall 4623 and the thickness 4658 of the bottom incline 4656. The thickness 4660 at the inflection point 4686 being consistent with or less than the thickness 4656, 4658 of the rear wall 4623 and the bottom incline 4656 allows for more uniform energy transfer and bending.

FIG. 48 illustrates another cross-sectional view of the golf club head 4400, similar to the detailed cross-section of golf club head 4400 illustrated in FIG. 44. The body 4401 of golf club head 4400 further comprises a minimum distance 4616, and a maximum distance 4618. The minimum distance of the body 4401 is measured as the perpendicular distance from the exterior surface 4403 of the strikeface 4412 in the upper region 4411 to the exterior surface 4403 of the rear wall 4623. The minimum distance 4616 can range from 0.20 inch to 0.40 inch. For example, the minimum distance 4616 can be 0.20 inch, 0.22 inch, 0.24 inch, 0.26 inch, 0.28 inch, 0.30 inch, 0.32 inch, 0.34 inch, 0.36 inch, 0.038 inch, or 0.40 inch. In some embodiments, the minimum distance 4616 of the body 4401 can be less the bottom incline length 4629. The maximum distance 4618 of the body 4401 is measured as the perpendicular distance from the exterior surface 4403 of the strikeface 4412 in the lower region 4413 to the exterior surface 4403 of the third reference point 4620. The maximum distance 4618 can range from 0.60 inch to 0.90 inch. For example, the maximum distance 4618 can be 0.60 inch, 0.64 inch, 0.68 inch, 0.72 inch, 0.76 inch, 0.80 inch, 0.84 inch, 0.88 inch, or 0.90 inch.

As illustrated in FIG. 46-48, the golf club head 4400 can be a hollow, or at least partially hollow body comprising an internal cavity 4416. Internal cavity 4416 of the body 4401 comprises a volume. The volume of the internal cavity 4416 can range from 0.65 $inch^3$ (10.65 $cm^3$) to 1.05 $inch^3$ (17.21 $cm^3$). In some embodiments, the internal cavity 4416 can comprise a volume of 0.65 $inch^3$ (10.65 $cm^3$), 0.70 $inch^3$ (11.47 $cm^3$), 0.75 $inch^3$ (12.29 $cm^3$), 0.80 $inch^3$ (13.11 $cm^3$), 0.85 $inch^3$ (13.93 $cm^3$), 0.90 $inch^3$ (14.75 $cm^3$), 0.95 $inch^3$ (15.57 $cm^3$), 1.00 $inch^3$ (16.39 $cm^3$), or 1.05 $inch^3$ (17.21 $cm^3$). Similarly, the solid portion of the body 4401, void of the cavity 4416, further comprises a material volume. The material volume of the body 4401 can range from 2.50 $inch^3$ (40.97 $cm^3$) to 3.50 $inch^3$ (57.35 $cm^3$). For example, the material volume of the body 4401 can be 2.50 $inch^3$ (40.97 $cm^3$), 2.60 $inch^3$ (42.61 $cm^3$), 2.70 $inch^3$ (44.25 $cm^3$), 2.80 $inch^3$ (45.88 $cm^3$), 2.90 $inch^3$ (47.52 $cm^3$), 3.00 $inch^3$ (49.16 $cm^3$), 3.10 $inch^3$ (50.80 $cm^3$), 3.20 $inch^3$ (52.44 $cm^3$), 3.30 $inch^3$ (54.08 $cm^3$), 3.40 $inch^3$ (55.72 $cm^3$), or 3.50 $inch^3$ (57.35 $cm^3$).

In many embodiments, the internal cavity 4416 of the body 4401 can be void of any substance. In other embodiments, the internal cavity 4416 of the body 4401 can comprise a polymer (not pictured), wherein the polymer can be at least partially fill the internal cavity 4416. The polymer can be polyethylene terephthalate, high-density polyethylene, polyvinyl chloride, polycarbonate, polypropylene, other thermoplastics, composites polymers or any combination thereof. The polymer can fill 10% to 80% 10% to 25%, 15% to 30%, 30% to 45%, 45% to 60%, 60% to 75%, 75% to 80%, 10% to 40%, 30% to 60%, or 40% to 80% of the internal cavity 4416 of the body 4401. For example, the polymer can fill 10%, 15%, 20%, 25%, 30%, 35%, 40%, 45%, 50%, 55%, 60%, 65%, 70%, 75%, 80%, or 85% of the internal cavity 4416 of the body 4401. In some embodiments, the polymer fills 80% of the internal cavity 4416 of the body 4401.

The polymer to at least partially fill the internal cavity 4416 of the body 4401 comprises a specific gravity ranging from 0.05 to 4. For example, the specific gravity of the polymer can be 0.5, 1.0, 1.5, 2.0, 2.5, 3.0, 3.5, or 4. In some embodiments, the specific gravity of the polymer is proportional to the mass of the polymer, wherein 1 specific gravity of the polymer is equal to 1 gram. Similarly, in those exemplary embodiments, the volume is proportional to the polymer specific gravity, wherein 1 specific gravity of the polymer is equal to 1 cc. In other embodiments, the volume is not proportional to the specific gravity of the polymer. For example, the ratio of the polymer specific gravity to the polymer volume can be 2:1 cc, 2:3 cc, 2:4 cc, 3:1 cc, 3:2 cc, 3:4 cc, 4:1 cc, 4:2 cc, or 4:3 cc.

The mass of the polymer allows for the swing weight of the golf club head 4400 to be customizable for each player. Increasing the volume of the polymer, and thus the mass, increases the swing weight. Similarly, decreasing the volume of the polymer decreases the swing weight. Having the appropriate swing weight for each individual player improves feel during a swing and can improve performance such as swing speed, swing path, ball speed, and ball trajectory. The polymer can further increase the overall mass of the golf club head 4400 more toward the sole 4406. Increasing the mass more toward the sole shifts the CG low and back, thereby improves the moment of inertia.

In some embodiments, the golf club head 4400 can further comprise an aperture (not pictured) located on the toe region 4404. The aperture comprises internal threads and is configured to receive a threaded screw weight (not pictured). The threaded screw weight comprises a mass, wherein the mass of the threaded screw weight can range from 2 grams to 12 grams. In other embodiments, the mass of the threaded screw weight can range from 4 grams to 10 grams. In some embodiments, the screw weight can be 2 grams, 3 grams, 4 grams, 5 grams, 6 grams, 7 grams, 8 grams, 9 grams, 10 grams, 11 grams, or 12 grams. The mass of the screw weight correlates with the length of the screw weight, wherein a longer threaded screw weight equates to a greater mass. The threaded screw weight further affects the mass and overall swing weight of the golf club head 4400. Therefore, the threaded screw weight can improve the feel of the golf club head 4400, as well as performance characteristics (e.g., swing speed, ball speed, and ball flight).

In many embodiments, the low positioning of the inflection point 4686 can provide an increase in golf ball speed over golf club head 1200 (or other standard golf club heads), can reduce the spin rate of standard hybrid club heads (or other standard golf club heads), and can increase the launch angle over both the standard hybrid and iron club heads. An inflection point positioned less than 40% down the body from the apex cannot buckle as easily because the high positioning decreases the leverage for the upper region to bend. Therefore, when the golf ball impacts strikeface 4412 of the club head 4400 with inflection point 4686 positioned at least 40% down the body 4401 from the apex 4628, the strikeface 4412 springs back like a drum, and the rear 4410 bends in a controlled buckle manner more than a golf club head having an inflection point positioned less than 40% down the body from the apex.

A standard top rail, and rear wall without a low positioned inflection point does not have this hinge/buckling effect, nor does it absorb a high level of stress over a large volumetric area of the top rail and rear wall. Therefore, the standard strikeface does not contract and then recoil as much as strikeface 4412. By adding more spring to the back end of the club (due to the thinness of the top rail 4415 and rear wall 4623, and the low position of the inflection point 4686), more force is displaced thoughout the volume of the structure. The stress is observed over a greater area of strikeface 4412, top rail 4415, and rear wall 4623 of the golf club head 4400. Peak stresses can be seen in the typically just along the top rail in a standard club head. However, more peak stresses are seen in the golf club head 4400, but distributed over a large volume of the material. The hinge and bend regions of the golf club head 4400 (i.e., the inflection point 4686) will not deform as long as the stress does not meet the critical buckling threshold. Inflection point 4686 and its placement can be designed to be under the critical K value of the buckling threshold.

Further, upon impact with the golf ball, strikeface 4412 can bend inward at a greater distance than on a golf club without a thin top rail 4415, a thin rear wall 4623, and an inflection point 4686 positioned at least 40% down the body from the apex 4628. In some embodiments, the strikeface 4412 has a 10% to a 50% greater deflection than a strikface on a golf club head without a thin top rail, a thin rear wall, and a low positioned inflection point. For example, the strikeface 4412 can have a 10%, a 15%, a 20%, a 30%, a 35%, a 40%, a 45%, or a 50% greater deflection than a strikeface of a golf club head without a thin top rail 4415, thin rear wall 4623, and low positioned inflection point 4686.

As shown in FIG. 48, a further deflection feature of the golf club head 4400 can be the uniform thinned region 4860, located at the sole 4406 and stretching between the rear 4410 of the body 4401 and the strikeface 4412, toward a cascading sole portion of the sole (as described in greater detail below). The uniform thinned region 4860 can provide multiple benefits. First, the uniform thinned region 4860 can reduce stress on the strikeface 4412 caused during impact with the golf ball. Second, the uniform thinned region 4860 can bend allowing the strikeface 4412 to experience greater deflection. Third, the uniform thinned region 4860 removes weight from the sole area, allowing the weight to be redistributed more toward the rear of the golf club head 4400. At impact, the energy imparted to the strikeface 4412 by the golf ball can cause the uniform thinned region 4860 to bend outward, which in turn increases the strikeface 4412 deflection. After bending, the uniform thinned region 4860 rebounds back to its original position returning the majority of the energy from impact back to the golf ball. The result is the golf club head 4400 imparts increased ball speeds and greater travel distances to the golf ball after impact.

In some embodiments, body 4401 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 4401 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 4412 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 4412 can comprise carpenter grade 455 steel, carpenter grade 475 steel, C300 steel, C350 steel, a Ni—Co—Cr steel alloy, a quench and tempered steel alloy, or 565 steel. In some embodiments, body 4401 can comprise the same material as strikeface 4412. In some embodiments, body 4401 can comprise a different material than strikeface 4412.

Figure 49:
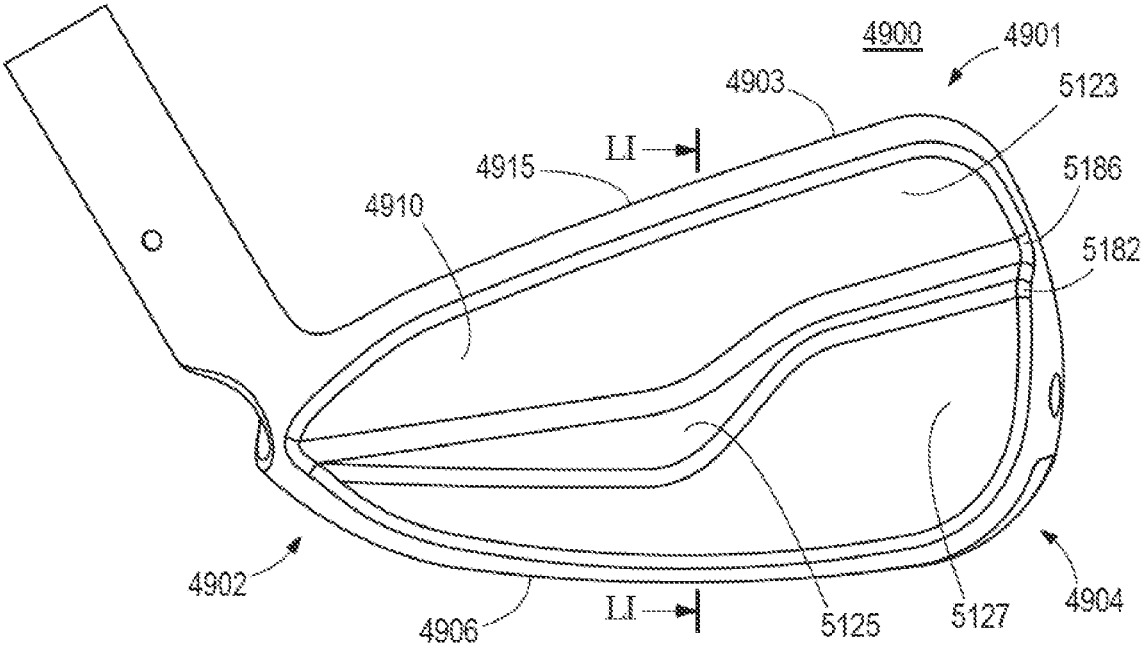
FIG. 49 depicts a back perspective view of a golf club head according to still yet another embodiment.
Figure 50:
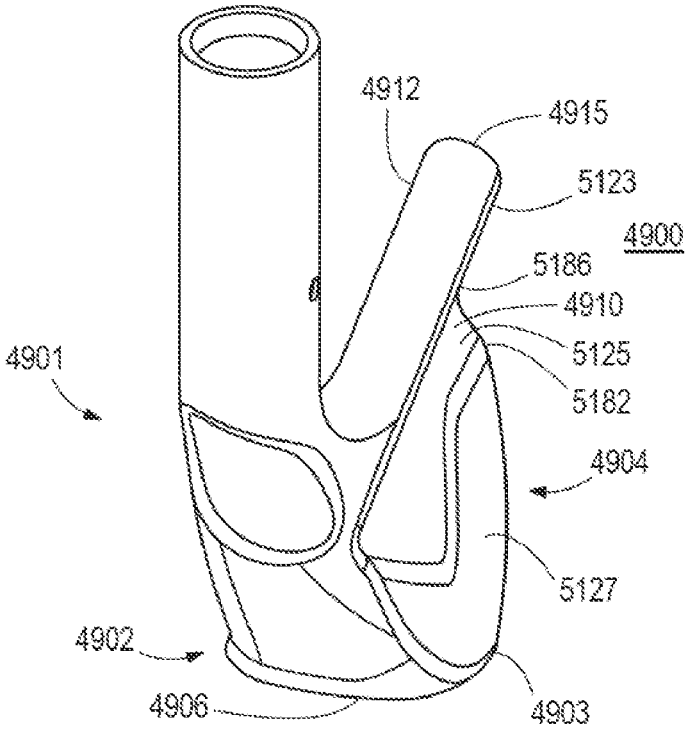
FIG. 50 depicts a back, heel-side perspective view of the golf club head according to the embodiment of FIG. 49.

FIG. 49 illustrates a back perspective view of an embodiment of a golf club head 4900, and FIG. 50 illustrates a back heel-side perspective view of the golf club head 4900 according to the embodiment of FIG. 49. In some embodiments, the golf club head 4900 can be similar to golf club head 1000 (FIG. 10), golf club head 2200 (FIG. 22), golf club head 2700 (FIG. 27), golf club head 3200 (FIG. 32), golf club head 3700 (FIG. 37), and/or golf club head 4400 (FIG. 44). The golf club head 4900 can be an iron-type golf club head. In some embodiments, the golf club head 4900 does not comprise a badge or a custom tuning port.

The golf club head 4900 comprises a body 4901. In some embodiments, the body 4901 can be similar to body 1001 (FIG. 10), body 2201 (FIG. 22), body 2701 (FIG. 27), body 3201 (FIG. 32), body 3701 (FIG. 37), and/or body 4401 (FIG. 44). The body 4901 further comprises an exterior surface 4903, a strikeface 4912, a heel region 4902, a toe region 4904 opposite the heel region, a sole 4906, a top rail 4915, and a rear 4910.

The body 4901 of FIGS. 49-52 further comprises a blade length. The blade length for the body 4901 can be measured similar to blade length 3725 as shown and described for golf club head 3700 in FIG. 43 (i.e., a measurement parallel to the flat surface of the strikeface, from a toe edge of the strikeface, to strikeface end before the strikeface integrally curves into the hosel). The blade length of the body 4901 can range from 2.50 inches (6.35 cm) to 2.90 inches (7.37 cm). In some embodiments, the blade length can range from 2.50 inches (6.35 cm) to 2.60 inches (6.60 cm), 2.60 inches (6.60 cm) to 2.70 inches (6.86 inches), 2.70 inches (6.86 cm) to 2.80 inches (7.11 cm), or 2.80 inches (7.11 cm) to 2.90 inches (7.37 cm). For example, in some embodiments, the body 4901 can comprise a blade length of 2.50 inches (6.35 cm), 2.54 inches (6.45 cm), 2.58 inches (6.55 cm), 2.62 inches (6.65 cm), 2.66 inches (6.76 cm), 2.70 inches (6.86 cm), 2.74 inches (6.96 cm), 2.78 inches (7.06 cm), 2.82 inches (7.16 cm), 2.86 inches (7.264 cm), or 2.90 inches (7.37 cm).

Figure 53:
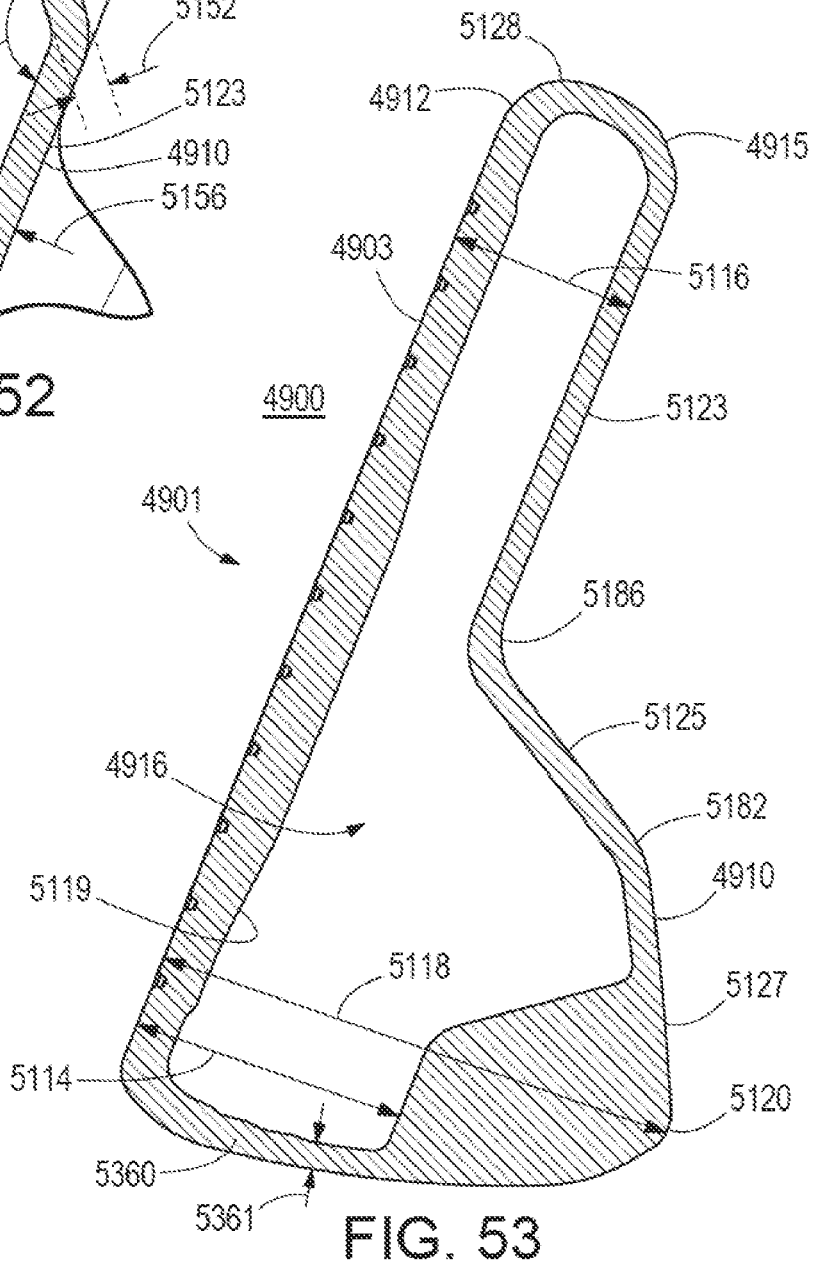
FIG. 53 depicts a simplified cross-sectional view of the golf club head of FIG. 49, similar to the detailed cross-sectional view of the golf club head in FIG. 51.

As shown in FIG. 53, a further deflection feature of the golf club head 4900 can be the uniform thinned region 5360, located at the sole 4906 and stretching between the rear 4910 of the body 4901 and the strikeface 4912, toward a cascading sole portion of the sole (as described in greater detail below). In the illustrated embodiment, the uniform thinned region 5360 comprises a sole thickness 5361 measured perpendicular from the exterior surface 4903 to an interior surface 5119 at the uniform thinned region 5360, which can remain constant from the bottom of the strikeface 4912 to adjacent the cascading sole portion of the sole 4906. In some embodiments, the sole thickness 5361 of the uniform thinned region 5360 can be thinner than a conventional sole. For example, in some embodiments, the sole thickness 5361 of the uniform thinned region 5360 may range from approximately 0.040 inch to 0.080 inch. In other embodiments, the sole thickness 5361 of the uniform thinned region 5360 may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region 5360 can be 0.040 inch, 0.045 inch, 0.050 inch, 0.060 inch, 0.065 inch, 0.070 inch, 0.075 inch, or 0.080 inch.

Figure 51:
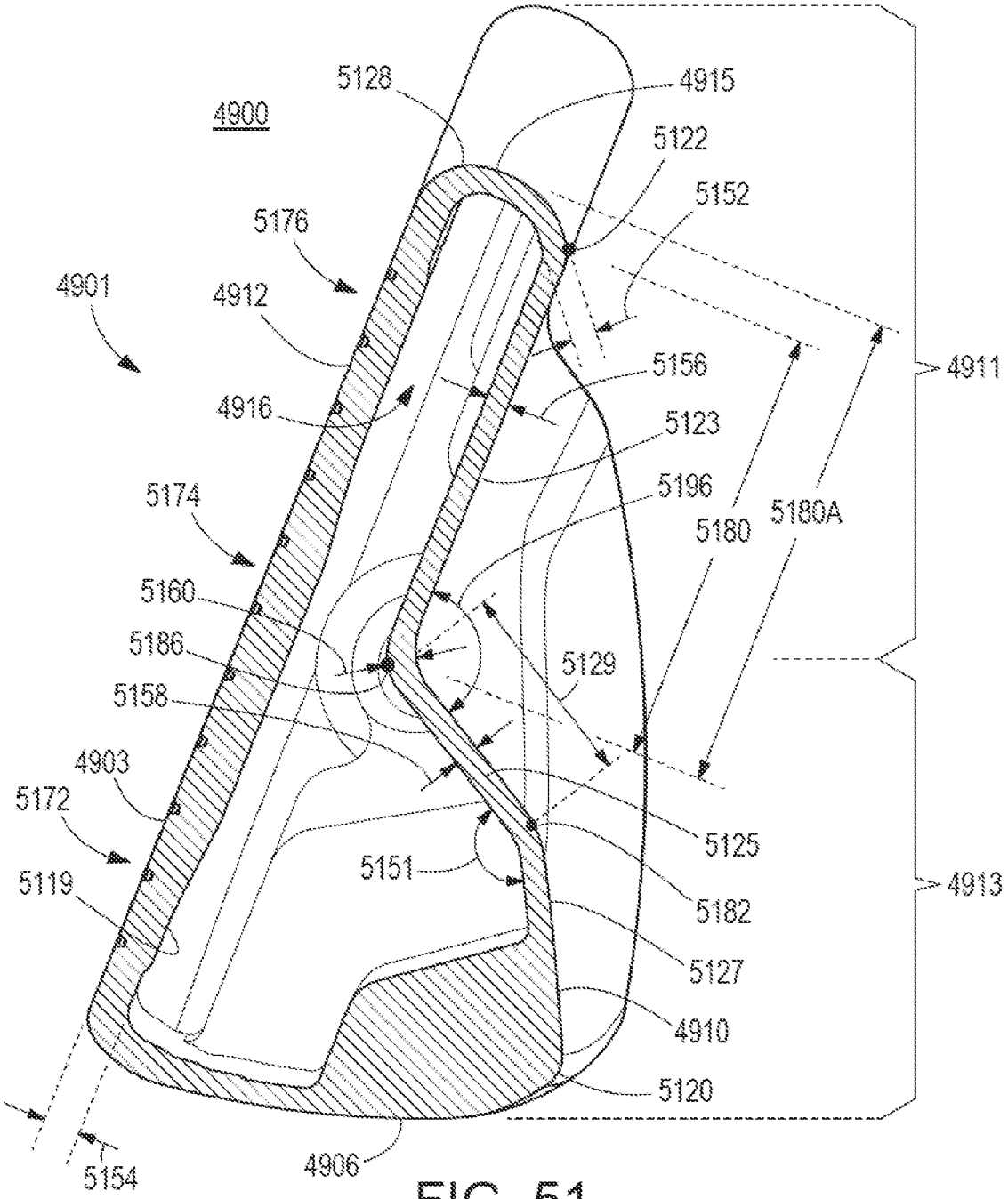
FIG. 51 depicts a cross-sectional view of the golf club head of FIG. 49 along the cross-sectional line LI-LI of FIG. 49.

FIG. 51 illustrates a cross-section of the golf club head 4900, according to one embodiment. As seen in FIG. 51, the strikeface 4912 comprises a high region 5176, a middle region 5174, and a low region 5172.

The strikeface 4912 of the body 4901 further comprises a thickness 5154 measured perpendicular to the strikeface 4912 from the exterior surface 4903 to an interior surface 5119. The thickness 5154 of the strikeface 4912 can range from 0.040 inch to 0.200 inch. In some embodiments, the thickness 5154 of the strikeface 4912 can range from 0.040 inch to 0.080 inch, 0.080 inch to 0.120 inch, 0.120 inch to 0.160 inch, or 0.160 inch to 0.20 inch. For example, the thickness 5154 of the strikeface 4912 can be 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, 0.100 inch, 0.150 inch, or 0.200 inch. In some embodiments, the thickness 5154 of the strikeface 4912 can vary from the heel region 4902 to the toe region 4904, and/or from the top rail 4915 to the sole 4906. For example, the thickness 5154 of the strikeface 4912 can be greatest at the central portion near the middle region 5174 of the strikeface 4912, and taper along the periphery near the high region 5176 and the low region 5172 of strikeface 4912. In many embodiments, the center of the strikeface 4912 can have a thickness 5154 range of 0.10 inch to 0.14 inch, and the periphery of the strikeface 4912 can have a thickness 5154 range of 0.06 inch to 0.10 inch. In some embodiments, the center of the strikeface 4912 can have a thickness 5154 range of 0.10 inch to 0.12 inch, or 0.12 inch to 0.14 inch. In other embodiments, the periphery of the strikeface 4912 can have a thickness 5154 range of 0.06 inch to 0.08 inch, or 0.08 inch to 0.10 inch. In other examples, the thickness 5154 can increase, decrease, or any variation thereof starting at the central region near the middle region of the strikeface and extending toward the periphery near the high region 5176 and the low region 5172.

The cross-section of the golf club head in FIG. 51 further illustrates the rear 4910. The rear 4910 can comprise an upper region 4911, a lower region 4913, and an inflection point 5186 disposed between the upper region 4911 and the lower region 4913. The inflection point 5186 is further located at the junction between the rear wall 5123 and the bottom incline 5125. The inflection point 5186 is located nearer to the sole 4906 of the club head 4900 than the top rail 4915.

The upper region 4911 of rear 4910 comprises a top rail 4915, an apex of top rail 5128, a rear wall 5123 orientated parallel to the strikeface 4912, and a first reference point 5122 disposed between the top rail 4915 and the rear wall 5123. The first reference point 5122 is located at the junction between the top rail 4915 and the rear wall 5123 parallel to the strikeface. In many embodiments, the rear wall 5123 of the upper region 4911 is located below and adjacent the top rail 4915.

In some embodiments, top rail 4915 of the upper region 4911 can be a flatter and taller top rail or skirt than in irons known to one skilled in the art. The flatter and taller rail can compensate for mishits or strikeface 4912 to increase playability off the tee. In some embodiments. The length of top rail 4915, measured from heel region 4902 to toe region 4904, can be 60% to 95% of the length of the golf club head 4900.

The top rail 4915 of the upper region 4911 comprises a thickness 5152. The thickness 5152 of the top rail 4915 can range from 0.040 inch to 0.080 inch. In some embodiments, the thickness 5152 of the top rail 4915 can range from 0.040 inch to 0.060 inch, or 0.060 inch to 0.080 inch. For example, the thickness 5152 of the top rail 4915 can be 0.040 inch, 0.043 inch, 0.046 inch, 0.049 inch, 0.051 inch, 0.054 inch, 0.057 inch, 0.060 inch, 0.063 inch, 0.066 inch, 0.069 inch, 0.071 inch, 0.074 inch, 0.077 inch, or 0.080 inch. In many embodiments, the thickness 5152 of the top rail 4915 is constant throughout. In other embodiments, the thickness 5152 of the top rail 4915 can vary. In the exemplary embodiment, the thickness 5152 of the top rail 4915 decreases from the strikeface 4912 toward the rear wall 5123. In many embodiments, due to the thickness of the top rail, top rail can provide an increase in the overall bending of strikeface. In some embodiments, the bending of strikeface can allow for a 2% to 5% increase of energy.

Figure 52:
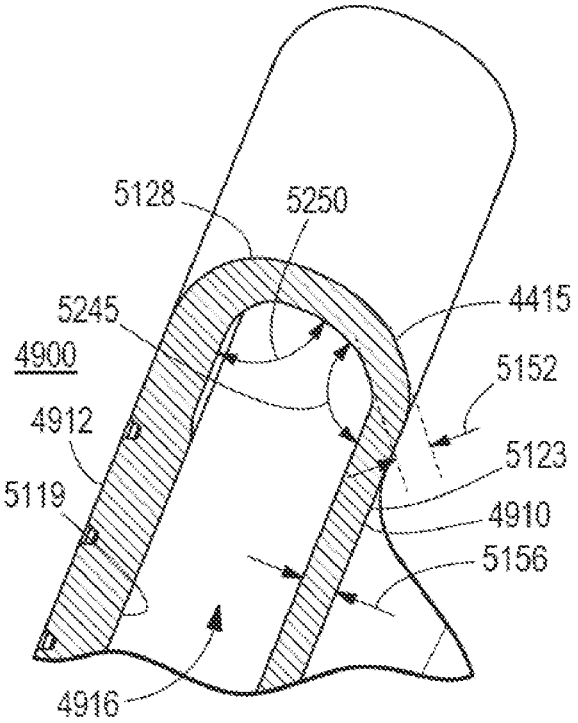
FIG. 52 depicts a portion of the golf club head of FIG. 49.

FIG. 52 illustrates the top rail 4915 and a portion of the rear 4910 of the cross-section of the golf club head of FIG. 49, different from cross-section of golf club head 1200 as shown in FIG. 13. The strikeface 4912 further comprises a strikeface angle 5250. The strikeface angle 5250 is measured from the strikeface 4912 to the top rail 4915, wherein the strikeface angle 5250 can range from 70 degrees to 160 degrees or 70 degrees to 110 degrees. In some embodiments, strikeface angle can be 70 degrees, 75 degrees, 80 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees.

FIG. 52 further illustrates the top rail 4915 comprising a top rail angle 5245. The top rail angle 5245 is measured from rear wall 5123 to the top rail 4915. In many embodiments, the top rail angle 5245 can range from 35 degrees to 150 degrees or 70 degrees to 145 degrees. In some embodiments, top rail angle 5245 can be 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, or 150 degrees.

The rear wall 5123 of the upper region 4911 comprises a height 5180. The height 5180 of the rear wall 5123 is measured from the first reference point 5122 to the inflection point 5186, wherein the first reference point 5122 is positioned at the junction between the top rail 4915 and the rear wall 5123 parallel to the strikeface 4912. The height 5180 of the rear wall 5123 can range from 0.55 inch to 0.60 inch, 0.60 inch to 0.70 inch, 0.70 inch to 0.80 inch, 0.80 inch to 0.85, 0.85 inch to 0.90 inch, 0.90 inch to 0.95, 0.95 inch to 1 inch or 0.55 inch to 1 inch. For example, the height 5180 of the rear wall 5123 can be 0.55 inch, 0.58 inch, 0.61 inch, 0.64 inch, 0.67 inch, 0.70 inch, 0.73 inch, 0.76 inch, 0.79 inch, 0.82 inch, 0.85 inch, 0.88 inch, 0.91 inch, 0.94 inch, 0.97 inch, or 1 inch. In some embodiments, the height 5180 of the rear wall 5123 range from 35% to 60%, 35% to 45%, 45% to 68%, 40% to 55%, 30% to 40%, 35% to 45%, 40% to 50%, 45% to 55%, or 50% to 60% of the total height of the golf club head 4900. For example, the height 5180 of the rear wall 5123 can be 35%, 38%, 41%, 44%, 47%, 50%, 53%, 56%, or 60% of the total height of the golf club head 4900.

The rear wall 5123 of the upper region 4911 can also comprise a secondary height 5180A. The secondary height 5180A is measured from the apex 5128 of the top rail 4915 to the inflection point 5186. The secondary height 5180A can range from 0.60 inch to 1.2 inch. In some embodiments, the secondary height 5180A can range from 0.60 inch to 0.80 inch, 0.80 inch to 1.0 inch, or 1.0 inch to 1.20 inches. For example, the secondary height 5180A can be 0.60 inch, 0.61 inch, 0.64 inch, 0.67 inch, 0.70 inch, 0.73 inch, 0.76 inch, 0.79 inch, 0.82 inch, 0.85 inch, 0.90 inch, 0.95 inch, 1.0 inch, or 1.2 inches. In some embodiments, the secondary height 5180A can range from 40% to 75% of the total height of the golf club head 4900. For example, the secondary height 5180A can be 40%, 41%, 42%, 43%, 44%, 45%, 46%, 47%, 48%, 49%, 50%, 51%, 52%, 53%, 54%, 55%, 56%, 60%, 65%, 70%, or 75% of the total height of the golf club head 4900.

The rear wall 5123 of the upper region 4911 further comprises a thickness 5156. The thickness 5156 is the perpendicular distance of the rear wall 5123 from the outer surface 4903 to the inner surface 5119. The thickness 5156 of the rear wall 5123 can range from 0.040 inch to 0.080 inch. In some embodiments, the thickness 5156 of the rear wall 5123 can range from 0.040 inch to 0.060 inch, or 0.060 inch to 0.080 inch. For example, the thickness 5156 of the rear wall 5123 can be 0.040 inch, 0.043 inch, 0.046 inch, 0.049 inch, 0.051 inch, 0.054 inch, 0.057 inch, 0.060 inch, 0.063 inch, 0.066 inch, 0.069 inch, 0.071 inch, 0.074 inch, 0.077 inch, or 0.080 inch. In many embodiments, the thickness 5156 of the rear wall 5123 is constant throughout. In other embodiments, the thickness 5156 of the rear wall 5123 can vary. In the exemplary embodiment, the thickness 5156 of the rear wall 5123 is a constant 0.045 inch. The thickness of the rear wall allows energy from an impact to transfer to the inflection point to help induce a buckling effect.

The lower region 4913 of the body 4901 comprises a bottom incline 5125, a lower exterior wall 5127, a second reference point 5182, and a third reference point 5120. The bottom incline 5125 is below and adjacent the inflection point 5186. The lower exterior wall 5127 is below and adjacent the bottom incline 5125. The second reference point 5182 is disposed between or positioned at the junction between the bottom incline 5125 and the lower exterior wall 5127. The third reference point 5120 is disposed between the lower exterior wall 5127 and the sole 4906. The bottom incline 5125 is angled away from the top rail 4915 and away from the strikeface 4912 in a direction toward the second reference point 5182.

In some embodiments, bottom incline 5125 of the lower region 4913 comprises a bottom incline length 5129. Bottom incline length 5129 is measured from the inflection point 5186 to the second reference point 5182. The bottom incline length 5129 can range from 0 inch to 0.55 inch. In some embodiments, the bottom incline length 5129 can range from 0 inch to 0.35 inch, or 0.35 inch to 0.55 inch. For example, the bottom incline length 5129 can be 0 inch, 0.05 inch, 0.10 inch, 0.15 inch, 0.20 inch, 0.20 inch, 0.25 inch, 0.30 inch, 0.35 inch, 0.40 inch, 0.45 inch, 0.50 inch, or 0.55 inch. In some embodiments, the bottom incline length 5129 can remain constant from the heel region 4902 to the toe region 4904. In other embodiments, the bottom incline length 5129 can vary from the heel region 4902 to the toe region 4904, as illustrated in FIG. 49. For example, the bottom incline length 5129 can increase from the heel region 4902 to the toe region 4904. In other embodiments, the bottom incline length 5129 can decrease from the heel region 4902 to the toe region 4904.

In some embodiments, the lower region 4913 further comprises a lower angle 5151 measured from between the bottom incline 5125 to the lower exterior wall 5127. In some embodiments, the lower angle 5151 can be less than 180 degrees. In a number of embodiments, the lower angle 5151 can be 130 degrees to 175 degrees. For example, the lower angle 5151 of the lower region 4913 can be 130 degrees, 135 degrees, 140 degrees, 145 degrees, 150 degrees, 155 degrees, 160 degrees, 165 degrees, 170 degrees, or 175 degrees.

The upper region 4911 and the lower region 4913 of the rear 4910 is separated by the inflection point 5186. Due to the height of the rear wall, the inflection point 5186 is positioned low on the body 4901. In many embodiments, the inflection point 5186 is positioned at least 40% down on the body 4901 below the apex 5128. For example, the inflection point 5186 can be positioned 40%, 42%, 44%, 46%, 48%, 50%, 52%, 54%, 56%, 58%, or 60% down on the body 4901 below the apex 5128. The low positioned inflection point 5186 allows for more leverage on the upper region 4911 to experience increased bending during impact with a ball, compared to a similar golf club head having a higher inflection point position.

The inflection point 5186 comprises an inflection angle 5196 measured from the rear wall 5123 of the upper region 4911, to the bottom incline 5125 of the lower region 4913. In some embodiments, the inflection angle 5196 can be measured from the rear wall 5123 to the lower exterior wall 5127 in the absence of the bottom incline 5125 (i.e., the bottom incline length is 0 inch). The inflection angle 5196 of the inflection point 5186 can range from at least 95 degrees to 150 degrees. In some embodiments, the inflection angle 5196 can be at least 95 degrees, 100 degrees, 105 degrees, 110 degrees, 115 degrees, 120 degrees, 125 degrees, 130 degrees, 135 degrees, 140 degrees, 145 degrees, or 150 degrees. In some embodiments, the inflection angle 5196 can be consistent from the heel region 4902 to the toe region 4904. In other embodiments, the inflection angle 5196 can vary from the heel region 4902 to the toe region 4904. In many embodiments, the inflection angle 5196 allows for the inflection point 5186 to act as a buckling point or plastic hinge upon the golf club head 4900 impacting the golf ball at strikeface 4912. In other examples of a similar golf club head having an inflection angle, wherein the inflection angle is less than 95 degrees (i.e., 90 degrees, or the bottom incline in oriented approximately perpendicular to the strikeface), the inflection angle would impede energy transfer and prevent bending at the inflection point.

The rear wall at the inflection point 5186 further comprises a thickness 5160. The thickness 5160 at the inflection point 5186 is measured perpendicularly of the inflection point 5186 from the exterior surface 4903 to the interior surface 5119. The thickness 5160 of the inflection point 5186 can range from 0.040 inch to 0.080 inch. In some embodiments, the thickness 5160 of the inflection point 5186 can range from 0.040 inch to 0.060 inch, or 0.060 inch to 0.080 inch. For example, the thickness 5160 can be 0.040 inch, 0.045 inch, 0.050 inch, 0.055 inch, 0.060 inch, 0.65 inch, 0.065 inch, 0.070 inch, 0.075 inch, or 0.080 inch. In many embodiments, the thickness 5160 of the inflection point 5186 is constant with the thickness 5156 of the rear wall 5123 and the thickness 5158 of the bottom incline 5125. In other embodiments, the thickness 5160 of the inflection point 5186 can be less than the thickness 5156 of the rear wall 5123 and the thickness 5158 of the bottom incline 5125. The thickness 5160 of the inflection point 5186 being consistent with or less than the thickness 5156, 5158 of the rear wall 5123 and the bottom incline 5125 allows for more uniform energy transfer and bending.

The body 4901 of the golf club head 4900 further comprises a minimum distance 5116, and a maximum distance 5118. The minimum distance 5116 of the body 4901 is measured as the perpendicular distance from the exterior surface 4903 of the strikeface 4912 in the upper region 4911 to the exterior surface 4903 of the rear wall 5123. The minimum distance 5116 can range from 0.20 inch to 0.44 inch. In some embodiments, the minimum distance 5116 can range from 0.20 inch to 0.30 inch, or 0.30 inch to 0.44 inch For example, the minimum distance 5116 can be 0.20 inch, 0.22 inch, 0.24 inch, 0.26 inch, 0.28 inch, 0.30 inch, 0.32 inch, 0.34 inch, 0.36 inch, 0.38 inch, 0.40 inch, 0.42 inch, or 0.44 inch. The maximum distance 5118 of the body 4901 is measured as the perpendicular distance from the exterior surface 4903 of the strikeface 4912 in the lower region 4913 to the exterior surface 4903 of the third reference point 5120. The maximum distance 5118 can range from 0.60 inch to 1.0 inch. In some embodiments, the maximum distance 5118 can range from 0.60 inch to 0.80 inch, or 0.80 inch to 1.0 inch. For example, the maximum distance 5118 can be 0.60 inch, 0.64 inch, 0.68 inch, 0.72 inch, 0.76 inch, 0.80 inch, 0.84 inch, 0.88 inch, 0.90 inch, 0.92 inch, 0.94 inch, 0.96 inch, or 1.0 inch.

The body 4901 of the golf club head 4900 further comprises an internal cavity distance 5114 as illustrated in FIG. 53. The internal cavity distance 5114 is measured as the perpendicular distance from the exterior surface 4903 of the strikeface 4912 in the lower region 4913 to the interior surface 5119 of the rear wall 5123. The internal cavity distance 5114 can range from 0.40 inch to 0.80 inch. In some embodiments, the internal cavity distance 5114 can range from 0.40 inch to 0.60 inch, or 0.60 inch to 0.80 inch. For example, the internal cavity distance 5114 can be 0.40 inch, 0.44 inch, 0.48 inch, 0.52 inch, 0.56 inch, 0.60 inch, 0.64 inch, 0.68 inch, 0.72 inch, 0.76 inch, or 0.80 inch.

As illustrated in FIGS. 49-52, the golf club head 4900 can be a hollow, or at least partially hollow body comprising an internal cavity 4916. Internal cavity 4916 of the body 4901 comprises a volume. The volume of the internal cavity 4916 can range from 1.20 $inch^3$ (19.66 $cm^3$) to 2.0 $inch^3$ (32.77 $cm^3$). In some embodiments, the internal cavity 4916 can range from 1.20 $inch^3$ (19.66 $cm^3$) to 1.6 $inch^3$ (26.22 $cm^3$), or 1.6 $inch^3$ (26.22 $cm^3$) to 2.0 $inch^3$ (32.77 $cm^3$). For example, the internal cavity 4916 can comprise a volume of 1.20 $inch^3$ (19.66 $cm^3$), 1.30 $inch^3$ (21.30 $cm^3$), 1.40 $inch^3$ (22.94 $cm^3$), 1.50 $inch^3$ (24.58 $cm^3$), 1.60 $inch^3$ (26.22 $cm^3$), 1.70 $inch^3$ (27.86 $cm^3$), 1.80 $inch^3$ (29.50 $cm^3$), 1.90 $inch^3$ (31.14 $cm^3$), or 2.0 $inch^3$ (32.77 $cm^3$). Similarly, the solid portion of the body 4900, void of the cavity 4916, further comprises a material volume. The material volume of the body can range from 3.0 $inch^3$ (49.16 $cm^3$) to 4.0 $inch^3$ (65.55 $cm^3$). In some embodiments, the material volume of the body can range from 3.0 $inch^3$ (49.16 $cm^3$) to 3.5 $inch^3$ (57.35 $cm^3$), or 3.5 $inch^3$ (57.35 $cm^3$) to 4.0 $inch^3$ (65.55 $cm^3$). For example, the material volume of the body can be 3.0 $inch^3$ (40.97 $cm^3$), 3.10 $inch^3$ (50.80 $cm^3$), 3.20 $inch^3$ (52.44 $cm^3$), 3.30 $inch^3$ (54.08 $cm^3$), 3.40 $inch^3$ (55.72 $cm^3$), 3.50 $inch^3$ (57.35 $cm^3$), 3.60 $inch^3$ (58.99 $cm^3$), 3.70 $inch^3$ (60.63 $cm^3$), 3.80 $inch^3$ (62.27 $cm^3$), 3.90 $inch^3$ (63.91 $cm^3$), or 4.0 $inch^3$ (65.55 $cm^3$).

In many embodiments, the internal cavity 4916 of the body 4900 can be void of any substance. In other embodiments, the internal cavity 4916 of the body 4900 can comprise a polymer (not pictured), wherein the polymer can at least partially fill the internal cavity 4916. The polymer can be polyethylene terephthalate, high-density polyethylene, polyvinyl chloride, polycarbonate, polypropylene, other thermoplastics, composites polymers or any combination thereof. The polymer can fill 10% to 80%, 10% to 25%, 15% to 30%, 30% to 45%, 45% to 60%, 60% to 75%, 75% to 80%, 10% to 40%, 30% to 60%, or 40% to 80% of the internal cavity of the body. For example, the polymer can fill 10%, 15%, 20%, 25%, 30%, 35%, 40%, 45%, 50%, 55%, 60%, 65%, 70%, 75%, 80%, or 85% of the internal cavity of the body. In some embodiments, the polymer fills 80% of the internal cavity 4916 of the body 4901.

The polymer to at least partially fill the internal cavity 4916 of the body 4901 comprises a specific gravity ranging from 0.05 to 4. In some embodiments, the specific gravity ranges from 0.05 to 0.10, 0.10 to 0.50, 0.50 to 1.0, 1.0 to 2.0, or 2.0 to 4.0. For example, the specific gravity of the polymer can be 0.50, 1.0, 1.5, 2.0, 2.5, 3.0, 3.5, or 4.0. In some embodiments, the specific gravity of the polymer is proportional to the mass of the polymer, wherein 1 specific gravity of the polymer is equal to 1 gram. Similarly, in those exemplary embodiments, the volume is proportional to the polymer specific gravity, wherein 1 specific gravity of the polymer is equal to 1 cc. In other embodiments, the volume is not proportional to the specific gravity of the polymer. For example, the ratio of the polymer specific gravity to the polymer volume can be 2:1 cc, 2:3 cc, 2:4 cc, 3:1 cc, 3:2 cc, 3:4 cc, 4:1 cc, 4:2 cc, or 4:3 cc.

Figure 54:
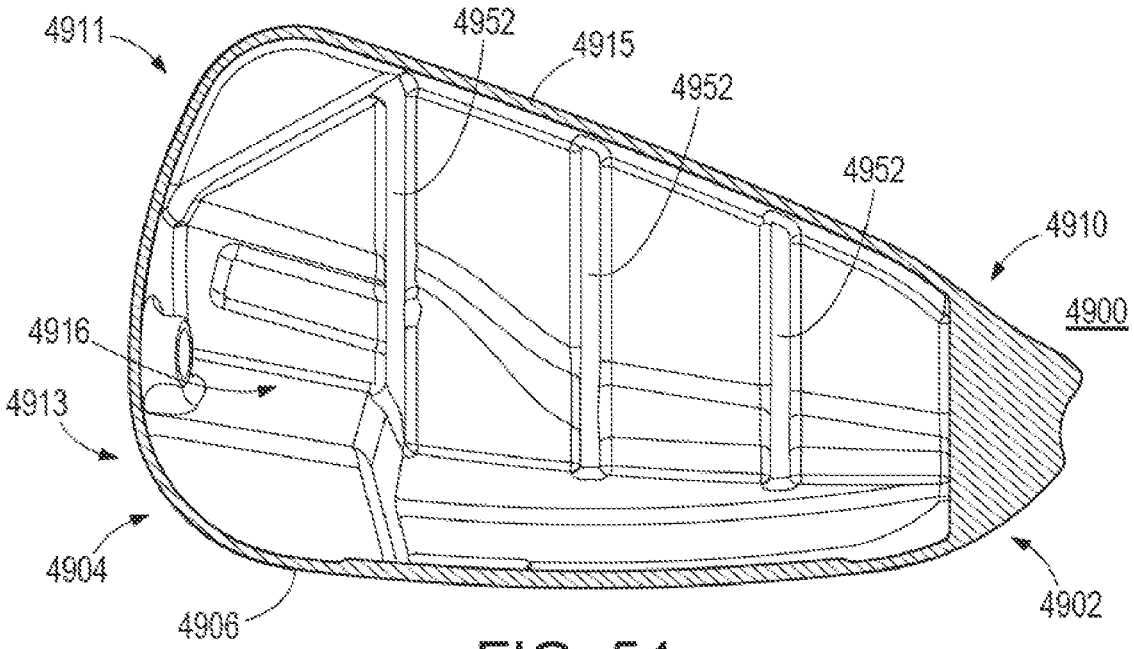
FIG. 54 depicts an interior view of a portion of the golf club head of FIG. 49.
Figure 55:
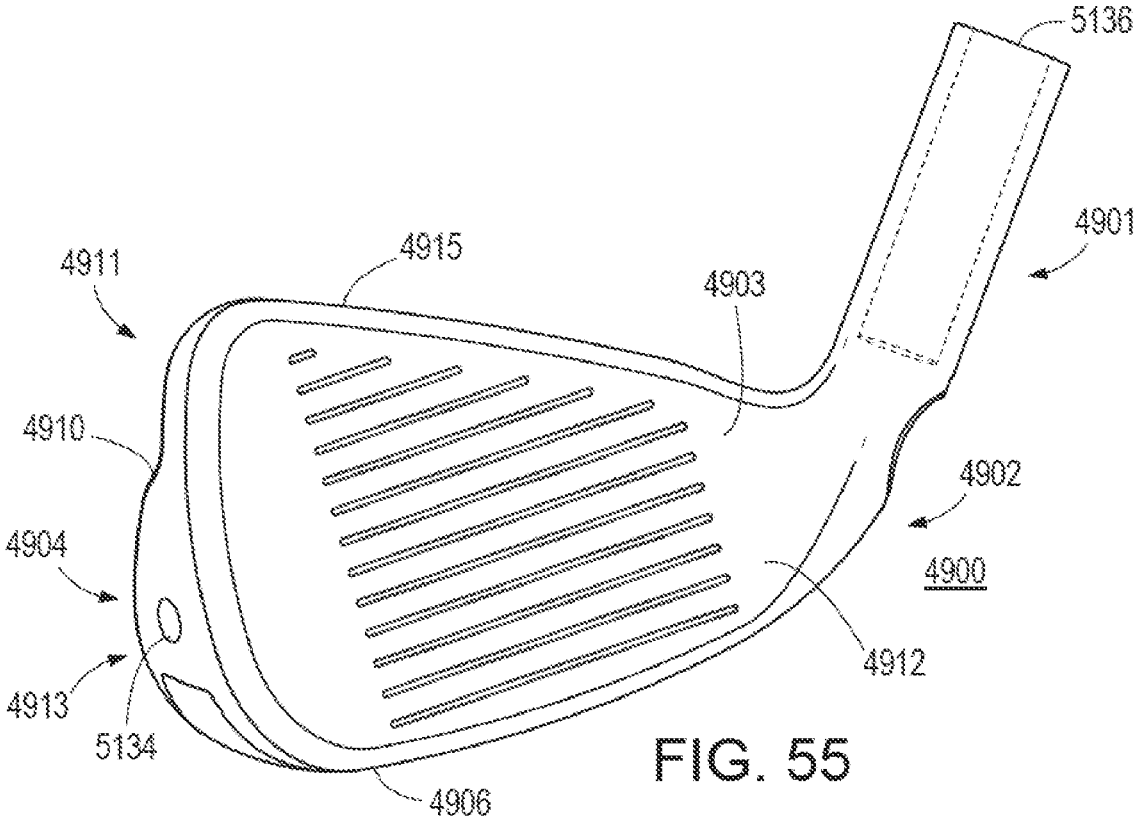
FIG. 55 depicts a front perspective view of the golf club head of FIG. 49.

In some embodiments, as illustrated in FIG. 54, the golf club head 4900 can further comprise a first aperture 5134 located on the toe region 4904 and a second aperture 5136 located in a hosel of the golf club head 4900. The first aperture 5134 is configured to receive a toe weight (not pictured), wherein the toe weight can range from 2 grams to 7 grams. In some embodiments, the toe weight can range from 2 grams to 5 grams, or 5 grams to 7 grams. For example, the toe weight can be 2 grams, 3 grams, 4 grams, 5 grams, 6 grams, or 7 grams. The second aperture 5136 is configured to receive a tip weight (not pictured), wherein the tip weight can range from 2 grams to 7 grams. In some embodiments, the tip weight can range from 2 grams to 5 grams, or 5 grams to 7 grams. For example, the tip weight can be 2 grams, 3 grams, 4 grams, 5 grams, 6 grams, or 7 grams. In many embodiments, the first aperture 5134 and the second aperture 5136 can further be configured to receive the polymer. The first aperture 5134 can receive 1 gram to 9 grams of polymer (e.g., 1 gram, 2 grams, 3 grams, 4 grams, 5 grams, 6 grams, 7 grams, 8 grams, or 9 grams). Similarly, the second aperture 5136 can receive 1 gram to 9 grams of polymer (e.g., 1 gram, 2 grams, 3 grams, 4 grams, 5 grams, 6 grams, 7 grams, 8 grams, or 9 grams). The toe and tip weight, and the polymer housed within the first aperture 5134 and the second aperture 5136 can affect the swing weight to optimize CG and MOI.

The internal cavity 4916 of the body 4901 further comprises interior surface 5119. In some embodiments, the interior surface 5119 of the rear 4910 is a planar and smooth surface. In other embodiments as illustrated in FIG. 52, the interior surface 5119 of the internal cavity 4916 of the rear 4910 comprises a plurality of ribs 4952. The plurality of ribs 4952 extend in a direction from top rail 4915 toward the sole 4906. The plurality of ribs 4952 can be located anywhere on interior surface 5119 of the rear 4910. In some examples, the plurality of ribs 4952 can be positioned onto a portion of interior surface 5119 of the lower exterior wall 5127. In other examples, the plurality of ribs 4952 can be positioned on a portion of the interior surface 5119 of the rear wall 5123. In some embodiments, the plurality of ribs 4952 can be positioned on a portion of the interior surface 5119 of the rear 4910 and can extend into another portion of the rear 4910. For example, the plurality of ribs 4952 are positioned on a portion of the interior surface 5119 of the rear wall 5123 and can extend up to at least a portion of the bottom incline 5125, or at least a portion of the lower exterior wall 5127. The plurality of ribs 4952 can comprise between one to eight ribs. For example, the plurality of ribs 4952 can comprise one rib, two ribs, three ribs, four ribs, five ribs, six ribs, seven ribs, or eight ribs. In embodiments having one or more plurality of ribs 4952, the plurality of ribs 4952 can be spaced equidistance from each other or more concentrated near the heel region 4902, toe region 4904, top rail 4915, or sole 4906. The plurality of ribs 4952 and the location of the plurality of ribs 4952 can help optimize the frequency and amplitude of sound response.

In some embodiments, body 4901 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 4901 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 4912 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 4912 can comprise carpenter grade 455 steel, carpenter grade 475 steel, C300 steel, C350 steel, a Ni—Co—Cr steel alloy, a quench and tempered steel alloy, or 565 steel. In some embodiments, the body 4901 can comprise the same material as the strikeface 4912. In some embodiments, the body 4901 can comprise a different material than the strikeface 4912.

Figure 56:
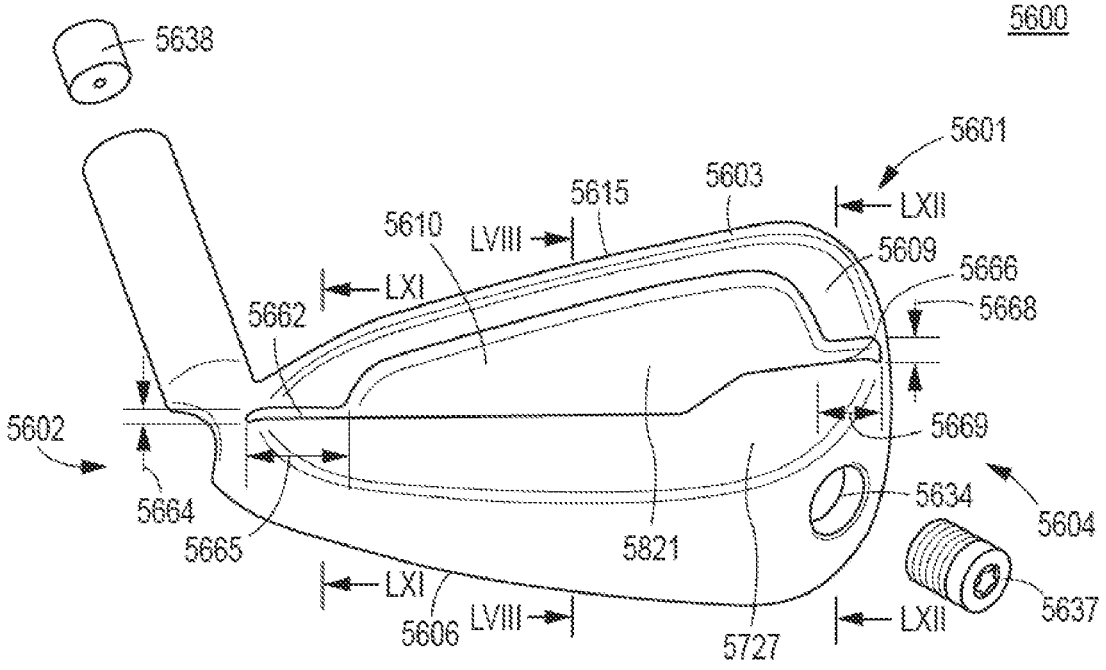
FIG. 56 depicts a back perspective view of a golf club head according to still yet another embodiment.
Figure 57:
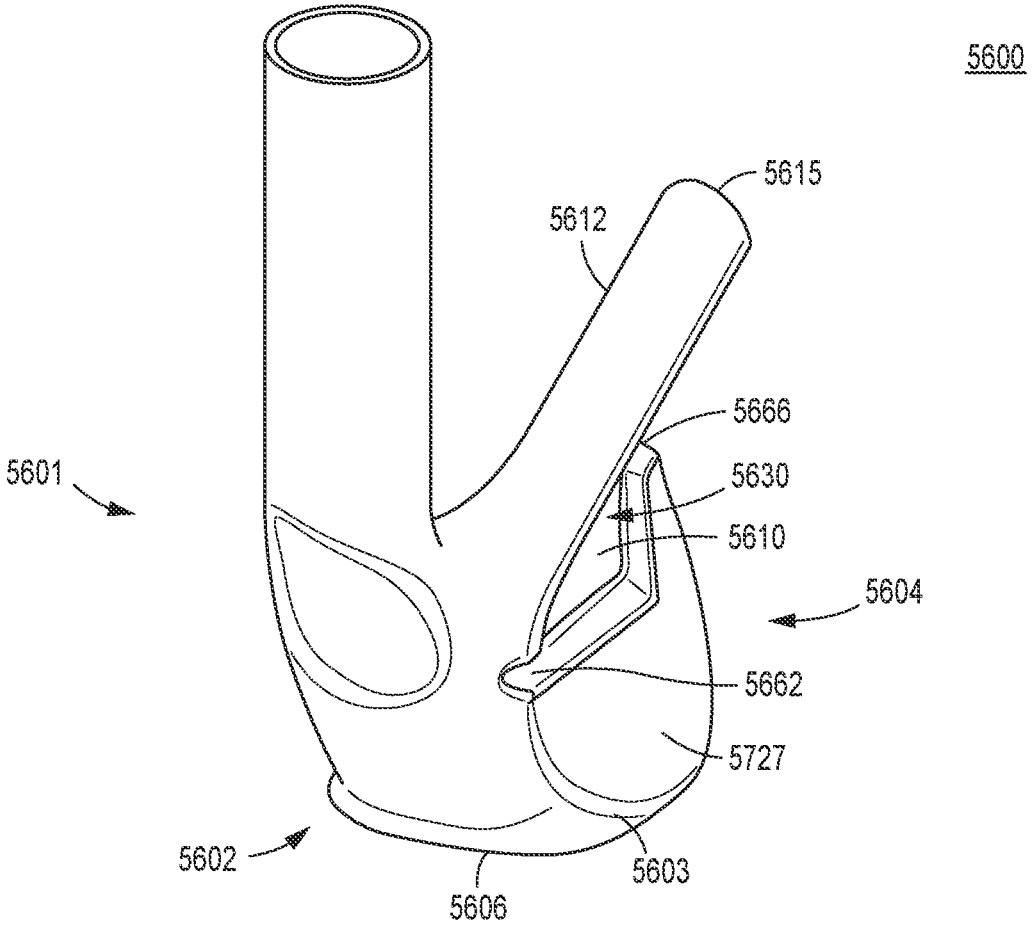
FIG. 57 depicts a back, heel-side perspective view of the golf club head according to the embodiment of FIG. 56.

FIG. 56 illustrates a back perspective view of an embodiment of golf club head 5600 and FIG. 57 illustrates a back heel-side perspective view of golf club head 5600 according to the embodiment of FIG. 56. In some embodiments, golf club head 5600 can be similar to golf club head 1000 (FIG. 10), golf club head 2200 (FIG. 22), golf club head 2700 (FIG. 27), golf club head 3200 (FIG. 32), golf club head 3700 (FIG. 37), and/or golf club head 4400 (FIG. 44). Golf club head 5600 can be an iron-type golf club head.

Golf club head 5600 comprises a body 5601. In some embodiments, body 5601 can be similar to body 1001 (FIG. 10), body 2201 (FIG. 22), body 2701 (FIG. 27), body 3201 (FIG. 32), body 3701 (FIG. 37), and/or body 4401 (FIG. 44). The body 5601 comprises an exterior surface 5603, a strikeface 5612, a heel region 5602, a toe region 5604 opposite the heel region 5602, a sole 5606, a top rail 5615, and a rear 5610. The strikeface 5612, sole 5606, top rail 5615, and rear 5610 of the body 5601 together form an internal cavity 5616. Furthermore, the golf club head 5600 can be divided into an upper region 5611 and a lower region 5613 (see FIG. 58).

The rear 5610 of the golf club head 5600 can comprise an indention 5630 that alters the deflection and/or weighting of the club head. The rear 5610 of the golf club head can further comprise a ledge 5825 or step wall below the indention 5630. The rear 5610 further comprises an upper perimeter portion 5609, which extends along the top rail 5615 and wraps down the sides of the toe region 5604 and heel region 5602. A toe slit 5666 and a heel slit 5662 are each positioned between a part of the upper perimeter portion 5609 and a lower exterior wall 5727 of a lower region 5613 of the club head 5600, allowing structural bending between upper and lower halves of the club head 5600. This bending allowed by the toe slit 5666 and heel slit 5662 results in greater deflection of the strikeface 5612 over a club head without these slits. The club head 5600 can further comprise a vibration damping layer 5878 on an interior surface 5819 of the strikeface 5612. In some embodiments, the internal cavity 5616 can be filled or partially filled with a polymer material.

Body 5601 of FIGS. 56-62 comprises a blade length. The blade length for body 5601 can be measured similar to blade length 3725 as shown and described in FIG. 43 (i.e., a measurement parallel to the flat surface of the strikeface 3712, from a toe edge 3726 of the strikeface 3712, to strikeface end 3727 before the strikeface 3712 integrally curves into the hosel). The blade length of the body 5601 can range from 2.50 inches (6.35 cm) to 2.90 inches (7.37 cm). For example, in some embodiments, the body 3701 can comprise a blade length of 2.50 inch (6.35 cm), 2.54 inch (6.45 cm), 2.58 inch (6.55 cm), 2.62 inch (6.65 cm), 2.66 inch (6.76 cm), 2.70 inch (6.86 cm), 2.74 inch (6.96 cm), 2.78 inch (7.06 cm), 2.82 inch (7.16 cm), 2.86 inch (7.264 cm), or 2.90 inch (7.37 cm).

Figure 60:
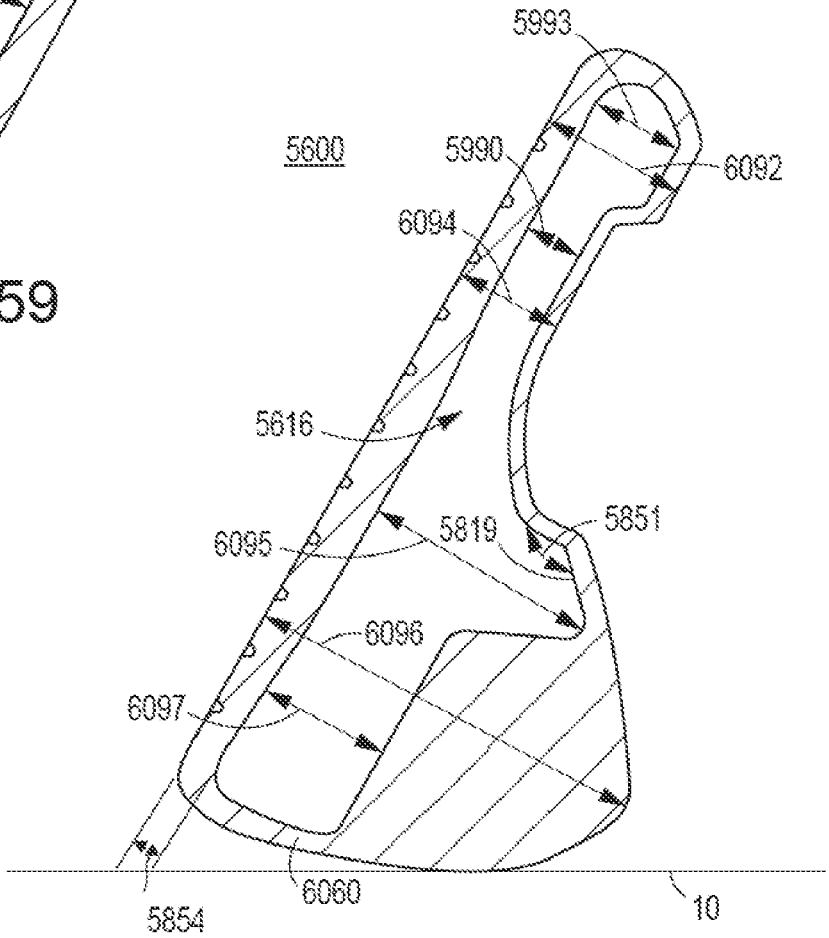
FIG. 60 depicts a simplified cross-sectional view of the golf club head of FIG. 56, similar to the detailed cross-sectional view of the golf club head in FIG. 59.
Figure 61:
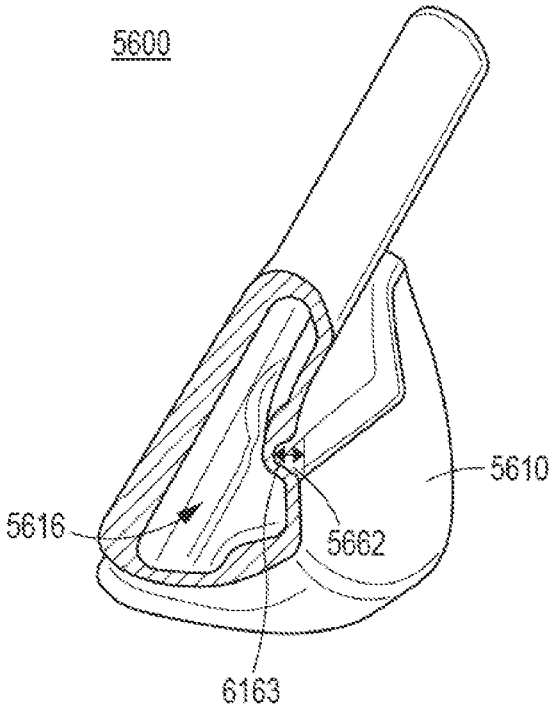
FIG. 61 depicts a rear, close-up view of the toe portion of the golf club head of FIG. 56, along the cross-sectional line LXI-LXI.
Figure 62:
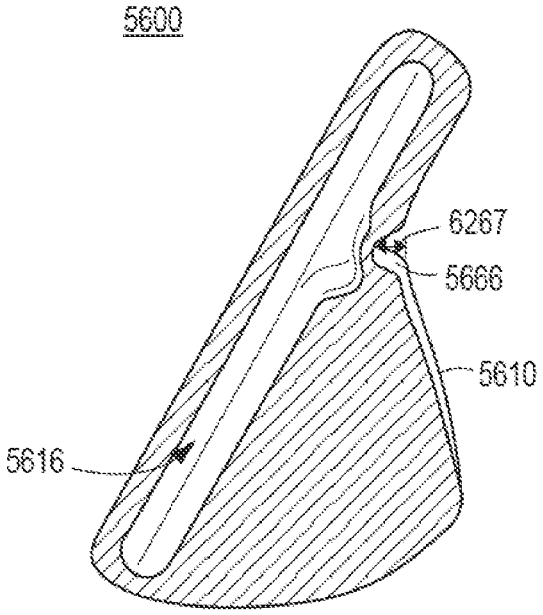
FIG. 62 depicts an front view of the golf club head of FIG. 56, along the cross sectional line LXII-LXII.

The sole can comprise a cascading sole portion of the sole, as described in greater detail below. As shown in FIG. 60, a deflection feature of the golf club head 5600 can be a uniform thinned region 6060, located at the sole 5606 and stretching between the rear 5610 of the body 5601 and the strikeface 5612, toward the cascading sole portion of the sole. In the illustrated embodiment, the uniform thinned region 6060 comprises a sole thickness measured perpendicular from the exterior surface 5603 to an interior surface 5819 at the uniform thinned region 6060, which can remain constant from the bottom of the strikeface 5612 to adjacent the cascading sole portion of the sole. In some embodiments, the sole thickness of the uniform thinned region 6060 can be thinner than a conventional sole. For example, in some embodiments, the sole thickness of the uniform thinned region 6060 may range from approximately 0.040 inch to 0.080 inch. In other embodiments, the sole thickness of the uniform thinned region 6060 may be within the range of 0.040 inch to 0.050 inch, 0.050 inch to 0.060 inch, 0.060 inch to 0.070 inch, 0.070 inch to 0.080 inch, 0.040 inch to 0.055 inch, 0.045 inch to 0.060 inch, 0.050 inch to 0.065 inch, 0.055 inch to 0.070 inch, 0.060 inch to 0.075 inch, or 0.065 inch to 0.080 inch. For example, the sole thickness of the uniformed thinned region 4860 can be 0.040 inch, 0.045 inch, 0.050 inch, 0.060 inch, 0.065 inch, 0.070 inch, 0.075 inch, or 0.080 inch.

Figure 58:
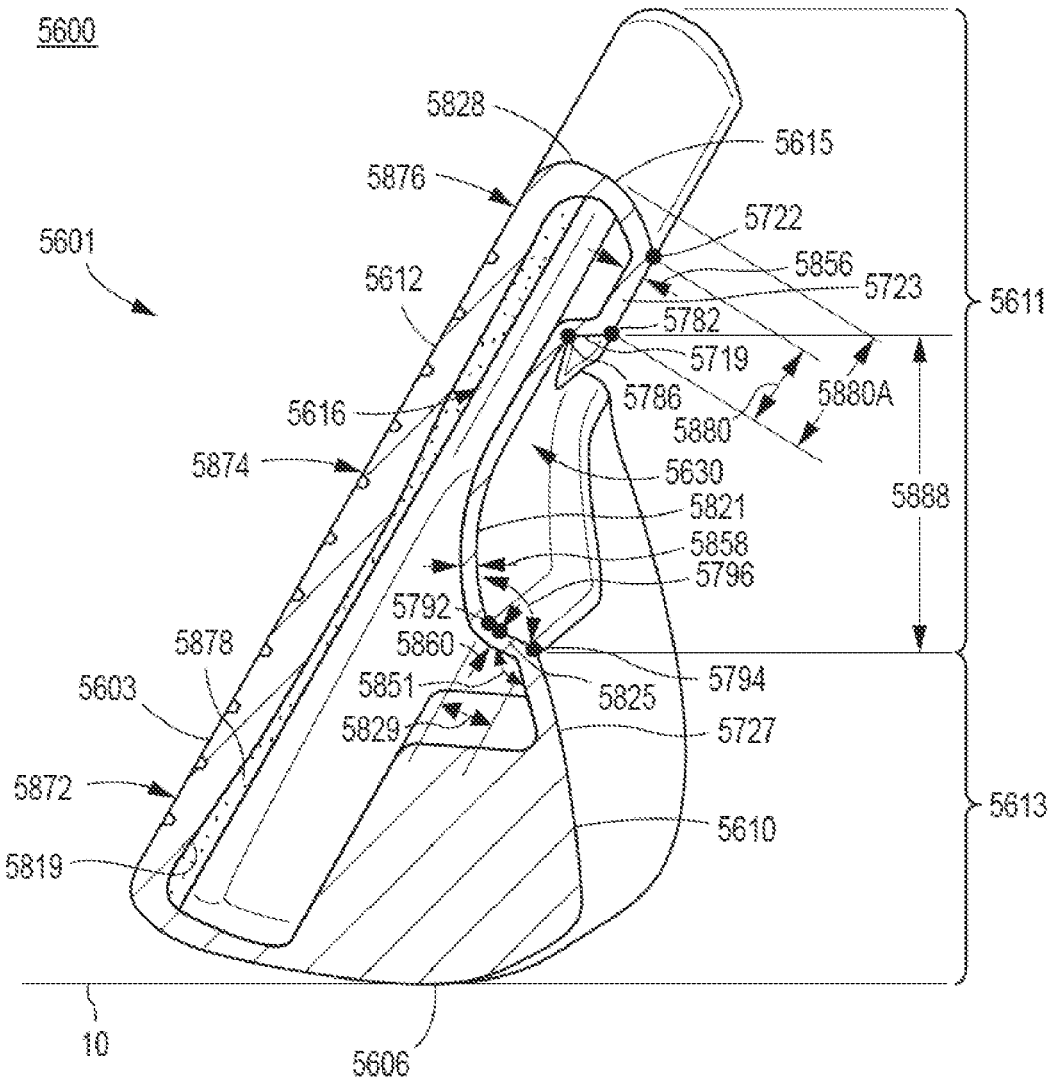
FIG. 58 depicts a cross-sectional view of the golf club head of FIG. 56 along the cross-sectional line LVIII-LVIII of FIG. 56.

FIG. 58 illustrates a cross-section of golf club head 5600 along the cross-sectional line LVIII-LVIII in FIG. 56, according to one embodiment. As seen in FIG. 58, strikeface 5612 comprises a high region 5876, a middle region 5874, and a low region 5872.

The strikeface 5612 of the body 5601 further comprises a thickness 5854 measured perpendicularly to the strikeface 5612 from the exterior surface 5603 to an interior surface 5819. The thickness 5854 of the strikeface 5612 can range from 0.040 inch to 0.100 inch. For example, the thickness 5854 of the strikeface 4412 can be 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. In some embodiments, thickness 5854 of the strikeface 5612 can vary from the heel region 5602 to the toe region 5604, and/or from the top rail 5615 to the sole 5606. For example, the thickness 5854 of the strikeface 5612 can be greatest at the central portion near the middle region 5874 of the strikeface 5612, and taper along the periphery near the high region 5876 and the low region 5872 of strikeface 5612. In many embodiments, the center of the strikeface 5612 can have a thickness 5854 of 0.090 inch and the periphery of the strikeface 5612 can have a thickness 5854 of 0.070 inch. In other examples, the thickness 5854 can increase, decrease, or any variation thereof starting at the central region near the middle region 5874 of the strikeface 5612 and extending toward the periphery near the high region 5876 and the low region 5872.

The upper region 5611 of rear 5610 comprises the upper perimeter portion 5609, the indention 5630, and the ledge 5825. The upper perimeter portion comprises the top rail of the club head and wraps down around a length of the toe and heel regions of the club head. The upper perimeter portion 5609 extends along a top edge of the golf club head 5600 from the heel region 5602 to the toe region 5604. In the toe region 5604 the upper perimeter portion 5609 extends down along a perimeter of the toe region 5604. In some embodiments, the upper perimeter portion 5609 extends roughly halfway down along the perimeter of the toe region 5604. The upper perimeter portion abuts the indention. The upper perimeter portion 5609 of the rear 5610 can provide perimeter weighting for the club head 5600. In addition, the upper perimeter portion 5609 allows stresses in the top rail 5615 to be dissipated into the rear 5610 of the club head 5600.

The indention 5630 is located on the exterior surface 5603, below the upper perimeter portion and above the lower region 5613 of the club head 5600. The indention 5630 of the rear 5610 extends inwards towards the strikeface of the golf club head 5600. The indention 5630 is located in the upper portion 5611 of the club head 5600. In some embodiments, the indention 5630 is located primarily in an upper half of the golf club head 5600. The indention 5630 is bounded on its top, toe, and heel sides by the upper perimeter portion 5609. The indention 5630 is bounded on its bottom side by the ledge 5825.

The ledge 5825 extends in a direction generally from the heel region 5602 towards the toe region 5604. The ledge 5825 helps form a lower boundary of the indention 5630. The ledge 5825 can be located at various heights above the ground plane 10 when the club head 5600 is at address position. The ledge 5825 can comprise multiple segments, wherein each segment is located at a different height above the ground plane 10, as shown in the rear view of FIG. 56. For example, the ledge 5825 can comprise a segment located in the toe region 5604 that is higher from the ground plane 10 than a segment located, at least partially, in the heel region 5602.

The ledge 5825 of the rear 5610 of the club head 5600 can be positioned in a plane roughly perpendicular to the strikeface 5612 plane. The ledge 5825 runs the length of the club head 5600 from the heel region 5602 to the toe region 5604. The ledge 5825 can also be thought of as a ledge or groove. At the heel end the ledge 5825 can blend into the heel slit 5662. At the toe end, the ledge 5825 can blend into the toe slit 5666.

The ledge 5825 can be angled with respect to the ground plane 10 at a ledge angle (not illustrated). In some embodiments, the ledge angle, measured from the ledge 5825 to ground plane 10, can range from 15 degrees to 45 degrees. In some embodiments, the ledge angle can be 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, 37 degrees, 38 degrees, 39 degrees, 40 degrees, 41 degrees, 42 degrees, 43 degrees, 44 degrees, or 45 degrees.

The toe and heel slits 5666, 5662 are positioned on the rear 5610 of the club head 5600 roughly half way upward from the ground plane 10 towards the top rail 5615. The toe and heel slits 5666, 5662 span short lengths across the toe and heel regions 5604, 5604 of the club head 5600, respectively. The toe and heel slits 5666, 5662 extend from either end of the ledge 5825. The toe slit 5666 is positioned in the toe region 5604 between the upper perimeter portion 5609 and the lower region 5613 of the club head 5600. The heel slit 5662 is positioned in the heel region 5602 between the upper perimeter portion 5609 next to and adjacent the hosel.

The toe slit 5666 and the heel slit 5662 are oriented in a toe-to-heel direction. The toe slit 5666 can be positioned between approximately half way and approximately ⅔ of the way upwards from the ground plane 10 towards the top rail 5615, measured parallel to the strikeface 5612. The heel slit 5662 can also be positioned between approximately half way up and approximately ⅔ of the way upwards from the ground plane 10 towards the top rail 5615. In some embodiments, the heel slit 5662 is positioned lower with respect to the ground plane 10 than the toe slit 5666. In these embodiments, the upper perimeter portion 5609 extends lower in the heel region 5602 than in the toe region 5604.

The toe slit 5666 has a depth 6267 such that a deepest surface of the slit 5666 blends into the indention 5630. The toe slit depth 6267 can be measured from the outer surface of the upper perimeter portion a lowest point inside the toe slit. The toe slit depth 6267 can range between 0.05 inch and 0.20 inch. For example, the toe slit depth 6267 can range between 0.05 inch and 0.15 inch, or 0.15 inch and 0.20 inch. A toe slit height 5668 can be measured in a direction generally orthogonal to the ground plane from the intersection of the upper perimeter portion 5609 and the toe slit 5666 to the intersection of the ledge 5825 and the toe slit 5666. The toe slit height 5668 can range between 0.10 inch and 0.30 inch. For example, the toe slit height 5668 can range between 0.15 inch and 0.17 inch, 0.10 inch and 0.15 inch, 0.15 inch and 0.20 inch, or 0.20 inch and 0.30 inch. The toe slit 5666 can comprise a length 5669 between the outer edge of the toe region 5604 to the indention 5630 where the toe slit 5666 terminates, as shown in FIG. 56. The toe slit length 5669 can range between 0.318 inch and 0.418 inch. For example, the toe slit length 5669 can be 0.318 inch, 0.320 inch, 0.330 inch, 0.340 inch, 0.350 inch, 0.360 inch, 0.368 inch, 0.370 inch, 0.380 inch, 0.390 inch, 0.400 inch, 0.0410 inch, or 0.418 inch. The dimensions of the toe slit 5666 can affect the deflection of the strikeface 5612, as described below.

The heel slit 5662 is similar in depth and orientation to the toe slit 5666. However, in some embodiments, the angular orientation of the heel slit 5662 with respect to the ground plane differs slightly from the angular orientation of the toe slit 5666. In some embodiments, the heel slit 5662 does not extend to a heel-most point of the club head 5600. A heel slit height 5664 can be measured in a direction generally orthogonal to the ground plane from the intersection of the upper perimeter portion 5609 and the heel slit 5662 to the intersection of the ledge 5825 and the heel slit 5662. The heel slit height 5664 can range between 0.10 inch and 0.30 inch. For example, the heel slit height 5664 can range between 0.13 inch and 0.16 inch, 0.10 inch and 0.15 inch, 0.15 inch and 0.20 inch, or 0.20 inch and 0.30 inch. The heel slit can comprise a length 5665, measured from adjacent an edge of the perimeter portion towards the heel region, as shown in FIG. 56. The heel slit length 5665 can be longer than the toe slit length 5669. In other embodiments, the heel and toe slits are the same length. The heel slit length 5665 can range between 0.325 inch and 0.425 inch. For example, the heel slit length 5665 can be 0.325 inch, 0.330 inch, 0.335 inch, 0.340 inch, 0.345 inch, 0.350 inch, 0.355 inch, 0.360 inch, 0.365 inch, 0.370 inch, 0.375 inch, 0.380 inch, 0.385 inch, 0.390 inch, 0.395 inch, 0.400 inch, 0.405 inch, 0.410 inch, 0.415 inch, 0.420 inch, or 0.425 inch. The dimensions of the heel slit 5662 can affect the deflection of the strikeface 5612, as described below.

In the lower region 5613 of the club head 5600, the body 5601 extends a greater perpendicular distance from the strikeface 5612 than the upper perimeter portion 5609 or the indention 5630. The lower region 5613 comprises, in part, a solid region adjacent the sole 5606 and the rear 5610 of the club head 5600. The solid region provides perimeter weighting to the club head 5600. The solid region is bounded by the sole 5606 and a lower exterior wall 5727. A front edge of the solid region defines a part of the internal wall of the internal cavity 5616.

The cross-section of golf club head 5600 in FIG. 58 further illustrates the rear 5610. The rear 5610 can be divided and understood with respect to the upper region 5611 and the lower region 5613 of the club head 5600. The upper region 6511 of the rear comprises the upper perimeter portion 5609 and the indention 5630, including the ledge 5825. As illustrated in FIG. 58, the upper perimeter portion 5609 comprises the top rail 5615, a rear wall 5723, and a top wall 5719. The indention 5630 is formed by the top wall 5719 of the upper perimeter portion, an indention wall 5821, and a ledge 5825.

As seen in FIG. 58, from a cross-sectional view, the upper region 5611 of rear 5610 comprises the top rail 5615, the rear wall 5723, the top wall 5719, the indention wall 5821, and the ledge 5825. The rear wall 5723 of rear 5610 is located below and adjacent to the top rail 5615. The top wall 5719 of rear 5610 is located below and adjacent to the rear wall 5723. The indention wall 5821 is located below and adjacent to the top wall 5719. The ledge 5825 is located below and adjacent to the indention wall 5821. In short, the top wall 5719 and the ledge 5825 are angled towards the strikeface and connect to the indention wall 5821, to form the indention 5630. The upper region 5611 further comprises a first reference point 5722 located between top rail 5615 and rear wall 5723, a second reference point 5782 located between rear wall 5723 and top wall 5719, a first inflection point 5786 located between top wall 5719 and the indention wall 5821, a second inflection point 5792 located between the indention wall 5821 and the ledge 5825, and a third inflection point 5794 located between the ledge 5825 and the lower region 5613.

In some embodiments, top rail 5615 of the upper perimeter portion can be a flatter and taller top rail or skirt than in irons known to one skilled in the art. The flatter and taller rail can compensate for mishits of strikeface 5612 to increase playability off the tee. In some embodiments, the length of top rail 5615, measured from heel region 5602 to toe region 5604, can be 70% to 95% of the length of golf club head 5600. In many embodiments, indention 5630 comprises a top rail box spring design. For some fairway iron-type golf club head embodiments, indention 5630 can be a reverse scoop or indentation of rear 5610 with body 5601 comprising a greater thickness toward sole 5606. In many embodiments, the top rail of the upper perimeter portion and the indention 5630 provide an increase in the overall bending of strikeface 5612. In some embodiments, the bending of strikeface 5612 can allow for a 2% to 5% increase of energy. The indention 5630 allows for strikeface 5612 to be thinner and allow additional overall bending.

The top rail 5615 of the upper perimeter portion comprises a thickness 6052. The thickness 6052 of the top rail 5615 can range from 0.040 inch to 0.080 inch. For example, the thickness 6052 of the top rail 5615 can be 0.040 inch, 0.043 inch, 0.046 inch, 0.049 inch, 0.051 inch, 0.054 inch, 0.057 inch, 0.060 inch, 0.063 inch, 0.066 inch, 0.069 inch, 0.071 inch, 0.074 inch, 0.077 inch, or 0.080 inch. In many embodiments, the thickness 6052 of the top rail 5615 is constant throughout. In other embodiments, the thickness 6052 of the top rail 5615 can vary. In the exemplary embodiment, the thickness 6052 of the top rail 5615 decreases from the strikeface 5612 toward the rear wall 5823. In many embodiments due to the thickness 6052 of the top rail, top rail 5615 can provide an increase in the overall bending of strikeface 5612.

Figure 59:
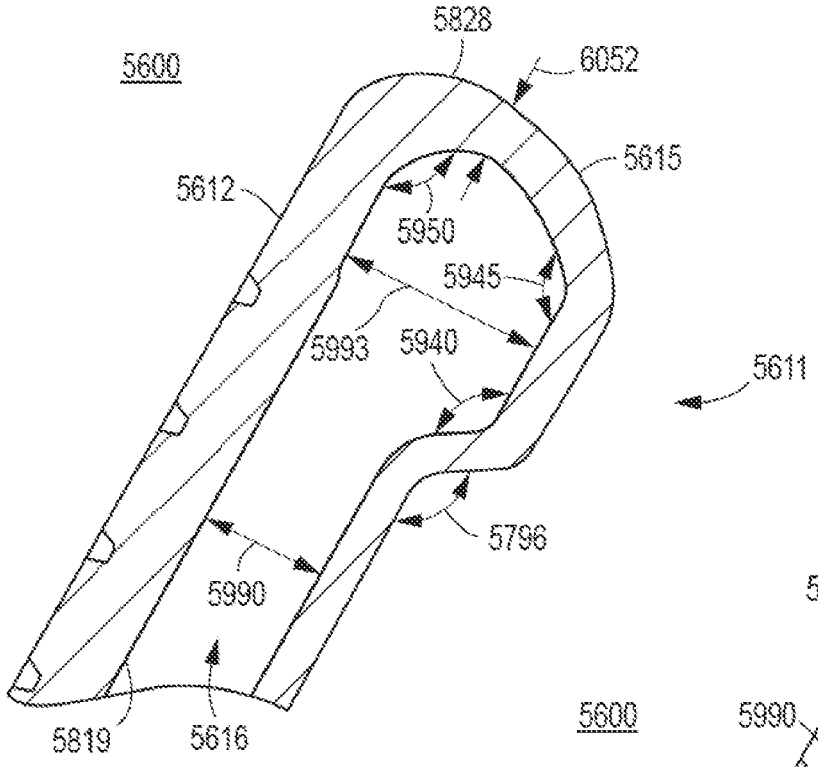
FIG. 59 depicts a portion of the golf club head of FIG. 58.

FIG. 59 illustrates a view of top rail 5615 and a portion of rear 5610 of the cross-section of golf club head 5600 of FIG. 56, along a cross-sectional line LVIII-LVIII in FIG. 56 that is similar to the cross-section of FIG. 58. In many embodiments, golf club head 5600 comprises a rear angle 5940, a top rail angle 5945, and a strikeface angle 5950. Rear angle 5940 is measured from top wall 5819 to rear wall 5823 of upper region 5611. In many embodiments, rear angle 5940 can range from 70 degrees to 140 degrees. In some embodiments, rear angle 5940 can be 70 degrees, 75 degrees, 80 degrees, 85 degrees, 90 degrees, 100 degrees, 105 degrees, 110 degrees, 115 degrees, 120 degrees, 125 degrees, 130 degrees, 135 degrees, or 140 degrees. In some embodiments, the rear angle 5940 is approximately 122 degrees.

The strikeface 5612 further comprises a strikeface angle 5950. Strikeface angle 5950 is measured from the strikeface 5612 to the top rail 5615, wherein the strikeface angle 5950 can range from 70 degrees to 160 degrees or 70 degrees to 110 degrees. In some embodiments, strikeface angle 5950 can be 70 degrees, 75 degrees, 80 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees. In some embodiments, the strikeface angle 5950 is approximately 90 degrees.

FIG. 59 further illustrates the top rail 5615 comprising a top rail angle 5945. The top rail angle 5945 is measured from rear wall 5823 to the top rail 5615. In many embodiments, the top rail angle 5945 can range from 70 degrees to 160 degrees or 90 degrees to 110 degrees. In some embodiments, top rail angle 5945 can be 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, or 160 degrees. In some embodiments, the top rail angle 5945 is approximately 131 degrees.

The rear wall 5723 extends from the first reference point 5722 to the second reference point in an orientation roughly parallel to the strikeface. The rear wall 5723 connects the top rail and the top wall 5719. The rear wall 5823 of the upper region 5611 comprises a height 5880. The height 5880 of the rear wall 5823 is measured from the first reference point 5722 to the second reference point 5782. The height 5880 of the rear wall 5823 can range from 0.055 inch to 0.060 inch, 0.060 inch to 0.070 inch, 0.070 inch to 0.080 inch, 0.080 in to 0.085 or 0.55 inch to 0.85 inch. For example, the height 4680 of the rear wall 4623 can be 0.55 inch, 0.58 inch, 0.61 inch, 0.64 inch, 0.67 inch, 0.70 inch, 0.73 inch, 0.76 inch, 0.79 inch, 0.82 inch, or 0.85 inch. In some embodiments, the height 5880 of the rear wall 4623 range from 35% to 60%, 35% to 45%, 45% to 68%, 40% to 55%, 30% to 40%, 35% to 45%, 40% to 50%, 45% to 55%, or 50% to 60% of the total height of the golf club head 5600. For example, the height 5880 of the rear wall 5823 can be 35%, 38%, 41%, 44%, 47%, 50%, 53%, 56%, or 60% of the total height of the golf club head 5600.

The rear wall 5823 of the upper region 5611 can also comprise a height 5680A. The height 5680A is measured from the apex 5828 of the top rail 5615 to the second reference point 5782. The height 5880A can range from 0.60 inch to 1.0 inch. For example, the height 5880A can be 0.60 inch, 0.61 inch, 0.64 inch, 0.67 inch, 0.70 inch, 0.73 inch, 0.76 inch, 0.79 inch, 0.82 inch, 0.85 inch, 0.90 inch, 0.95 inch, or 1.0 inch. In some embodiments, the height 5880A can range from 40% to 75% of the total height of the golf club head 5600. For example, the height 5880A can be 40%, 44%, 47%, 50%, 53%, 56%, 60%, 65%, 70%, or 75% of the total height of the golf club head 5600.

The rear wall 5823 of the upper region 5611 further comprises a rear wall thickness 5856. The rear wall thickness 5856 is the perpendicular distance of the rear wall 5823 from the outer surface 5603 to the inner surface 5619 of the internal cavity 5630. The rear wall thickness 5856 can range from 0.040 inch to 0.080 inch. For example, the rear wall thickness 5856 can be 0.040 inch, 0.043 inch, 0.046 inch, 0.049 inch, 0.051 inch, 0.054 inch, 0.057 inch, 0.060 inch, 0.063 inch, 0.066 inch, 0.069 inch, 0.071 inch, 0.074 inch, 0.077 inch, or 0.080 inch. In many embodiments, the rear wall thickness 5856 is constant throughout. In other embodiments, the rear wall thickness 5856 5823 can vary. In the exemplary embodiment, the rear wall thickness 5856 is a constant 0.05 inch. The rear wall thickness 5856 allows energy from an impact to transfer to the inflection point 5886 to help induce a buckling effect.

The top wall 5719 is angled toward the strikeface and away from the top rail 5615 in a direction toward the first inflection point 5786. The top wall 5719 extends from the second reference point 5782 to the first inflection point 5786. The described configuration of the rear wall 5723 and top wall 5719 allows increased bending of the top rail 5615 of the club head 5600 on impact with a golf ball, compared with a club head devoid of the described rear and top wall configuration. The top wall 5719 connects to the indention wall 5821 at the first inflection point 5786.

The indention 5630 is formed by the top wall 5719, the indention wall 5821, and the ledge 5825. In some embodiments, the indention wall 5821 can be roughly planar. In some embodiments, the indention wall 5821 can comprise an at least partially curved profile, when viewed from a cross-sectional view, as shown in FIG. 58. An indention wall thickness 5858 is measured perpendicularly from the exterior surface 5603 to the interior surface 5819 at a point along the indention wall 5821 between the first inflection point 5786 and the second inflection point 5792. The indention wall thickness 5858 can range from 0.040 inch, to 0.080 inch. For example, the indention wall thickness 5858 can be 0.040 inch, 0.045 inch, 0.050 inch, 0.055 inch, 0.060 inch, 0.65 inch, 0.065 inch, 0.070 inch, 0.075 inch, or 0.080 inch. In many embodiments, the indention wall thickness 5858 is constant with the rear wall thickness 5856 and a ledge thickness 5860. In other embodiments, the indention wall thickness 5858 can be less than the rear wall thickness 5856 and the ledge thickness 5860. The indention wall thickness 5858 being consistent with or less than the thickness 5823, 5860 of the rear wall 5723 and the ledge 5825 allows for more uniform energy transfer and bending.

As best understood from a rear view, such as FIG. 56, the indention wall 5821 can cover a surface area between 10% and 40% of the surface area of the rear 5610. For example, the indention wall 5821 can cover a surface area between 10% and 20%, 20% and 30%, or 30% and 40% of the surface area of the rear 5610. In some embodiments, the indention wall 5821 can cover a surface area approximately 29% of the surface area of the rear 5610.

A height 5888 of the indention 5630 is measured perpendicular to the ground plane 10 from the second reference point 5782 to the third inflection point 5794. The height 5888 of the indention 5630 can range from 0.15 inch to 1.1 inch. For example, the height 5888 of the indention 5630 can range from 0.15 inch to 0.30 inch, 0.30 inch to 0.45 inch, 0.45 inch to 0.60 inch, 0.60 inch to 0.75 inch, 0.75 inch to 0.90 inch, or 0.90 inch to 1.0 inch. For example, the height 5888 of the indention 5630 can be approximately 0.21 inch in the heel region 5602, approximately 0.63 inch in a center of the club head between the heel region 5602 and the toe region 5604, and approximately 0.98 inch in the toe region 5604. In some embodiments, the maximum height 5888 of the indention is between 0.80 inch and 1.1 inch.

The second inflection point 5792 comprises a second inflection angle measured from the indented wall 5721 to the ledge 5825. The second inflection angle of the second inflection point 5792 can range from at least 95 degrees to 150 degrees. In some embodiments, the second inflection angle 5796 can be at least 95 degrees, 100 degrees, 105 degrees, 110 degrees, 115 degrees, 120 degrees, 125 degrees, 130 degrees, 135 degrees, 140 degrees, 145 degrees, or 150 degrees. In some embodiments, the second inflection angle can be consistent from the heel region 5602 to the toe region 5604. In other embodiments, the second inflection angle 5796 can vary from the heel region 5602 to the toe region 5604. In many embodiments, the second inflection angle 5796 allows for the second inflection point 5686 to act as a buckling point or plastic hinge upon the golf club head 5600 impacting the golf ball at strikeface 5712.

As illustrated in FIG. 58, in some embodiments, the ledge comprises a ledge width 5829. The ledge width 5829 is measured along the ledge 5825 from the second inflection point 5792 to the third inflection point 5794. The ledge width 5829 can range from 0.088 inch to 0.128 inch. For example, the ledge width 5829 can be 0.090, 0.094 inch, 0.098 inch, 0.100 inch, 0.104 inch, 0.108 inch, 0.110 inch, 0.112 inch, 0.114 inch, 0.118 inch, 0.120 inch, 0.124 inch, or 0.128 inch. In some embodiments, the ledge width 5829 can remain constant from the heel region 5602 to the toe region 5604. In other embodiments, the ledge width 5829 can vary from the heel region 5602 to the toe region 5604. For example, the ledge width 5829 can increase from the heel region 5602 to the toe region 5604. In other embodiments, the ledge width 5829 can decrease from the heel region 5602 to the toe region 5602.

The ledge 5825 comprises a ledge thickness measured perpendicularly from the exterior surface 5603 to the interior surface 5819 at a point along the ledge 5825 between the second inflection point 5792 and the third inflection point 5794. The ledge thickness can be similar to the indented wall thickness.

The upper region 5611 and the lower region 5613 of the rear 5610 are separated by the third inflection point 5794. In many embodiments, the third inflection point 5794 is positioned at least 40% down on the body 5601 below the apex 5828. For example, the third inflection point 5694 can be positioned 40%, 42%, 44%, 46%, 48%, 50%, 52%, 54%, 56%, 58%, 60%, 62%, 64%, 66%, 68%, or 70% down on the body 5601 below the apex 5828. The low positioned third inflection point 5794 allows for more leverage on the upper region 5611 to experience increased bending during impact with a ball, compared to a similar golf club head having a higher inflection point position.

The lower region 5613 of the body 5601 begins at the third inflection point 5794 and comprises a lower exterior wall 5827. The lower exterior wall 5827 extends from the first inflection point 5794 to the sole 5606. The lower exterior wall 5827 can be angled with respect to the strikeface. The lower region 5613 comprises a height measured from the ground plane 5703 to the third inflection point 5794 adjacent a lowest end of the ledge 5825. The lower region 5613 height can range between 0.40 inch and 1.20 inch. For example, the lower region 5613 height can range between 0.40 inch and 0.70 inch, 0.60 inch and 0.80 inch, 0.70 inch and 0.90 inch, 0.80 inch and 1.00 inch, 0.90 inch and 1.10 inch, or 1.00 inch and 1.20 inch.

A third inflection angle 5851 is measured between the ledge 5825 and the lower exterior wall 5727, at the third inflection point 5794. In some embodiments, the third inflection angle 5851 can be less than 160 degrees. In a number of embodiments, the third inflection angle 5851 can be 90 degrees to 175 degrees. For example, the third inflection angle 5851 can be 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, 160 degrees, 165 degrees, 170 degrees, or 175 degrees.

The lower exterior wall 5727 is located in the lower region 5613 of the club head 5600. The lower exterior wall 5727 extends downward from the third inflection point 5794 at an edge of the ledge 5825 to the sole of the club head 5600. A section of the lower exterior wall 5727 forms an outer rear edge of the solid region of the lower region 5613. The lower exterior wall 5727 bounds the rear of the club head 5600 below the ledge 5825.

FIG. 60 illustrates another cross-sectional view of the golf club head 5600, similar to the detailed cross-section of golf club head 5600 illustrated in FIG. 56. The internal cavity 5616 comprises a top cavity width 5993, a minimum cavity width (minimum gap) 5990, a maximum cavity width 6095, and a lower region cavity width 6097, all measured in a direction perpendicular from the strikeface 5612 from an interior surface 5819 of the strikeface 5612 to a back edge of the internal cavity 5616. The top cavity width 5993 is located above the minimum upper cavity width 5990. The region of the internal cavity 5616 having the greater top cavity width 5993 corresponds to the upper perimeter portion 5609. The portion of the internal cavity 5616 adjacent the minimum upper cavity width 5990 corresponds to the indention 5630. The top cavity width 5993 is above the minimum cavity width 5990, which is above the maximum cavity width 6095, which is above the lower region cavity width 6097. In some embodiments, the maximum cavity width 5990 is located in the lower region 5613 of the club head 5600. In many embodiments, the lower region 5613 of the body 5601 comprises a solid region adjacent the rear 5610. The solid region provides weighting to the rear 5610 of the club head 5600. This solid region causes the lower region cavity width 6097 to be less than a width of the cavity adjacent and below the indention 5630. The minimum cavity width 5990 can be between 20% and 55% of the lower region cavity width 6097 in a central portion of the club head 5600, such as is shown in the cross-section of FIG. 60. For example, the minimum cavity width 5990 can be 20%, 25%, 30%, 35%, 40%, 45%, or 50% of the lower region cavity width 6097.

The top cavity width 5993 is measured between the rear wall 5723 and a back surface of the strikeface 5612. In some embodiments, top cavity width 5993 can range from 0.079 inch (2 mm) to 0.24 inch (6 mm). For example, top cavity width can be 0.079 inch (2 mm), 0.118 inch (3 mm), 0.16 inch (4 mm), 0.197 inch (5 mm) or 0.24 inch (6 mm). In other embodiments, top cavity width can range from 0.118 inch (3 mm) to 0.16 inch (4 mm). In some embodiments, top cavity width can be 0.135 inch (3.429 mm).

In some embodiments, the minimum cavity width 5990 is located between the first inflection point 5786 and the back surface of the strikeface 5612. In some embodiments, the minimum cavity width 5990 is located between the indention wall 5821 and the back surface of the strikeface 5612. In some embodiments, minimum cavity width 5990 can range from 0.079 inch (2 mm) to 0.24 inch (6 mm). For example, minimum cavity width 5990 can be 0.079 inch (2 mm), 0.118 inch (3 mm), 0.16 inch (4 mm), 0.197 inch (5 mm) or 0.24 inch (6 mm). In other embodiments, minimum cavity width 5990 can range from 0.118 inch (3 mm) to 0.16 inch (4 mm). In some embodiments, minimum cavity width 5990 can be 0.135 inch (3.429 mm).

The maximum cavity width 6095 is located beneath the indention 5630. In some embodiments, maximum cavity width 6095 can range from 0.40 inch to 0.70 inch. For example, the maximum cavity width can be 0.40 inch, 0.45 inch, 0.50 inch, 0.55 inch, 0.60 inch, 0.65 inch, or 0.70 inch. In other embodiments, maximum cavity width 6095 can range from 0.55 inch to 0.60 inch. In some embodiments, maximum cavity width 6095 can be 0.59 inch.

The lower region cavity width 6097 is measured between the solid region and the interior surface 5819 of the strikeface 5612. In some embodiments, lower region cavity width 6097 can range from 0.15 inch to 0.40 inch. For example, the lower region cavity width 6097 can be 0.15 inch, 0.20 inch, 0.25 inch, 0.30 inch, 0.35 inch, or 0.40 inch. In other embodiments, lower region cavity width 6097 can range from 0.27 inch to 0.31 inch. In some embodiments, top cavity width can be 0.29 inch.

Referring again to FIG. 60, the body 5601 of golf club head 5600 further comprises an upper perimeter portion distance 6092, a minimum distance 6094, and a maximum distance 6096. The upper perimeter portion distance 6092 of the club head 5600 adjacent to the top rail 5615 is measured as the perpendicular distance from the exterior surface 5603 of the strikeface 5612 to the exterior surface 5603 of the rear wall 5623. The upper perimeter portion distance 6092 of the club head is between 0.305 inch and 0.325 inch. In some embodiments, the upper perimeter portion distance 6092 of the club head is between 0.305 inch and 0.310 inch, 0.310 inch and 0.315 inch, 0.315 inch and 0.320 inch, or 0.320 inch and 0.325. In some embodiments, the upper perimeter portion distance 6092 of the club head 5600 is greater than the ledge width 5829.

The minimum distance 6094 of the body 5601 is measured as the perpendicular distance from the exterior surface 5603 of the strikeface 5612 in the upper region 5611 to the exterior surface 5603 of the rear wall 5623. The minimum distance 6094 can range from 0.20 inch to 0.40 inch. For example, the minimum distance 6094 can be 0.20 inch, 0.22 inch, 0.24 inch, 0.26 inch, 0.28 inch, 0.30 inch, 0.32 inch, 0.34 inch, 0.36 inch, 0.038 inch, or 0.40 inch. In some embodiments, the minimum distance 6094 of the body 5601 can be greater than the ledge width 5829. The maximum distance 6096 of the body 5601 is measured as the perpendicular distance from the exterior surface 5603 of the strikeface 5612 to the exterior surface 5603 of the rear 5610. The maximum distance 6096 can range from 0.60 inch to 0.90 inch. For example, the maximum distance 6096 can be 0.60 inch, 0.64 inch, 0.68 inch, 0.72 inch, 0.76 inch, 0.80 inch, 0.84 inch, 0.88 inch, or 0.90 inch.

As illustrated in FIGS. 58-62, the golf club head 5600 can be a hollow, or at least partially hollow body comprising an internal cavity 5616. Internal cavity 5616 of the body 5601 comprises a volume. The volume of the internal cavity 5616 can range from 0.65 $inch^3$ (10.65 $cm^3$) to 1.05 $inch^3$ (17.21 $cm^3$). In some embodiments, the internal cavity 5616 can comprise a volume of 0.65 $inch^3$ (10.65 $cm^3$), 0.70 $inch^3$ (11.47 $cm^3$), 0.75 $inch^3$ (12.29 $cm^3$), 0.80 $inch^3$ (13.11 $cm^3$), 0.85 $inch^3$ (13.93 $cm^3$), 0.90 $inch^3$ (14.75 $cm^3$), 0.95 $inch^3$ (15.57 $cm^3$), 1.00 $inch^3$ (16.39 $cm^3$), or 1.05 $inch^3$ (17.21 $cm^3$). Similarly, material portion of the body 5601, void of the cavity 5616, further comprises a material volume. The material volume of the body 5601 can range from 2.50 $inch^3$ (40.97 $cm^3$) to 3.50 $inch^3$ (57.35 $cm^3$). For example, the material volume of the body 5601 can be 2.50 $inch^3$ (40.97 $cm^3$), 2.60 $inch^3$ (42.61 $cm^3$), 2.70 $inch^3$ (44.25 $cm^3$), 2.80 $inch^3$ (45.88 $cm^3$), 2.90 $inch^3$ (47.52 $cm^3$), 3.00 $inch^3$ (49.16 $cm^3$), 3.10 $inch^3$ (50.80 $cm^3$), 3.20 $inch^3$ (52.44 $cm^3$), 3.30 $inch^3$ (54.08 $cm^3$), 3.40 $inch^3$ (55.72 $cm^3$), or 3.50 $inch^3$ (57.35 $cm^3$).

In many embodiments, the internal cavity 5616 of the body 5601 can be void of any substance. In other embodiments, the internal cavity 5616 of the body 5601 can comprise a polymer (not pictured), wherein the polymer can be at least partially fill the internal cavity 5616. The polymer can be polyethylene terephthalate, high-density polyethylene, polyvinyl chloride, polycarbonate, polypropylene, other thermoplastics, composites polymers or any combination thereof. The polymer can fill 10% to 80% 10% to 25%, 15% to 30%, 30% to 45%, 45% to 60%, 60% to 75%, 75% to 80%, 10% to 40%, 30% to 60%, or 40% to 80% of the internal cavity 5616 of the body 5601. For example, the polymer can fill 10%, 15%, 20%, 25%, 30%, 35%, 40%, 45%, 50%, 55%, 60%, 65%, 70%, 75%, 80%, or 85% of the internal cavity 5616 of the body 5601. In some embodiments, the polymer fills 80% of the internal cavity 5616 of the body 5601.

The polymer at least partially filling the internal cavity 5616 of the body 5601 can comprise a specific gravity ranging from 0.05 to 4. For example, the specific gravity of the polymer can be 0.5, 1.0, 1.5, 2.0, 2.5, 3.0, 3.5, or 4. In some embodiments, the specific gravity of the polymer is proportional to the mass of the polymer, wherein 1 specific gravity of the polymer is equal to 1 gram. Similarly, in those exemplary embodiments, the volume is proportional to the polymer specific gravity, wherein 1 specific gravity of the polymer is equal to 1 cc. In other embodiments, the volume is not proportional to the specific gravity of the polymer. For example, the ratio of the polymer specific gravity to the polymer volume can be 2:1 cc, 2:3 cc, 2:4 cc, 3:1 cc, 3:2 cc, 3:4 cc, 4:1 cc, 4:2 cc, or 4:3 cc.

The mass of the polymer allows for the swing weight of the golf club head 4400 to be customizable for each player. Increasing the volume of the polymer, and thus the mass, increases the swing weight. Similarly, decreasing the volume of the polymer decreases the swing weight. Having the appropriate swing weight for each individual player improves feel during a swing and can improve performance such as swing speed, swing path, ball speed, and ball trajectory. The polymer can further increase the overall mass of the golf club head 5600 more toward the sole 5606. Increasing the mass more toward the sole shifts the CG low and back, thereby improves the moment of inertia.

The strikeface 5612 can be coated with a durable finish. For example, the strikeface 5612 can be coated with Hydropearl 2.0 chrome plate finish or a high polished chrome. In some embodiments, the strikeface 5612 is further finished with brushing or blasting. The golf club head 5600 can further comprise an vibration damping layer 5878 on the interior surface 5819 of the strikeface 5612. The vibration damping layer 5878 can be formed from an elastomer material or any other suitable material. For example, the vibration damping layer 5878 can be formed from a urethane and graphene coating, a urethane coating, or a silicon gel. The vibration damping layer 5878 can have a weight of 1-7 grams. For example, the vibration damping material can have a weight of 1 gram, 3 grams, 5 grams, or 7 grams. The vibration damping layer 5878 can fill between 10%-30% of the volume of the internal cavity of the club head 5600. The vibration damping layer 5878 can partially or fully cover the interior surface 5819 of the strikeface 5612. The thickness of the vibration damping layer 5878, measured perpendicular to the strikeface 5612, can either vary or be uniform across the interior surface 5819 of the strikeface 5612.

In some embodiments, the golf club head 5600 can further comprise an aperture 5634 located on the toe region 5604. The aperture 5634 comprises internal threads and is configured to receive a threaded screw weight 5637, as seen in FIG. 56. FIG. 56 illustrates the threaded screw weight 5637 removed from the aperture 5634 but positioned for insertion into the aperture 5634. The threaded screw weight 5637 comprises a mass, wherein the mass of the threaded screw weight 5637 can range from 2 grams to 12 grams. In other embodiments, the mass of the threaded screw weight 5637 can range from 4 grams to 10 grams. In some embodiments, the screw weight 5637 can weight 2 grams, 3 grams, 4 grams, 5 grams, 6 grams, 7 grams, 8 grams, 9 grams, 10 grams, 11 grams, 12 grams, 13 grams, or 14 grams. The mass of the screw weight 5637 correlates with the length of the screw weight 5637, wherein a longer threaded screw weight 5637 equates to a greater mass. The threaded screw weight 5637 further affects the mass and overall swing weight of the golf club head 5600. Therefore, the threaded screw weight 5637 can improve the feel of the golf club head 5600, as well as performance characteristics (e.g., swing speed, ball speed, and ball flight).

The hosel of the club head 5600 can house a tip weight 5638. FIG. 56 depicts the tip weight 5638 removed from the hosel, but in position for insertion into the hosel. The tip weight 5638 can have a weight that ranges between 0.1 and 10 grams. For example, the tip weight 5638 can have a weight of 0.2, 0.4, 0.6, 0.8, 1, 2, 3, 4, 5, 6, 7, 8, 9, or 10 grams.

Although both the toe slit 5666 and heel slit 5662 affect the deflection of the club head 5600, the toe slit 5666 has a greater effect on the deflection. The slits 5666, 5662 reduce concentrated stresses at toe and heel junctions between the lower region 5613 and the upper perimeter portion 5609 and spread impact stresses across a greater volume of the club body 5601. The toe and heel slits 5666, 5662 allow structural bending between the upper region 5611 and the lower region 5613 of the club head 5600, which results in greater deflection of the strikeface 5612 than would be present in a similar golf club head lacking toe and/or heel slits. The slits 5666, 5662 can increase the bending between the lower region 5613 and the upper region 5611 around the second inflection point 5792. The greater deflection of the strikeface 5612 provides a higher dynamic loft angle to the golf club 5600. The loft angle is an acute angle measured from the strikeface 5612 to a ground reference plane 10. By dynamically increasing the deflection of the club head 5600, the conventional loft angle can be lowered without sacrificing trajectory. For example, a first club head with a loft angle lower than a second club head can have a trajectory equal to the trajectory of the second club head if the first club head comprises slits that increase the deflection of the club head. In some embodiments, the conventional loft angle can be reduced by up to 0.6 degrees, up to 0.5 degrees, or up to 0.4 degrees. The lower loft of the first club head can result in a higher ball speed for a golf ball impacted by the club head due to the lower loft angle of the first club. The gapping between clubs in a set can be more uniform in a club head set that comprises the slits disclosed herein.

Furthermore, in many embodiments, indention 5630 can provide an increase in golf ball speed over ball speeds of standard golf club heads and can increase the launch angle over both the standard hybrid and iron club heads. A golf club head lacking the indention 5630 cannot buckle in a controlled manner during impact or spring back like a drum after impact as well as the club head 5600. The first, second, and third inflection points 5786, 5792, and 5794 allow the body 5601 to bend backwards when a golf ball impacts the strikeface in a manner not possible for a golf club head lacking these inflection points.

The upper perimeter portion can provide spring to the back end of the club and exhibit low peak stress concentrations. The interaction of the strikeface 5612, the top rail 5615, the rear wall 5723, and the top wall 5719 is affected by the strikeface angle 5950, the top rail angle 5945, and the rear angle 5940. The strikeface 5612, the top rail 5615, the rear wall 5723, and the top wall 5719 interact and benefit the hinging of the club head in a manner similar to the respective components of golf club head 3700 described above.

The uniform thinned region 6060 on the sole 5606, described above, can provide multiple benefits, similar to those described above for the uniform thinned regions of golf club heads 2200, 2700, 3200, 3700, 4400, and 4900.

In some embodiments, body 5601 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, body 5601 can comprise carpenter grade 455 steel, carpenter grade 475 steel, C300 steel, C350 steel, a Ni—Co—Cr steel alloy, a quench and tempered steel alloy, or 565 steel. In some embodiments, strikeface 4412 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, strikeface 4412 can comprise carpenter grade 455 steel, carpenter grade 475 steel, C300 steel, C350 steel, a Ni—Co—Cr steel alloy, a quench and tempered steel alloy, or 565 steel. In some embodiments, body 5601 can comprise the same material as strikeface 5612. In some embodiments, body 5601 can comprise a different material than strikeface 5612.

III. Golf Club Head with Cascading Sole and Back Cavity

Figure 14:
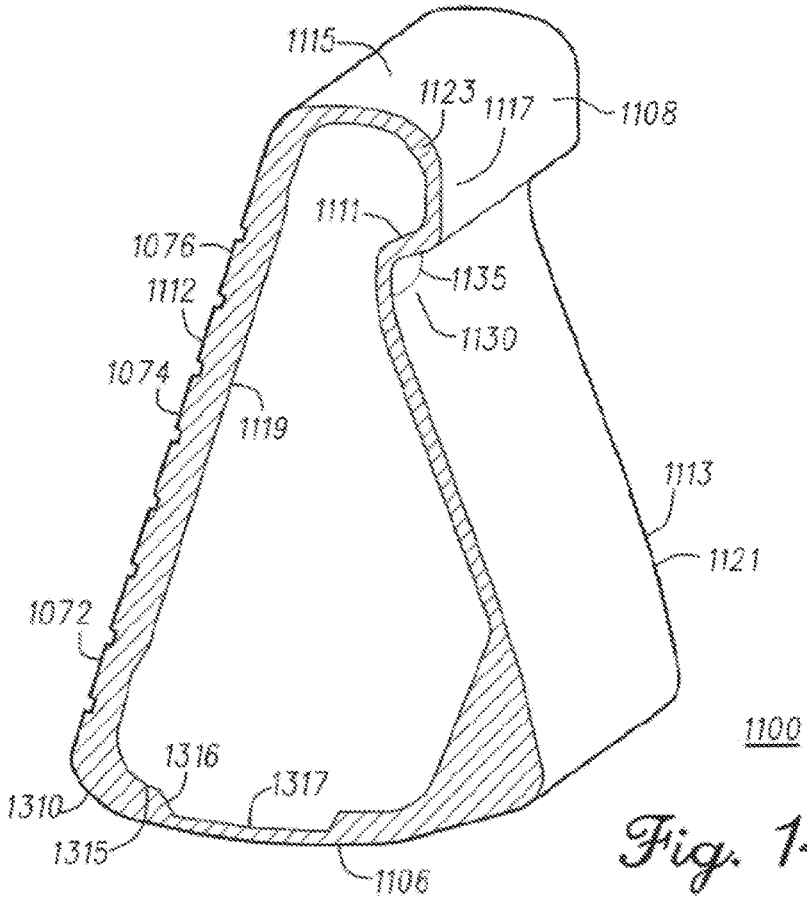
FIG. 14 depicts a cross-section view of a golf club head, similar to the golf club head of FIG. 10, along a cross-sectional line similar to cross-sectional line XII-XII of FIG. 10, according to another embodiment.

In some embodiments, a golf club head with a back cavity can further comprise a cascading sole with tiered thin sections. The cascading sole can be implemented within club heads 2200, 2700, 3200, 3700, 4400, 4900, and 5600. FIG. 14 illustrates a cross-section of golf club head 1100, which can be similar to golf club head 1000 (FIG. 10), along a similar cross-sectional line XII-XII in FIG. 10, according to an embodiment. Similar to golf club head 1000 (FIG. 10), golf club head 1100 comprises a body 1101. Body 1101 comprises a strikeface 1112, a sole 1106, and a crown 1108. Strikeface 1112 comprises a high region 1176, a middle region 1174, and a low region 1172. Crown 1108 comprises an upper region 1111 and a lower region 1113. The upper region 1111 comprises a top rail 1115. In many embodiments, a cavity 1130 is located below top rail 1115. The golf club head 1100 further comprises a cascading sole 1310, similar to internal radius transition 310 (FIG. 3). The internal radius transition 1310 comprises a first tier 1315 at a first thickness, a second tier 1317 at a second thickness, and a tier transition region 1316. In some embodiments, the cascading sole 1310 can provide further pliability to top rail 1115. In many embodiments, the back cavity combined with the cascading sole can provide an even greater spring effect on the strikeface. In some embodiments, the back cavity with the cascading sole allows approximately 3%-5% more energy in the deflection of the strikeface. The cascading sole 1310 can include any number of tiers greater than or equal to two tiers. For example, the cascading sole 1310 can have 2, 3, 4, 5, 6, or 7 tiers.

The golf club head 1100 (in some embodiments, club heads 2200, 2700, 3200, 3700, 4400, 4900, and 5600) having the cascading sole and the back cavity can provide a greater recoiling force to the strikeface than the golf club head having the cascading sole or back cavity alone. This is due to the combined increased recoiling force from both the internal radius transition and the back cavity, as discussed above. The increased recoiling force to the strikeface leads to greater deflection, which in turn increases the impact force applied to the golf ball thereby increasing the speed of the golf ball. In some embodiments, golf club head 1100 comprising both cavity 1130 and internal radius transition 1310 can increase ball speed, increase launch angle, and provide better distance control. In various embodiments, golf club head 1100 can increase ball speeds approximately 1% to approximately 4%. In some embodiments, golf club head 1100 can increase ball speeds approximately 1%, 2%, 3%, or 4%. In many embodiments, golf club head 1100 provides a larger increase in ball speeds when the golf ball impacts the strikeface in high region 1176. In some embodiments, golf club head 1100 can increase the launch angle by approximately 0.5 degrees to approximately 1.1 degrees. In some embodiments, golf club head 1100 can increase the launch angle by approximately 0.5 degrees, 0.6 degrees, 0.7 degrees, 0.8 degrees, 0.9 degrees, 1.0 degrees, or 1.1 degrees.

Figure 19:
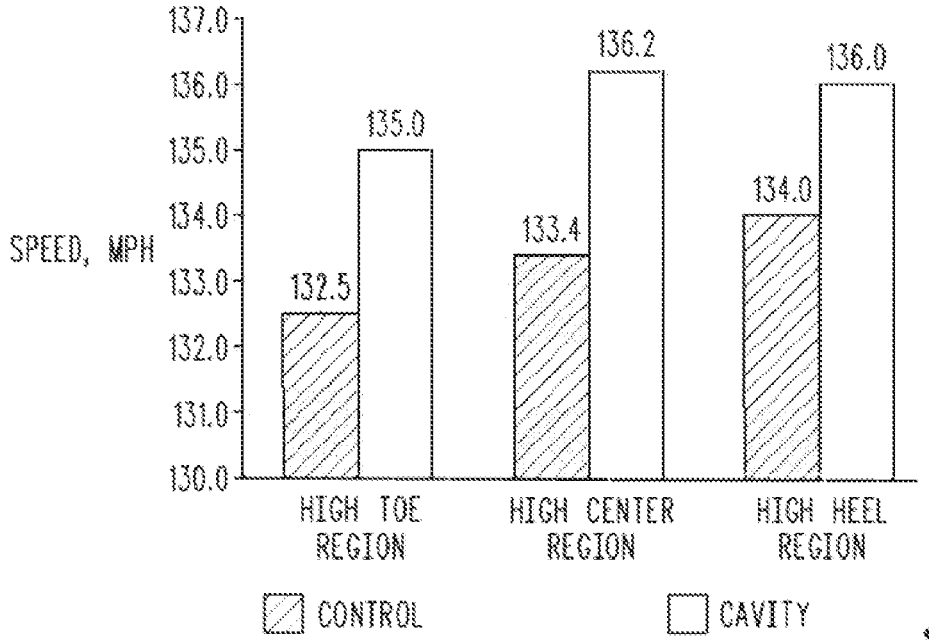
FIG. 19 depicts results from testing of the golf club head of FIG. 14, according to another embodiment.
Figure 20:
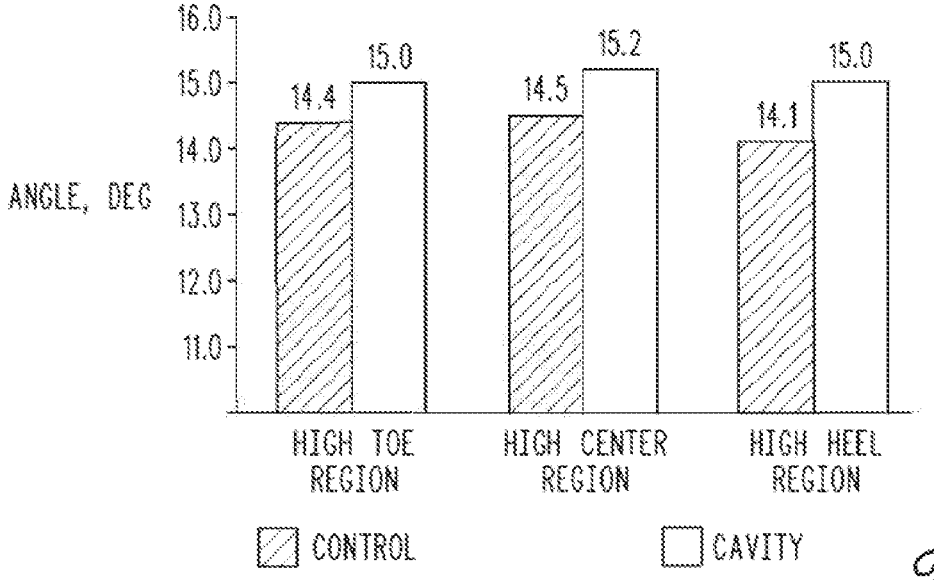
FIG. 20 depicts results from testing of the golf club head of FIG. 14, according to another embodiment.

An embodiment of golf club head 1100 having the cascading sole and the back cavity was tested. Overall, when compared to a control golf club head devoid of the cascading sole and the back cavity, the cavity golf club head showed an increase in golf ball speed and an increase in launch angle. The cavity golf club head showed the increase in golf ball speed and the increase in launch angle for all contact positions on the face due to the combined spring effect from the combination of cascading sole 1310 (FIG. 14) and cavity 1130 (FIG. 14). In some embodiments, a greater increase in golf ball speed and launch angle was observed on contact with high portions of the face, (e.g., high region 1076 (FIG. 12) or high region 1176 (FIG. 14)) due in part from the spring effect of cavity 1130 (FIG. 14). FIGS. 19-20 depict results from the testing of the embodiment of golf club head 1100 (cavity golf club head) compared to a standard iron-type golf club head (control golf club head) with a closed back design and similar loft angle as the cavity golf club head. FIG. 19 shows an increase in golf ball speed in the cavity golf club head compared to the control golf club head when the golf ball impacts the high region of the strikeface, and FIG. 20 shows an increase in launch angle of the cavity golf club head compared to the control golf club head when the golf ball impacts the high region of the strikeface.

Specifically, FIG. 19 shows that golf ball speed is increased by approximately 1.9% (or approximately 2.5 mph) for the cavity golf club head when the golf ball impacts a high-toe region of the strikeface, approximately 2.1% (or approximately 2.8 mph, or approximately 4.5 kph) when the golf ball impacts a high-center region of the strikeface, and approximately 1.5% (or approximately 2.0 mph, or approximately 3.2 kph) when the golf ball impacts a high-heel region of the strikeface (all of the cavity golf club head), when compared to the control golf club head. When the golf ball impacts the strikeface in the high-toe region of the control golf club head, the golf ball speed is approximately 132.5 mph (213.2 kph), while the golf ball reaches approximately 135.0 mph (217.3 kph) when it impacts the strikeface in the high-toe region of the cavity golf club head. When the golf ball impacts the strikeface in the high-center region of the control golf club head, the golf ball speed is approximately 133.4 mph (214.7 kph), while the golf ball reaches approximately 136.2 mph (219.2 kph) when it impacts the strikeface in the high-center region of the cavity golf club head. When the golf ball impacts the strikeface in the high-heel region of the control golf club head, the golf ball speed is approximately 134.0 mph (215.7 kph), while the golf ball reaches approximately 136.0 mph (218.9 kph) when it impacts the strikeface in the high-heel region of the cavity golf club head.

FIG. 20 shows that launch angle of the cavity golf club head is increased by approximately 4.2% (or approximately 0.6 degrees) when the golf ball impacts the high-toe region of the strikeface, approximately 4.8% (or approximately 0.7 degrees) when the golf ball impacts the high-center region of the strikeface, and approximately 6.4% (or approximately 0.9 degrees) when the golf ball impacts the high-heel region of the strikeface (all of the cavity golf club head), when compared with the control golf club head. When the golf ball impacts the strikeface in the high-toe region of the control golf club head, the launch angle is approximately 14.4 degrees, while the launch angle is approximately 15.0 degrees when it impacts the strikeface in the high-toe region of the cavity golf club head. When the golf ball impacts the strikeface in the high-center region of the control golf club head, the launch angle is approximately 14.5 degrees, while the launch angle is approximately 15.2 degrees when it impacts the strikeface in the high-center region of the cavity golf club head. When the golf ball impacts the strikeface in the high-heel region of the control golf club head, the launch angle is approximately 14.1 degrees, while the launch angle is approximately 15.0 degrees when it impacts the strikeface in the high-heel region of the cavity golf club head.

Figure 17:
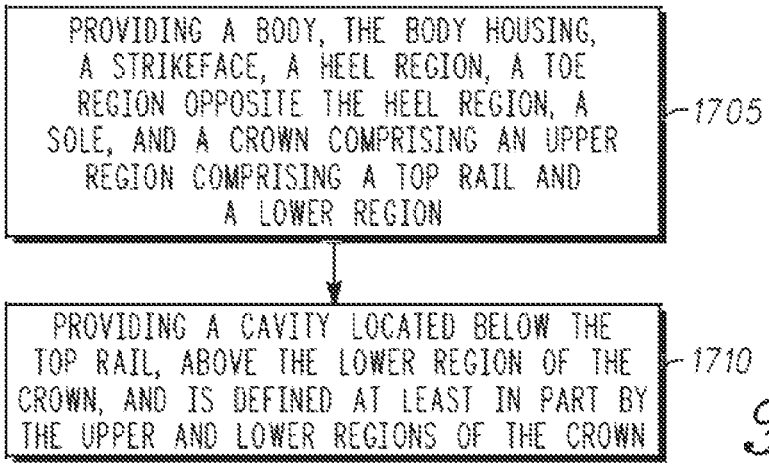
FIG. 17 depicts a flow diagram illustrating a method of manufacturing a golf club head according to an embodiment of another method.

FIG. 17 illustrates method 1700 for manufacturing a golf club head. Method 1700 comprises providing a body (block 1705). Providing a body in block 1705 comprises the body having a strikeface, a heel region, a toe region opposite the heel region, a sole, and a crown. In many embodiments, the crown comprises an upper region and a lower region. In some embodiments, the upper region comprises a top rail. In many embodiments, a cavity is located below the top rail and is located above the lower region of the crown (block 1710). In some embodiments, the cavity is defined at least in part by the upper and lower regions of the crown. The cavity comprises a top wall, a back wall adjacent to the top wall, a bottom incline adjacent to the back wall, a back cavity angle measured between the top and back walls of the cavity, and at least one channel.

In some embodiments, method 1700 further comprises providing an insert at the lower region of the crown towards the toe region. In some embodiments, the insert is similar to insert 1062 (FIG. 10).

In some embodiments, providing the body in block 1705 further comprises the body having a cascading sole. The cascading sole comprises an internal radius transition region from the strikeface to the sole. In many embodiments, the internal radius transition region can be similar to internal transition region or cascading sole 1310 (FIG. 14). In some embodiments, the internal transition region comprises a first tier comprising a first thickness, a second tier comprising a second thickness smaller than the first thickness, and a tier transition region between the first tier and the second tier.

IV. Golf Club with Cascading Sole and Back Cavity

Figure 15:
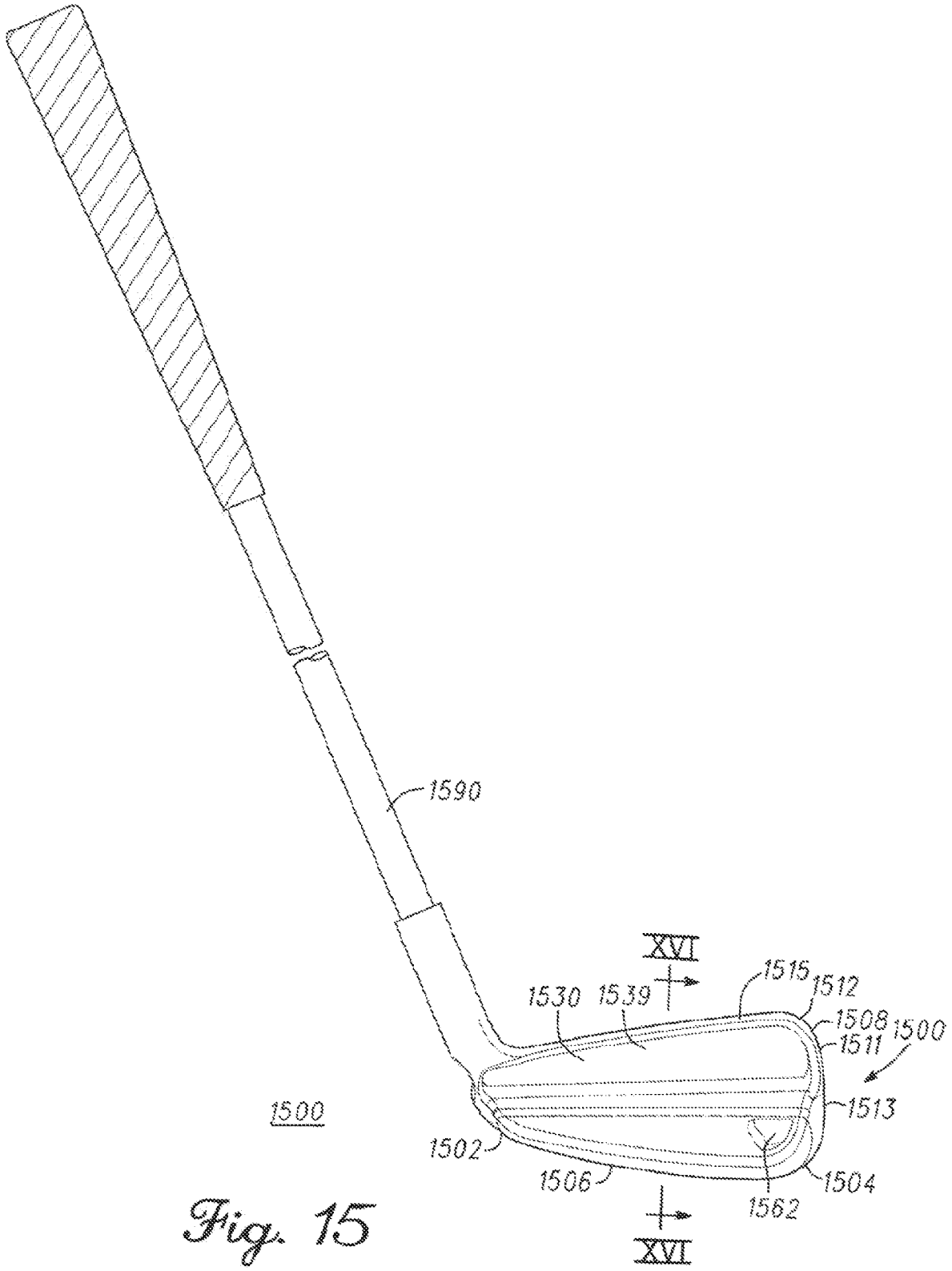
FIG. 15 depicts a back, toe-side perspective view of a golf club according to another embodiment.

Turning to FIG. 15, FIG. 15 illustrates a golf club 1500 comprising a golf club head 1500 and a shaft 1590 coupled to golf club head 1500. In some embodiments, golf club head 1500 of golf club 15000 comprises a hybrid-type golf club head. In other embodiments, golf club head 1500 can be an iron-type golf club head or a fairway wood-type golf club head. In many embodiments, golf club head 1500 can be similar to golf club head 100 or golf club head 1000 (FIG. 10). Golf club head 1500 can be hollow-bodied and comprises a strikeface 1512, a heel region 1502, a toe region 1504 opposite heel region 1502, a sole 1506, and a crown 1508. The crown 1508 comprises an upper region 1511 and a lower region 1513. The upper region 1511 comprises a top rail 1515. Golf club head 1500 further comprises a cavity 1530 located below top rail 1515 and above lower region 1513 of crown 1508.

Figure 16:
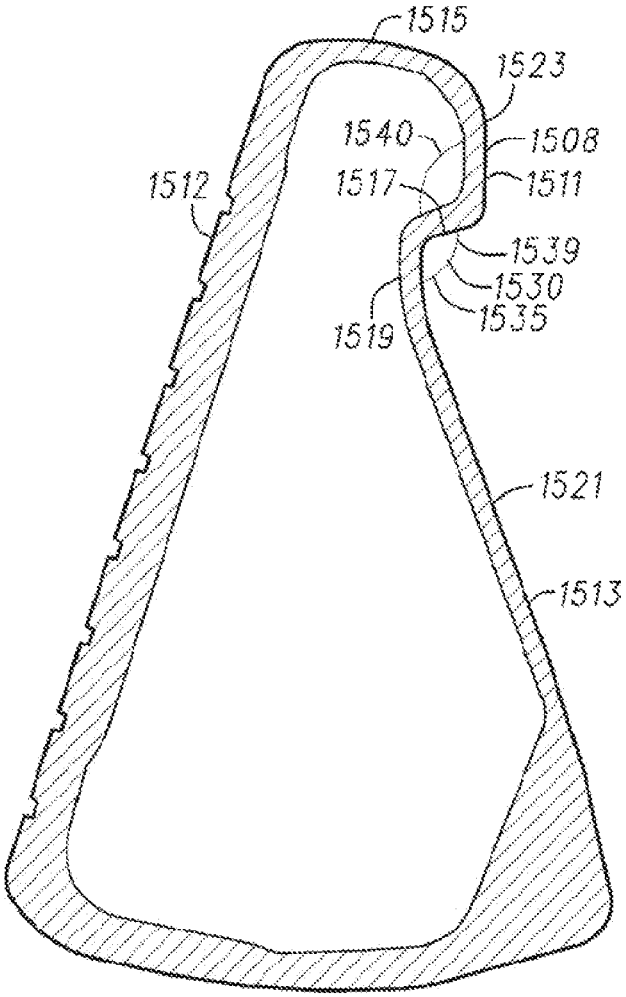
FIG. 16 depicts a cross-sectional view of the golf club head of FIG. 15 along the cross-sectional line XVI-XVI of FIG. 15.

FIG. 16 illustrates a cross-section of golf club head 1500 along the cross-sectional line XVI-XVI in FIG. 15, according to one embodiment. In some embodiments, cavity 1530 can be defined at least in part by upper region 1511 and lower region 1513. In many embodiments, cavity 1530 comprises a top wall 1517, a back wall 1519, a bottom incline 1521, a back cavity angle 1535 measured between top wall 1517 and back wall 1519, and at least one channel 1539. In some embodiments, an apex of top wall 1517 is approximately 0.25 inch to approximately 1.25 inches below an apex of top rail 1515. In some embodiments, the apex of top wall 1517 is approximately 0.375 inch below the apex of top rail 1515. In some embodiments, bottom incline 1521 can be at least approximately 0.50 inch to approximately 2 inches below an apex of top rail 1515. In many embodiments, back cavity angle 1535 can be approximately 70 degrees to approximately 110 degrees. In some embodiments, back cavity angle 1535 can be approximately 90 degrees.

In many embodiments, the upper region 1511 comprises the top and back walls of the cavity; and the lower region of the crown comprises the bottom incline of the cavity. In some embodiments, upper region 1511 further comprises a rear wall 1523 adjacent to top wall 1517 of cavity 1530 and a rear angle 1540 measured between top wall 1517 of cavity 1530 and rear wall 1523 of upper region 1511. In many embodiments, rear angle 1540 is approximately 70 degrees to approximately 110 degrees.

In another embodiment, the golf club head can comprise a hosel. The hosel can comprise a hosel notch. The hosel notch can allow for iron-like range of loft and lie angle adjustability. Although not illustrated in FIG. 16, golf club head 1500 also can have a cascading sole or an internal radius transition at the sole.

The golf club heads with energy storage characteristics discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of golf club heads with energy storage characteristics, and may disclose alternative embodiments of golf club heads with tiered internal thin sections.

EXAMPLES

Example 1: Cavity Back vs. Hollow Body/Inflection Point Golf Club

Referring to Table 1 below, the exemplary club head 3700 being a hollow bodied iron club head with an inflection point 3986 was compared to two control club head (hereafter "Control 1" and "Control 2"). Control 1 and Control 2 were cavity back iron club heads that were similar in size and loft angle to exemplary club head 3700, but were devoid of an inflection point. Control 2 has a more pronounced cavity and wider sole than Control 1. Ball speed (measured in mph), launch angle (measured in degrees), carry distance (measured in yards), and spin rate (measured in rpm) were measured between the exemplary club head 3700, Control 1, and Control 2.

TABLE 1

Performance of Club Head 3700 vs. Control Club Heads 1 and 2

| | Average Ball Speed (mph) | Average Launch Angle (degrees) | Average Spin Rate (rpm) | Average Carry Distance (yards) |
|---|---|---|---|---|
| Club Head 3700 | 127.3 | 15.9 | 5931 | 193 |
| Control 1 | 127.6 | 15.4 | 5972 | 190 |
| Control 2 | 126.3 | 15.8 | 6551 | 185 |

As shown in Table 1, the exemplary club head 3700 having a hollow body and inflection point 3986 produced an average ball speed of 127.3 mph, an average launch angle of 15.9 degrees, an average carry distance of 193 yards, and an average spin rate of 5931 rpm. Comparatively, Control 1 produced an average ball speed of 127.6 mph, an average launch angle of 15.4 degrees, an average carry distance of 190 yards, and an average spin rate of 5972 rpm, and Control 2 produced an average ball speed of 126.3 mph, an average launch angle of 15.8 degrees, an average carry distance of 185 yards, and an average spin rate of 6551 rpm. Although the exemplary club head 3700 experienced a decrease of about 0.2% in average ball speed compared to Control 1 and an increase of about 0.8% to 1% in average ball speed compared to Control 2, the average launch angle and average spin rate increased the average carry distance farther due to the hollow body and inflection point 3986 of the exemplary club head 3700. The exemplary club head 3700 experienced a 3.25% increase in the average launch angle compared to Control 1, and a 0.6% to 1% increase in the average launch angle compared to the Control 2 respectively. Further, the exemplary club head 3700 experienced around a 0.7% decrease in average spin rate compared to Control 1 and a 9.46% decrease in average spin rate compared to Control 2 respectively. The increased average launch angle and decreased average spin rate of the exemplary club head 3700 compared to the Control 1 and 2 increased the carry distance of the ball during impact. More specifically, the exemplary club head 3700 experienced a 1.58% compared to Control 1 and 4.32% increase in average carry distance of the ball compared to Control 1 and Control 2. Therefore, the hollow body and inflection point 3986 of the exemplary club head 3700 increases the bending of the strikeface 3712 to produce optimal ball performance characteristic compared to similar sized club heads devoid of an inflection point.

Example 2: Cavity Back vs. Hollow Body/Inflection Point Golf Club

Referring to Table 2 below, the exemplary club head 4400 being a hollow bodied iron club head with an inflection point 4686 that is 55% from the top rail apex to the inflection point of the club head 4400 was compared to a control club head (hereafter "Control Club Head"). Control Club Head was a cavity back iron club head similar in size and loft angle to exemplary club head 4400, but devoid of an inflection point and hollow body. Similar to Table 1 above, the parameters measured to compare the exemplary club head 4400 and the Control Club Head were as follows: ball speed (measured in mph), launch angle (measured in degrees), carry distance (measured in yards), and spin rate (measured in rpm).

TABLE 2

Performance of Club Head 4400 vs. Control Club Head

| | Average Ball Speed (mph) | Average Launch Angle (degrees) | Average Spin Rate (rpm) | Average Carry Distance (yards) |
|---|---|---|---|---|
| Club Head 4400 | 123.8 | 16.8 | 6211 | 179.2 |
| Control 1 | 123.3 | 16.1 | 6746 | 175.7 |

As shown in Table 2, the exemplary club head 4400 having a hollow body and inflection point 4686 produced an average ball speed of 123.8 mph, an average launch angle of 16.8 degrees, an average carry distance of 179.2 yards, and an average spin rate of 6211 rpm, compared to the Control Club Head which produced an average ball speed of 123.3 mph, an average launch angle of 16.1 degrees, an average carry distance of 175.7 yards, and an average spin rate of 6746 rpm. The exemplary club head 4400 experienced a 0.5-1% increase in ball speed compared to the Control Club Head, but due to the hollow body and inflection point 4686 which increased the bending of the strikeface 4412, the exemplary club head 4400 experienced a 4.35% increase in the launch angle and a 7.93% decrease in the spin rate. Because of the 4.35% increase in the launch angle and 7.93% decrease in spin rate, the exemplary club head 4400 experienced an increase of around 2% of the carry distance farther than the Control Club Head. Therefore, this increase in bending of the strikeface 4412 due to the hollow body and inflection 4686 of the exemplary club head 4400 allows for farther carry distances of the ball compared to club head similar in size, devoid of an inflection point.

Example 3: Smaller Volume Hollow Body Irons vs. Hollow Body Crossover

Referring to Table 3 below, the exemplary club head 3700, and exemplary club head 4400 were compared to exemplary club head 2700. All three exemplary club heads 3700, 4400, and 2700 had similar loft angles and comprised a hollow body, and an inflection point. Exemplary club heads 3700 and 4400 are both significantly smaller in size (volume ranging from 0.65 inch$^3$ to 1.70 inches$^3$) than the exemplary club head 2700 (volume around 1.75 inches$^3$). Similar to Table 1 and Table 2 above, the parameters measured for the exemplary club heads 3700, 4400, and 2700 are ball speed (measured in mph), launch angle (measured in degrees), carry distance (measured in yards), and spin rate (measured in rpm).

TABLE 3

Performance of Club Head 3700 and Club Head 400 vs. Club Head 2700

| | Average Ball Speed (mph) | Average Launch Angle (degrees) | Average Spin Rate (rpm) | Average Carry Distance (yards) |
|---|---|---|---|---|
| Club Head 3700 | 138.8 | 12.2 | 4322 | 219 |
| Club Head 4400 | 138.0 | 11.4 | 4135 | 216 |
| Club Head 2700 | 139.3 | 11.8 | 4312 | 217 |

As shown in Table 3, the exemplary club head 3700 produced an average ball speed of 138.8 mph, an average launch angle of 12.2 degrees, an average spin rate of 4322 rpm, and an average carry distance of 219 yards; the exemplary club head 4400 produced an average ball speed of 138.0 mph, an average launch angle of 11.4 degrees, an average spin rate of 4135 rpm, and an average carry distance of 216 yards; and the exemplary club head 2700 produced an average ball speed of 139.3 mph, an average launch angle of 11.8 degrees, an average spin rate of 4312 rpm, and an average carry distance of 217 yards. The exemplary club head 3700 experienced a 0.92% increase in carry distance over the exemplary club had 2700, while the exemplary club head 4400 experienced a 0.46% decrease in carry distance compared to the exemplary club had 2700. The small percent difference of the carry distance of the ball between the exemplary club heads 3700, 4400, and 2700, were indicative to the bending of the strikeface due to the hollow body and inflection points, regardless of the significantly smaller sizes of the exemplary club head 3700 and exemplary club head 4400. Because of the smaller size and lower inflection point, the exemplary club heads 3700 and 4400 allows a player the benefit of the look and feel of a smaller iron body club head, with the ball performance results (e.g., launch angle, carry distance) of a higher volume sized hollow body club head with a higher inflection point (i.e., exemplary club head 2700).

Example 4: Cavity Back vs. Hollow Body/Inflection Point Golf Club

Referring to Table 4 below, the exemplary club head 4900 is a hollow bodied iron club head with an inflection point 5186 located roughly 52% below the top rail apex. The club head 4900 was compared to a control club head (hereafter "Control Club Head"). Control Club Head was a cavity back iron club head similar in size to exemplary club head 4900, but devoid of an inflection point and hollow body. The Control Club Head comprised a loft angle roughly 1° lower than the exemplary club head 4900. Similar to Table 1 above, the parameters measured to compare the exemplary club head 4900 and the Control Club Head were as follows: ball speed (measured in mph), launch angle (measured in degrees), carry distance (measured in yards), and spin rate (measured in rpm).

TABLE 4

Performance of Club Head 4900 vs. Control Club Head

| | Average Ball Speed (mph) | Average Launch Angle (degrees) | Average Spin Rate (rpm) | Average Carry Distance (yards) |
|---|---|---|---|---|
| Club Head 4900 | 145.1 | 11.6 | 3980 | 229 |
| Control 1 | 146.1 | 11.1 | 4073 | 227 |

As shown in Table 2, the exemplary club head 4900 having a hollow body and inflection point 5186 produced an average ball speed of 145.1 mph, an average launch angle of 11.6 degrees, an average carry distance of 229 yards, and an average spin rate of 3980 rpm, compared to the Control Club Head which produced an average ball speed of 146.1 mph, an average launch angle of 11.1 degrees, an average carry distance of 227 yards, and an average spin rate of 4073 rpm.

The higher launch angle of the club head 4900 results from its higher loft angle. The lower ball speed can also be expected due to the higher loft angle of the club head 4900. The unexpected result is in the spin rate of the club head 4900 versus the spin rate of the Control Club Head. One of skill in the art would expect the spin rate of the higher-lofted club head (in this example the club head 4900) to be significantly greater than the spin rate of the lower-lofted club head (in this example the Control Club Head). However, the measured spin rates are close to each other, to the extent that in the measured data, the error bars of the spin rates overlap. The spin rates of the club head 4900 and the Control Club Head are not significantly different. Thus, this test shows that the golf club head 4900 exhibits lower spin rates than the Control Club Head for a given loft angle. This lower spin rate reduces the ballooning of the golf ball during flight. Golf balls that are imparted a high spin rate upon impact tend to twist upwards, or balloon, during flight. This dynamic increase in the flight trajectory height of the golf ball can adversely affect the carry distance and result in unpredictable shots. The average carry distance for the exemplary golf club 4900 is roughly the same as the average carry distance of the Control Club Head. The inflection point 5186 of the exemplary club head 4900 along with the hollow body allow the faceplate 4912 to bend in a manner that reduces the spin imparted to the golf ball.

In addition to the data in Table 4 above, the test revealed an average statistical plot area within which the test shots landed. The average statistical plot area for the exemplary club head 4900 was 6.2% smaller than the average statistical plot area for the Control Club Head. This shows that the exemplary club head 4900 demonstrated higher precision than the Control Club Head. Therefore, the hinging of the faceplate 4912 about the inflection point 5186 does not adversely affect the golfer's ability to control their shots. Rather, the golfer's shot precision is increased.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable to other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A hollow golf club head having a closed internal volume, the hollow golf club head comprising:

a strikeface;

a rear wall on an opposite side of the closed internal volume from the strikeface;

a sole coupling the strikeface with the rear wall;

a top rail coupling the strikeface with the rear wall on an opposite side of the closed internal volume from the sole;

a plurality of ribs protruding from the rear wall and each oriented along a respective longitudinal axis that extends in a direction from the top rail to the sole, and wherein each rib of the plurality of ribs includes a respective first end in contact with the sole and an opposite second end in contact with the top rail such the rib extends from the sole to the top rail;

wherein the strikeface, rear wall, sole, and top rail each have a respective internal surface and a respective external surface, and wherein the internal surface of each of the strikeface, rear wall, sole, and top rail define the closed internal volume;

wherein the rear wall comprises an upper rear wall and a lower rear wall;

wherein the upper rear wall directly abuts the top rail, and the lower rear wall directly abuts the sole;

wherein a maximum upper distance, measured as a maximum perpendicular distance from the external surface of the strikeface to the external surface of the upper rear wall, is between 0.20 inch and 0.59 inch; and wherein the top rail comprises a thickness, measured between the internal surface and the external surface of the top rail, of between 0.04 inch and 0.08 inch.

2. The hollow golf club head of claim 1, wherein:

the lower rear wall comprises a bottom incline extending from the upper rear wall and a lower exterior wall extending from the bottom incline to the sole;

the hollow golf club head further comprises:

a first inflection point defining a junction between the upper rear wall and the bottom incline;

a second inflection point defining a junction between the bottom incline and the lower exterior wall;

a lower angle measured at the second inflection point between the bottom incline and the lower exterior wall, the lower angle is less than 180 degrees; and an inflection angle measured at the first inflection point from the upper rear wall to the bottom incline, the inflection angle between 95 degrees and 150 degrees.

3. The hollow golf club head of claim 1, wherein:

the lower rear wall comprises a bottom incline extending from the upper rear wall and a lower exterior wall extending from the bottom incline to the sole;

the hollow golf club head further comprises:

a first inflection point defining a junction between the upper rear wall and the bottom incline, the first inflection point being located at a vertex of an angle formed between the upper rear wall and the bottom incline; and a second inflection point defining a junction between the bottom incline and the lower exterior wall, the second inflection point being located at a vertex of an angle formed between the bottom incline and the lower exterior wall;

the upper rear wall comprises a thickness, measured between the internal surface and the external surface of the upper rear wall, of between 0.04 inch and 0.08 inch;

the rear wall at the first inflection point comprises a thickness, measured between the internal surface and the external surface of the rear wall, of between 0.04 inch to 0.08 inch; and the thickness of the rear wall at the first inflection point is less than a thickness of the bottom incline, measured between the internal surface and the external surface of the bottom incline.

4. The hollow golf club head of claim 1, wherein a thickness of the rear wall, measured between the internal surface and the external surface of the rear wall, equals the thickness of the top rail.

5. The hollow golf club head of claim 2, wherein the bottom incline comprises a length measured from the first inflection point to the second inflection point, the length of the bottom incline between 0 inch to 0.55 inch.

6. The hollow golf club head of claim 1, wherein the upper rear wall is parallel to the strikeface.

7. The hollow golf club head of claim 1, wherein:

the hollow golf club head further comprises a first inflection point defining a junction between the upper rear wall and the lower rear wall, the first inflection point being located at a vertex of an angle formed between the upper rear wall and the lower rear wall;

the upper rear wall comprises a height measured from the first inflection point to an apex of the top rail and parallel to the strikeface, and wherein the height of the upper rear wall is between 0.6 inch and 1.2 inch.

8. The hollow golf club head of claim 1, wherein:

the hollow golf club head further comprises a first inflection point defining a junction between the upper rear wall and the lower rear wall, the first inflection point being located at a vertex of an angle formed between the upper rear wall and the lower rear wall;

the hollow golf club head comprises a height, measured parallel to the strikeface from the sole to the top rail; and the upper rear wall comprises a height measured from the first inflection point to an apex of the top rail, the height of the upper rear wall between 40% to 75% of the height of the hollow golf club head.

9. The hollow golf club head of claim 1, wherein the plurality of ribs comprises between one and eight ribs.

10. The hollow golf club head of claim 1, wherein the plurality of ribs comprises at least three ribs.

11. The hollow golf club head of claim 1, wherein the plurality of ribs are spaced equidistant from each other.

12. The hollow golf club head of claim 1, wherein each of the plurality of ribs are positioned on an interior surface of the rear wall.

13. The hollow golf club head of claim 1, wherein the hollow golf club head further comprises a polymer material that at least partially fills the closed internal volume.

14. The hollow golf club head of claim 13, wherein the polymer material comprises a weight between 2 grams and 7 grams.

15. The hollow golf club head of claim 13, wherein the polymer material comprises a specific gravity between 0.05 and 4.00.

* * * * *